United States Patent [19]

Stapp et al.

[11] 4,064,675

[45] Dec. 27, 1977

[54] MACHINE FOR OPENING, INSPECTING AND PACKING A FOLDING CARTON

[75] Inventors: Willis J. Stapp, Clermont County, Miami Township; Quentin E. Honnert, Cincinnati, both of Ohio

[73] Assignee: Multifold-International, Inc., Milford, Ohio

[21] Appl. No.: 714,562

[22] Filed: Aug. 16, 1976

[51] Int. Cl.[2] ..... B65B 57/00

[52] U.S. Cl. ..... 53/54; 53/53; 53/78; 53/381 R; 93/53 SD; 93/53 AC

[58] Field of Search ..... 53/53, 54, 78, 48, 186, 53/381 R, 382, 386; 93/53 R, 53 LF, 53 SD, 53 AC

[56] References Cited

U.S. PATENT DOCUMENTS

| | | | |
|---|---|---|---|
| 3,035,380 | 5/1962 | Leavens | 53/78 X |
| 3,643,552 | 2/1972 | Stork | 53/53 X |
| 4,020,616 | 5/1977 | Nakajima | 53/54 |

*Primary Examiner*—Robert L. Spruill
*Attorney, Agent, or Firm*—James W. Pearce; Roy F. Schaeperklaus

[57] ABSTRACT

A machine for opening and inspecting a folding carton to break improper glue spots and to demonstrate that the carton opens properly. Vacuum cups engage opposite side panels of the carton as the carton advances through an inspection section. The vacuum cups advance with the carton and diverge from the path of the carton to separate the panels. As the carton reaches an inspection station, photocell devices inspect the carton to determine if the carton is properly opened. The carton is advanced to the inspection station by a conveyor which picks up the carton from an accelerator device. The accelerator device in turn picks up the carton from the bottom of a stack and accelerates the carton to conveyor speed. Before the accelerator device initiates advance of the carton in conveyor direction, a carton releasing device engages a side of the carton and advances the carton transversely of the direction of conveyor advance to free the carton from other cartons in the stack. As the carton leaves the inspection section, the carton is closed. The closed carton is fed to a stacking device which inserts the carton into a case. The cartons are delivered into the case transversely of an open side to be stacked on edge in the case. A tongue engages the stack in the case to meter case advance until the case is filled. The tongue is then withdrawn, and a carton advancing device advances the last cartons of the stack fully into the case and holds the cartons in the case as the tongue is withdrawn.

10 Claims, 91 Drawing Figures

FIG. 10
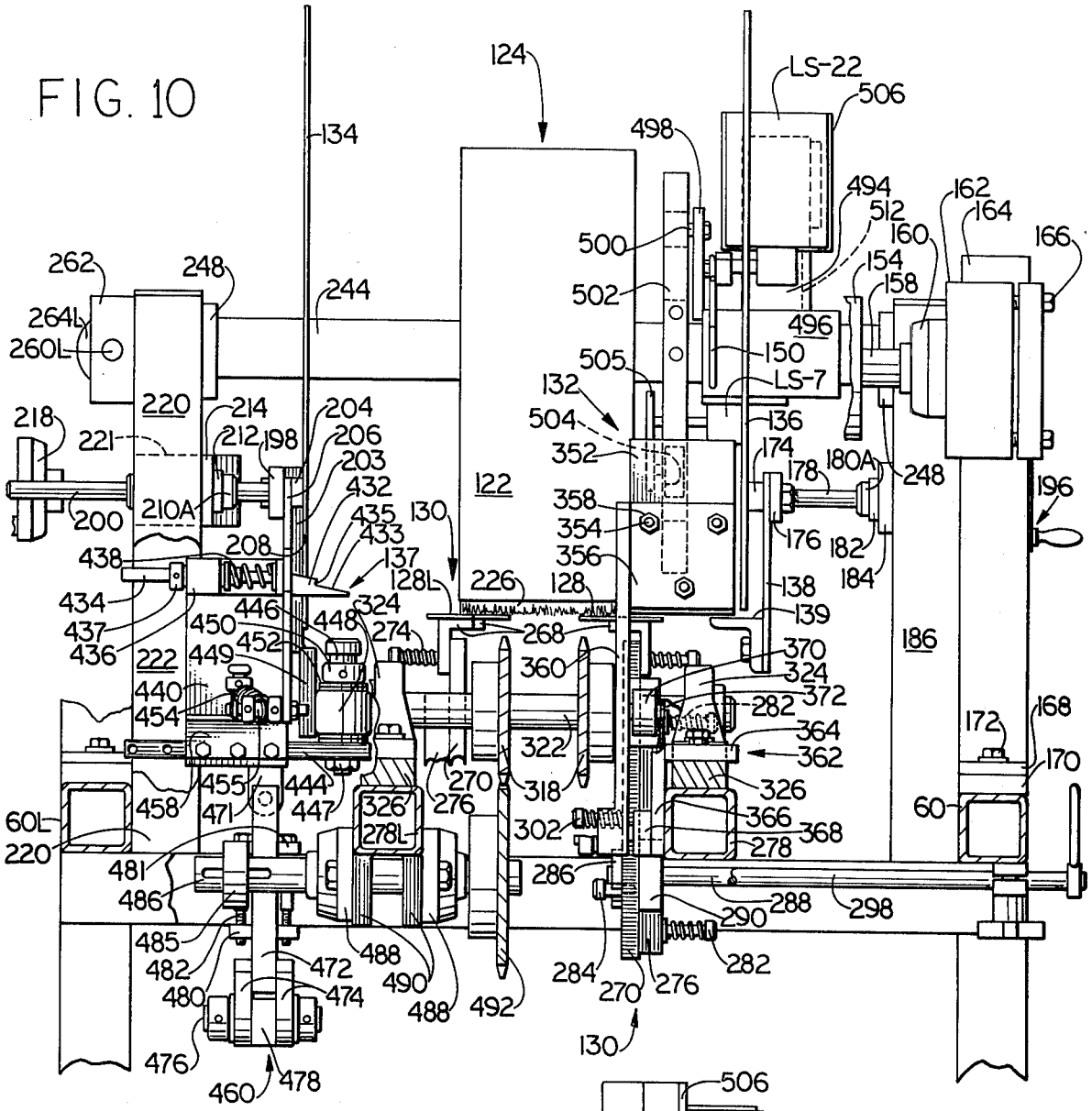
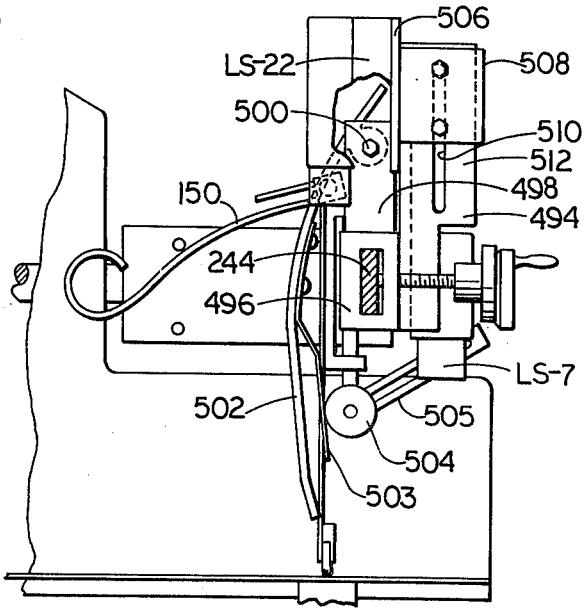
FIG. 11

19
18
17B
533
532
60L
60
PC-1
LS-21

518
525
760
761
762
764
765
766
768
770
772
773
774
775
776
778
779
780
781
782
783
785

792
773
814
810
811
825
824
814
773
26
26
27
27
817
810
812
794
788
808
820
806
822
798
805
804
802
803
816
793
680
800
796
834
806
826
816
829
830
832
819
818
828
835
836
840
838
831
835
819
828
842
843
848
843
836
838
840
846
845
844
680
834
795

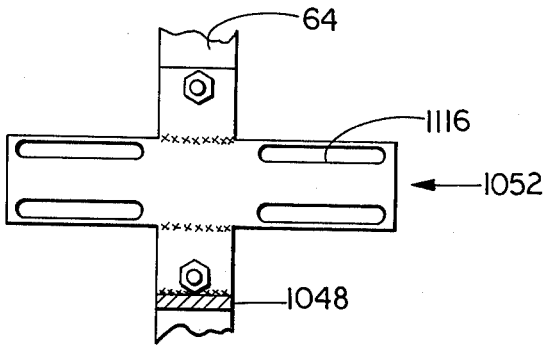
FIG. 32
FIG. 33
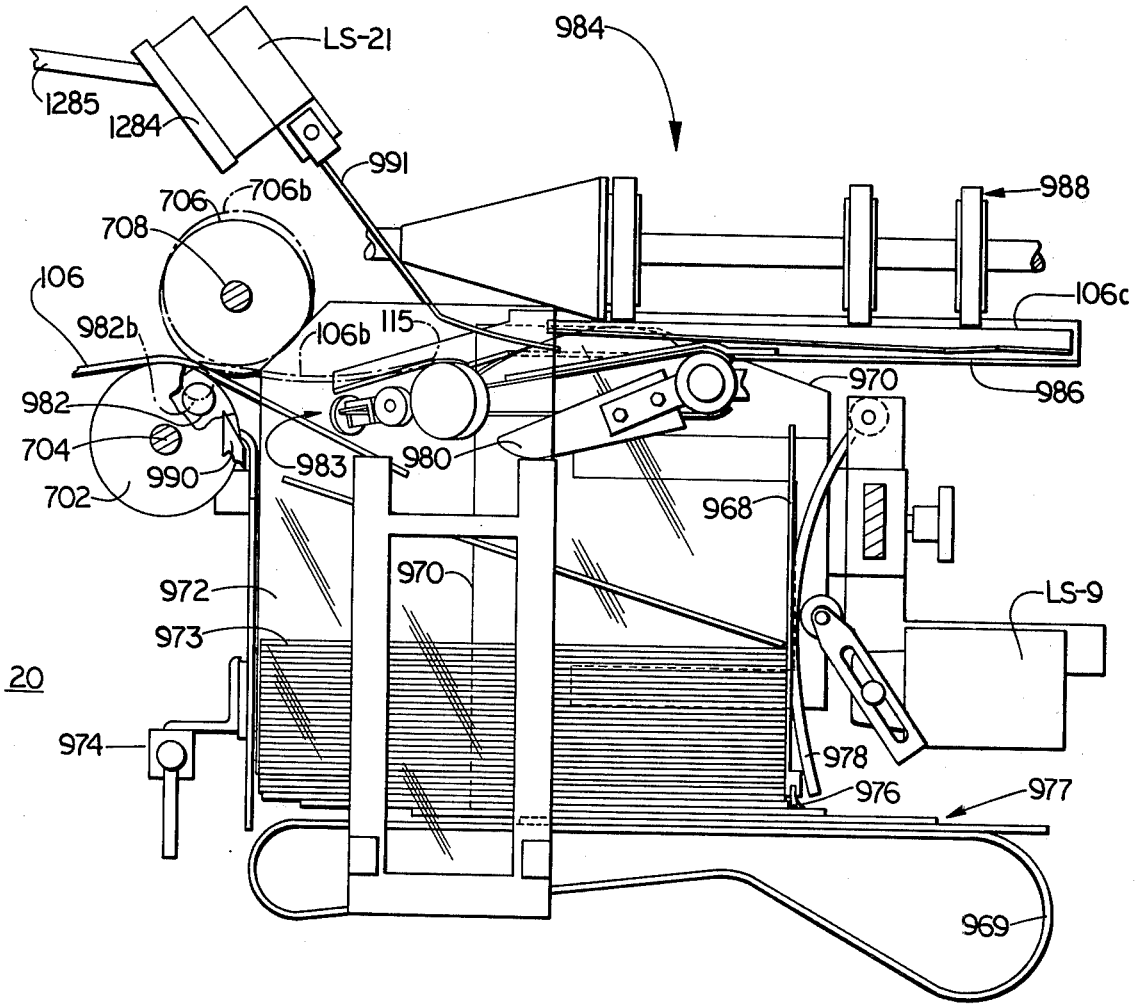

984
LS-20

FIG. 63
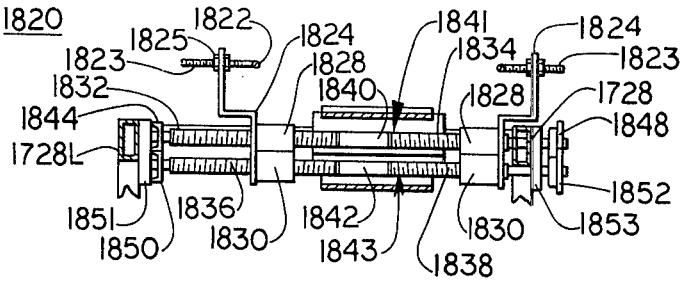
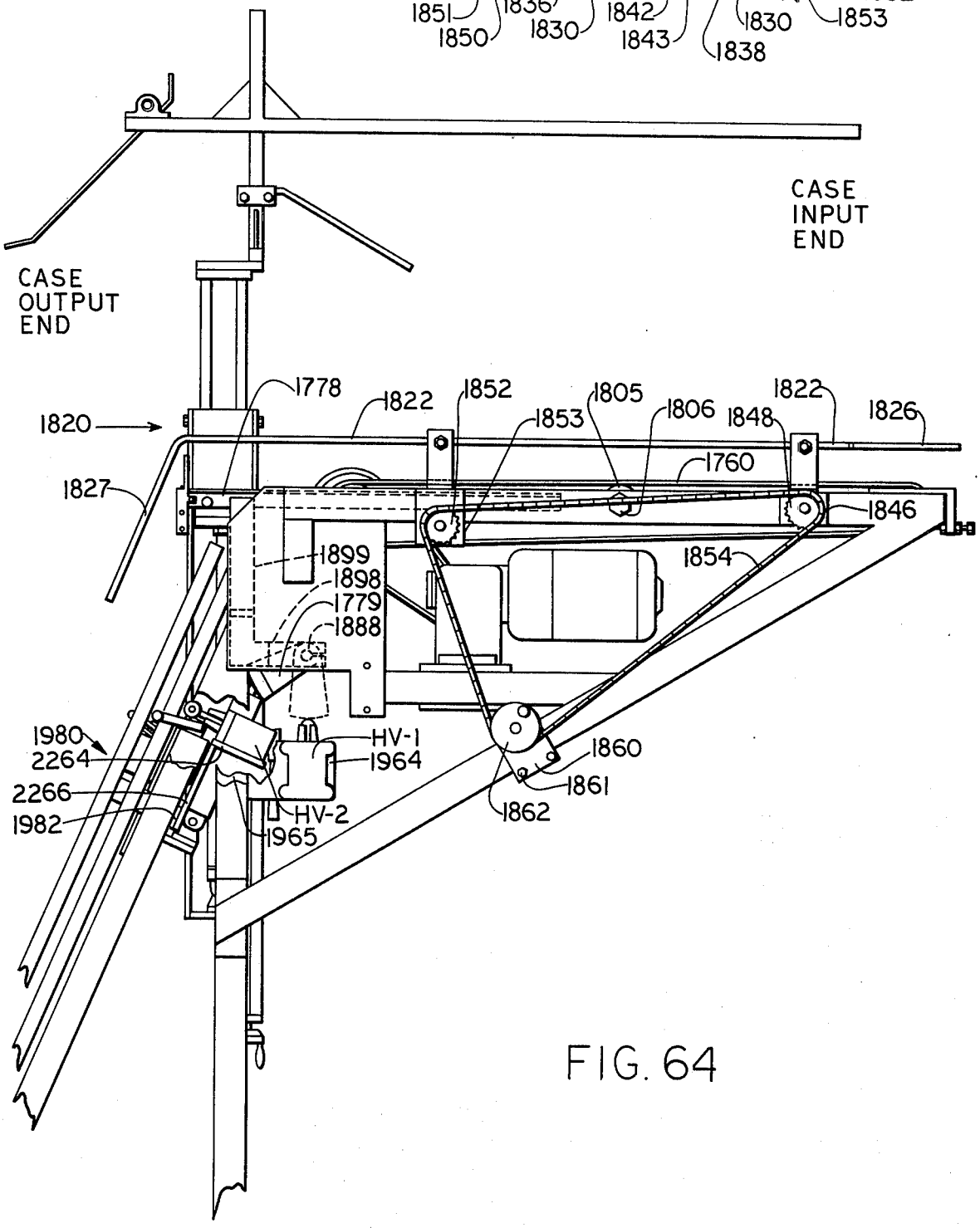
FIG. 64

FIG. 69
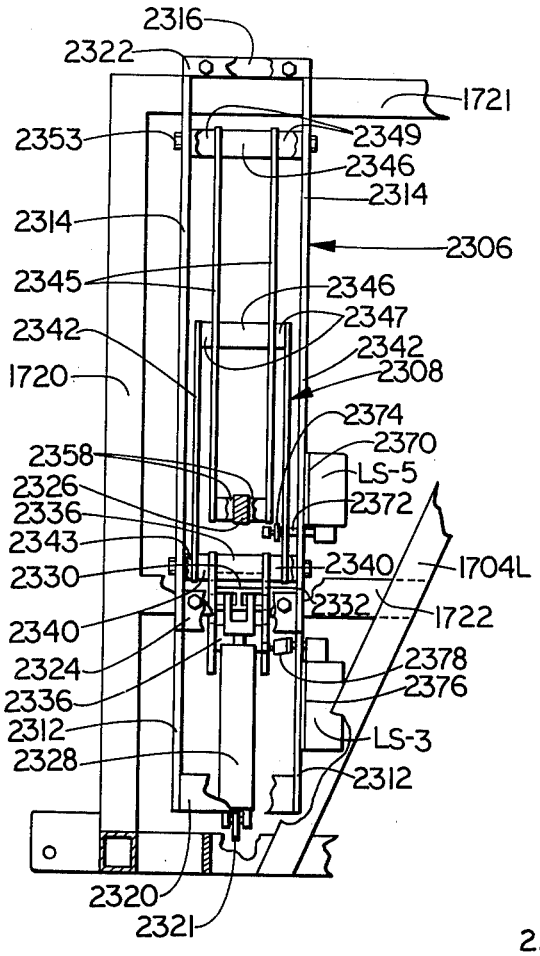
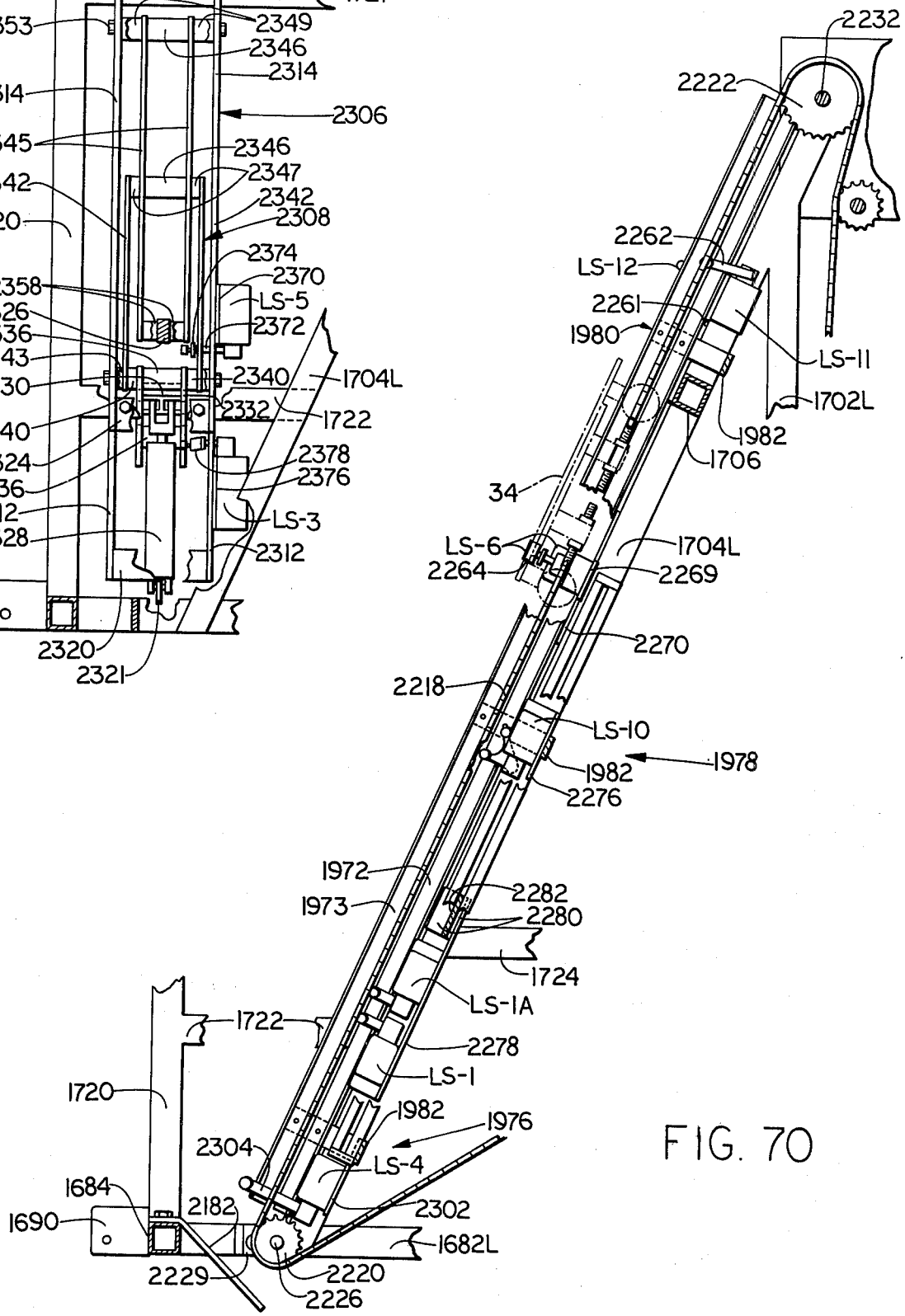
FIG. 70

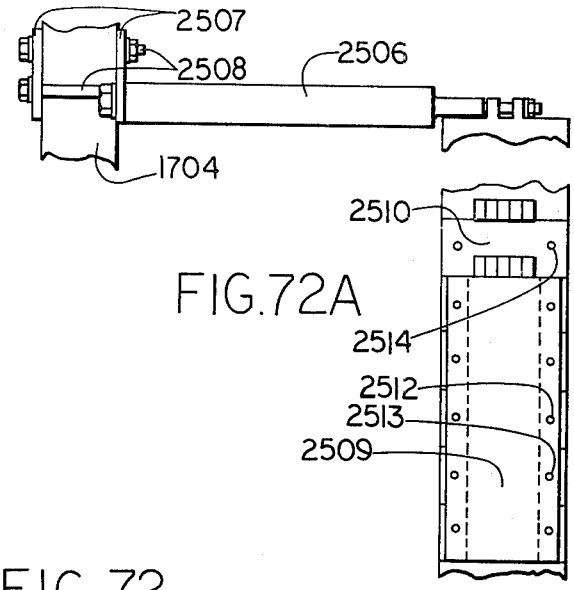
FIG.72A
FIG.72
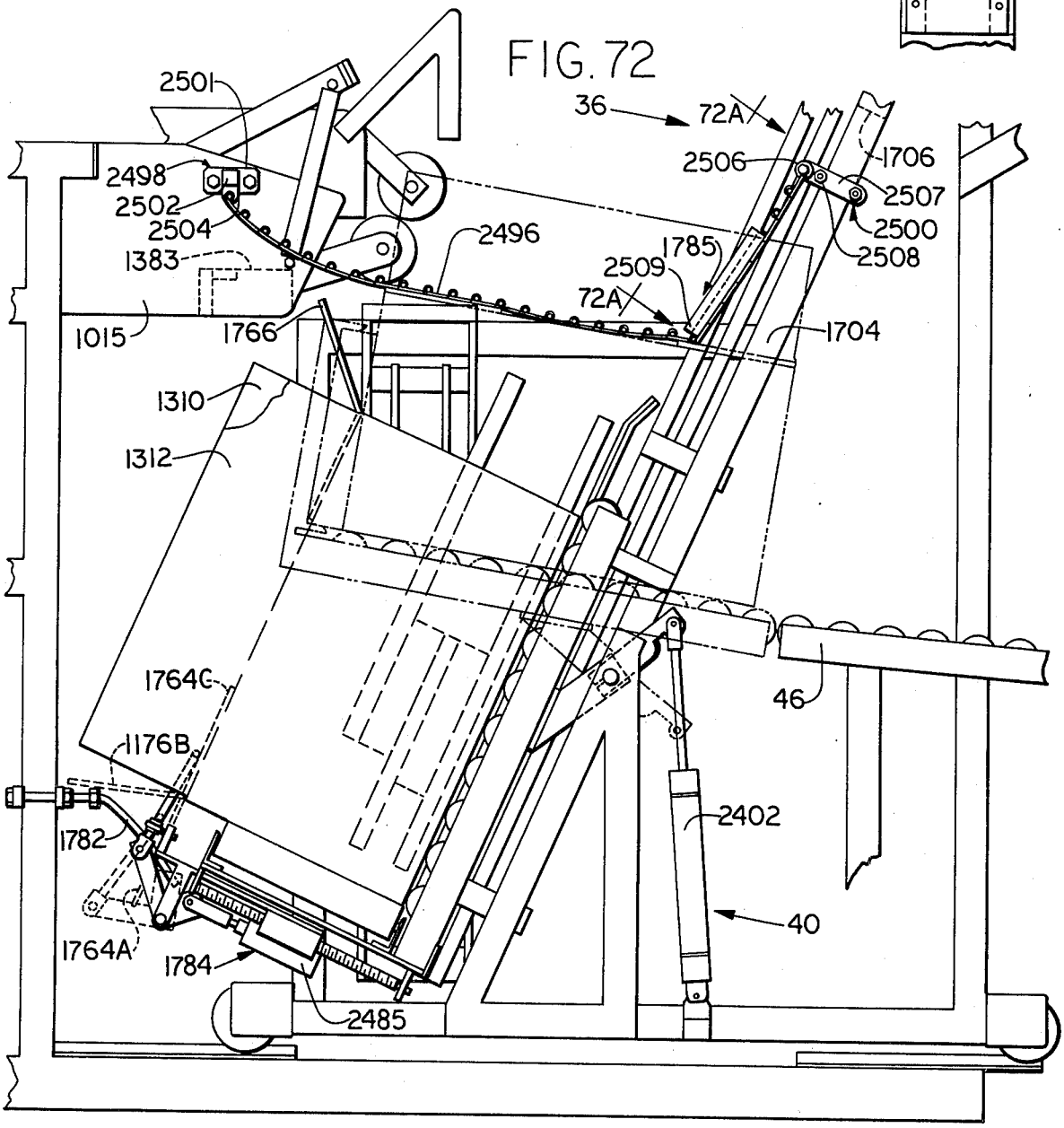

MACHINE FOR OPENING, INSPECTING AND PACKING A FOLDING CARTON

This invention relates to a machine for checking or testing folding cartons of the type used for supporting bottles and the like and for freeing portions of the carton which may be held together inadvertently by misplaced specks or splatter of glue, and then packing the cartons in a case.

As folding cartons come from a gluing machine, glue specks can be on unwanted surfaces of the cartons and can improperly hold surfaces together preventing ready use of the cartons in automatic machinery. In addition, if one of the cartons is erected after the glue has set and cured, the panels of the carton can be torn because the glue specks prevent separation of such surfaces.

An object of this invention is to provide a machine which receives cartons from a gluing machine and partially opens each carton to break improperly glued portions before the glue has time to set permanently and cure.

A further object of this invention is to provide such a machine in which cartons are fed from a stack to a carton opening and inspection station one at a time and in which provision is made for moving each carton sidewise and also endwise before a conveyor picks up the carton for feeding to the carton opening and inspection station to insure that each carton is separated from a following carton in the stack.

A further object of this invention is to provide such a machine which inspects each carton at the carton opening and inspection station to determine that each carton is properly opened at the carton opening and inspection station.

A further object of this invention is to provide such a machine which discharges cartons which are found on inspection to be improperly glued.

A further object of this invention is to provide such a machine which, after inspection, feeds the cartons in a stream directly into a case.

A further object of this invention is to provide such a machine in which the height of a stack of cartons forming inside the case is measured as the cartons are being introduced into the case so that the delivery of cartons to the case can be stopped when the case has been filled and so that the case can be replaced by another case.

A further object of this invention is to provide such a machine in which the cartons pass through the carton opening and inspection station in a steady stream, but in which the flow of cartons to the case is interrupted when the case must be removed for replacement by another case.

Briefly, this invention provides a machine which receives folding cartons from a gluing machine and in which the cartons form an input stack as they are received from the gluing machine. The lowermost carton on the stack is advanced sidewise and also endwise a small amount to separate the lowermost carton from the next higher carton in the input stack. A conveyor then picks up the lowermost carton and advances the carton to a carton opening and inspection station. At this station, vacuum cups engage upper and lower faces of the folding carton and draw the upper and lower faces apart to cause partial opening of the carton. Any small glue specks which might set and cure to prevent opening of the carton are broken in this carton opening operation. While the carton is partially open, the carton passes an inspection position at which a light beam is directed into the carton to demonstrate that the carton has properly opened. The carton passes from the carton opening and inspection station to a surge hopper from which cartons are fed in a shingle stream formation to a loading station at which a case is supported in position to receive the stream of cartons. A carton hold down and metering arm overlies the cartons as the cartons build up in the case, and the case is lowered under control of mechanism actuated by the hold down and metering arm until the case has been filled. When the case has been lowered to a position at which the case is filled, the flow of cartons to the case is halted as the case is removed and a new case is introduced into position for receiving cartons. The new case is automatically introduced when the first case is removed. However, the flow of cartons through the carton opening and inspection station continues unhalted and cartons build up in the surge hopper. The case introducing apparatus holds the new case open as the hold down and metering arm is inserted into the new case and the case filling operation is started again.

The above and other objects and features of the invention will be apparent to those skilled in the art to which this invention pertains from the following detailed description and the drawings, in which:

FIG. 8A is a fragmentary view in side elevation on an enlarged scale showing a pick-off lug and associated structure;

FIG. 9 is a fragmentary view in end elevation of a bottle carrier pre-accelerator subassembly looking in the direction of the arrows 9—9 in FIG. 7;

FIG. 10 is a view in section of the bottle carrier input hopper that is taken generally along line 10—10 in FIG. 7, parts being partially or wholly cut away to expose essential parts that lie beyond them;

FIG. 11 is a fragmentary view in section of an input basket limit switch that is taken along the line 11—11 in FIG. 7;

FIG. 20 is a fragmentary view in end elevation of an upper inspection section mount support looking in the direction of the arrows 20—20 in FIG. 19;

FIG. 21 is a fragmentary view in end elevation of a lower inspection section mount support taken in the direction of the arrows 21—21 in FIG. 19;

FIG. 32 is a fragmentary plan view of a surge hopper side guide mount that is shown in context in FIG. 34, a portion of a frame and of a slide rail mount being shown in association therewith;

FIG. 33 is a schematic view in side elevation of a surge hopper assembly;

FIG. 63 is a view in section taken on the line 63—63 in FIG. 65;

FIG. 64 is a side elevational view of the case input section taken in the direction of the arrows 64—64 in FIG. 61;

FIG. 69 is a view in section showing the case pushoff assembly taken on the line 69—69 in FIG. 68, a pusher plate being omitted;

FIG. 70 is a sectional view of the packing elevator taken on the line 70—70 in FIG. 68, parts being cut away to further expose pertinent machinery and limit switches;

FIG. 72 is a schematic view in side elevation that depicts the inter-relationship between the packing assembly, case pushoff assembly, an output tipover assembly, a flap closing belt and the customer output conveyor;

FIG. 72A is a fragmentary view looking in the direction of the arrows 72A—72A in FIG. 72;

In the following detailed description and the drawings, like reference characters indicate like parts.

INTRODUCTION

Figure 1:
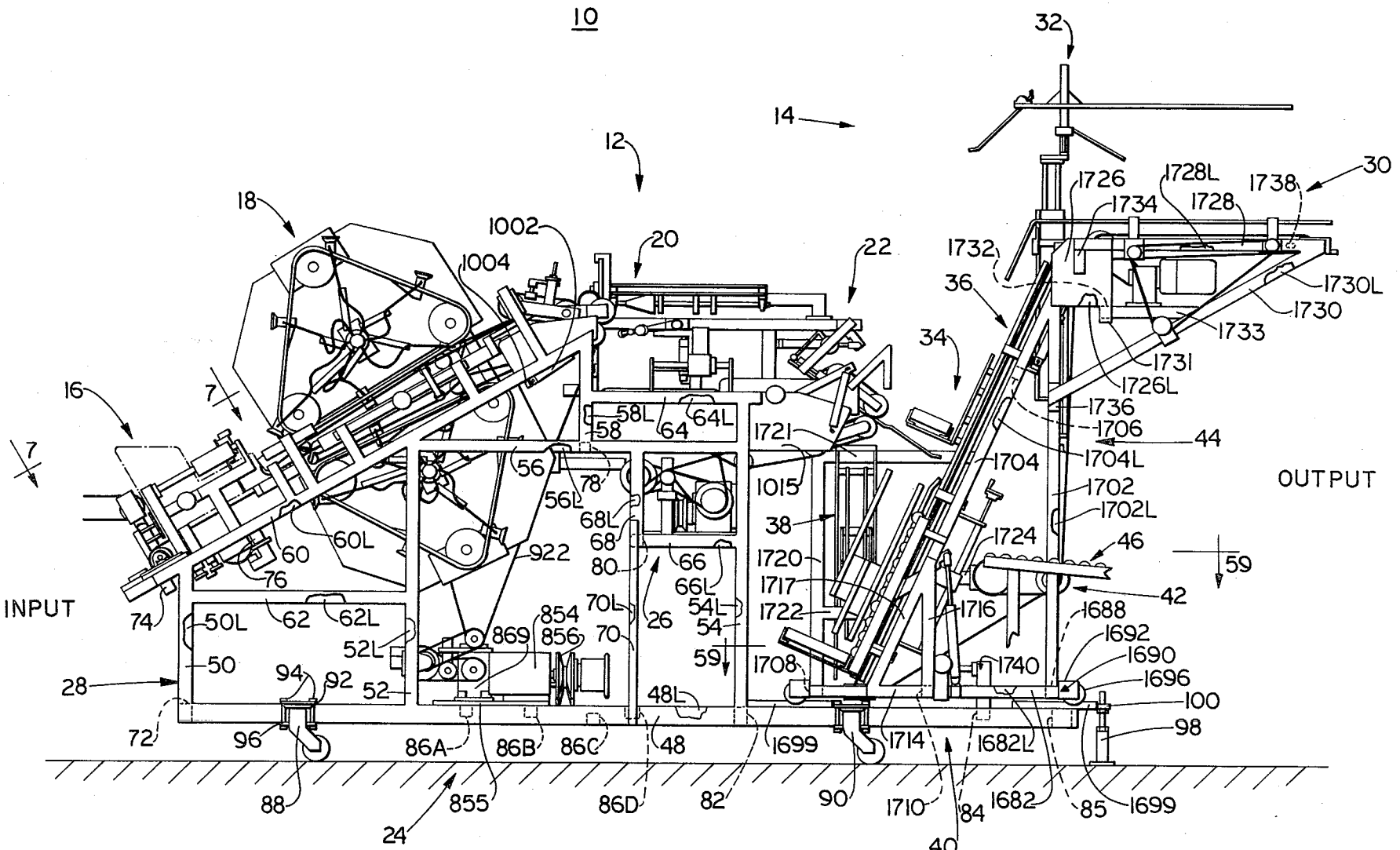
FIG. 1 is a somewhat schematic side elevational view of a bottle carrier checker/packer machine constructed in accordance with an embodiment of this invention showing the major structure of the machine and the relative placement of subassemblies thereupon.

FIG. 1 shows a bottle carrier checker/packer machine 10 which is constructed in accordance with an embodiment of this invention.

The bottle carrier checker/packer machine 10 is comprised of two major sections; a bottle carrier handling assembly 12 and a case handling assembly 14. The bottle carrier handling assembly 12 is further comprised of an input hopper 16, a carrier inspection section 18, a surge hopper 20, a carrier packing assembly 22, an inspection and input section drive assembly 24, a surge and pack section drive assembly 26 and a carrier section frame assembly 28. The case handling assembly 14 is further comprised of a case input conveyor 30, an input tipover assembly 32, a packing elevator 34, an elevator incline 36, a case pushoff assembly 38, an output tipover assembly 40, a case handling system drive assembly 42 and a case section frame assembly 44.

A definition of logistical terms is now in order. The reader, in viewing FIG. 1, is looking at the right side of the bottle carrier checker/packer machine 10. This is also known as the operator side. The left side of the machine is known as the reject side. This convention of left and right sides will be maintained for both the bottle carrier handling assembly 12 and the case handling assembly 14.

The left extremity of FIG. 1 is the carrier input end. The longitudinal direction is in general parallel to the direction of bottle carrier flow. The lateral direction is transverse to the longitudinal direction. The lateral and longitudinal conventions will apply to the entire bottle carrier checker/packer machine 10.

The bottle carriers travel from the left to the right of the figure. The output end of the bottle carrier handling assembly 12 is at the right hand extremity of the carrier packing assembly 22. Conversely, the input end of the case handling assembly 14 is located at the extreme upper right of FIG. 1. Corrugated cases (one of which is shown at 1288 in FIG. 44) are entered onto the case input conveyor 30 (FIG. 1) either manually, or by customer conveyor, and the cases travel temporarily from right to left of the figure, then in general, vertically downward by means of the packing elevator 34. The cases reverse directions by means of the output tipover assembly 40, exiting the case handling assembly 14 travelling from left to right on a customer output conveyor 46. Except for the case input conveyor 30 and the input tipover assembly 32 of the case handling assembly 14, the input side of any part is that side which faces the input end of the bottle carrier handling assembly 12, while the output side of any part is that side which faces the customer output conveyor 46. With respect to the case input conveyor 30 and the input tipover assembly 32, the input side of any part is that side which faces an oncoming case, while the output side of any part is that side which faces the bottle carrier handling assembly 12.

The carrier section frame assembly 28 is comprised of a pair of bottom stringers 48 and 48L. The stringers 48 and 48L run the full length of the bottle carrier handling assembly 12 and the case handling assembly 14. A pair of short input posts 50 and 50L is rigidly affixed in a vertical disposition to the carrier input ends of the pair of bottom stringers 48 and 48L. Following from left to right of FIG. 1, the carrier section frame assembly 28 also comprises a pair of long input posts 52 and 52L and a pair of output posts 54 and 54L. A pair of short stringers 56 and 56L is fixedly attached in a horizontal disposition from the top end of the pair of long input posts 52 and 52L to the input face of and near the top of the pair of output posts 54 and 54L. A pair of short output posts 58 and 58L is rigidly affixed in a vertical disposition to the center of the span of the pair of short stringers 56 and 56L. A pair of inclined stringers 60 and 60L is rigidly affixed across the top of the pair of short input posts 50 and 50L, the pair of long input posts 52 and 52L and the pair of short output posts 58 and 58L, as shown in FIG. 1. A pair of longitudinal input stiffeners 62 and 62L is rigidly affixed between the pair of short input posts 50 and 50L and the pair of long input posts 52 and 52L. Rigidly affixed to the output face of the pair of short output posts 58 and 58L and across the top of the pair of output posts 54 and 54L is a pair of top longitudinal stringers 64 and 64L. The surge and pack section drive assembly 26 is fixedly mounted upon a pair of short mounting members 66 and 66L that is suspended in horizontal disposition from the bottom ends of a pair of short vertical hangers 68 and 68L and the input face of the pair of output posts 54 and 54L. A pair of vertical support members 70 and 70L is fixedly attached to the outboard surfaces of, the lower extremity of the pair of short vertical hangers 68 and 68L, and the pair of bottom stringers 48 and 48L.

The right and left hand sides of the carrier section frame assembly 28 are held in spaced lateral and parallel relation with each other by means of an input lateral stiffener 72, an input incline lateral stiffener 74, a second incline lateral stiffener 76, an inspection output lateral stiffener 78, a drive assembly lateral stiffener 80, a carrier output lateral stiffener 82, a case lateral stiffener 84 and a case output lateral stiffener 85. Secondary lateral stiffeners 86A, 86B, 86C and 86D are provided to also function as support members for the inspection and input section drive assembly 24 as well as providing lateral stability to the carrier section frame assembly 28.

The carrier section frame assembly 28 is supported and made movable by a pair of input casters 88 and a pair of output casters 90 that are fixedly attached to a set of four caster mounting plates 92. The set of four caster mounting plates 92 support the pairs of input and output casters 88 and 90, respectively, in a cantilever manner on the outboard sides of the carrier section frame assembly 28. Each mounting plate of the set of four caster mounting plates 92 is fixedly clamped about its respective bottom stringer 48 and 48L by means of a set of four bolts and nuts 94 and a bottom retainer plate 96. The manner of attachment permits the longitudinal repositioning of the pairs of input and output casters 88 and 90 respectively, if necessary. Upon installation, the bottle carrier checker/packer machine 10 is aligned and positioned with respect to customer related machinery by means of the pairs of input and output casters 88 and 90 and then locked into fixed position by means of a jack screw 98. The jack screw 98 is threadably mounted in a jack plate 100 that is in turn rigidly affixed to the top and center of the case output lateral stiffener 85 in cantilever manner as shown at the case output end of FIG. 1.

INPUT HOPPER

Figure 2:
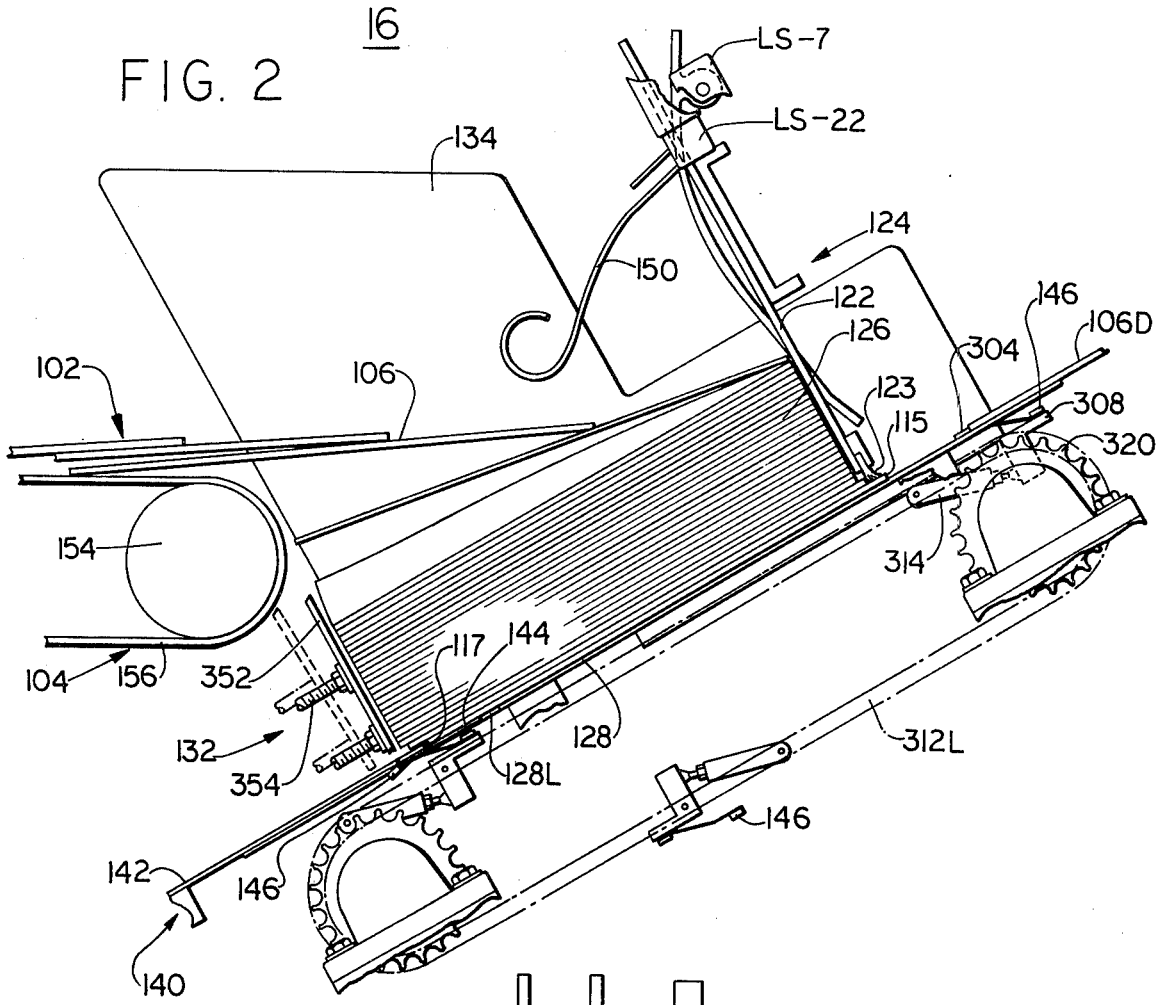
FIG. 2 is a fragmentary schematic view in side elevation of a bottle carrier input hopper section of the machine, an input conveyor being shown schematically in association therewith.

Referring to FIG. 2, a stream of bottle carriers or cartons 102, traveling from left to right as shown in FIG. 1, is delivered to the input hopper 16 by means of a carrier input conveyor 104 (shown schematically) which can be the terminus of a gluer-sealer processing machine.

Figure 5:
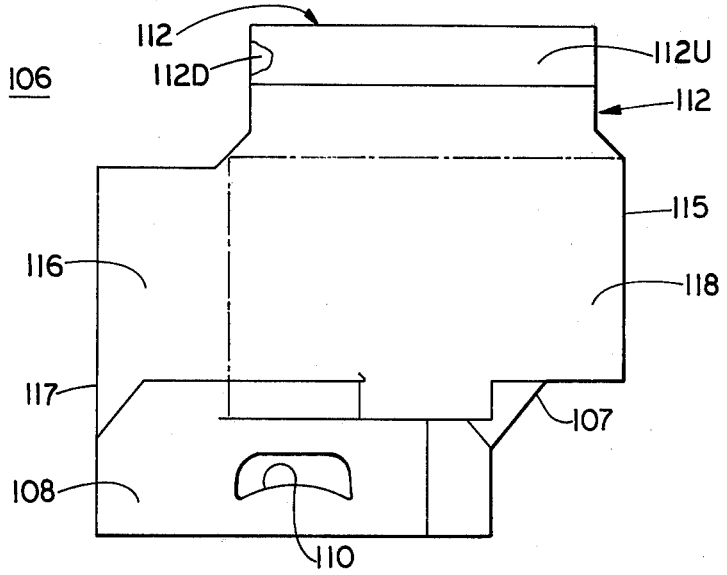
FIG. 5 is a plan view of an unopened bottle carrier or carton in the proper relative position for processing in the bottle carrier checker/packer machine of FIG. 1, fold lines being indicated by dot-dash lines.
Figure 6:
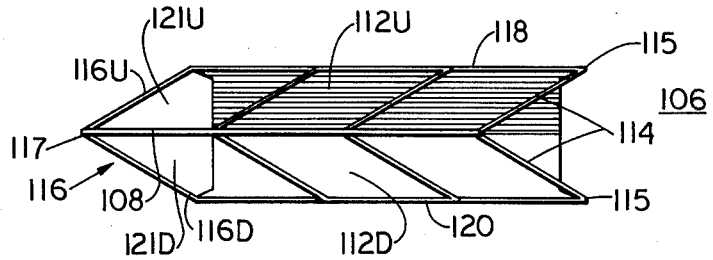
FIG. 6 is a side elevational view of the bottle carrier or carton of FIG. 5, but in partially opened configuration for subsequent inspection thereof.

A bottle carrier or carton 106 is shown in FIG. 5 in the folded and flat configuration. The bottle carrier to carton can be of the type known as a Bottle Master Hi-Cushion, a trademark of The Mead Corporation. A bottle carrier handle central panel 107 has a portion 108, which incorporates a finger cutout 110. The handle portion 108 passes through the bottle carrier checker/-packer machine 10 adjacent to the right hand side of the machine. A carrier bottom 112 of the bottle carrier 106 consisting of bottom half panels 112U and 112D passes through the bottle carrier checker/packer machine 10 adjacent to the left hand side of the machine. A concave end panel 114 (FIG. 6) is the front of the bottle carrier 106 and passes from left to right of the figure and likewise through the bottle carrier checker/packer machine 10. Leading edges 115 are at opposed edges of the concave end panel 114. A convex end panel 116 is therefore the trailing portion of the bottle carrier 106. A trailing edge 117 divides the convex end panel 116 into upper and lower sections 116U and 116D. The bottle carrier 106 is shown in FIG. 6 in the partially opened configuration which occurs in the carrier inspection section 18 as will be described hereinafter. A carrier top panel 118 is defined as that otherwise side panel that faces upwardly in FIGS. 5 and 6, and a carrier bottom panel 120 faces downwardly. The top panel 118, the central panel 107, and the bottom panel 120 are parallel and spaced in their partly open position. As shown in FIG. 6, there are open spaces 121U and 121D between the carrier handle 108 and the upper and lower sections 116U and 116D, respectively.

Figure 3:
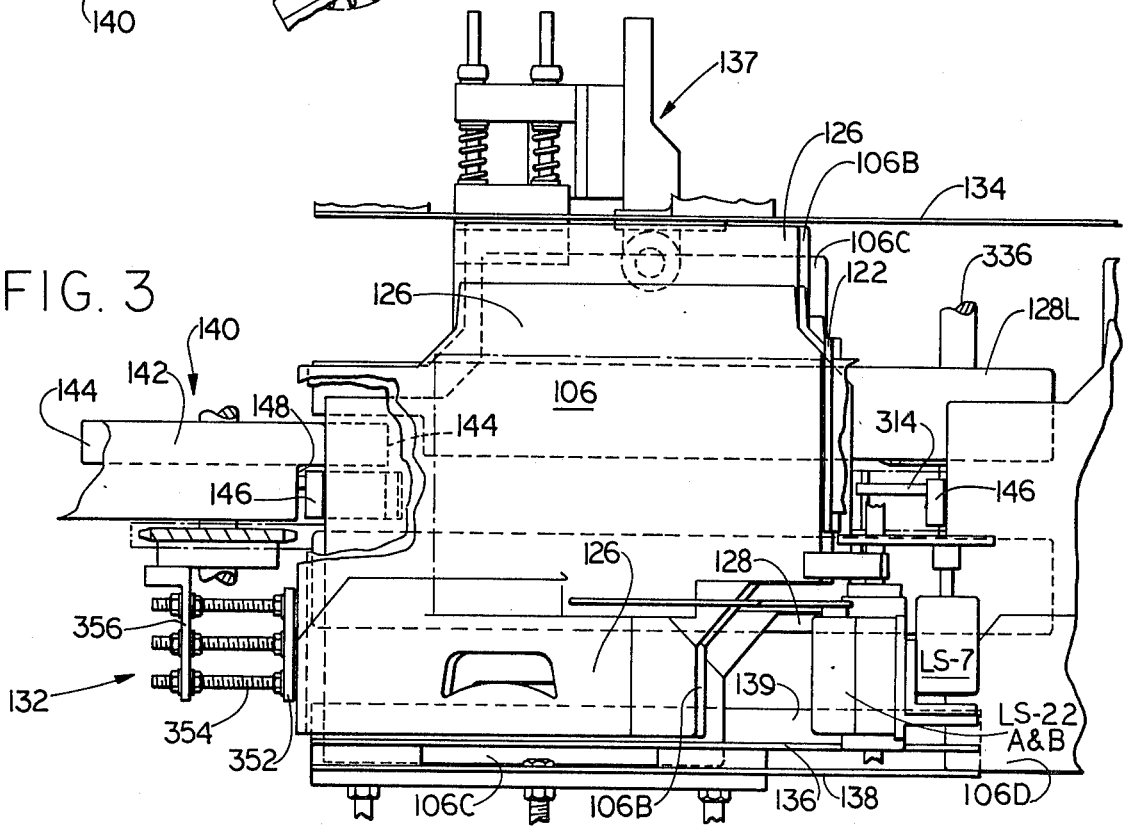
FIG. 3 is a fragmentary schematic plan view of the bottle carrier input hopper section shown in FIG. 2 with parts being broken away to reveal details of structure.
Figure 4:
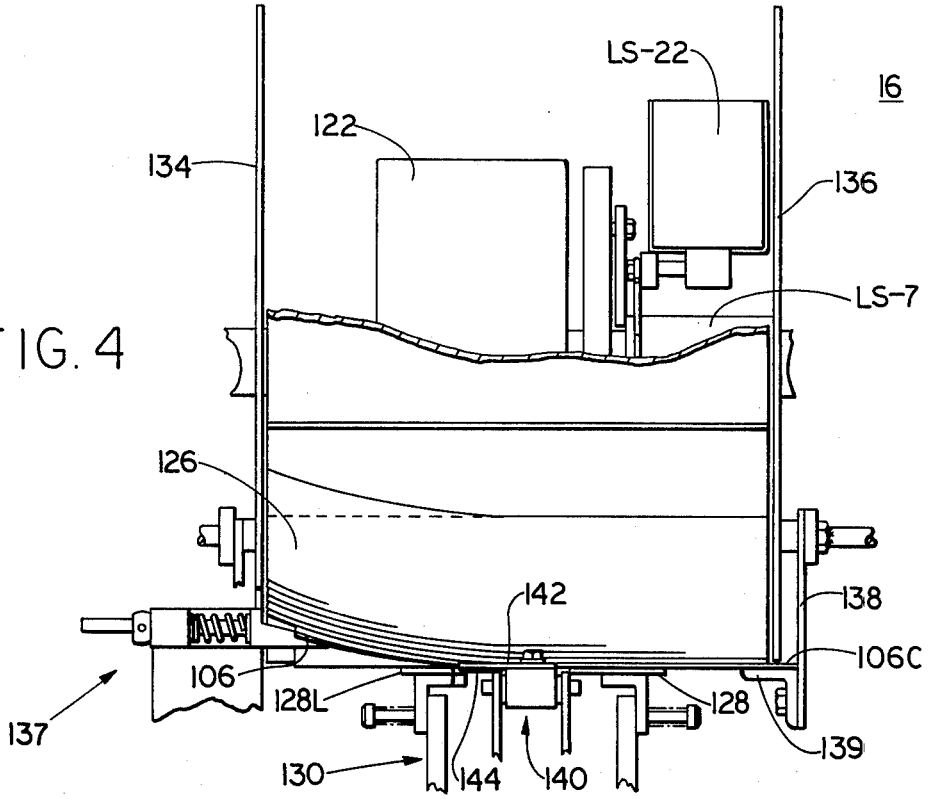
FIG. 4 is a fragmentary schematic view in end elevation of the bottle carrier input hopper section shown in FIG. 2.
Figure 7:
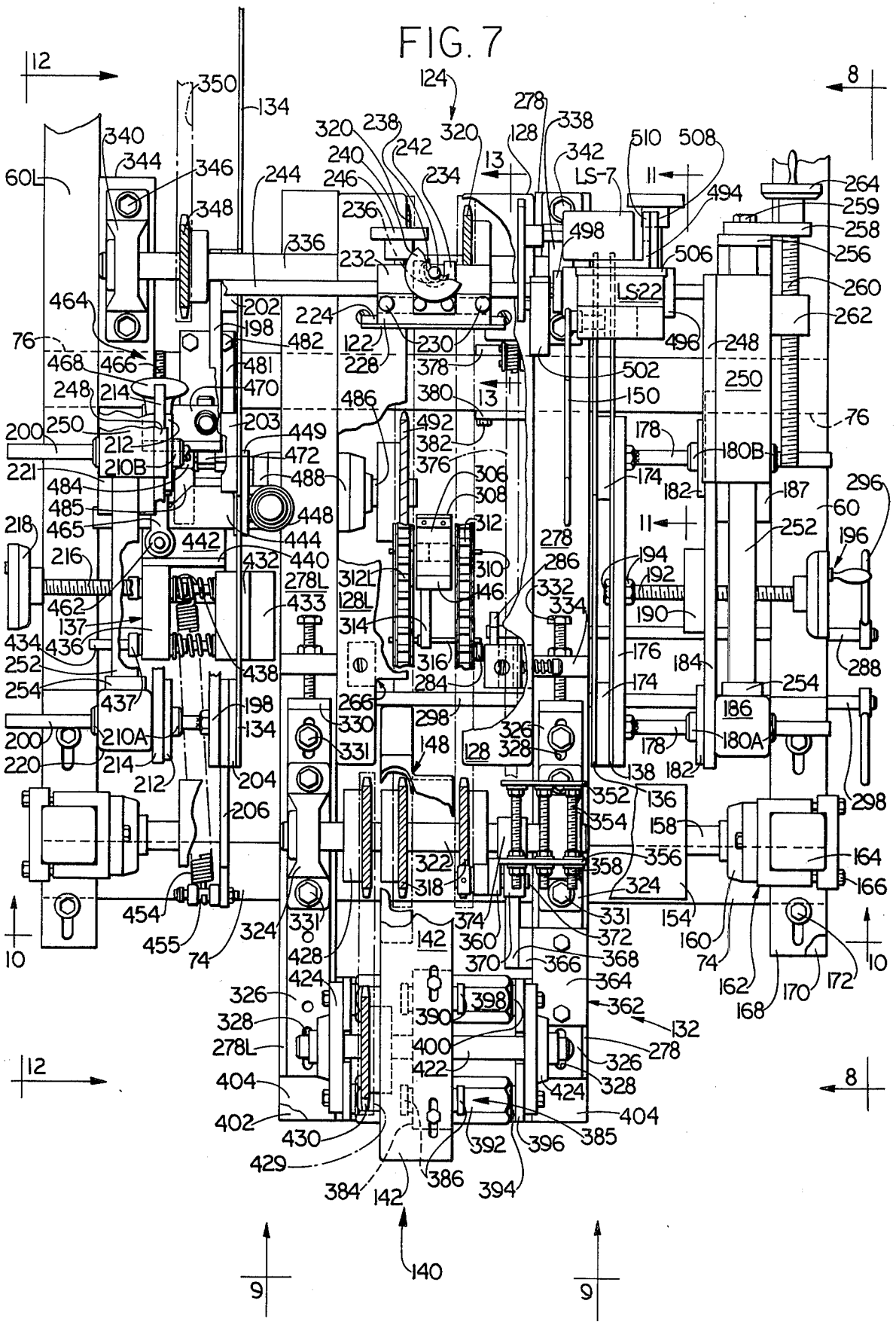
FIG. 7 is a view of the bottle carrier input hopper looking in the direction of the arrows 7—7 in FIG. 1 with several parts partially cut away to expose essential parts that underlie them.

Referring to FIG. 2, the bottle carrier 106 exits the carrier input conveyor 104 and proceeds forward until it impacts against a discriminator plate 122 of an input discriminator assembly 124. The bottle carrier 106 then falls into a stack of carriers 126 that rests upon a pair of bottom rails 128 and 128L of a bottom rail assembly 130 (FIG. 4). The stack of carriers 126 is retained against the discriminator plate 122 by means of a back patter assembly 132 (FIGS. 2 and 3). The stack of carriers 126 is held in lateral spaced relationship with the input hopper 16 by means of a left side plate 134 and a right side plate 136 (FIG. 7). As the bottle carrier 106 reaches the bottom of the stack of carriers 126 it is differentially moved forward to a position 106B (FIG. 3). This movement is a result of friction transfer up through the stack as the bottom carrier is stripped away. The position 106B is limited by a discriminator brush 123 of the input discriminator assembly 124. The bottle carrier 106 is then moved laterally to the right to a position 106C by means of a side shuffler assembly 137 as is shown in FIGS. 3 and 4. The bottom carrier is limited in this lateral movement by an offset right side plate 138. A flange of an angle 139, which is attached to the plate 138, supports the edge of the bottle carrier at the plate 138. The bottle carrier 106 is now in position to be moved from under the stack and into the carrier inspection assembly 18.

Referring to FIGS. 2, 3 and 4, the forward movement of the bottle carrier is initiated by a pre-accelerator assembly 140. The working parts of the pre-accelerator assembly incorporate a pusher tongue or carton starting lug 142 (FIGS. 2 and 4) that stays in horizontal alignment with the trailing edge of the lowermost bottle carrier 106C by means of a bottom retainer tongue 144. This insures that the pusher tongue 142 will always contact the trailing edge of the bottom bottle carrier 106C only. The pusher tongue 142 is cam oscillated, as will be described hereinafter, and receives the trailing edge of the bottle carrier 106C at very low velocity. The cam operation provides an increase in speed until at midstroke the bottom bottle carrier 106 has received its highest acceleration from this assembly, at which point a pickoff lug 146 (FIGS. 2 and 3) comes in contact with the trailing edge 117 of the bottle carrier 106 by entering a tongue cutout 148 (FIG. 3) of the pusher tongue 142, and in sequence translates the bottom bottle carrier 106C under the input discriminator assembly 124 and into the carrier inspection section 18 (FIG. 1). Bottle carriers 106 accumulate in the input hopper 16 (FIGS. 2, 3 and 4) until the inspection and pack cycles are activated by means of a limit switch LS-7. If the stream of bottle carriers 102 enter the input hopper 16 faster than they are removed, then the stack of carriers 126 will increase until an arm 150 of a limit switch LS-22 is activated to activate a first pole LS-22A thereof, thus causing the inspection and pack cycles to increase speed. If the stack of carriers 126 continue to increase, a second pole LS-22B will be activated causing the gluer-sealer and the carrier input conveyor 104 to stop.

Figure 8:
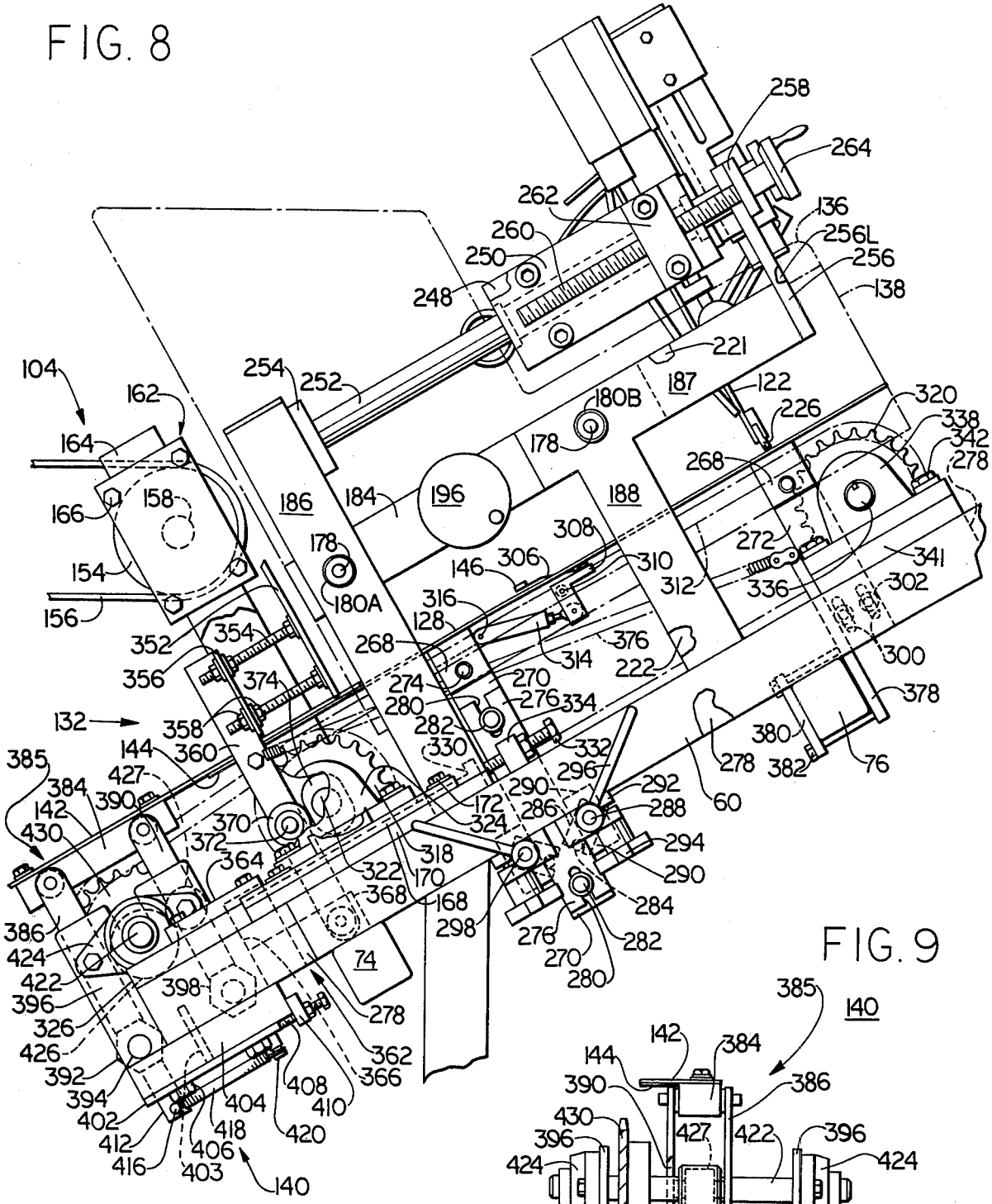
FIG. 8 is a side elevational view of the bottle carrier input hopper looking in the direction of the arrows 8—8 in FIG. 7, a side plate and an offset side plate being shown in dot-dash lines.

The terminus of the carrier input conveyor 104 is an integral part of the input hopper 16 and comprises an input roller 154 and an input conveyor belt 156 as is shown in FIGS. 7, 8 and 10. The input conveyor belt 156 moves clockwise about the input roller 154 (with respect to FIG. 8), the input roller 154 being rigidly affixed to an input shaft 158. The input shaft 158 is rotatably mounted in a pair of input bearings 160 (FIG. 7) that is in turn fixedly attached to a pair of input slide blocks 162 that is adjustably clamped to a pair of short input risers 164 to provide vertical adjustment thereof. Each slide block of the pair of input slide blocks 162 is releasably secured to an associated input riser 164 by means of a set of four bolts 166. The pair of short input risers 164 is perpendicularly and adjustably attached to the top input ends of the pair of inclined stringers 60 and 60L by means of a pair of integral mounting feet 168 in conjunction with a pair of spacers 170 and bolts 172. This provides a degree of longitudinal adjustment to the terminus of the carrier input conveyor 104.

The right side plate 136 is employed as a guide for the stack of carriers 126 and is shown in side elevation and dot-dash lines in FIG. 8. The offset right side plate 138 is shown in FIGS. 7 and 10 and is a rectangular piece extending the length of the right side plate 136. The right side plate 136 and the offset right side plate 138 are held in lateral spaced relationship by a pair of spacer blocks 174, the two plates and the pair of spacer blocks 174 being fixedly attached to a mounting bar 176. The mounting bar 176 is rigidly affixed to a pair of slide rods 178 that is laterally movable within a pair of bushings 180A and 180B. Each of the pair of bushings 180A and 180B incorporate, in an integral manner, a mounting plate 182. The pair of mounting plates 182 is fixedly attached near each end of a jack mounting bar 184 (FIGS. 7, 8 and 9) that is in turn rigidly affixed to the inboard surface of a right side input riser 186 and a right side short stringer 187. The right side short stringer 187 is rigidly affixed across the top of a right side output riser 188 in the form of a "T". The bottom extremity of the right side input riser 186 is rigidly affixed to the inboard surface of the right side inclined stringer 60 approximate to the right member of the pair of short input risers 164. In similar manner the bottom extremity of the right side output riser 188 is fixedly attached to the inboard surface of the right hand inclined stringer 60 adjacent to the location of the second inclined lateral stiffener 76. The jack mounting bar 184 rigidly incorporates a thread block 190 (FIG. 7) through which a right side jack screw 192 is threadably mounted. The inboard end of the right side jack screw passes through a clear hole in the mounting bar 176 and is retained in lateral relation with the mounting bar 176 by a pair of stop nuts 194. The pair of stop nuts 194 is fixedly attached to the jack shaft 192 on both sides of the mounting bar 176 thus providing a rotatable attachment. The outboard end of the right side jack screw 192 is fixedly fitted with a crank handle 196. Clockwise rotation of the crank handle 196 translates the right side plate 136 and the offset right side plate 138 toward the center of the machine providing an adjustable right side guide for the incoming bottle carrier 106. Counterclockwise rotation of the crank handle 196 translates the right side plate 136 away from the center of the machine.

Figure 12:
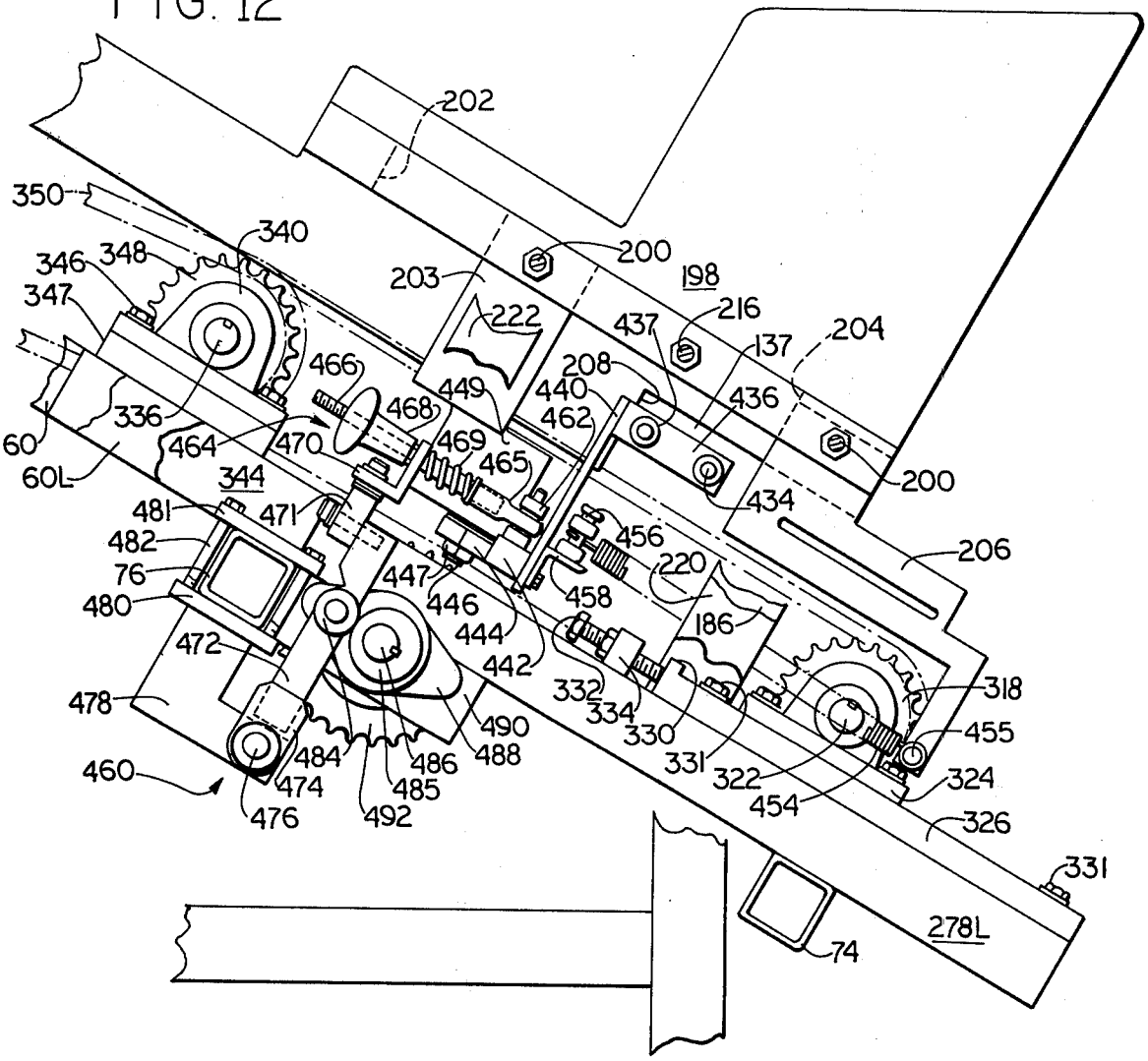
FIG. 12 is a fragmentary view in side elevation of the bottle carrier input hopper showing a side shuffler subassembly that is taken in the direction of the arrows 12—12 in FIG. 7.

The left side plate 134 is shown in FIGS. 7, 10 and 12. A long mounting bar 198 (broken away in FIG. 7 to expose parts below it) is rigidly affixed to a pair of slide rods 200. The left side plate 134 and the long mounting bar 198 are held in lateral spaced relationship by an output spacer block 202 near the output end of the left side plate 134, a primary shuffler mount 203, and a thin input spacer 204 in combination with a spring tiedown plate 206 near the input end of the left side plate 134. The left side plate 134 incorporates a rectangular cutout 208 to provide passage of the side shuffler assembly 137. The pair of slide rods 200 is slidably mounted in a pair of left side bushings 210A and 210B. Each of the pair of left side bushings 210A and 210B fixedly incorporate a mounting flange 212. The left side bushing 210A is fixedly attached to the input end of a jack base plate 214 and the left side bushing 210B is fixedly attached approximate to the output end of the jack base plate 214. The jack base plate 214 is shown in FIG. 7 with its middle portion cut away to expose parts that underlie it. A left side jack screw 216 that incorporates a crank handle 218 for rotation thereof is threadably mounted to the jack base plate 214 and then pivotally attached to the long mounting bar 198 in the same manner as, but in mirror image to, the jack mounting bar 184 and the mounting bar 176 of the right side plate 136. The input end of the jack base plate 214 is rigidly affixed to the inboard side of a left side input riser 220 and the output end is rigidly affixed to the inboard surface of a left side short stringer 221 (FIG. 8) that is in turn rigidly affixed across the top of a left side output riser 222 (FIG. 12) in the form of a "T", in the same manner as that of the right side short stringer 187. The left side input riser 220 is rigidly mounted to the inboard side of the left hand inclined stringer 60L (FIG. 7) slightly downstream of the input incline lateral stiffener 74. The left side output riser 222 (FIG. 12) is likewise rigidly mounted to the inboard side of the left hand inclined stringer 60L adjacent to the second incline lateral stiffener 76. The left side plate 134 is employed as a side guide for the incoming bottle carrier 106, being laterally adjustable to accommodate carriers of various sizes.

Figure 13:
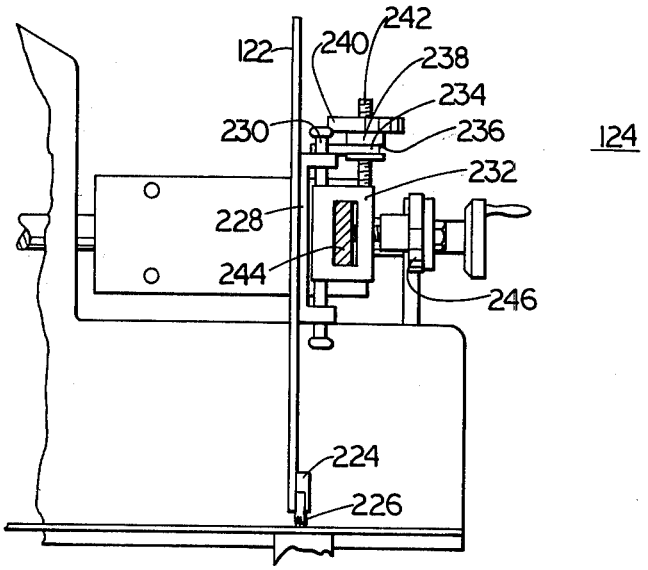
FIG. 13 is a fragmentary view in section of a bottle carrier input hopper discriminator that is taken along line 13—13 in FIG. 7.

The mechanical means whereby the input discriminator assembly 124 (FIG. 2) is held in place is shown in FIGS. 7, 8, 10 and 13. Referring specifically to FIGS. 7 and 13, the discriminator plate 122 incorporates a brush retainer 224 that is fixedly attached along its bottom output edge, and fixedly clamped therebetween an input discriminator brush 226. The discriminator plate 122 is fixedly attached to an elevation channel 228 that is slidably mounted for a vertical degree of freedom upon a pair of elevation rods 230. The pair of elevation rods 230 is rigidly affixed in a vertical disposition within a mounting slide collar 232. The elevation channel 228 incorporates an elevation fork 234 that is fixedly attached to the top thereof. The elevation fork 234 rests in an annular slot 236 that is integrally incorporated within a shank 238 of an adjustment handle 240. The adjustment handle 240 and its shank 238 is threadably mounted upon a vertical shaft 242 that is in turn rigidly affixed within the top of the mounting slide collar 232. By rotation of the adjustment handle 240, the elevation fork 234 and the input discriminator brush 226 are displaced vertically, providing a rate control to the stream of bottle carriers 102 passing thereunder. The mounting slide collar 232 is laterally displaceable upon an input lateral rail 244. It can be fixedly held at any lateral location by a lock handle 246 that is threadably mounted through the output side of the mounting slide collar 232 to forcefully bear against the input lateral rail 244.

The input lateral rail 244 and its mounting is shown in FIGS. 7, 8 and 10. A pair of mounting plates 248 is rigidly affixed in a perpendicular manner at the ends of the input lateral rail 244 for mounting thereof. The left side of the input lateral rail 244 in FIG. 7 has been cut away to expose parts that underlie it. The left hand side of this assembly is a mirror image of the right hand side. The pair of mounting plates 248 is fixedly attached to the inboard surfaces of a pair of input discriminator slide blocks 250 that is in turn slidably mounted about a pair of input slide rods 252. This allows a longitudinal degree of freedom to the input lateral rail 244 and consequently to the input discriminator brush 226. The input ends of the pair of input slide rods 252 are inserted into holes in a pair of input mount blocks 254 that is in turn fixedly attached to the top and output faces of the right side input riser 186 and the left side input riser 220. The output ends of the pair of input slide rods 252 are likewise inserted into corresponding holes located at the top of a pair of supplemental output risers 256 (FIG. 7, right side, and FIG. 8) and 256L. The pair of input slide rods 252 is held in place within the holes provided within the pair of input mount blocks 254 and the pair of supplemental output risers 256 and 256L by a pair of butt plates 258, one of which is shown in FIG. 7, that is rigidly affixed to the output faces of the pair of supplemental output risers 256. The pair of input slide rods 252 is restrained from rotation by means of a pair of end screws 259, one of which is shown in FIG. 7. The pair of supplemental output risers 256 is vertically and rigidly affixed against the output ends of the right side short stringer 187 and the left side short stringer 221. In this manner rigid support is provided to the longitudinally slidable input lateral rail 244.

The pair of butt plates 258 extends laterally outboard to rotatably accommodate a pair of adjusting screws 260 and 260L as shown in FIGS. 7, 8 and 10. The pair of adjusting screws 260 and 260L is threadably mounted through a pair of lugs 262 (one of which is shown in FIGS. 7 and 8) fixedly attached to the outboard surfaces of the pair of input discriminator slide blocks 250. By rotation of a pair of handle cranks 264 and 264L fixedly attached to cylindrical extensions of the pair of adjusting screws 260, the pair of input discriminator slide blocks 250 is controlled in longitudinal movement upon the pair of input slide rods 252.

The mechanical structure of the bottom rail assembly 130 (FIG. 4) is shown in FIGS. 7, 8 and 10. The pair of bottom rails 128 and 128L provides bottom support for the stack of carriers 126 (FIG. 4) as previously described. Each member of the pair of bottom rails 128 and 128L is a flat plate of elongated ractangular shape except for the left hand bottom rail 128L that is provided with a small rectangular cutout 266 (FIG. 7) that provides entry of the pusher tongue 142 of the preaccelerator assembly 140. The pair of bottom rails 128 and 128L is fixedly secured to a set of four mounting lugs 268 (FIG. 10) of inverted "L" shape, the one adjacent to the rectangular cutout 266 being foreshortened to be commensurate with the cutout. The set of four mounting lugs 268 is pivotally mounted to the top extremities of a pair of input elevation bars 270 and a pair of output elevation bars 272 by a set of four spring loaded cap screws 274. This pivotal arrangement allows for differential height adjustment between the pair of input elevation bars 270 and the pair of output elevation bars 272.

The pair of input elevation bars 270 (FIGS. 8 and 10) is vertically slidable with respect to a pair of input elevation mounts 276 rigidly affixed in generally upright manner across the inboard faces of a pair of short incline stringers 278 and 278L. The pair of short incline stringers 278 and 278L is rigidly affixed in a longitudinal direction across the top of the input incline lateral stiffener 74 and the second incline lateral stiffener 76. Each of the pair of input elevation mounts 276 is provided with a slot 280 at each end thereof. Received through these slots is a set of four spring loaded cap screws 282 that threadably mount in a solid manner in threaded holes provided near each end of the pair of input elevation bars 270, The springs of the set of four spring loaded cap screws 282 bear pressure against the outboard surfaces of the pair of input elevation mounts 276, thus slidably retaining the pair of input elevator bars 270 against the inboard faces of the pair of input elevation mounts 276. Each member of the pair of input elevation bars 270 is provided with an elevation peg 284. The elevation peg 284, of the right hand portion of the bottom rail assembly 130, is motivated in the vertical direction by a pivoting elevation fork 286 that is rigidly affixed to the inboard end of a lifter rod 288. The lifter rod 288 is pivotally mounted through a retaining ear 290 that is rigidly affixed to the output edge of the right hand member of the pair of input elevation mounts 276, and just underneath the right hand short incline stringers 278. The lifter rod 288 is also pivotally retained and lockable in a split mounting lug 292 (FIG. 8) that is rigidly affixed to the bottom of the right hand inclined stringer 60,. The split mounting lug 292 is provided with a clamp handle 294 that compresses the split mounting lug 292 and thus retains the lifter rod 288 in fixed place. The outboard extremity of the lifter rod 288 is provided with a handle 296 for rotation thereof. Thus, by releasing the clamp handle 294 and manually pivoting the handle 296, the pivoting elevation fork 286 in concert with the elevation peg 284 will raise or lower the right hand member of the pair of input elevation bars 270 to vertical adjust the input end of the right hand bottom rail 128. The input end of the left hand bottom rail 128L is vertically adjusted in the same manner with the following differences. In viewing FIG. 8, the vertical adjusting mechanism for the left hand bottom rail 128L is generally similar to that heretofore described. A left hand lifter rod 298 extends laterally across the machine (FIG. 7) to actuate the left hand member of the pair of input elevation bars 270 with an identical arrangement to that of the right hand side, except that the left hand parts are installed in a mirror image to that of the right side. Thus, the input ends of the pair of bottom rails 128 and 128L are independently adjustable in a vertical manner.

The pair of output elevation bars 272 is adjustably mounted near their bottom ends to the inboard faces of the pair of short incline stringers 278 and 278L and each incorporates a pair of slots 300. Details of mounting of the right hand elevation bar 272 are shown in FIGS. 8 and 10, the mounting of the left hand output elevation bar, not shown, being similar. A pair of spring loaded cap screws 302 pass through the pair of slots 300 (FIGS. 8 and 10) and is fixedly threaded into the inboard face of the right hand member of the pair of short incline stringers 278. The springs of the pair of spring loaded cap screws 302 hold pressure between the head of the cap screws and the inboard faces of the pair of output elevation bars 272 to securely clamp them against the inboard faces of the pair of short incline stringers 278, but still permit vertical adjustment thereof.

The pickoff lug 146 (FIG. 2), as shown in FIGS. 7, 8 and 8A, is fixedly attached to the free end of a small offset leaf spring 306 that is in turn fixedly clamped to the forward end of a lug pivot holder 308. The lug pivot holder 308 is pivotally mounted on a short shaft 310 (FIGS. 7 and 8) that is suspended at each end in a pair of input pickup chains 312 and 312L. The input end of a lug radius arm 314 is pivotally mounted upon a chain shaft 316 that is in turn pivotally mounted between the pair of input pickup chains 312 and 312L and the output end thereof is pivotally attached near the bottom of the lug pivot holder 308.

The pair of pickup chains 312 and 312L move in a clockwise loop about a pair of input sprockets 318 and a pair of output sprockets 320 (FIGS. 7, 8, 10 and 12). The pair of input sprockets 318 is fixedly attached to an input hopper shaft 322 that is rotatably mounted in a pair of input hopper bearings 324 that is in turn fixedly attached to the top of a pair of slide shims 326. Each of the pair of slide shims 326 incorporates at each end a slot 328, and a compression lug 330 at its output end. A set of four bolts 331 pass through the slots 328 and threadably mount through the top of the pair of short incline stringers 278 and 278L. A pair of stop lugs 334 is rigidly affixed to the upper surfaces of the pair of short incline stringers 278 and 278L and is longitudinally positioned to be spacedly adjacent the output ends of the pair of slide shims 326. A pair of bolts 332 is threadably mounted in a longitudinal orientation through the pair of stop lugs 334 to push against the two compression lugs 330. In so doing, the pair of slide shims 326 is moved toward the input end of the input hopper 16, thereby bringing tension into the pair of pickup chains 312 and 312L. The set of four bolts 331 are then tightened to secure the pair of input sprockets 318 in place.

The pair of output sprockets 320 is fixedly attached to an output hopper shaft 336, FIGS. 7, 8 and 12, that is in turn rotatably mounted in a right side output bearing 338 and a left side output bearing 340. The right side output bearing 338 (FIGS. 7 and 8) is fixedly attached to the top face of the right hand short incline stringer 278 by means of a pair of bolts 342, and at the proper elevation thereabove by a spacer block 341. The left side output bearing 340 (FIGS. 7 and 12) is fixedly attached to the top face of an auxiliary stringer 344 by means of a pair of bolts 346 and at the proper elevation thereabove by a spacer block 347. The auxiliary stringer 344 is rigidly affixed in a parallel orientation to the inboard surface of the left hand inclined stringer 60L, and with its input end coincident with the input face of the second incline lateral stiffener 76 as can be seen in FIG. 12.

An input hopper drive sprocket 348, shown in FIGS. 7 and 12, is fixedly attached to the output hopper shaft 336 just inboard of the left side output bearing 340. A power input chain 350 transfers power from the bottle carrier inspection section 18 (FIG. 1) to the output hopper shaft 336, thus moving the pair of pickup chains 312 and 312L in a clockwise rotation with respect to FIG. 8 as stated heretofore. Referring now to FIGS. 2 and 3, the pair of pickup chains 312 and 312L carry three equally spaced pickoff lugs 146 and related assembly so that when one lug is picking up a carrier from position 106C (FIG. 3), the preceding lug has moved the preceding carrier to a position 106D where it is picked up by the belting of the bottle carrier inspection section 18. The lug radius arm 314 (FIG. 8) holds the lug 304 in a generally longitudinal orientation as it withdraws downwardly without rotation from the carrier trailing edge 117 as the lug pivot holder 308 starts its clockwise movement about the pair of output sprockets 320.

Details of construction of the back patter assembly 132 are shown in FIGS. 7, 8 and 10. The back patter assembly 132 is comprised of a patter plate 352 that is held in upright disposition behind the stack of carriers 126 (FIG. 2) by a set of three threaded rods 354 that is fixedly attached thereto. The set of three threaded rods 354 is also threadably mounted through an upper plate 356 and fixedly held therein by a set of six nuts 358. The upper plate 356 is rigidly affixed along its left side to the output face of an oscillator arm 360 that is pivotally attached to a patter mount assembly 362. The patter mount assembly 362 comprises a patter mount plate 364, a vertical bar extension 366 rigidly attached to the left side thereof and extending downward therefrom, and a horizontal bar extension 368 that is rigidly affixed to the lower extremity and inboard face of the vertical bar extension 366. The patter mount plate 364 is fixedly attached to the top surface of the right hand member of the pair of slide shims 326. A patter cam roller 370 is rotatably mounted on a cam shaft 372 that is in turn threadably mounted into the outboard surface of the oscillator arm 360 and in longitudinal line with the input hopper shaft 322. The input hopper shaft 322 incorporates a patter cam 374 that is fixedly attached thereto and in alignment with the patter cam roller 370. The patter cam roller 370 is held in continuous contact with the patter cam 374 by means of a patter spring 376 (FIG. 8). The patter spring 376 is retained at its input end upon the outboard side of the oscillator arm 360 just above the patter cam roller 370, and at its output end by a spring tie-down bar 378. The spring tie-down bar 378 is fixedly clamped against the output face of the second incline lateral stiffener 76 by means of a clamp plate 380 and a set of four bolts 382. Therefore, as the input hopper shaft 322 rotates one revolution, the two lobes of the patter cam 374 causes the oscillator arm 360 that is associated with the patter plate 352 to cycle two times per shaft revolution.

The pre-accelerator assembly 140 is shown in FIGS. 7, 8 and 9. The pre-accelerator assembly 140 is comprised of the pusher tongue 142 with the bottom retainer tongue 144 fixedly attached to the bottom surface and output end thereof, and a pivoted parallelogram structure or mounting assembly 385. The pusher tongue 142 is a flat plate of generally elongated rectangular shape, except for the tongue cutout 148 (FIG. 7) at its right output end that provides unobstructed space for the entrance of the pickoff lug 146. The bottom retainer tongue 144 is a flat sheet with spring characteristics and also of rectangular shape that underlies only the left side of the pusher tongue 142 without interfering with the tongue cutout 148. The pusher tongue 142 is fixedly attached to the top surface of a mount bar 384 (FIG. 8) that is pivotally attached at the upper ends of a pair of input oscillator arms 386 and to the upper ends of a pair of output oscillator arms 390. The pair of input oscillator arms 386 is rigidly affixed upon the top surface of an input spindle 392 of hexagon shape whose cylindrical end spindles 394 pivotally mount within a pair of side mount plates 396. In like manner, the pair of output oscillator arms 390 is rigidly affixed upon the top surface of an output spindle 398 of hexagon shape whose cylindrical end spindles 400 pivotally mount within the pair of side mount plates 396. The pair of side mount plates 396 is vertically and rigidly affixed upon the top surface of a bottom plate 402 that extends laterally to fulfill the outside width of the pair of short incline stringers 278 and 278L. Structural rigidity of the pair of side mount plates 396 is insured by a center brace plate 403 that is rigidly affixed therebetween and also to the top surface of the bottom plate 402. A pair of spacer blocks 404 is rigidly affixed to the bottom surfaces of, and at the input end of, the pair of short incline stringers 278 and 278L. The bottom plate 402 is adjustably mounted to the bottom surface of the pair of spacer blocks 404 by a set of four cap screws 406 that passes through longitudinally oriented slots 407 in the bottom plate 402. The plate 402 is forcefully moved toward the input end of the machine by a pair of adjustment screws 408 that is threadably mounted in a pair of adjustment lugs 410. The pair of adjustment lugs 410 is rigidly affixed to the output faces of the pair of spacer blocks 404. An oscillator lobe 412 is rigidly affixed to the bottom surface of the input spindle 392 and extends downwardly through a slot 414 (FIG. 9) in the bottom plate 402. The lower extremity of the oscillator lobe 412 is fitted with a transverse spindle 416. Each end of the transverse spindle 416 retains the input end of one of a pair of oscillator springs 418, whose output end is similarly retained by a pair of upright spring mount pins 420. The pair of upright spring mount pins 420 is rigidly affixed in the bottom surface of the bottom plate 402. An oscillator shaft 422 is rotatably mounted in a pair of bearings 424 that is in turn adjustably fixed to the outboard surfaces of the pair of side mount plates 396. An eccentric circular cam 426 is fixedly attached to the middle of the oscillator shaft 422. The eccentric circular cam 426 is held in contact with a cam roller 427 by the pair of oscillator springs 418. The cam roller 427 is rotatably mounted between the pair of output oscillator arms 390. Power is transferred from the input hopper shaft 322 by means of an oscillator transfer sprocket 428 and a chain 429 to the oscillator shaft 422 through an oscillator sprocket 430 fixedly attached thereto. Therefore, the pusher tongue 142 cycles one time for each revolution of the input hopper shaft 322.

The side shuffler assembly 137 is shown in FIGS. 7, 10 and 12. The working extremity of the side shuffler assembly 137 comprises a pickoff wedge 432, a pair of slide pins 434, a slide base 436, a pair of shock springs 438, an upright pivot plate 440, a spacer block 442 and a shuffler pivot arm 444. The pickoff wedge 432 incorporates a tongue ramp 433 that always underlies the bottom bottle carrier 106 and a step or lug means 435 of such dimension that it will only engage one bottle carrier 106 at a time. The pickoff wedge 432 is rigidly affixed to and suspended in a cantilever manner from the inboard extremities of the pair of slide pins 434. The pair of slide pins 434 is slidably mounted through the slide base 436 and is retained therein by a pair of small locking collars 437 adjustably attached thereto. The pickoff wedge 432 is held extended toward the inboard portion of the machine by the pair of shock springs 438 that is compressively mounted between the slide base 436 and the outboard surface of the pickoff wedge 432. In this manner the pair of springs 438 will absorb any shock encountered by the pickoff wedge 432, and return the wedge to its full extended position. The slide base 436 is rigidly affixed at its output end to the upper input face of the vertical pivot plate 440 that is in turn rigidly and spaceably affixed to the input surface of the shuffler pivot arm 444 by the interspacing auspices of the spacer block 442. A shuffler pivot shaft 446 is threadably mounted through the inboard end of the shuffler pivot arm 444 and locked therein by a nut 447. The shuffler pivot shaft 446 is pivotally mounted within a pivot drum 448 that is in turn rigidly affixed to the inboard surface of a secondary shuffler mount 449. The secondary shuffler mount 449 is rigidly affixed to the bottom inboard edge of, and slightly displaced longitudinally in the input direction along, the primary shuffler mount 203 whose attachment has been previously described. The shuffler pivot shaft 446 is retained within the pivot drum 448 by a locking collar 450. Free rotation is assured thereof by a set of four thrust washers 452 (FIG. 10). Consequently, as the shuffler pivot shaft 446 rotates counterclockwise with respect to FIG. 7, the pickoff wedge 432 essentially moves in a lateral direction toward the inboard portion of the input hopper 16. The pickoff wedge is motivated in this direction by a shuffler tension spring 454. The input end of the shuffler tension spring 454 is retained upon a spring pin 455 that is perpendicularly fixed to the lower extremity of the spring tie down plate 206. The attachment of the spring tie down plate 206 has been described heretofore. The output end of the shuffler tension spring 454 is retained upon a shuffler pin 456 that is threadably attached in an upright disposition in the top member of a mount angle 458. The mount angle 458 is fixedly attached to the lower input face of the vertical pivot plate 440.

A shuffler oscillator assembly 460, as shown in FIGS. 7, 10 and 12, incorporates an oscillator pin 462 that is threadably mounted in the top surface of the spacer block 442. Pivotally attached thereto is a longitudinal adjustment arm 464 that is comprised of a pivot coupling 465 and a portion of threaded rod 466. Compressively attached between a threaded handle 468 and a compression spring 469 is an angle pivot 470. By tightening the threaded handle 468 against the compression spring 469, the lateral position of the pickoff wedge 432 can be adjusted. The lower portion (FIG. 12) of the angle pivot 470 is pivotally mounted to a universal joint 471 that is in turn pivotally attached at the top output end of a shuffler oscillator arm 472. The universal joint 471, the angle pivot 470 and the pivot coupling 465 provide a full degree of torque freedom in the physical connection between the shuffler oscillator arm 472, that runs only in a vertical and longitudinal plane, and the shuffler pivot arm 444, that oscillates only in a generally horizontal plane. The bottom end of the shuffler oscillator arm 472 incorporates a pair of pivot lugs 474 (FIGS. 10 and 12) rigidly affixed to either side thereof to form a pivot yoke. The pair of pivot lugs 474 is pivotally mounted upon a short oscillator shaft 476 that is in turn fixedly mounted through the lower extremity of an "L" shaped oscillator arm mount 478. The top end of the oscillator arm mount 478 is rigidly affixed to the bottom surface of an arm plate 480. The arm plate 480 is fixedly clamped to the bottom surface of the second incline lateral stiffener 76 by a top plate 481 and a set of four bolts 482. A shuffler cam roller 484 is rotatably mounted upon the outboard side of the shuffler oscillator arm 472 at about its middle. Cooperating with the shuffler cam roller 484 is a shuffler cam 485 that is an eccentrically mounted disc. The shuffler cam 485 is fixedly attached to the left end of a shuffler drive shaft 486 that is in turn rotatably mounted within a pair of shuffler bearings 488. The pair of shuffler bearings 488 is fixedly attached to the outer faces of a pair of bearing mounts 490 that is in turn rigidly affixed to the bottom surface of the left hand short incline stringer 278L. The right extremity of the shuffler drive shaft 486 fixedly incorporates a shuffler sprocket 492 that cooperates with the left hand pickup chain 312L to absorb power therefrom.

The mechanical mounting structure of limit switch LS-7 is shown in FIGS. 7, 10 and 11. The limit switch LS-7 is fixedly attached to the lower end of a switch mount bracket 494 that is in turn fixedly attached to the output surface of a slide mount 496 in such manner that it rises above the slide mount 496. The slide mount 496 is similar in structure and operation to the mount slide collar 232 previously described herein. The slide mount 486 is slidable along the input lateral rail 244 to provide for lateral adjustment of the limit switch LS-7. A riser bracket 498 is rigidly affixed to the top inboard surface of the slide mount 496 and provides a pivot pin 500 fixedly mounted at the top therein, for pivotal accommodation of an auxiliary switch lever 502. The auxiliary switch lever 502 incorporates a shock spring 503 that rides in contact with a switch roller 504 that is rotatably mounted at the end of a switch arm 505 of the limit switch LS-7. As the stack of carriers 126 rises in the input hopper 16, the individual bottle carriers 106 impact against the auxiliary switch lever 502. The shock spring 503 absorbs this shock without operating the limit switch LS-7. As the stack of carriers 126 reaches a minimum height, the stack will forcefully move the bottom end of the auxiliary switch lever 502 in the output direction, thus operating LS-7 which in turn starts the bottle carrier inspection section 18.

Limit switch LS-22, also shown in FIGS. 7, 10 and 11, is fixedly mounted upon an "L" shaped bracket 506. The "L" shaped bracket 506 incorporates a foot 508 that is adjustably but fixedly attached to a flange 512 of the switch mount bracket 494 by a pair of bolts that pass through a slot 510 of the flange 512. This arrangement provides a vertical degree of adjustment for the limit switch LS-22. The limit switch LS-22 incorporates the curved switch arm 150 that rides upon the top of the stack of carriers 126. As the stack reaches a full height, the first pole LS-22A of limit switch LS-22 is made, thus causing the bottle carrier inspection section to speed up. If the stack reaches an overfill height, the second pole LS-22B of the limit switch LS-22 will be made, thus shutting down the gluer/sealer machine and the input conveyor belt 156.

BOTTLE CARRIER INSPECTION SECTION

The individual bottle carrier 106 leaves the input hopper 16 in a longitudinally spaced relationship with subsequent carriers as has been previously shown by position 106D in FIG. 3. The bottle carrier 106 then enters the carrier inspection section 18 as is shown by position 106E (FIGS. 14 and 16), and is motivated therethrough by a pair of handle belts 516U and 516D that firmly grips the bottle carrier handle 108. The handle belts 516U and 516D extend the full length of the carrier inspection section 18. The carrier top panel 118 and the carrier bottom panel 120 are therefore not restrained or controlled until each is acted upon by an upper and lower suction cup assembly 518U and 518D, respectively. Referring specifically to FIG. 16, the suction cup assemblies 518U and 518D are shown in an approach position hereinafter referred to as position "*a*". In like manner, the suction cup assemblies 518U and 518D pass through an inspection area "*b*" where initial entry to this area causes the upper and lower suction cup assemblies 518U and 518D, respectively, to come in face and suction contact with the top panel 118 and the bottom panel 120 of the bottle carrier 106 simultaneously. The suction cup assemblies 518U and 518D are pivotally attached to a pair of top cup chains 520 and a pair of bottom cup chains 522, respectively. The pair of top cup chains 520 is motivated in a counter clockwise motion with respect to FIG. 16, while the pair of bottom cup chains 522 is motivated in a clockwise motion. As the pairs of top and bottom cup chains 520 and 522, respectively, move from left to right through the inspection area "*b*", they gradually diverge from each other in such manner that the top panel 118 and the bottom panel 120 are pulled away from the plane of the bottle carrier handle portion 108 of the bottle carrier 106. As the bottle carrier 106 moves through the position 106F in FIG. 16, the bottle carrier begins to open. Opening of the carton serves to break small glue spots which, if permitted to set and cure, would interfere with later opening of the carton. The bottle carrier shown at position 106G in dashed lines, has been opened a predetermined amount by the time that it has reached an inspection lamp assembly 524 where its presence is affirmed by breaking the light beam of photocell assembly PC2, shown in FIG. 15. A photocell assembly PC3 casts a light beam across the top of the bottle carrier handle 108 that is intended to be broken by the interference of the portion of the carton bottom half panel 112U that is adjacent to the carrier top panel 118. If the carrier top panel 118 is glued fast to the central panel 107 of the bottle carrier 106 or if the carrier is otherwise misglued, the suction cup assembly 518U, by flexing the pair of top cup chains 522, may not be able to open it, thus causing the light beam of photocell assembly PC3 to continue uninterrupted. The appropriate circuit is thereby made, causing this particular carton to enter the reject cycle to be described hereinafter. In like manner, a photocell assembly PC4 determines whether the carrier bottom panel 120 has been glued fast to the central panel 107, and likewise has a control over the reject cycle. The photocell assemblies PC2, PC3 and PC4 are active only during the time interval that a trigger 525 (FIGS. 17 and 23) that is fixedly attached to the left hand member of the pair of top cup chains 520 passes between elements of a photocell assembly PC1 (FIG. 17) that is fixedly attached to the chain mounting structure to be discussed hereinafter. In this manner, the photocells of the inspection lamp assembly 524 will not interfere with the suction cup assemblies 518U and 518D.

After passing through the inspection area "*b*" (FIG. 16), the suction cup assemblies 518U and 518D enter a release position "*c*" where suction pressure is terminated and the suction cup assemblies 518U and 518D begin to retreat from each other. The bottle carrier 106 is left in partially opened condition after inspection. This condition is indicated at position 106H in FIG. 14. FIG. 16 shows the bottle carrier 106 in the position 106H, but does not indicate its openness. A pair of primary closing belts 526U and 526D begin to close the bottle carrier 106 by gradually compressing the opposing halves of the carrier bottom 112. As the bottom closes, the pair of primary closing belts 526U and 526D performs a holding function for the bottle carrier 106 to prevent any pivotal and lateral sliding thereof as the bottle carrier 106 enters a pair of secondary compression belts 528U and 528D. The pair of secondary compression belts 528U and 528D completes the closing of the bottle carrier 106 and compresses it with sufficient pressure to insure that it will not reopen in subsequent processing through the bottle carrier checker/packer 10. The pair of handle belts 516U and 516D, the pair of primary closing belts 528U and 528D, and the pair of secondary compression belts 528U and 528D, combine their compressive functions to deliver the bottle carrier 106, completely compressed across its lateral dimension to a pair of output nip rolls 530 as is shown at position 106I in FIGS. 14 and 16.

Figures 17, 17A, 17B:
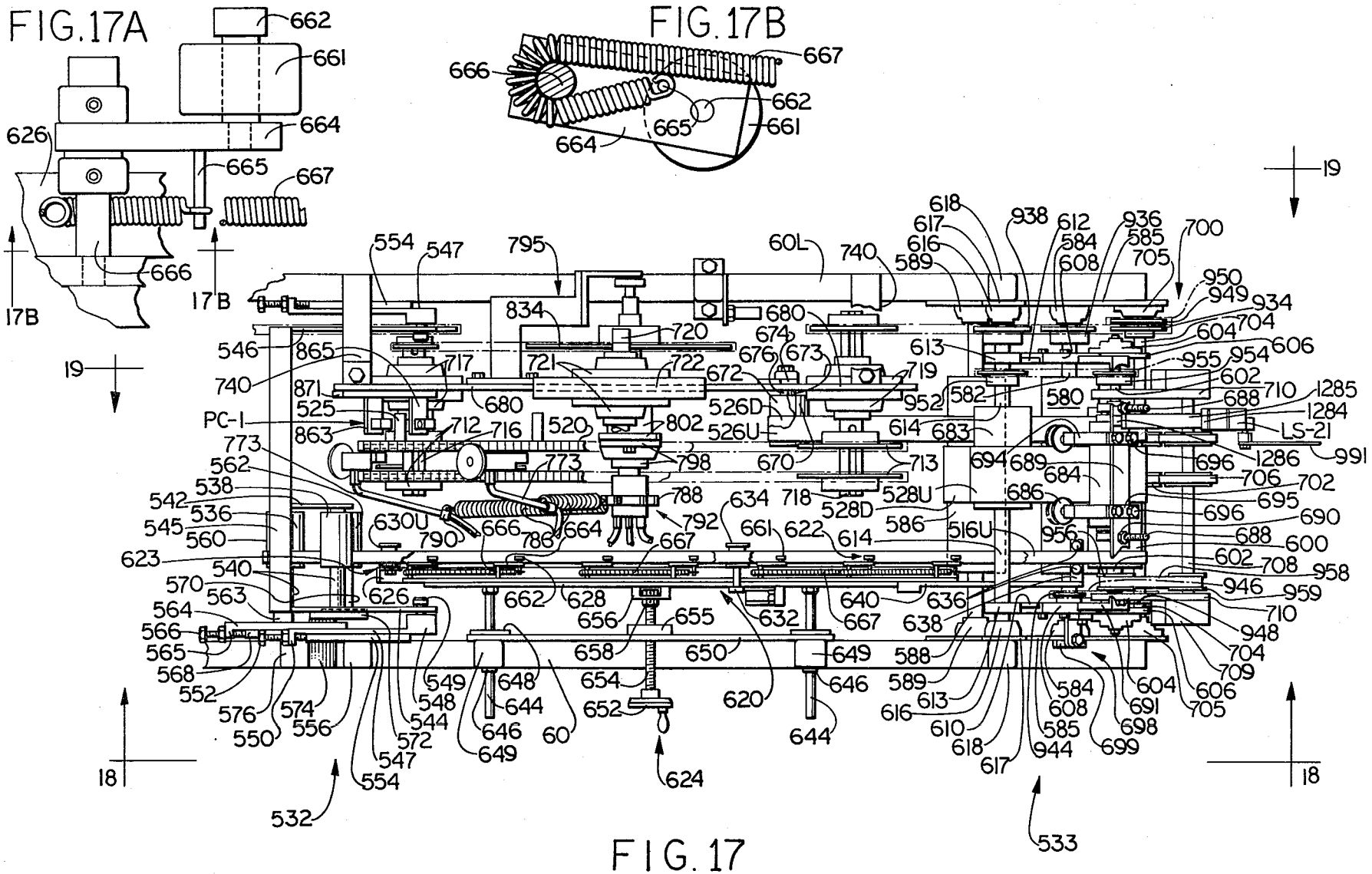
FIG. 17 is a plan view of the bottle carrier inspection section of the bottle carrier checker/packer machine with several parts partially or wholly cut away to expose parts that underlie them.
FIG. 17A is a fragmentary view on an enlarged scale showing details of construction of a hold-down roller mount, parts of a spring being broken away.
FIG. 17B is a view in section taken on the line 17B—17B in FIG. 17A.
Figure 18:
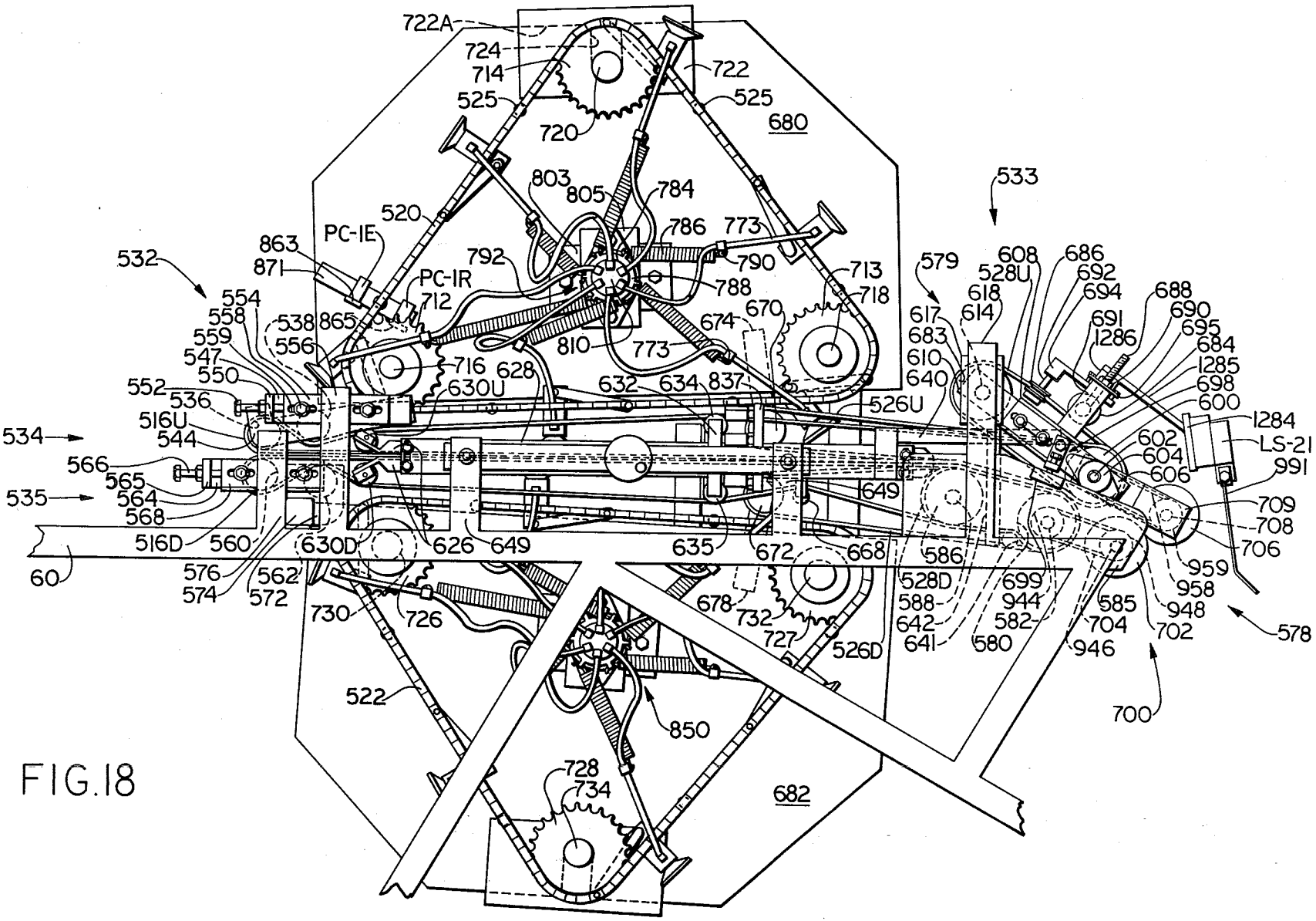
FIG. 18 is a side elevational view of the bottle carrier inspection section taken in the direction of the arrows 18—18 in FIG. 17.

The pair of handle belts 516U and 516D is movably mounted upon an input roller assembly 532 and an output roller assembly 533 as is shown in FIGS. 17 and 18. The input roller assembly 532 is comprised of an upper input roller assembly 534 and a lower input roller assembly 535. The upper input roller assembly 534 (FIGS. 17 and 18) incorporates a top input roller 536 and a top input back roller 538 that are rotatably mounted upon a pair of short shafts 540 that is in turn fixedly attached at its ends between an inboard cantilever mount 542 and a right hand elevation arm 544. The inboard cantilever mount 542 is rigidly affixed to the bottom surface of, and pointing in an output direction from, an input lateral brace 545. The right hand end of the input lateral brace 545 is rigidly affixed to the top input surface of the right hand elevation arm 544 while the left hand end is rigidly affixed in a similar manner to a left hand elevation arm 546, providing laterally fixed and spaced relationship therebetween. The output ends of the right hand elevation arm 544 and the left hand elevation arm 546 are pivotally attached to the output ends of a pair of top input slide plates 547. The output end of each member of the pair of top input slide plates 547 fixedly incorporate a spindle block 548 and associated spindle 549, and the input end fixedly incorporates an adjustment lug 550 through which is threadably mounted a top adjustment screw 552. Each top adjustment screw 552 works agains the input ends of a pair of top input slide mounts 554 that is rigidly affixed in symmetrical manner across the inboard surface of, and at the upper end of, a pair of top input risers 556. Each of the pair of top input slide plates 547 fixedly incorporates a pair of slide studs 558 (FIG. 18) and is slidable in the longitudinal direction upon the inboard surfaces of the pair of top input slide mounts 554 by the cooperation of the pair of slide studs 558 with a pair of slide slots 559 provided therein. The pair of top input risers 556 is rigidly affixed to the top surface of the pair of inclined stringers 60 and 60L.

The lower input roller assembly 535 incorporates a bottom input roller 560 that is rotatably mounted upon a short cantilever shaft 563 that is fixedly attached at its right end to a right hand bottom slide 564 (FIG. 18). The right hand bottom slide 564 rigidly incorporates an input lug 565 that threadably accommodates a bottom belt adjustment screw 566, the end thereof bearing against the input end of a bottom belt slide mount 568. The right hand bottom slide 564 is slidably attached to the bottom belt slide mount 568 in the same manner as that of the pair of top input slide plates 547 to the pair of top input slide mounts 554. The bottom input back roller 562 is rotatably mounted on a short outside cantilever shaft 570 that is fixedly attached at its outboard end to a right side auxiliary mount plate 572. The right side auxiliary mount plate 572 is rigidly affixed to the inboard extremity of a short lateral tube 574 that is in turn rigidly affixed to the output surface of a short right hand riser 576. The short right hand riser 576 is rigidly affixed in an upright orientation on top of the right hand incline stringer 60.

The output roller assembly 533 is comprised of a lower output roller assembly 578 and an upper output roller assembly 579. The lower output roller assembly 578 incorporates a primary output roller 580 whose lateral dimension is considerably longer than that of the bottom input roller 560, as is most clearly shown in FIG. 17. The primary output roller 580 is rigidly affixed upon a lower output shaft 582 that is in turn rotatably mounted within a pair of lower output bearings 584. The pair of lower output bearings 584 is fixedly attached to the inboard surfaces of a pair of mounting panels 585 that is in turn rigidly affixed to the inboard surfaces of the pair of inclined stringers 60 and 60L. Also incorporated into the lower output roller assembly 578 is a secondary output roller 586 that is similar in construction to that of the primary output roller 580. The secondary output roller 586 is rigidly affixed to a lower secondary output shaft 588 that is in turn rotatably mounted within a pair of lower secondary output bearings 589. The pair of lower secondary output bearings 589 is fixedly attached to the inboard sides of, and near the input end of, the pair of mounting panels 585.

The upper output roller assembly 579 incorporates an upper primary output roller 600 that is shorter in lateral length than that of the primary output roller 580 of the lower output roller assembly 578. The upper primary output roller 600 is rigidly affixed to an upper primary shaft 602 that is rotatably mounted in a pair of upper output bearings 604. The pair of upper output bearings 604 is fixedly attached to the outboard surfaces of, and at the free ends of, a pair of slide arms 606. The upper primary shaft 602 passes through clear holes in the pair of slide arms 606. The input end of each member of the pair of slide arms 606 incorporate a pair of retainer rails 608 that is rigidly affixed to the top and bottom surfaces of, and protrudes beyond the inboard surface thereof, to form overlapping side rails that cooperate with a right side radius arm 610 and a left side radius arm 612. The input ends of the right and left side radius arms 610 and 612, respectively, incorporate a pair of shaft bushings 613 that is in turn pivotally mounted upon a secondary upper output shaft 614. The secondary upper output shaft 614 is rotatably mounted at its ends within a pair of upper secondary bearings 616 that is in turn fixedly mounted to a pair of bearing mounting fixtures 617. The pair of bearing mounting fixtures 617 is rigidly affixed to the inboard surfaces of, and at the top of, a pair of output risers 618. The pair of output risers 618 is perpendicularly mounted to the top surfaces of the pair of inclined stringers 60 and 60L and also rigidly affixed to the outboard surfaces of the pair of mounting panels 585.

The top handle belt 516U generally travels in a counterclockwise direction (FIG. 18) around the top input roller 536 and the upper primary output roller 600. The bottom handle belt 516D generally travels in a clockwise direction about the bottom input roller 560 and the primary output roller 580. The rollers upon which the pair of handle belts 516U and 516D travel are smooth drums that do not provide any lateral guidance to the belts. The top handle belt 516U and the bottom handle belt 516D are opposedly mounted against each other in such manner to forcefully compress the carrier handle 108 firmly between their adjacent surfaces. This compressive force along the longitudinal length of the pair of handle belts 516U and 516D, as well as lateral guidance thereof is provided by a handle belt compression and guide assembly 620.

Figure 19:
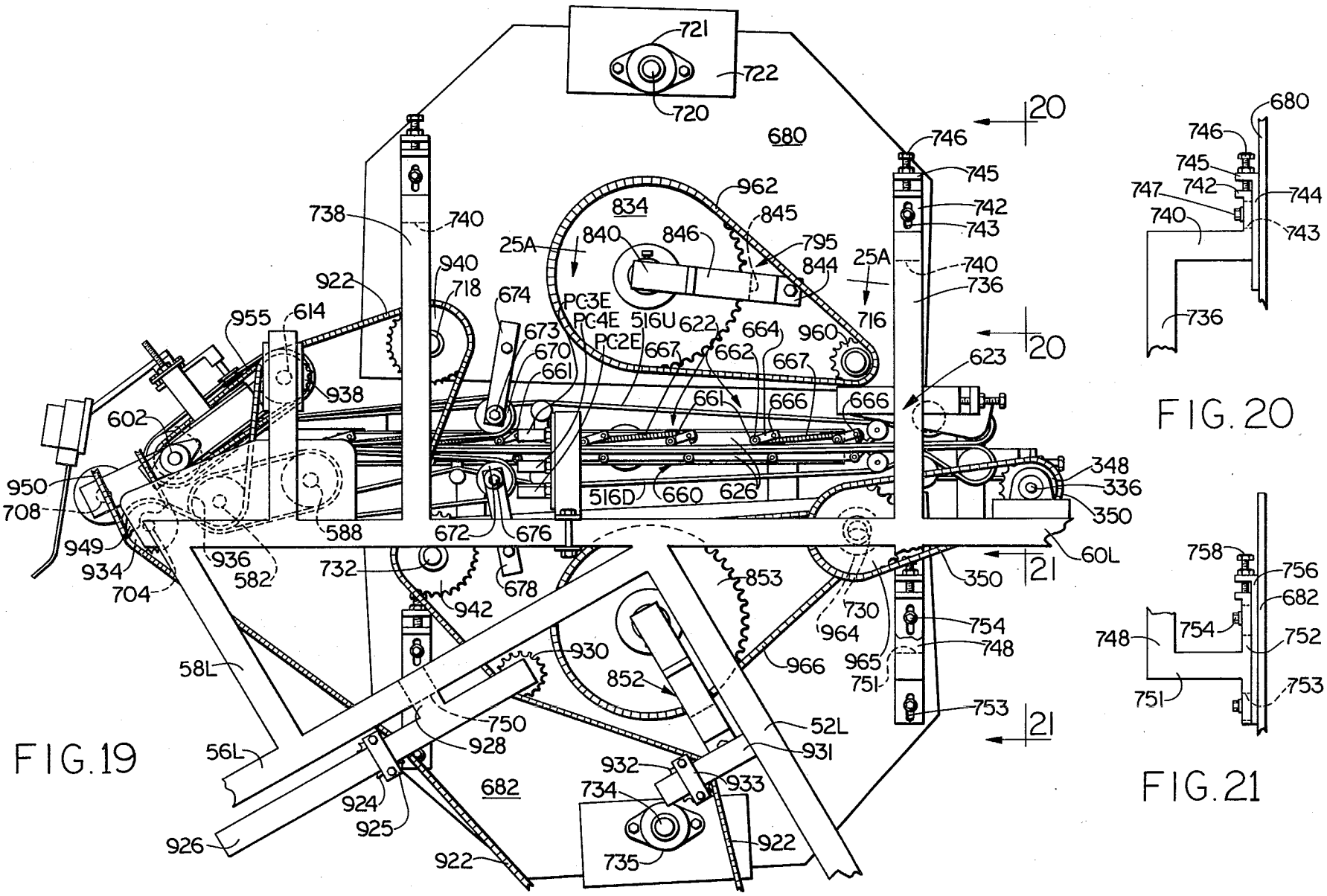
FIG. 19 is a side elevational view of the bottle carrier inspection section taken in the direction of the arrows 19—19 in FIG. 17.

The handle belt compression and guide assembly 620 is shown in FIGS. 17, 18 and 19, and is comprised of a roller hold down assembly 622, a guide assembly 623 and an adjusting assembly 624. The guide assembly 623, best shown in FIGS. 17 and 18, incorporates a pair of angle rails 626, each member thereof being opposedly and adjustably mounted upon the inboard face of a guide mount rail 628 in such manner that the laterally protruding angles thereof lie adjacent to each other in horizontal planes. The input ends of the pair of adjusting rails 626 are modified by the removal of a short portion of the vertical angle portions thereof to permit the resulting unsupported ends of the laterally protruding angles to be divergently inclined to form a mounting base for a pair of input guide rollers 630U and 630D. Fixedly attached in a vertical disposition to the outboard surfaces of the pair of angle rails 626, and at their approximate horizontal center, is a twin roller mount 632. The twin roller mount 632 rotatably incorporates, at its top inboard end, an upper guide roller 634, and at its bottom end, a lower guide roller 635. A pair of output roller guides 636, each member of which work against each side of the top portion of the upper handle belt 516U, are rotatably mounted to the top surface of a lateral mount extension 638 of a longitudinal mount arm 640 that is in turn fixedly attached to the outboard surface of, and at the output end of, the guide mount rail 628. A bottom roller guide 641 (FIG. 18) is rotatably mounted upon the output face of, and at the bottom of, an upright roller riser 642. The vertical roller riser 642 is rigidly affixed in a perpendicular disposition from the bottom surface of the longitudinal mount arm 640 to provide guidance for the lower surface of the bottom handle belt 516D.

The adjusting assembly 624 is best illustrated in FIGS. 17 and 18, and incorporates the guide mount rail 628 and a pair of slide rods 644 rigidly affixed to the outboard surface thereof. The pair of slide rods 644 is slidably mounted in a pair of bushings 646, each of which incorporates at its inboard end an integral mounting flange 648. The pair of bushings 646 is mounted through the top of a pair of short middle risers 649 that is rigidly affixed in a perpendicular manner to the top surface of the right hand inclined stringer 60. A jack mount 650 is mounted across the inboard surfaces of the pair of short middle risers 649 and is parallel to the right hand inclined stringer 60. The pair of bushings 646 is also mounted through each end of the jack mount 650 and is fixedly attached to the inboard surface thereof by means of the integral mounting flanges 648. The guide assembly 623 is adjusted in the lateral direction by a handle crank 652 that is rigidly affixed to the end of a jack screw 654 that is in turn threadably mounted through a jack block 655 that is rigidly affixed to the inboard surface of the jack mount 650. The inboard end of the jack screw 654 is rotatably mounted through a thrust bracket 656 (FIG. 17) that is in turn rigidly affixed to the outboard surface of the guide mount rail 628. The jack screw 654 is pivotally retained in the thrust bracket 656 by a pair of nuts 658 fixedly attached on the inboard end thereof, and an opposing sides of a central portion of the thrust bracket 656. By rotating the handle crank 652, the guide assembly 623 with its pair of input guide rollers 630, the upper guide roller 634, the lower guide roller 635, the pair of output roller guides 636 and the bottom roller guide 641 can be moved laterally to adjust the running pair of handle belts 516U and 516D to a new lateral position along the limits set by the top and bottom input rollers 536 and 560, respectively.

The roller hold down assembly 622 comprises a plurality of base rollers 660 and a plurality of compression rollers 661 as is shown most clearly in FIG. 19. The plurality of base rollers 660 is evenly spaced along the bottom member of the pair of angle rails 626, and each of the base rollers 660 is rotatably attached on a cantilever shaft mounted thereto. The plurality of compression rollers 661 is similarly and evenly spaced along the upper member of the pair of angle rails 626. Each compression roller of the plurality of compression rollers 661 is rotatably mounted on a spindle shaft 662 that is in turn fixedly attached near the free end of a roller pivot arm 664. The roller pivot arm 664 is pivotally attached to a short pivot spindle 666 that is in turn fixedly mounted in a cantilever manner from the inboard vertical side of the top member of the pair of angle rails 626 as is shown in FIG. 17. FIG. 19 shows that the plurality of compression rollers 661 pushes downwardly upon the lower portion of the upper handle belt 516U to firmly grasp the bottle carrier handle 108 upon the top portion of the lower handle belt 516D that is in turn backed up by the plurality of base rollers 660. Compressive force for the plurality of compression rollers 661 is provided by tension springs 667. Each roller pivot arm 664 is provided with a spring anchor pin 665, as shown in FIGS. 17A and 17B. An end of the spring 667 is attached to the pin 665 and extends around the spindle 666 and then, as shown in FIG. 19, to the pin of the next pivot arm 664 to urge the rollers 661 downwardly. The tension springs 667 form separated pairs or can be continuously coupled from one to the other in the same manner as described.

Specifically then, the bottom handle belt 516D travels in a clockwise direction (FIG. 18) from the top surface of the bottom input roller 560 straight through the handle belt compression and guide assembly 620, then slightly downwardly over the top of the secondary output roller 586 and on to the primary output roller 580. The bottom handle belt 516D wraps about the primary output roller 580, then rides up and over the bottom roller guides 641 before passing under the secondary output roller 586. A bottom tension roller 668 bears against the underside of the bottom handle belt 516D as it passes from the secondary output roller 586 to the lower guide roller 635. The belt continues in the input direction to the bottom input guide roller 630D under which it passes, and then over the top of the bottom input back roller 562 that provides tension therein before completion of the loop around the bottom input roller 560.

The top handle belt 516U travels in a counterclockwise rotation about the top input roller 536, as is shown in FIG. 18, leaving the bottom of the top input roller 536 in the output direction and on top of the bottom handle belt 516D. The belts travel in this adjacent relationship the full length of the bottle carrier inspection section 18, at which point the top handle belt 516U rolls up and around the upper primary output roller 600, slanting upwardly to pass between the pair of output roller guides 636 and on over the upper guide roller 634. From the upper guide roller 634 the upper handle belt 516U extends toward the input end to pass over the upper input guide roller 630U, then under the top input back roller 538, that provides tension thereto, to complete the loop at the top input roller 536.

The pair of primary closing belts 526U and 526D is so mounted as to provide a wedge shaped entry for the carrier bottom 112 as can be seen in FIGS. 18 and 19. FIG. 17 shows the upper primary closing belt 526U in plan view. The upper primary closing belt 526U is made movable in a counterclockwise direction with respect to FIG. 18, about a primary closing belt input roller 670 and the left side of the upper primary output roller 600. In complementary opposition thereto, the lower primary closing belt 526D is made movable in a clockwise rotation about a lower primary closing belt input roller 672, across the top of the secondary output roller 586, and then around the primary output roller 580. The lower side of the upper primary closing belt 526U comes to lie firmly against the upper part of the lower primary closing belt 526D from the secondary output roller 586 to the primary output roller 580, thus gradually catching, compressing and holding the carrier bottom 112 in fixed parallel alignment with the bottle carrier inspection section 18. The primary closing belt input pulley 670 is rotatably mounted on a spindle 673 (FIGS. 17 and 19) that is rigidly affixed in a cantilever manner to the bottom of a tension arm 674 that is in turn compressively and adjustably pinned from an upper chain mounting panel 680 to be described hereinafter. Also, the lower primary closing belt input pulley 672 is rotatably mounted on a lower spindle 676 that is rigidly affixed in a cantilever manner to the top of a bottom tension arm 678 that is in turn adjustably erected upon a lower chain mounting panel 682 to be described hereinafter.

The pair of secondary compression belts 528U and 528D is so arranged as to form a wedge shaped entry for the center panels of the bottle carrier 106, as can be seen in FIGS. 18 and 19, and in plan view in FIG. 17. The top secondary compression belt 528U is made movable in a counterclockwise rotation with respect to FIG. 18, about a top compression roller 683 and the center portion of the upper primary output roller 600. A top tension roller 684 provides tension control for the top secondary compression belt 528U, while a pair of lateral guide rollers 686 prevents the belt from running out of lateral placement. The bottom secondary compression belt 528D is made movable in the clockwise direction about the center portion of the secondary output roller 586 and the primary output roller 580. The top portion of the bottom secondary compression belt 528D comes in compressive contact with the bottom output end of the top secondary compression belt 528U to communicate compressive forces across the carrier top panel 118 and the carrier bottom panel 120. This compressive force is limited by a down stop 698 that is adjustably attached to the outboard surface of the right hand member of the pair of slide arms 606 and communicates with a stop block 699 that is rigidly affixed at the top edge of the right hand member of the pair of mounting panels 585. As a bottle carrier 106 passes between the belts, the upper primary output roller 600 will be forced upward requiring the right and left side radius arms 610 and 612, respectively, to pivot slightly upward, thus relieving excessive compressive forces.

The top compression roller 683 is rigidly affixed upon the secondary upper output shaft 614. The top secondary compression belt 528U extends from this roller and shaft to the upper primary output roller 600, being controlled by the pair of lateral guide rollers 686 and the top tension roller 684, as has been previously described. The top tension roller 684 is rotatably mounted in a pair of eye bolts 688 that incorporates threaded shanks. The threaded shanks pass through clear holes in an accessory bridge plate 689 (FIG. 17) and are adjustably held therein by a set of nuts 690. The accessory bridge plate 689 is rigidly affixed in suspended elevation above the output end of the carrier inspection section 18 by a pair of bridge risers 691 that is rigidly affixed in a perpendicular orientation to the top members of each pair of retainer rails 608 of the pair of slide arms 606. The pair of lateral guide rollers 686 is rotatably mounted upon the lower end of a pair of roller spindles 692 that is in turn fixedly but adjustably attached within the ends of a pair of roller hangers 694. The pair of roller hangers 694 is adjustably clamped to the underside of the accessory bridge plate 689 by a pair of cover plates 695 and a set of eight bolts 696. This arrangement permits lateral and vertical adjustment of the pair of lateral guide rollers 686.

The stream of bottle carriers 102 is processed through the carrier inspection section 18 and is ejected therefrom through the action of a set of nip wheels 700 as shown in FIGS. 17 and 18. A pair of bottom nip wheels 702 is fixedly attached at a central position to a bottom nip shaft 704 that is in turn rotatably mounted at each end in a pair of bottom nip bearings 705. The pair of bottom nip bearings 705 is fixedly attached to the inboard surfaces of the pair of mounting panels 585 at the output end of the carrier inspection section 18. A pair of top nip wheels 706 is fixedly mounted on an upper nip shaft 708 and in opposition to the pair of bottom nip wheels 702. The upper nip shaft 708 passes through clear holes in the free ends of a pair of secondary radius arms 710 to mount in a pair of bushing blocks 709. The input ends of the pair of secondary radius arms 710 are pivotally mounted upon the upper primary shaft 602, while the pair of bushing blocks 709 is fixedly attached to the outboard surfaces of, and at the free ends thereof. In this manner, the pair of top nip wheels 706 is free to move upwardly to provide release of excessive compressive pressures while bottle carriers are passing through the machine. Under certain conditions, the passage of the bottle carriers can resonate the pair of top nip wheels 706, and kick them violently upward, thus disturbing the operation of the entire machine. To prevent this, a nip wheel spring stop assembly 711 is mounted upon the right hand member of the pair of mounting panels 585 and restrains the upward movement of the right hand member of the pair of bushing blocks 709 and consequently the pair of top nip wheels 706 as is shown in the upper left hand corner of FIG. 35.

The nip wheel spring stop assembly 711 is comprised of a restraining spring 723, a spring pin 725, a lateral extension arm 729, a vertical riser 731, a pivot mount 733 and a retaining spring 737. The spring pin 725 incorporates a flat head 739 rigidly affixed upon its lower end, while its upper shaft passes through a clear hole in the free inboard end of the lateral extension arm 729. A pair of lock nuts 741 retains the spring pin 725 within the lateral extension arm 729 against the pressure of the restraining spring 723 that is compressively and coaxially installed upon the spring pin 725. The outboard extremity of the lateral extension arm 729 is rigidly affixed to the top end of the vertical riser 731 that is in turn pivotally mounted at its lower end to the pivot mount 733. The pivot mount 733 is a yoke type mount that is fixedly attached to the outboard surface of the right hand member of the pair of mounting panels 585. The vertical riser 731 is retained in a fixed vertical dispostion against the upper portion of the pivot mount 733 by the retainer spring 737 that is in turn hooked between a vertical riser spring lug 749 and the right hand member of the pair of mounting panels 585. The vertical riser spring lug 749 is rigidly affixed to the outboard surface of the vertical riser 731. In this manner, the nip wheel spring stop assembly 711 can be pivoted outboardly to free the top nip wheels 706 for service or inspection. Otherwise, this assembly dampens resonate motion of the top nip wheels 706 and proper operation thereof will not be interrupted.

Power distribution for the elements of the bottle carrier inspection section 18 will be described next.

A plurality of six upper suction cup assemblies 518U are made movable upon the pair of top cup chains 520 in counterclockwise direction and also a plurality of six suction cup assemblies 518D are made movable upon the pair of bottom cup chains 522 in the clockwise direction. As is shown in FIGS. 14, 16, 17 and 18, the procession of suction cup assemblies is from left to right when acting on bottle carriers.

The pair of top cup chains 520 is made mobile upon a pair of input sprockets 712, a pair of output sprockets 713, and a pair of top sprockets 714. The pair of input sprockets 712 is fixedly attached to an input spindle 716 that is in turn rotatably mounted in a pair of input bearings 717 as in FIG. 17. The individual bearings of the pair of input bearings 717 are fixedly attached in a back-to-back manner to both sides of the upper chain mounting panel 680 near its lower left hand corner (FIG. 18). The pair of output sprockets 713 is fixedly attached to an output spindle 718 that is in turn rotatably mounted in a pair of output bearings 719. The individual bearings of the pair of output bearings 719 are fixedly mounted in a back-to-back manner to both sides of the upper chain mounting panel 680 near its lower right hand corner. The pair of top sprockets 714 is fixedly attached to a top spindle 720 that is in turn rotatably mounted in a pair of top chain bearings 721. The individual bearings of the pair of top chain bearings 721 are fixedly mounted in a back-to-back manner to opposite sides of a yoke mounting plate 722 that slides down over the top edge of the upper chain mounting panel 680 and is fixedly clamped thereto by appropriate fasteners (not shown). The yoke mounting plate 722 is provided with a central upright slot 722A which receives the edge of the mounting panel 680. The top spindle 720 is received in a slot 724 incorporated in the top edge of the upper chain mounting panel 680 to provide a vertical degree of adjustment thereto. The pairs of input, output and top chain sprockets 712,713 and 714, respectively, are spacedly attached to their respective spindles and in a cantilever disposition on the right side of the upper chain mounting panel 680 so that the pair of top cup chains 520 that is mounted thereupon is also laterally spaced to provide for the six upper suction cup assemblies 518U.

The pair of bottom cup chains 522 is movably mounted upon a pair of bottom input sprockets 726 (FIGS. 18 and 19), a pair of bottom output sprockets 727, and a pair of bottom sprockets 728. The pair of bottom input sprockets 726 is fixedly attached to a bottom input spindle 730 that is in turn rotatably mounted in a pair of bearings that is not shown in detail. The pair of bottom output sprockets 727 is fixedly attached to a bottom output spindle 732 that is in turn rotatably mounted in a pair of bearings that is not shown. The pair of bottom sprockets 728 is rotatably mounted upon a bottom spindle 734 that is also rotatably mounted in a pair of bottom bearings 735, one of which is shown in FIG. 19. The bearings of the bottom input spindle 730, the bottom output spindle 732 and the bottom spindle 734 are fixedly attached to the lower chain mounting panel 682 in a manner similar to the mounting of the pair of input bearings 717, the pair of output bearings 719 and the pair of top chain bearings 721 on the upper chain mounting panel 680. The pairs of chain sprockets are spacedly attached to their respective spindles and in a cantilever disposition on the right side of the lower chain mount panel 682 so that the pair of bottom cup chains 522 are in lateral spaced alignment with the pair of top cup chains 520. The lateral spaced relationship of the pair of bottom cup chains 522 then provides for incorporation of the set of six lower suction cup assemblies 518D.

The upper chain mounting panel 680 is held in vertical and spaced relationship above the left side incline stringers 60L by a panel input riser 736 and a panel output riser 738 as shown in FIGS. 17 and 19. The panel input riser 736 and the panel output riser 738 are rigidly and perpendicularly affixed to the top surfaces of the left hand incline stringer 60L. The top ends of the panel input riser 736 and the panel output riser 738 incorporate lateral standoffs 740 rigidly affixed thereto and extending laterally toward the center of the machine (see FIG. 20). The inboard end of the lateral standoff 740 incorporates and adjustment slide mount 742 that comprises a vertical slot 743 therethrough. Rigidly affixed to the left side of the upper chain mounting panel 680 is a jack mount 744 that incorporates an end flange 745. The jack mount 744 is held against the face of the adjustment slide mount 742 by a bolt 747 that passes through the slot 743 to be threadably affixed in the jack mount 744. A jack screw 746 is threadably mounted through the end flange 745 and bears against the top end of the adjustment slide mount 742. By turning the two jack screws 746, the upper chain mounting plate 680 is adjusted in vertical position upon both the panel input riser 736 and the panel output riser 738.

The lower chain mounting panel 682 is vertically suspended in parallel alignment with the upper chain mounting panel 680 by an input hanger 748 and an output standoff 750 as in FIG. 19. The input hanger 748 is rigidly affixed to the bottom surface of the left hand incline stringer 60L and in vertical alignment with the panel input riser 736. The lower extremity of the input hanger 748 incorporates a bottom lateral standoff 751. The output standoff 750 is rigidly affixed to the inboard surface of the left hand short stringer 56L about midway between left hand long input post 52L and the left hand short output post 58L. The inboard terminus of the bottom lateral standoff 751 and the output standoff 750 each fixedly incorporate a bottom jack mount 752, as is shown more clearly in FIG. 21. The bottom jack mount 752 incorporates a pair of vertical slots 753 through which a pair of bolts 754 passes. The bolts 754 are threadably mounted in a jack slide 756, the top end of which incorporates a flange through which a bottom jack screw 758 is threadably mounted and bears against the top extremity of the bottom jack mount 752. The lower chain mounting panel 682 is rigidly affixed to the jack slide 756, and in the manner, the turning of the bottom jack screw 758 will raise and lower it. The pair of bolts 754 fixedly holds the jack slide 756 in place.

Figures 22, 23, 24:
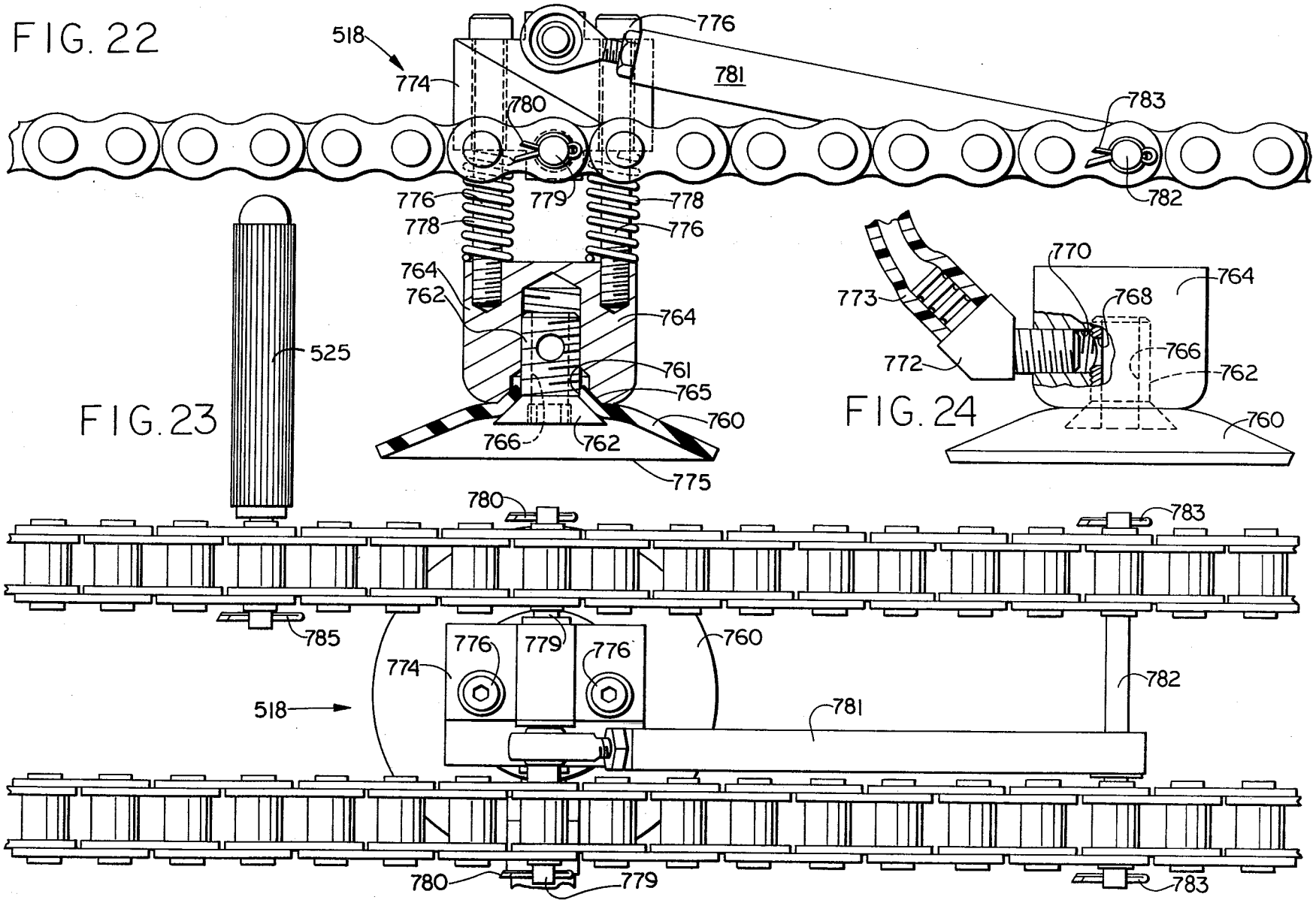
FIG. 22 is an enlarged view in side elevation of a suction cup subassembly of the bottle carrier inspection section of FIG. 18, the lower portion of the subassembly being shown in section.
FIG. 23 is an enlarged plan view of the suction cup subassembly and suction control trigger of the bottle carrier inspection section of FIG. 22.
FIG. 24 is an enlarged fragmentary view in side elevation and partially cut away of the lower portion of the suction cup subassembly of FIG. 23.

The upper and lower suction cup assemblies 518U and 518D are of identical construction. Each suction cup assembly 518, shown specifically in FIGS. 22, 23 and 24, incorporates suction foot 760 that is constructed of a flat disc of rubber 760 which has a center hole 761. A flat head machine screw 762 is forcibly placed through the center hole 761, stretching it considerably oversize and thereby imparting the three dimensional character to the flat disc of rubber that is shown in cross section in FIG. 22. The flat head machine screw 762 is threadably mounted in a suction head 764 so that a central annular portion of the flat disc of rubber 760 is fixedly clamped between the head of the screw and a countersink 765 of the suction head 764. As is shown in FIG. 24, the flat head machine screw 762 incorporates a central bore 766 and a side bore 768 that communicate with each other. The side bore 768 also communicates with a suction head bore 770 that is in axial line therewith. A 45° hose fitting 772 is threadably mounted in the suction head bore 770 to provide a coupling between the suction head 764 and a vacuum hose 773. In this manner, air is evacuated from the internal confines of the flat disc of rubber 760 through the central bore 766, the side bore 768, the suction head bore 770, the 45° hose fitting 772 and finally through the vacuum hose 773 to form a vacuum cup assembly. An annular edge face portion 775 of the suction foot engages a panel of the carrier or carton.

Referring now to FIG. 22, the suction head 764 is mounted to a suction cup base 774 by means of a pair of shoulder bolts 776 that is threadably mounted in the top of the suction head 764 and whose shoulder portions slidably pass through holes in the suction cup base 774. The suction cup base 774 is retained against the heads of the pair of shoulder bolts 776 by a pair of springs 778 that is coaxially mounted about the pair of shoulder bolts 776. This mounting limits the amount of pressure that can be applied by the suction cup assembly 518 upon the carrier top and bottom panels 118 and 120, respectively, of the bottle carrier 106 and permits overtravel of the upper and lower cup assemblies 518 and 518D (FIG. 16) as the cup assemblies come into registry.

The suction cup base 774 is pivotally mounted about a base shaft 779 that is in turn pivotally held at both ends in the pair of top cup chains 520 (FIG. 18) or a pair of bottom cup chains 522, whichever is applicable. The base shaft 779 (FIG. 23) is held in place within the chains by a pair of cotter pins 780. Pivotal relationship of the suction cup assembly 518 is maintained with the pair of chains by means of a base radius arm 781 that is pivotally attached at one end to the top of the suction cup base 774, and at the output end to a lead shaft 782. The lead shaft 782 is retained within the pair of chains by a pair of cotter pins 783. As the lead shaft 782 begins to make the arc around one of the pairs of chain sprockets, such as the pair of output sprockets 713 in FIG. 18, the trailing end of the base radius arm 781 is translated slightly aft of the base shaft 779, imparting a pre-turn tilt to the suction cup assembly 518 that aids in releasing the suction pressure thereof.

Referring to FIG. 23, the trigger 525 is pivotally mounted through one of the chain links and held therein by a cotter pin 785. The trigger 525 is placed in the fourth link behind its adjacent suction cup assembly 518, but provides control over the suction cup assembly 518 that precedes the one that it is adjacent to.

Referring to FIG. 18, the vacuum hose 773 of each suction cup assembly 518 is connected to a central vacuum head assembly 784 that rotates in unison with its respective pair of top or bottom cup chains 520 or 522, respectively. To manage the placement of the vacuum hose 773 across the variable radius from the vacuum head assembly 784 to the suction head assembly 518 a tension spring 786 is hooked through the appropriate eyelet in a spring collar 788 that is fixedly mounted about the circumference of the vacuum head assembly 784, and then similarly hooked in a hose clamp 790 that is fixedly mounted about the vacuum hose 773. The tension spring 786 then functions to gather up excess vacuum hose and keep it clear of the various pairs of sprocket wheels previously described.

Figures 25, 25A, 26, 27:
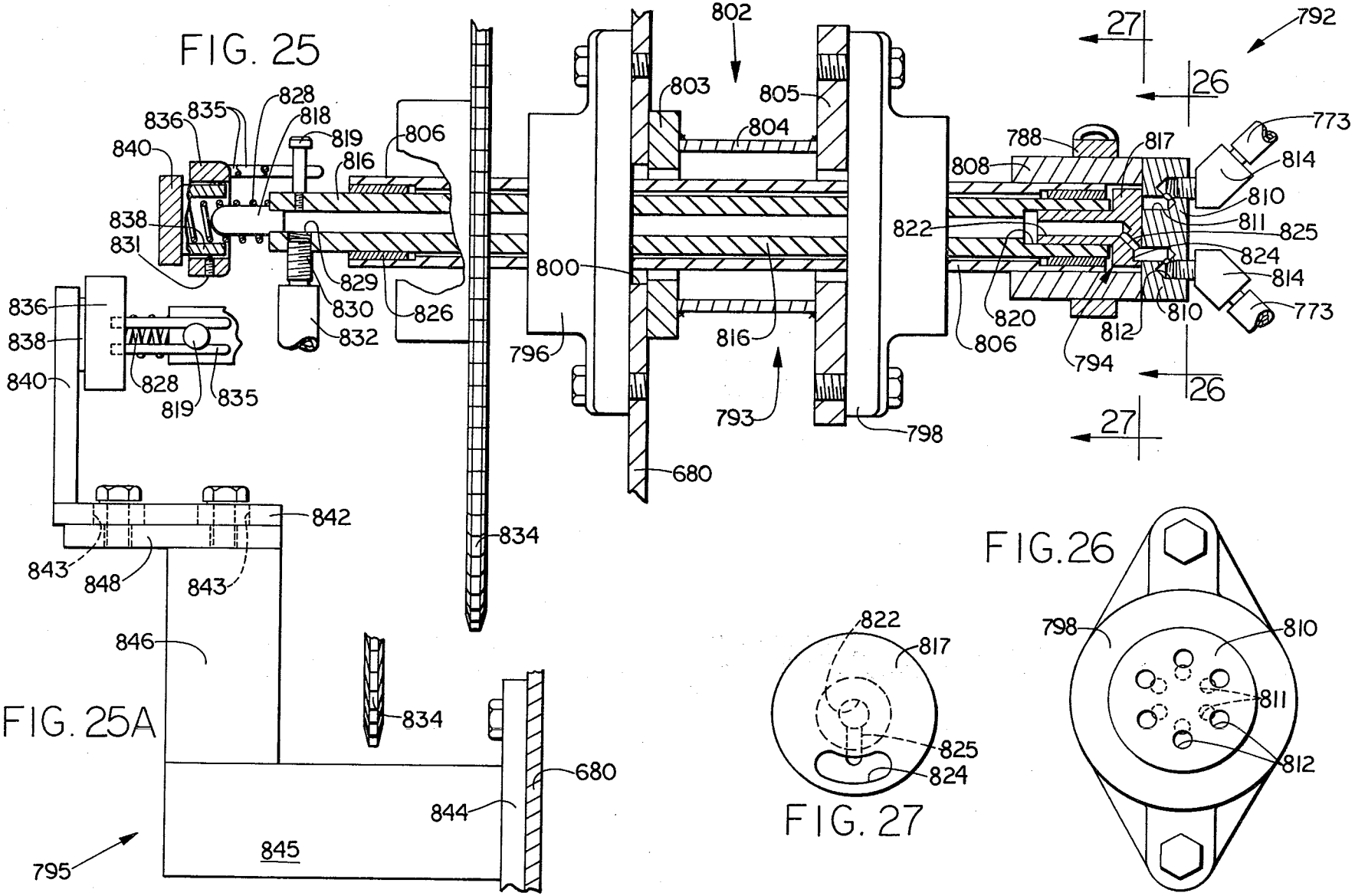
FIG. 25 is a fragmentary plan view partially in section of a vacuum hub assembly of the bottle carrier inspection section.
FIG. 25A is a view in section taken on the line 25A—25A in FIG. 19.
FIG. 26 is a fragmentary view taken in the direction of the arrows 26—26 in FIG. 25.
FIG. 27 is a fragmentary view in section taken in the direction of the arrows 27—27 in FIG. 25.

The vacuum distributor assembly 792 is shown most specifically in FIGS. 25, 26 and 27, and in general in FIGS. 17, 18 and 19. Referring now to FIG. 25, the vacuum distributor assembly 792 is comprised of a mounting assembly 793, a distributor assembly 794, an anchor assembly 795 and the vacuum head assembly 784. The distributor assembly 794, a non-rotating assembly, is mounted within the vacuum head assembly 784. The vacuum head assembly 784 is rotatably mounted in a panel bearing 796 and a standoff bearing 798 and in such manner as to accept a thrust load in the direction from the panel bearing 796 to the standoff bearing 798. The panel bearing 796 is fixedly attached to the outboard surface of the upper chain mounting panel 680 and in concentric alignment with a hole 800 that is centrally located in the upper chain mounting panel 680. A turret standoff bracket 802 is comprised of a plate mount 803, a spacer tube 804 and a standoff bearing mount 805. The plate mount 803, a rectangular plate, is rigidly affixed across one end of the spacer tube 804, and the standoff bearing mount 805, also a rectangular plate, is rigidly affixed across the other end of the spacer tube 804, and in such orientation that the long axis of the plate and standoff bearing mounts 803 and 805, respectively, are at right angles with each other. The turret standoff bracket 802, thus formed, is fixedly attached to the inboard surface of the upper chain mounting panel 680 by means of the plate mount 803 whose long axis is mounted generally longitudinally. The turret standoff bracket 802 is also in concentric alignment with the hole 800 of the upper chain mounting panel 680. The standoff bearing 798 is fixedly attached to the inboard surface of the standoff bearing mount 805.

The vacuum head assembly 784 is comprised of a hollow shaft 806, a cap mount 808 and a distributor cap 810. The hollow shaft 806 is rotatably mounted in the panel bearing 796 and the standoff bearing 798. The cap mount 808, a heavy walled cylindrical piece, is fixedly mounted upon the inboard end of the hollow shaft 806. In turn then, the distributor cap 810 is fixedly attached to the end of the cap mount 808. Referring also to FIG. 26, the distributor cap 810 incorporates in the left hand surface thereof, a set of six holes 811, equally spaced about a small circumference and whose depth is slightly greater than half the thickness of the part. A set of six companion holes 812 is equally spaced about a slightly larger diameter and is entered from the outer surface to communicate in an offset manner with each hole of the set of six holes 811. Each hole of the set of six companion holes 812 is threaded to accept a 45° tube fitting 814 that in turn accepts the vacuum hose 773.

The distributor assembly 794 is comprised of a static hollow shaft 816, a distributor 817, an end plug 818 and a torque pin 819. The right hand end of the static hollow shaft 816 is provided with a deep counterbore 820 that fixedly receives the shank of the distributor 817. The shank of the distributor 817 incorporates a drill hole 822 extending into the head of the part. Referring now to FIG. 27, the head of the distributor 817 is provided with an arcuate slot 824 whose arc length corresponds to the time interval necessary for the upper and lower suction cup assemblies 518U and 518D, respectively, to open and inspect a bottle carrier 106. A slanted hole 825 (FIGS. 25 and 27) communicates between the bottom of the drill hole 822 and the bottom of the circumferential slot 824 to provide an airpath therebetween. The static hollow shaft 816 is slidably mounted within the hollow shaft 806 by a pair of bushings 826. The pair of bushings 826 is pressed into each end of the hollow shaft 806. The left end of the static hollow shaft 816 is provided with the end plug 818 that serves as a spring retainer for thrust spring 828. The torque pin 819 is essentially a long shoulder bolt that is threadably mounted in the side of the static hollow shaft 816 approximate the left or plug end thereof. Directly opposed to the torque pin 819 is a threaded hole 829 that receives a tube fitting 830 that in turn receives a vacuum supply hose 832. The thrurst spring 828 insures that the end surface of the distributor 817 is kept in sealed contact with the inner surface of the distributor cap 810.

A dirve sprocket 834 is fixedly attached to the outboard end of the hollow shaft 806 0f the vacuum head assembly 784 to impart rotation thereto. As the distributor cap 810 rotates, each hole of the set of six holes 811 comes in successive communication with the stationary circumferential slot 824 of the distributor assembly 794, providing vacuum pressure through the vacuum hose 773 of the suction cup assembly 518 that is in contact with a bottle carrier 106. The torque pin 819 is restrained from rotation by a pair of anchor pins 835 that is in turn rigidly affixed in the face of an anchor ring 836 (FIG. 25A). The anchor ring 836 is fixedly held upon the outer diameter of a spring retainer 838 by a set screw 831. When the set screw 831 is released, the hollow shaft 816 and the distributor 817 can be turned to adjust the position of the slot 824 and the location of each vacuum cup at which it is supplied with vacuum or cut off from the vacuum. The spring retainer 838 is rigidly affixed to the inboard surface of, and at the output end of, a thrust anchor 840, that is in turn rigidly affixed to the left hand edge of a thrust foot 842 (FIG. 25A). The thrust foot 842 incorporates a pair of slots 843 and is adjustably mounted to the anchor assembly 795. The anchor assembly 795 is comprised of a base plate 844, a lateral standoff 845, a radial arm 846, and a thrust mount plate 848. The lateral standoff 845 is rigidly affixed to the left hand surface of the base plate 844, that is in turn fixedly attached to the outboard surface of, and approximate the input side of, the upper chain mounting panel 680 as is shown in FIG. 19. The radial arm 846 is rigidly affixed to the free end and output surface of the lateral standoff 845. The thrust mount plate 848 is rigidly affixed to the extended end of the radial arm 846 to form the anchor assembly 795 for the thrust anchor 840.

A lower vacuum distributor assembly 850 (FIG. 18) is centrally mounted through the lower chain mounting panel 682 in substantially the same manner as that of the vacuum distributor assembly 792 of the upper chain mounting panel 680. The only exception is in the orientation of a lower anchor assembly 852 shown in FIG. 19. The lower anchor assembly 852 is fixedly mounted upon the left side of the lower chain mounting panel 682 in such orientation as to be parallel with the left hand input post 52L. A lower drive sprocket 853 delivers rotation to the lower vacuum distributor assembly 850 in the same manner as that of the drive sprocket 832 of the vacuum distributor assembly 792 of the upper chain mounting panel 860.

Figure 14:
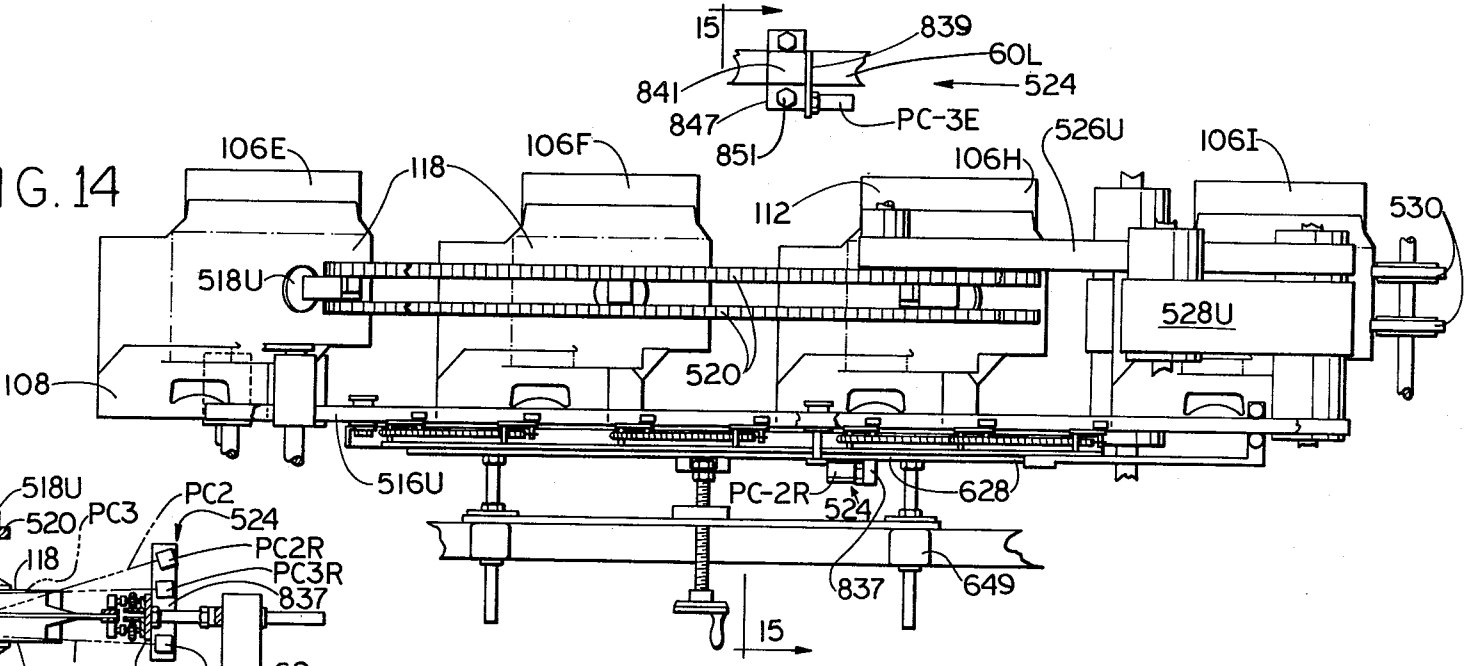
FIG. 14 is a fragmentary schematic plan view of a bottle carrier inspection section of the bottle carrier checker/packer machine.
Figure 15:
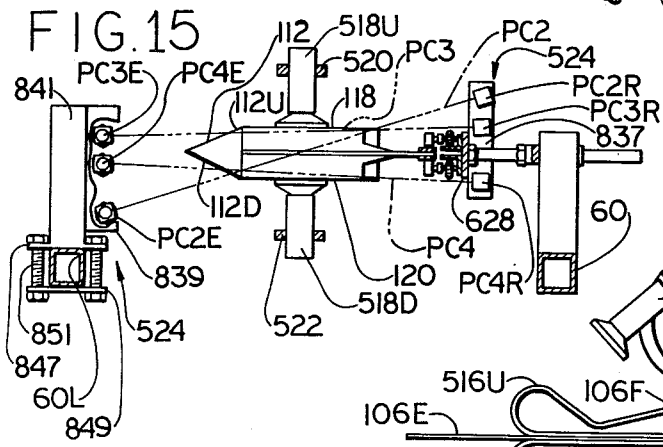
FIG. 15 is a schematic view in section of the bottle carrier inspection section taken along line 15—15 in FIG. 14.
Figure 16:
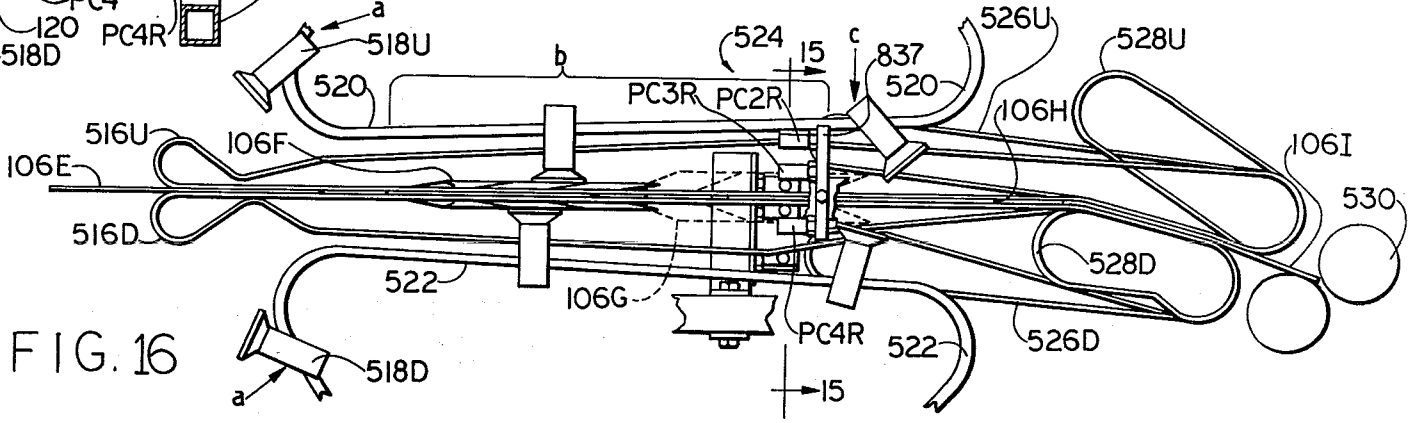
FIG. 16 is a schematic view in side elevation of the bottle carrier inspection section shown in FIG. 14.

Referring now to FIGS. 14, 15 and 16, the photocell receiving units for the photocell assemblies PC-2, PC-3 and PC-4 are mounted in vertically spaced position on an input face of a receiver mount bar 837 as indicated at PC-2R, PC-3R and PC-4R. The mount bar 837 is in turn mounted in a perpendicular orientation across the outboard surface of the guide mount rail 628 of the handle belt compression and guide assembly 620. The receiver mount bar 837 is located adjacent to the input side of the output member of the pair of short middle risers 649 as can be seen in FIG. 18. As can be seen in FIG. 15, the photocell receiving units PC-2R and PC3R are located above the guide mount rail 628, while the photocell receiving unit PC-4R is located below the guide mount rail 628. All three photocell receiving units are adjustable in angle so that alignment can be made with the emitter units on the left side of the machine.

The emitter units for the photocell assemblies PC-2, PC-3 and PC-4 are mounted in vertically spaced relation on an output face of a cell mount plate 839 as indicated at PC-2E, PC-3E and PC-4E. The mount plate 839 is attached to the output surface of a cell riser 841 integrally incorporates a mounting foot 847 that is clamped to the upper surface of the left hand incline stringer 60L by a bottom clamp plate 849 and a pair of bolts 851. The cell riser 841 is longitudinally placed upon the left hand inclined stringer 60L so that the light beams of the photocells pass laterally across the carrier inspection section 18 to their respective receiving units, as previously described. The emitter units of the photocells PC-2, PC-3 and PC-4 are angularly adjustable so that their beams can be properly aligned. The photocell emitters are arranged in the following order from top to bottom upon the cell riser 841: PC-3E, PC-4E and PC-2E. In this manner the photocell assemblies perform their respective functions as has been previously described.

The photocell assemblies PC-2, PC-3 and PC-4 function only momentarily when the bottle carrier 106 is in proper longitudinal place. This operation is controlled by the triggers 525 (FIGS. 17 and 22) that break the light beam of the photocell assembly PC-1, as is shown in FIGS. 17 and 18. The photocell assembly PC-1 is located near the lower input corner of the upper chain mounting plate 680 and is comprised of an emitter PC-1E and a receiver PC-1R. The emitter PC-1E is mounted on the upper surface of an emitter standoff mount 863, and the receiver PC-1R is mounted on a receiver standoff mount 865. The emitter and receiver standoff mounts 863 and 865, respectively, are mounted at their left hand ends on the bottom edge of a photocell mount plate 871 and are so spaced thereon to permit the triggers 525 to pass therebetween. The photocell mount plate 871 is appropriately affixed to the upper chain mounting plate 680 by a fastener, not shown in detail.

Figure 28:
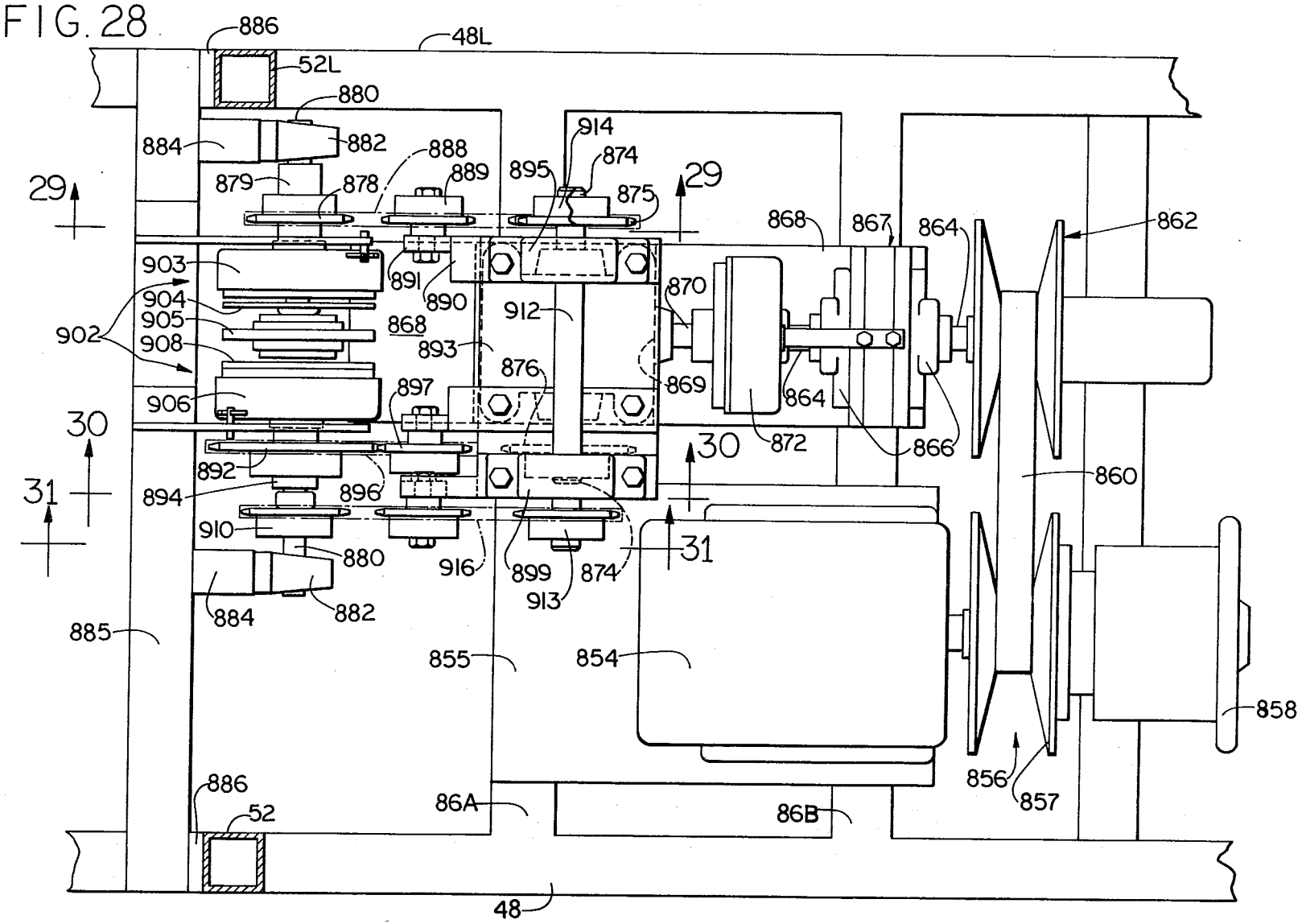
FIG. 28 is a plan view of the power and speed control assembly for the input hopper and the bottle carrier inspection section of the bottle carrier checker/packer, framing members being shown in section.

Power is provided to the input hopper 16 and the carrier inspection 18 by a carrier assembly motor 854 that is fixedly mounted upon a motor plate 855 that is in turn rigidly supported across the top surfaces of the secondary lateral stiffeners 86A and 86B shown in FIGS. 1 and 28. The shaft of the carrier assembly motor 854 is fitted with an adjustable pulley 856 that incorporates a movable disc 857. The width of the adjustable pulley 856 can be set by a manual adjusting wheel 858 that in turn controls the radius on which a belt 860 runs. A variable speed pulley 862 is mounted upon a transfer shaft 864 that is in turn rotatably mounted in a pair of bearings 866. The discs of the variable speed pulley 862 are spring loaded and are consequently free to expand or contract according to the amount of transverse pressure applied by the belt 860. As the manual adjusting wheel 858 is turned in one direction, the movable disc 857 is moved toward its mate, thus forcing the belt 860 to a larger radius. As the belt 860 expands its circumference about the adjustable pulley 856, it must consequently decrease its circumference about the variable speed pulley 862, forcing the discs of the variable speed pulley 862 apart in opposition to spring pressure. In so doing, the speed of the transfer shaft is adjusted upwardly, permitting the speed of the input hopper 16 and the carrier inspection section 18 to be synchronized with the carrier input conveyor 104 of the customer machine. When the manual adjusting wheel 858 is turned in the opposite direction, the speed of the transfer shaft 864 and associated elements is reduced.

The pair of bearings 866 is fixedly attached to each side of a transfer mount 867 through which the transfer shaft passes. The transfer mount 867 is rigidly affixed upon the output end of a gear box mount plate 868, that is in turn rigidly affixed across the secondary lateral stiffeners 86A and 86B, but adjacent to the left hand side of the bottle carrier checker/packer 10. A reduction gear box 869 is fixedly mounted upon the top of the gear box mount plate 868 and largely above the secondary lateral stiffener 86A as is seen also in FIG. 30. The reduction gear box 869 incorporates a gear box input shaft 870 that extends in the output direction. Mounted between the gear box input shaft 870 and the transfer shaft 864 is a carrier section clutch 872 that couples the reduction gear box 869 to the variable speed pulley 862, and subsequently the carrier assembly motor 854. The carrier section clutch 872 disengages upon signal from a limit switch LS20 (FIG. 43) when the surge hopper 20 (FIG. 33) is in an overfill condition.

Figure 29:
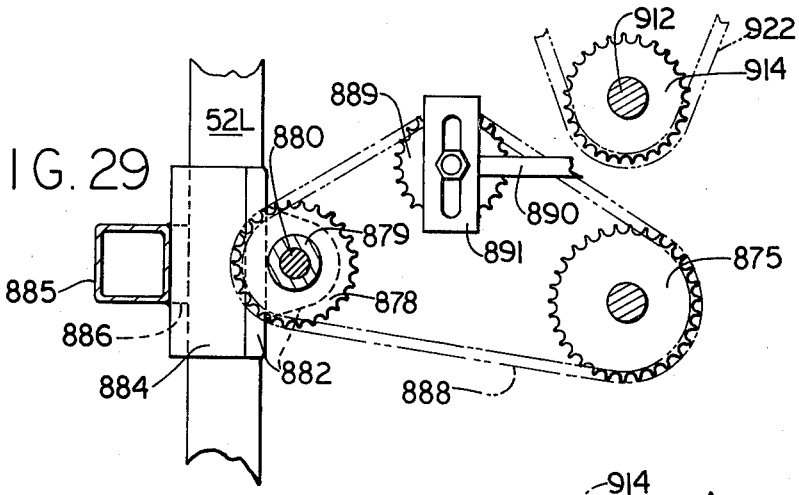
FIG. 29 is a view in section taken on the line 29—29 in FIG. 28.
Figure 30:
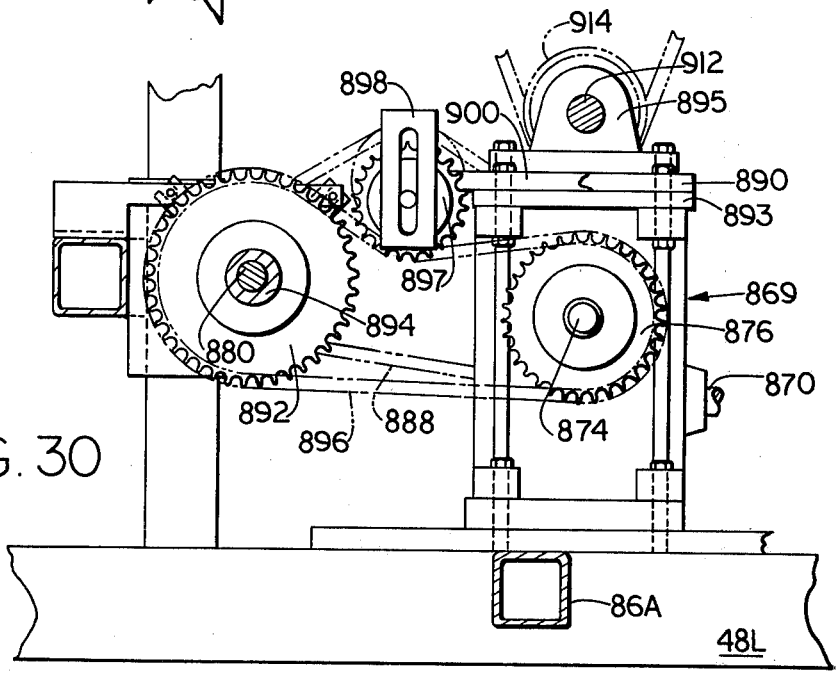
FIG. 30 is a view in section taken on the line 30—30 in FIG. 28.

A gear box output shaft 874 (FIG. 30) extends through the reduction gear box 869 in the lateral direction, providing a power takeoff receptacle on both the left and right sides thereof. The left side power takeoff incorporates a left side sprocket 875 (FIG. 29) and, similarly, the right side power takeoff incorporates a right side sprocket 876 (FIG. 30). Referring specifically to FIGS. 28 and 29, power is transferred from the left side sprocket 875 to a high speed sprocket 878. The high speed sprocket 878 is fixedly attached upon a left side coaxial shaft 879 that is rotatably mounted upon a power delivery shaft 880. The power delivery shaft 880 is rotatably mounted in a pair of transmission bearings 882 that is in turn fixedly attached to a pair of standoff blocks 884. The pair of standoff blocks 884 is rigidly affixed to the output face of a transmission mount bar 885 that is in turn rigidly affixed in a lateral orientation across the input faces of the pair of long input posts 52 and 52L through the interspacing auspices of a pair of block spacers 886. The left side sprocket 875 and the high speed sproccket 878 are coupled by a high speed chain 888 whose tension is maintained by a left side idler 889 (FIG. 29). The left side idler 889 is vertically adjustable and rotatably mounted through a left side idler mount 891. The left side idler mount 891 is rigidly affixed in a cantilever manner to the input end of an extension arm 890 that is in turn fixedly attached across the top left hand surface of a jack shaft mount plate 893 as is shown in FIG. 30. A left side jack plate bearing 895, the extension arm 890 and the jack shaft mount plate 893 are fixedly attached simultaneously to the top left hand surface of the reduction gear box 869.

Referring specifically to FIGS. 28 and 30, the right side sprocket 876 transfers power to a low speed sprocket 892 that is fixedly attached to a right side coaxial shaft 894. The right side coaxial shaft 894 is rotatably mounted upon the power delivery shaft 880. The right side sprocket 876 and the low speed sprocket 892 are coupled by a low speed chain 896 whose tension is maintained by a low speed idler 897. The low speed idler 897 is vertically adjustable and rotatably mounted in a right side idler mount 898 that is in turn rigidly affixed in a cantilever manner to the input end of a right side idler extension 900. The right side idler extension 900 and the jack shaft mount plate 893 are fixedly and simultaneously attached across the right hand top surface of the reduction gear box 869.

Centrally located on the power delivery shaft 880 is a double clutch 902 as is seen in FIG. 28. A left hand clutch 903, of the double clutch 902, couples the right hand extremity of the left side coaxial shaft 879 to the power delivery shaft 880 through the selective function of a left side clutch plate 904 that is an integral part of a central armature assembly 905. In similar manner, a right hand clutch 906, of the double clutch 902, couples the left hand extremity of the right side coaxial shaft 894 to the power delivery shaft 880, through the selective function of a right side clutch plate 908 that is an integral part of the central armature assembly 905. The central armature 905 is a flip-flop device, either engaging the left hand clutch 903 or the right hand clutch 906. The difference in speed of the power delivery shaft 880 from high to low is not great, but is sufficient to prevent the gluer sealer customer machine from overfilling the input hopper 16, or from preventing the carrier inspection section 18 from emptying the input hopper 16.

Figure 31:
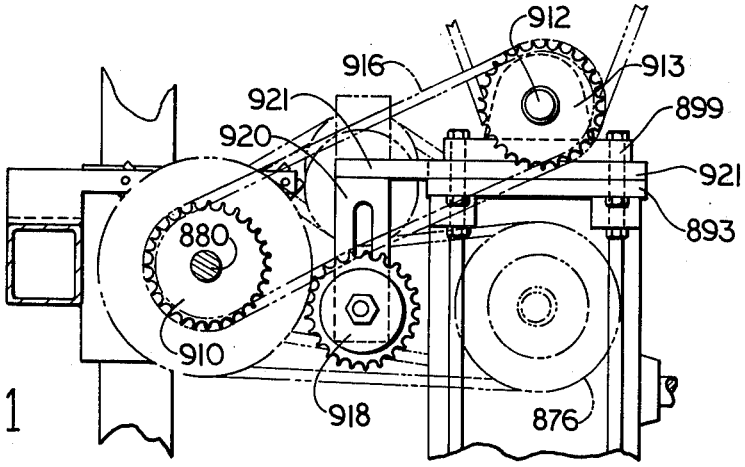
FIG. 31 is a view in section taken on the line 31—31 in FIG. 28.

A power output sprocket 910 is fixedly attached to the right hand side of the power delivery shaft 880, as can be seen in FIGS. 28 and 31. A jack shaft 912 is rotatably mounted in the left side jack shaft bearing 895 and a right side jack shaft bearing 899 and fixedly incorporates, upon its right hand extremity, a jack shaft input sprocket 913; and upon its left hand extremity, a jack shaft output sprocket 914. Power is tranferred from the power output sprocket 910 to the jack shaft input sprocket 913 by means of a transfer chain 916. Tension is maintained in the transfer chain 916 by a transfer idler 918 that is vertically adjustable and rotatably mounted in a transfer idler bracket 920. The transfer idler bracket 920 is rigidly suspended from the bottom input end of a transfer bracket arm 921. The right side jack shaft bearing 899 and the transfer bracket arm 921 are simultaneously and fixedly attached to the overhung right hand end of the jack shaft mount plate 893. Power is delivered from the jack shaft output sprocket 914 to the main power chain 922 as can be seen in FIGS. 1 and 29. The jack shaft output sprocket 914, as viewed in the figures, rotates counterclockwise, thus the output side of the main power chain 922 rises while the input side descends.

Referring now to FIG. 19, the output side of main power chain 922 is guided in its ascent by an output side idler 924. The output side idler 924 is rotatably mounted upon a slide bracket 925 that is in turn longitudinally adjustable and fixedly attached to an idler mount 926. The idler mount 926 is rigidly mounted parallel to and slightly underneath the left side short stringer 56L and adjacent to the output standoff 750 by a short hanger 928. The input end of the idler mount 926 incorporates a top idler 930 rotatably mounted to the inboard surface thereof. A short idler mount 931 is rigidly affixed in a cantilever manner to the output surface of the left side long input post 52L approximate to the bottom sprindle 734 of the lower chain mounting panel 682. An input side idler 932 is rotatably mounted in a bottom slide bracket 933 that is adjustably affixed to the short idler mount 931. The output side idler 924 and the input side idler 932 maintain proper tension in the main power chain 922 as it makes its circuit through the carrier inspection section 18.

The output side of the main power chain 922 rises from the jack shaft output sprocket 914 and passes over the top of the output side idler 924, then further ascends to an idler sprocket 934 that is rotatably attached to the left side of the bottom nip shaft 704 (FIGS. 19 and 17). The main power chain 922 passes around the idler sprocket 934 in a clockwise direction (with respect to FIG. 19) then passes under and about a first input sprocket 936 that is fixedly attached to the right side of the lower output shaft 582. The main power chain subsequently rises to a second input sprocket 938 that is fixedly attached to the secondary upper output shaft 614. After passing over the top of the second input sprocket 938, the main power chain passes toward the input end of the carrier inspection section 18 to pass in a clockwise manner about a third input sprocket 940. The third input sprocket 940 is fixedly attached to the left hand extremity of the output spindle 718 of the upper chain mounting panel 680. The main power chain 922 then descends to pass around the output side of a fourth input sprocket 942 that is fixedly attached to the left hand extremity of the bottom output spindle 732 of the lower chain mounting panel 682. Further descent of the main power chain 922 takes it under the top idler 930, over the input side idler 932 and lastly returns to the input side of the jack shaft output sprocket 914.

Power is received from the main power chain 922 by the first input sprocket 936, then transmitted laterally across the machine to the primary output roller 580 (FIG. 17) and a power transfer sprocket 944. The power transfer sprocket 944 is fixedly attached to the right side of the lower output shaft 582, adjacent to the right hand bearing of the pair of lower output bearings 584 (see FIGS. 17 and 18). Power is then transferred from the power transfer sprocket 944 through a short transfer chain 946 to a bottom nip sprocket 948, and then laterally through the bottom nip shaft 704 to the pair of bottom nip wheels 702. The bottom nip sprocket 948 is fixedly attached upon the right side of the bottom nip shaft 704. The left side of the bottom nip shaft 704 incorporates the rotatably mounted idler sprocket 934 as previously described, and immediately adjacent to it a power takeoff discard sprocket 949 as is seen in FIGS. 17 and 19. The power takeoff discard sprocket 949 is fixedly attached to the bottom nip shaft 704 and incorporates therearound a discard chain 950 that rises vertically to power a discard section to be described hereinafter.

Continuing with FIGS. 17 and 19, power is next transmitted to the second input sprocket 938 and then laterally through the secondary upper output shaft 614 to an upper power transfer sprocket 952. The upper power transfer sprocket 952 is fixedly attached to the secondary upper output shaft 614 adjacent to the left hand side of the top compression roller 683. The upper power transfer sprocket 952 communicates power to a secondary nip sprocket 954 by an upper nip chain 955. The secondary nip sprocket 954 is fixedly attached to the left hand side of the upper primary shaft 602 that in turn communicates power through the shaft to the upper primary output roller 600 and a timing belt pulley 956 that is fixedly attached to the right hand side of the upper primary shaft 602. The timing belt pulley 956, through the auspices of a nip timing belt 958, further communicates power to a nip wheel pulley 959 that is subsequently fixedly attached to the upper nip shaft 708 which motivates the pair of top nip wheels 706.

The main power chain 922 passes from the second input sprocket 938 to the third input sprocket 940 as shown in FIG. 19. With respect to FIG. 19, clockwise rotational power is transmitted to the output spindle 718 and transmits counterclockwise rotational energy to the pair of output sprockets 713 as in FIG. 18, to motivate the pair of top cup chains 520 thereabout, thus propelling the upper suction cup assemblies 518U from left to right of the central portion of FIG. 18. The pair of top cup chains 520 therefore transmits power to the pair of input sprockets 712, the input spindle 716, and finally to an upper istributor transfer sprocket 960 as is shown in FIG. 19. The upper distributor transfer sprocket 960 rotates clockwise in FIG. 19 since it is fixedly attached to the left end of the input spindle 716. Power is communicated from the upper distributor transfer sprocket 960 to the drive sprocket 834 by a top distributor chain 962, subsequently rotating the vacuum distributor assembly 792 (FIG. 18) in concert with the pair of top cup chains 520 and the upper suction cup assemblies 518U.

The main power chain 922 (FIG. 19) descends from the third input sprocket 940 to the fourth input sprocket 942 to impart rotational power thereto. The fourth input sprocket 942 rotates counterclockwise, with respect to the figure, delivering power to the bottom output spindle 732, the pair of bottom output sprockets 727 (FIG. 18), the pair of bottom cup chains 522, the pair of bottom input sprockets 726, and finally the bottom input spindle 730. Referring again to FIG. 19, the left end of the bottom input spindle 730 fixedly incorporates a lower distributor transfer sprocket 964 and an input hopper power takeoff sprocket 965 in adjacent relationship thereto. Power is delivered to the lower drive sprocket 853 from the lower distributor transfer sprocket 964 by a bottom distributor chain 966, that imparts a clockwise rotation with respect to FIG. 18, to the lower vacuum distributor assembly 850. Thus, the lower vacuum distributor assembly 850 rotates in concert with the bottom suction cup assemblies 518D which in turn traverse the carrier inspection section 18 in coordinated pairs with the upper suction cup assemblies 518U. Finally, the input hopper power takeoff sprocket 965 transfers power to the input hopper drive sprocket 348 by the power input chain 350 of the input hopper 16.

As a result, when viewing FIG. 18, the upper primary output roller 600 provides counterclockwise motive power to the upper handle belt 516U, the upper primary closing belt 526U, and the upper secondary compression belt 528U. Similarly, the lower output shaft 582, through the clockwise rotation of the primary output roller 580, imparts motive power to the lower handle belt 516D, the lower primary closing belt 526D and the lower secondary compression belt 528D. The linear speeds of these pairs of belts are all the same. The tangential velocity of the outer circumference of the pair of top nip wheels 706 and the pair of bottom nip wheels 702 is somewhat higher than the belts of the carrier inspection section 18 to insure that the bottle carrier 106 does not slow down as it is snatched from the terminus of the belts and propelled through the nip wheels into the surge hopper 20 for continued processing or rejection thereof.

SURGE HOPPER AND REJECT PLATFORM

As the bottle carrier 106 exits the carrier inspection section 18, it passes between the pair of bottom nip wheels 702 and the pair of upper nip wheels 708, either having passed or failed the inspection test of photocells PC-3 and/or PC-4. If the bottle carrier 106 passed the inspection test, it passes between the pairs of bottom and upper nip wheels 702 and 706, respectively, uninterrupted as shown in solid line in FIG. 33. The bottle carrier 106 is thrust forward and downwardly into the surge hopper 20 where it is arrested in its forward motion when it impacts against a surge hopper discriminator plate 968. The bottle carrier 106 then falls vertically downward and comes to rest in a stack of carriers 973 upon a surge hopper belt 969. Each bottle carrier 106 is restrained in lateral movement by a left side surge guide 970 and a right side surge guide 972 as it falls to form the stack of carriers 973 within the surge hopper 20. The stack of carriers 973 is urged into a straight stack against the surge hopper discriminator plate 968 by a surge hopper patter 974. The surge hopper belt 969 runs in a clockwise rotation with respect to the FIG. 33 and strips the bottom bottle carriers 106 from under the stack of carriers 973 and moves them out of the surge hopper 20 in a shingle formation. Friction forces are transferred from the bottom bottle carrier 106 up through the stack of carriers 973, and thereby also move adjacent bottle carriers 106 along with the bottom one. A limit is placed upon this vertical transfer of friction up through the stack of carriers 973 by a surge discriminator brush 976 of the surge hopper discriminator plate 968, and thereby defines the amount of overlap permitted in the surge hopper output stream of carriers 977. As the stack of carriers 973 begins to rise in the surge hopper 20, it reaches a low point depth that rotates the actuation arm 978 of limit switch LS-9 clockwise so as to make the portion of the circuit that starts the surge hopper belt 969. The surge hopper belt 969 is in low speed at this time. As the stack of carriers 973 increases to a point of considerable depth, a second pole of the limit switch LS-9 is made, changing the surge hopper belt into high speed. If the surge hopper 20 overfills, the stack of carriers 973 will rise until an actuation shoe 980 of limit switch LS-20 (FIG. 43) is raised to actuate the limit switch LS-20 to de-energize the carrier section clutch 872, as already explained.

If the bottle carrier 106 fails the inspection test of photocells PC-3 and/or PC-4, then a reject roller 982, shown in solid line between the pairs of bottom and upper nip wheels 702 and 706, respectively (FIG. 33), is moved upward to a position **982*b*. In doing so, the bottle carrier 106, and consequently the pair of top nip wheels 706, are moved to a position 106*b* and 706*b*, respectively. The leading edge 115 of the bottle carrier 106*b* is thereby raised sufficiently to pass over a diverter assembly 983 of a discard assembly 984. The bottle carrier 106*b* proceeds forwardly, riding up on a discard plate 986 until the left hand edge, or the bottle carrier bottom 112, comes under the influence of a set of canted reject wheels 988. As the bottle carrier 106*b* impacts under the rotating set of canted reject wheels 988, its forward motion is arrested, and at the same time it receives a lateral thrust that quickly propels it to the left out of the bottle carrier checker/packer machine 10. If for some reason a bottle carrier 106*c* or cartons become jammed and will not pass under the set of canted reject wheels 988, a sensing arm 991 of a limit switch LS-21 will be rotated slightly in the counterclockwise direction, making an appropriate circuit that will shut down the input hopper 16**.

Air is used to augment the mechanical means employed in diverting the bottle carrier 106, either to the surge hopper 20, or to the discard assembly 984. If the bottle carrier 106 has passed its inspection and is passing into the surge hopper 20, then two streams of air are continuously delivered from a diverter plate tube 989 (FIGS. 40 and 41) and an overhead tube 987 that are simultaneously directed against the carrier top panel 118 to insure that its leading edge 115 does clear the leading edge of the diverter assembly 983.

As the bottle carrier **106*b* passes over the diverter assembly 983 and into the discard assembly 984, the leading edge 115 of the bottle carrier 106 is assisted up and over the diverter assembly 983 by a stream of air delivered from a vertical nozzle 990 (FIG. 33) that is directed against the carrier bottom panel 120. The mechanical features of the surge hopper 20 and the discard assembly 984** will be discussed herein.

Figure 34:
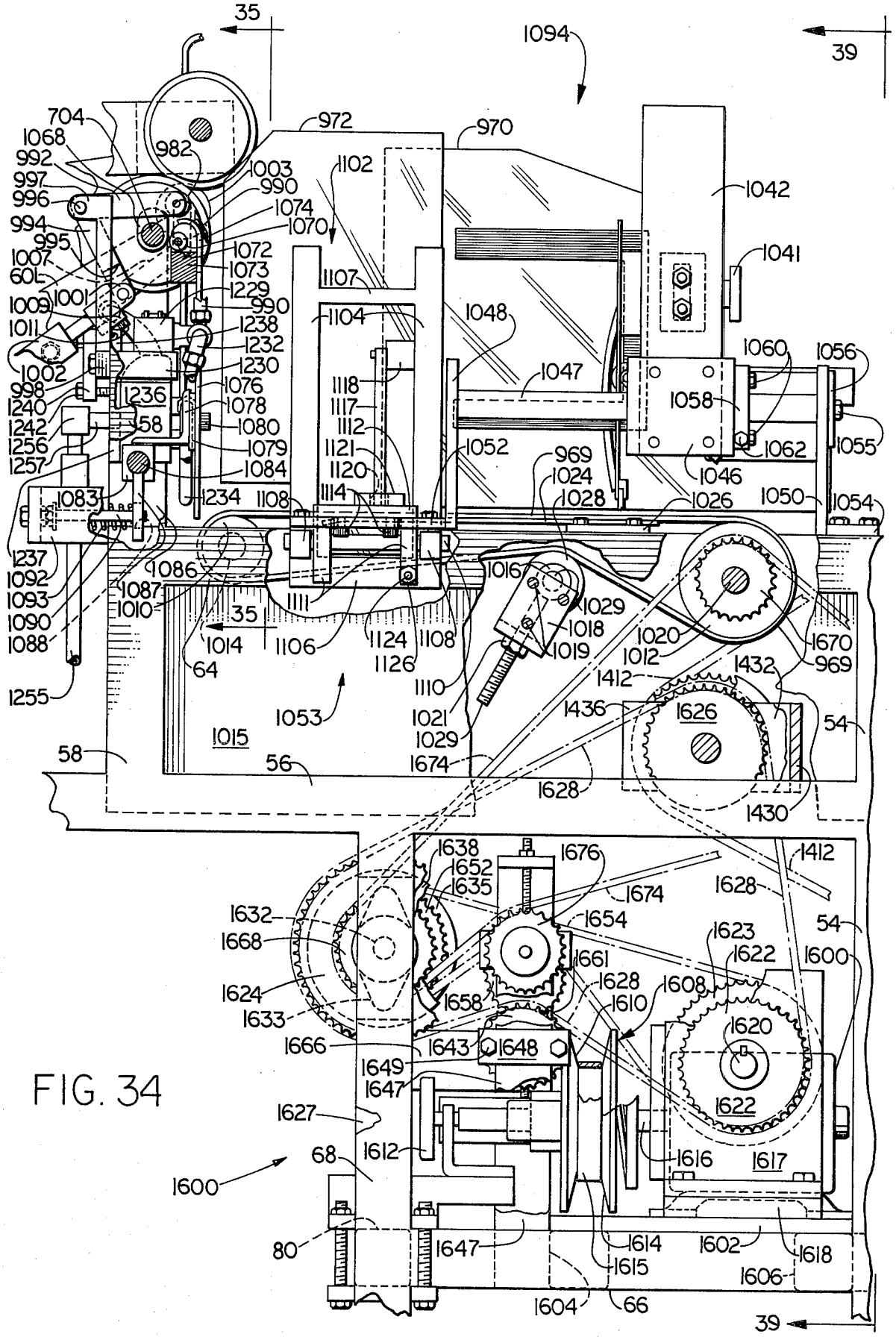
FIG. 34 is a side elevational view of the surge hopper assembly of FIG. 33 and a power assembly for the surge hopper assembly and a pack assembly section, parts being partially cut away to expose pertinent machinery.
Figure 35:
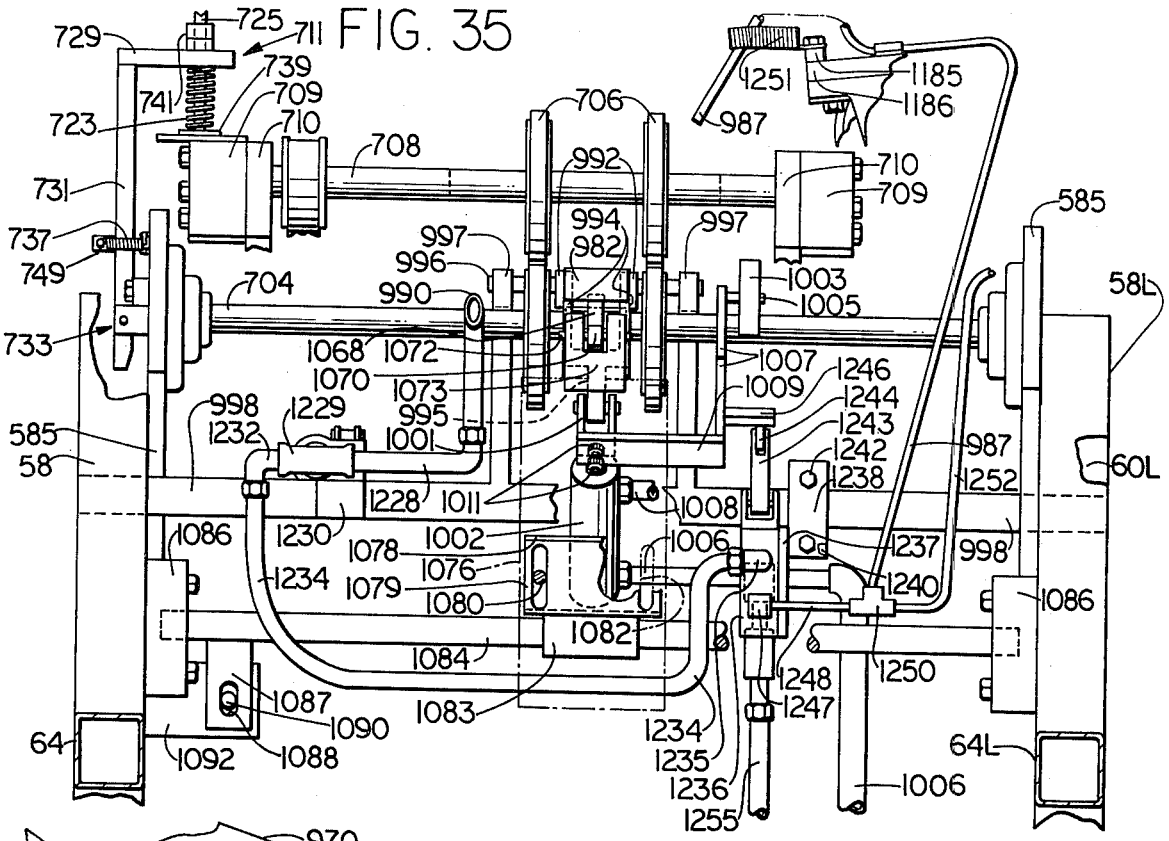
FIG. 35 is a cross sectional view of the surge hopper input section taken on the line 35—35 in FIG. 34.

The reject roller 982 and its related assembly is shown in FIGS. 34 and 35. The reject roller 982 is rotatably mounted between the ends of a pair of yoke extension arms 992 that is in turn rigidly affixed at the top extremity of, and upon the outer surfaces of a pair of forks 994 of a reject yoke 995. The reject yoke 995 is pivotally mounted upon a reject pivot shaft 996 that is in turn fixedly inserted into the upper ends of a pair of reject mount risers 997. The pair of reject mount risers 997 is rigidly affixed in a vertical disposition upon the top surface of a lateral reject mount 998. The lateral reject mount 998 is fixedly attached across the input faces of the pair of short output posts 58 and 58L, and slightly below the intersection of the pair of inclined stringers 60 and 60L. The bottom extremity of the reject yoke 995 is pivotally attached to a cylinder clevis 1001 of a reject cylinder 1002. Referring to FIG. 1, the reject cylinder 1002 is pivotally mounted at its fixed end to a lateral cylinder mount 1004 that is rigidly affixed across the bottom surfaces of the pair of inclined stringers 60 and 60L. As is shown in FIG. 35, a compressed air line 1006 is fixedly attached near the lower left hand side of the reject cylinder 1002, and is the input air line. The reject cylinder 1002 is lubricated by an oil mist unit that enters oil into the compressed air (not shown). A vent line 1008 is fixedly attached near the top left hand side of the reject cylinder 1002. The function of the reject roller 982 is augmented by a left side reject wheel 1003 that is of considerably larger diameter than the reject roller 982. The left side reject wheel 1003 is rotatably mounted upon a short spindle 1005 that is in turn fixedly inserted in a cantilever manner into the upper end of, and upon the left side of, an extension arm mount 1007. The extension arm mount 1007 is rigidly affixed to the top surface of, and at the left end of, a lateral extension mount 1009. The right end of the lateral extension mount 1009 is fixedly attached to the bottom surface of the cylinder clevis 1001 by a pair of socket head cap screws 1011. In this manner the left side reject wheel 1003 operates in fixed relationship with the reject roller 982 to forcefully raise the left side of the bottle carrier 16 as it is being rejected into the discard assembly 984.

Figure 39:
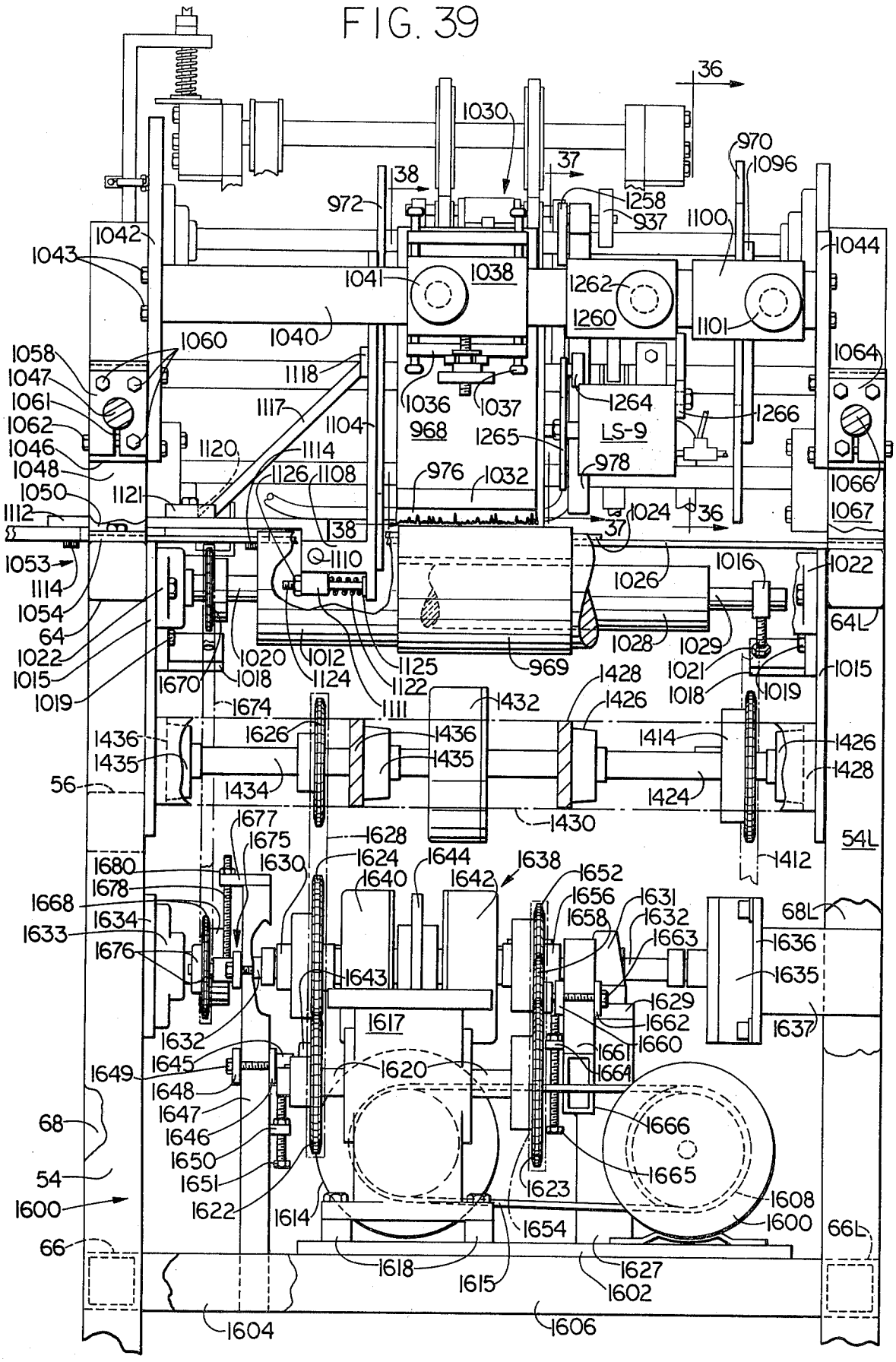
FIG. 39 is a view of the surge hopper in section taken on the line 39—39 in FIG. 34.

Referring now to FIGS. 34 and 39, the surge hopper belt 969 is mounted and made mobile in the clockwise direction as shown in FIG. 34 upon an input surge roller 1010 and an output surge roller 1012. The input surge roller 1010 is rotatably mounted upon an input bar 1014 that is fixedly inserted into holes that are incorporated in a pair of pack assembly side plates 1015. The pair of pack assembly side plates 1015 is of rectangular shape and is rigidly affixed upon the inboard surfaces of, and bounded by, the pair of top longitudinal stringers 64 and 64L, the lower portions of the pair of short output posts 58 and 58L, and the output half of the pair of short stringers 56 and 56L. These relationships can be more easily seen in FIG. 1. The output ends of the pair of pack assembly side plates 1015 overhand the confines of these frame members to provide mounting structure for the carrier packing assembly 22. The output surge roller 1012 is fixedly attached upon a surge output shaft 1020 that is in turn rotatably mounted in a pair of surge bearings 1022 (FIG. 39). The pair of surge bearings 1022 is fixedly attached upon the inboard faces of the pair of pack assembly side plates 1015 and adjacent to the pair of output posts 54 and 54L.

The top portion of the surge hopper belt 969 slides across a surge hopper base plate 1024 that is rigidly affixed upon a hopper mount bar 1026 that is in turn fixedly attached across the top surfaces of the pair of top longitudinal stringers 64 and 64L. Continuing with FIGS. 34 and 39, tension is maintained in the surge hopper belt 969 by a surge hopper tension roller 1028 that is rotatably mounted upon a tension bar 1029. The tension bar 1029 is fixedly mounted at its ends in a pair of eyebolts 1016. The pair of eyebolts 1016 mounts through clear holes in a pair of angle mounts 1018, and is adjustably held therein by a set of four lock nuts 1021. The pair of angle mounts is fixedly attached to the inside surfaces of the pair of pack assembly side plates 1015 by a set of six bolts 1019. Therefore, by manipulating the set of four lock nuts 1021, the pair of eyebolts 1016 can be adjusted forcefully upward, bringing the surge hopper tension roller 1028 into compressive contact with the lower panel of the surge hopper belt 969 to produce tension therein.

Figure 38:
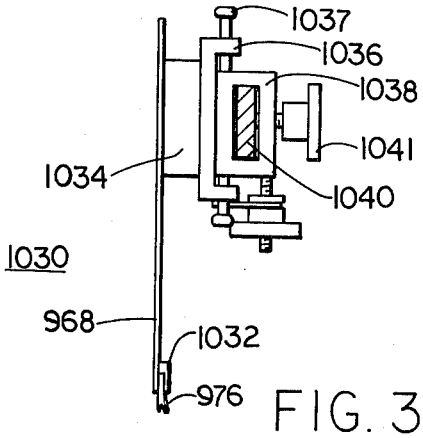
FIG. 38 is a view in section taken on the line 38—38 in FIG. 39.

Clearly shown in FIGS. 38 and 39, is a surge hopper discriminator assembly 1030. The surge hopper discriminator brush 976 is fixedly clamped to the output face of the surge hopper discriminator plate 968 by a clamp bar 1032. The surge hopper discriminator plate 968 is fixedly attached to the input face of a standoff block 1034 that is in turn rigidly affixed to the input face of an elevation slide bracket 1036. The elevation slide bracket 1036 is slidably mounted upon a pair of vertical slide posts 1037 that is in turn fixedly attached through the input side of a lateral slide mount 1038. The lateral slide mount 1038 is similar to a section of box channel slidably surrounding a surge hopper accessory rail 1040. The lateral slide mount 1038 is moved to the proper lateral position upon the surge hopper accessory rail 1040 and then clamped into fixed position by a lock handle 1041 whose shaft is threadably mounted through the output side of the lateral slide mount 1038. The surge hopper accessory rail 1040 is fixedly attached at each end by a pair of machine screws 1043 that passes through clear holes in a right side accessory mount 1042 and a left side accessory mount 1044 before threadably mounting therein, as is shown in FIG. 34.

The right side accessory mount 1042 is fixedly attached to the inboard surface of a right side slide block 1046 that is in turn slidably mounted upon a right side surge rail 1047. The right side surge rail 1047 is inserted at each end in a hole that is incorporated in the upper end of an input slide rail mount 1048 and an output slide rail mount 1050. The input slide rail mount 1048 is vertically and rigidly mounted against the extended output edge of a base plate 1052 of a right side surge guide assembly 1053, as is shown in FIG. 32. The right side surge guide assembly 1053 is fixedly mounted upon the top surface of right hand top longitudinal stringer 64 and its structure and mounting will be discussed hereinafter. The output slide rail mount 1050 rigidly incorporates a mounting foot 1054 that is in turn fixedly attached upon the top surface of the right hand top longitudinal stringer 64 approximate to the intersection of the right hand output post 54. The right side surge rail 1047 is fixedly held within the holes of the input and output slide rail mounts 1048 and 1050, respectively, by a cap screw 1055 that is inserted through a clear hole that is incorporated in an end cap 1056, and then threadably mounted into the output end thereof. The end cap 1056 is rigidly affixed to the output surface of the output slide rail mount 1050. The right side slide block 1046 is freely slidable upon the right side surge rail 1047, and is locked into fixed longitudinal position thereupon by a lock collar 1058. The lock collar 1058 (FIGS. 34 and 39) is fixedly attached to the output end of the right side slide block 1046 by a set of three cap screws 1060. The lower portion of the lock collar 1058 incorporates a slit 1061 which permits compression of opposing sides of the lock collar 1058 against the right side surge rail 1047 by a lock screw 1062.

The left side accessory mount 1044 is of lesser vertical dimension than the right side accessory mount 1042 but in other respects is similar. The left side accessory mount 1044 (FIG. 39) is fixedly attached upon the inboard surface of a left side slide block 1064 that is in turn slidably and lockably mounted upon a left side surge rail 1066 in the same manner as that of the right side slide block 1046. The left side surge rail 1066 is also mounted in spaced vertical elevation above the left hand top longitudinal stringer 64L in the same way as the right side surge rail 1047 is mounted above the left hand top longitudinal stringer 64, except that a left hand input slide rail mount 1067 is fixedly attached to the left hand top longitudinal stringer 64L by a simple mounting foot (not shown) similar to that of the mounting foot 1054 of the output slide rail mount 1050.

The surge hopper patter 974 is shown in FIGS. 34 and 35. A patter cam 1068 is fixedly attached upon the bottom nip shaft 704 and at its center, to cooperate with a small cam roll 1070 that is rotatably mounted upon a short spindle 1072. The short spindle 1072 is fixedly inserted across two lobes of a patter cam roll mount 1073. The patter cam roll mount 1073 is in turn fixedly attached to the input side of a top extension 1074 of a surge patter plate 1076. The top extension 1074 is rolled in the input direction to conform with the rounded top of the patter cam roll mount 1073 and also assures that the top of the surge patter plate 1076 will not interfere with the bottle carrier 106.

The surge patter plate 1076 is fixedly attached to the outboard face of a mount angle 1078 through the interspacing auspices of an adjustment shim 1079. A pair of socket head machine screws 1080 passes through a pair of vertical adjustment slots 1082 (FIG. 35) of the surge patter plate 1076, through clear holes in the adjustment shim 1079, and threadly mounts in the face of the mount angle 1078. This provides the surge patter plate with a degree of vertical adjustment to insure that proper alignment between the small cam roll 1070 and the patter cam 1068 is obtained. The mount angle 1078 is rigidly affixed upon the top surface of an oscillator block 1083 that is in turn fixedly mounted upon the center of an oscillator rod 1084. Each end of the oscillator rod 1084 is pivotally inserted into a hole that is incorporated in each one of a pair of oscillator rod mount blocks 1086. The pair of oscillator rod mount blocks 1086 is fixedly attached upon the inboard surfaces of the right and left hand members of the pair of short output posts 58 and 58L respectively. Near the right hand end of the oscillator rod 1084 is a spring torque arm 1087, rigidly affixed in a vertical disposition to the bottom surface thereof. The lower end of the spring torque arm 1087 incorporates a slot 1088 through which the free end of a return-spring stud 1090 extends. The return-spring stud 1090 is fixedly attached through the lateral leg of a return spring mount 1092, the longitudinal leg of which is rigidly affixed upon the input surface of the right hand output post 58 and adjacent to the intersection of the right hand top longitudinal stringer 64. A return spring 1093 is inserted over the return spring stud 1090 and between the lateral foot of the return spring mount 1092 and the spring torque arm 1087. As the bottom nip shaft 704 rotates, the patter cam 1068 pushes the top of the surge patter plate 1076 toward the output end of the surge hopper 20, pivoting the oscillator block 1083 and the spring torque arm clockwise with respect to FIG. 34, thereby compressing the return spring 1093. The return spring provides the restoring force that keeps the small cam roll 1070 in rolling contact with the patter cam 1068.

Figure 36:
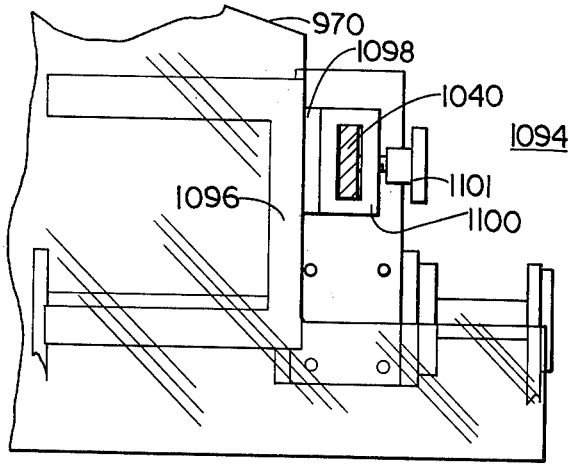
FIG. 36 is a view in section taken on the line 36—36 in FIG. 39.
Figure 37:
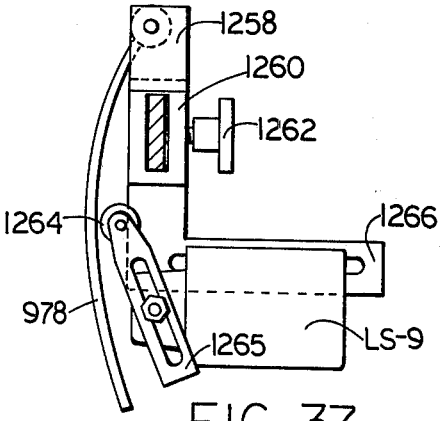
FIG. 37 is a view in section taken on the line 37—37 in FIG. 39.

A left hand surge hopper side guide assembly 1094 is shown in FIGS. 34, 36 and 39. The left side surge guide 970 is so shaped that it will guide each bottle carrier 106 in its vertical descent into the surge hopper 20. It also guides the bottle carrier 106 as it leaves the surge hopper 20 upon surge hopper belt 969. The left side surge guide 970 is fixedly attached to the inboard surface of a mounting frame 1096. The mounting frame 1096 is a three-sided frame, with its one vertical side rigidly affixed to the input surface of a frame mount 1098 as is shown in FIG. 36. The frame mount 1098 is fixedly attached to the input surface of a side guide slide mount 1100. The side guide slide mount 1100 is a built up piece of boxlike cross section that fits closely around the surge hopper accessory rail 1040 and provides a measure of lateral adjustment to the left side surge guide 970. The side guide slide mount 1100 is held in fixed place by a side guide lock handle 1101 whose shank is threaded through the output wall of the side guide slide mount 1100 to forcefully lock it upon the surge hopper accessory rail 1040.

A right side surge guide assembly 1053 is shown in FIGS. 34 and 39. The right side surge guide 972 is fixedly attached to the inboard surfaces of a folding mount assembly 1102 and guides the right hand side of the bottle carrier 106 as it enters, descends through, and exits from the surge hopper 20. The folding mount assembly 1102 is comprised of a pair of side bars 1104, a bottom bar 1106, a top bar 1107 and a pair of pivot lugs 1108. The assembly will be discussed in terminology fitting the assembly's erect position, as is shown in the figures The pair of side bars 1104 rigidly incorporates on its outboard surface and near its bottom extremity the pair of pivot lugs 1108. Each one of the pair of side bars 1104 is held in longitudinal and parallel spaced relationship by the bottom bar 1106 that is rigidly affixed between the lower extremities thereof, and the top bar 1107 that is rigidly affixed between the side bars at a point near their upper extremities. The pair of pivot lugs 1108 is pivotally mounted upon each end of a pivot bar 1110 that is in turn fixedly inserted through a pair of hangers 1111. The pair of hangers 1111 is rigidly affixed to the inboard end of a slide plate 1112 that threadably incorporates a set of four socket head cap screws 1114, located in a rectangular pattern in the underside of the slide plate 1112. The set of four socket head cap screws cooperates with a set of four slots 1116 that is incorporated through the overhanging extremities of the base plate 1052 (FIG. 32) to provide lateral adjustment of the folding right side surge guide 972.

The right side surge guide 972 is held in vertical placement by a diagonal strut 1117 that is pinned at its upper extremity to a side guide tiedown 1118 that is rigidly affixed to the input edge of the output member of the pair of side bars 1104. The bottom extremity of the diagonal strut 1117 fits into a slot 1120 of a strut detent 1121 that is rigidly affixed to the upper surface of the slide plate 1112. Detent pressure is supplied by a detent spring 1122 that is mounted on a detent shaft 1124 that in turn passes through a clear hole in the bottom extremity of the output member of the pair of hangers 1111. The detent shaft 1124 is retained in the clear hole by a nut 1126 that is threadably mounted on the outboard end thereof, and a shaft cap 1125 that is rigidly affixed to the inboard end thereof. The detent spring 1122 is compressively inserted upon the detent shaft 1124 between the inboard face of the right hand member of the pair of hangers 1111 and the outboard surface of the shaft cap 1125. In this manner the outboard surface of the bottom bar 1106 comes in contact with the shaft cap 1125, compressing the detent spring 1122 a small amount before the bottom extremity of the diagonal strut 1117 is retained in the slot 1120 of the strut detent 1121. The right side surge guide 972 is made foldable to provide access to the surge hopper 20 for service thereof.

Figure 40:
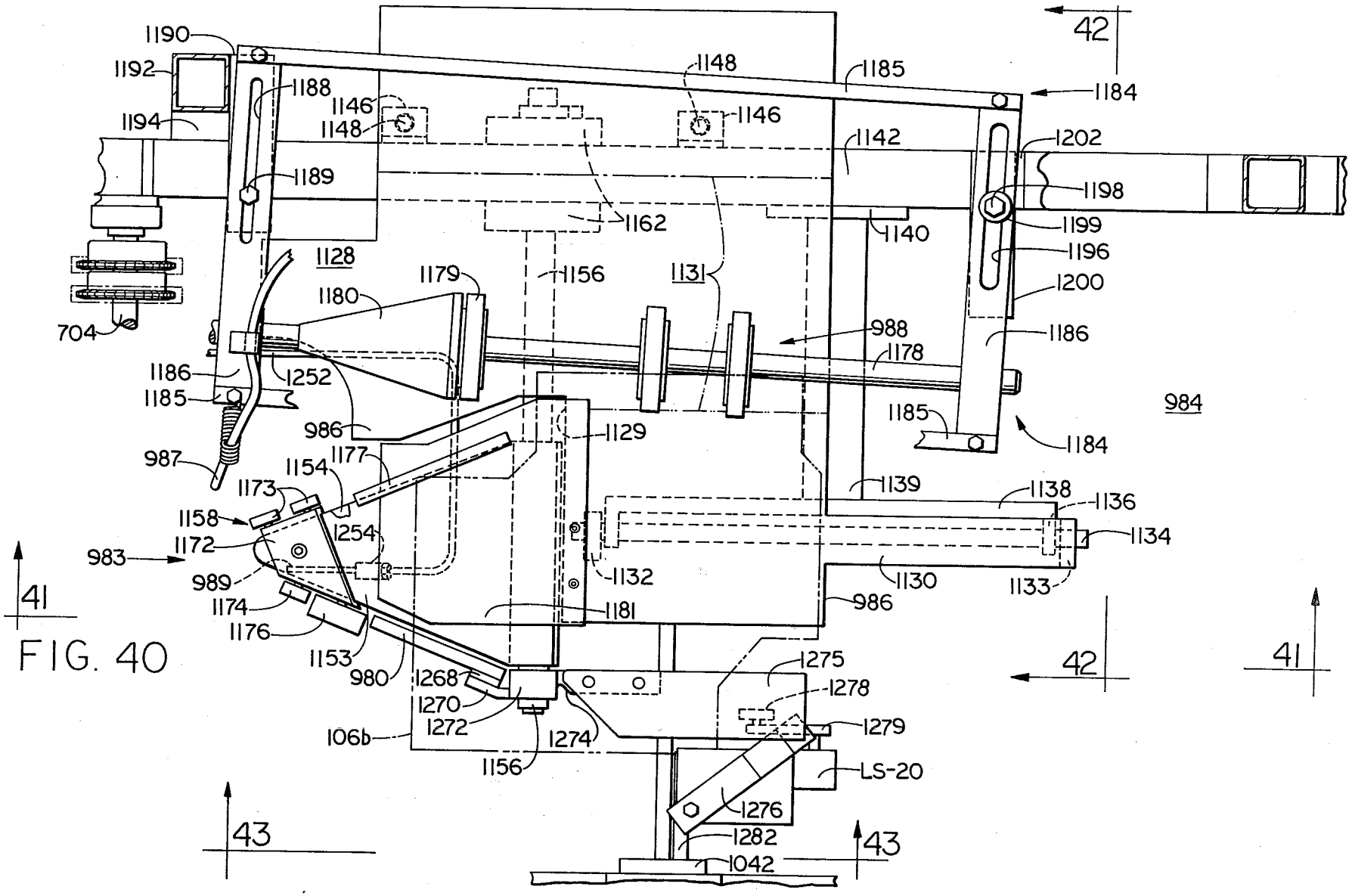
FIG. 40 is a plan view of a discard assembly that is located above the surge hopper assembly of FIG. 34.
Figures 41, 42, 43:
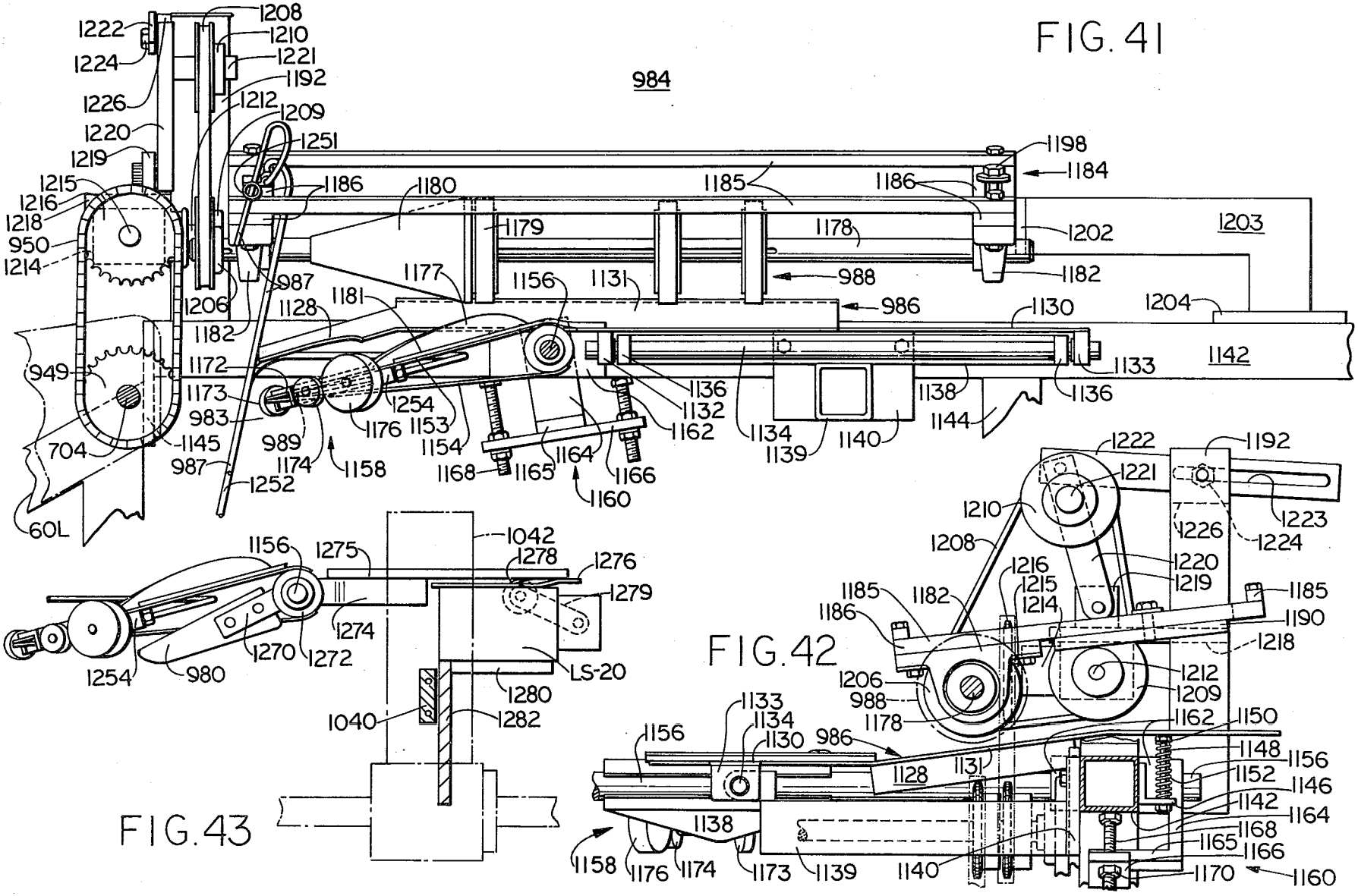
FIG. 41 is a view in section of the discard assembly taken on the line 41—41 in FIG. 40.
FIG. 42 is a view in section of the discard assembly taken on the line 42—42 in FIG. 40.
FIG. 43 is a fragmentary sectional view showing a surge hopper limit switch in side elevation and taken on the line 43—43 in FIG. 40.

The discard assembly 984 is shown in FIGS. 40, 41 and 42. The discard plate 986 is of irregular shape that incorporates an input-side extension 1128, an input right side corner cutout 1129, and an output side mounting extension 1130. The input side extension 1128 is so shaped and downwardly bent so as to provide a pickup ramp for the left side or bottom panel of the bottle carrier 106 as it enters the discard assembly 984. The input right side corner cutout 1129 is provided to make access for the inclusion of the diverter assembly 983. The output side mounting extension 1130 provides remote mounting capability. A central panel 1131 of the discard plate 986 is inclined slightly, as is seen in FIG. 42, to bring the rejected bottle carrier 106 up and over the left side mounting structure of the discard assembly 984.

Fixedly attached to the underside of the discard plate 986 and its output side mounting extension 1130, are a central right side mounting lug 1132 and a right side output lug 1133. The central right side mounting lug 1132 and the right side output lug 1133 are pivotally mounted upon a right side mount shaft 1134 that is in turn fixedly held in a pair of lugs 1136 of an elongated yoke mount 1138. The yoke mount 1138 is rigidly affixed in a longitudinal orientation across the top surface and free end of a lateral cantilever plate mount 1139. The left hand extremity of the lateral cantilever plate mount 1139 is rigidly affixed to a mount bracket 1140 that is in turn fixedly attached to the inboard surface of a diverter stringer 1142. The diverter stringer 1142 is mounted parallel to, and above the left hand top longitudinal stringer 64L (see FIG. 44) by a discard riser 1144 that is rigidly affixed near its output end, and by a discard mount plate 1145 that is rigidly affixed to its input end. The discard mount plate 1145 is rigidly affixed to the output end of the left hand inclined stringer 60L. The bottom end of the discard riser 1144 is rigidly affixed to the output end of the left hand top longitudinal stringer 64L. The outboard surface of the diverter stringer 1142 rigidly incorporates a pair of plate mounting angles 1146 as is shown in FIGS. 40 and 42. The lower flanges of the pair of plate mounting angles 1146 each include a clear hole through which a vertical spring stem 1148 passes. The vertical spring stem 1148 is retained therein by a pair of stop nuts 1150, threadably affixed at each end thereof and brought into proper location thereupon by a coaxially installed relief spring 1152. The top end of the vertical spring stem 1148 bears up under the left side of the discard plate 986, holding it in a horizontal position. The two relief springs 1152, that are associated with the pair of plate mounting angles 1146, are included in order to permit the left side of the discard plate 986 to move downward, by pivoting about the right side mount shaft 1134, to provide pressure relief for a bottle carrier 106, or carriers, that are traversing between the discard plate 986 and the set of reject wheels 988.

The diverter assembly 983, shown in FIGS. 40 and 42 inclusive, is comprised of an upper triangular plate 1153, a lower triangular plate 1154, a diverter pivot shaft 1156, a wheel assembly 1158 and a rocker arm lock assembly 1160. The base or output side of the upper and lower triangular plates 1153 and 1154, respectively, are rigidly affixed to opposing sides of, and near the right end of, the diverter pivot shaft 1156. The vertices of the upper and lower triangular plates 1153 and 1154, respectively, are rigidly affixed together to form a wedge for separating the discarded stream of carriers from the accepted stream of carriers. The left end of the diverter pivot shaft 1156 is pivotally mounted through a pair of bushings 1162 that is rigidly affixed to either side of the diverter stringer 1142 and adjacent to the input end of the right side mount shaft 1134 in FIG. 41. The diverter pivot shaft 1156 is retained in fixed angular relationship with the diverter stringer 1142 by the rocker arm lock assembly 1160 that is fixedly attached to the left extremity of the diverter pivot shaft 1156.

The rocker arm lock assembly 1160 is comprised of a radial arm 1164 (FIGS. 41 and 42), a lateral extension 1165, a tangential torque arm 1166 and a pair of jack screws 1168. The lateral extension 1165 is rigidly affixed to the bottom of the radial arm 1164, and extends inwardly under the diverter stringer 1142. The tangential torque arm 1166 is rigidly affixed across the bottom inboard end of the lateral extension 1165 so that it lies in line with the diverter stringer 1142. Each end of the tangential torque arm 1166 incorporates a threaded hole through which each of the pair of jack screws 1168 is rotatably inserted and axially adjustable. A set of four locking nuts 1170 fixedly retains the pair of jack screws 1168 in set position with heads of the jack screws 1168 jammed against the bottom surface of the diverter stringer 1142, thus making the diverter assembly 983 fixedly positioned, but pivotally adjustable.

The wheel assembly 1158 is comprised of a trapezoidal base channel 1172, that is fixedly attached in an inverted position to the top vertex surface of the upper triangular plate 1153, as is best seen in FIG. 40. The left flange of the trapezoidal base channel 1172 incorporates a pair of cam rolls 1173, while the right hand flange incorporates an input cam roll 1174, of the same diameter as the pair of cam rolls 1173, and an output cam roll 1176 of large diameter. The cam rolls are free to rotate in either direction, assisting an incoming bottle carrier 106 in clearing the vertex of the diverter assembly 983. For example, as a rejected bottle carrier 106 is diverted up and over the input member of the pair of cam rolls 1173 and the input cam roll 1174, it can in fact impact them in their upper input quadrants, rotating them clockwise with respect to FIG. 41. As the bottle carrier 106 proceeds, its right hand side will be further elevated above the upper triangular plate 1153 by the larger diameter output cam roll 1176, and its left hand side will be likewise elevated by a slide shoe 1177 that is fixedly attached along the left hand side of the upper triangular plate 1153. The leading edge 115 of the bottle carrier 106 is guided over the intersection of the diverter assembly 983 and the discard plate 986 by a flexible sheath 1181 of fitted planform shape as can be most clearly seen in FIGS. 40 and 41.

The set of reject wheels 988 (FIGS. 40, 41 and 42), three in all, is rotatable with but axially adjustable upon a reject shaft 1178 so that compensation can be made for various sizes of bottle carriers 106. Longitudinal entry of a bottle carrier 106 to the first reject wheel 1179 of the set of reject wheels 988 is facilitated by an entry cone 1180, also rotatable with and adjustably mounted upon the reject shaft 1178. The reject shaft 1178 is rotatably mounted in a pair of bearings 1182 that is in turn fixedly attached to the underside of a reject mount rack 1184. The reject mount rack 1184 is a rectangular structure comprising a pair of longitudinal beams 1185 and a pair of lateral beams 1186. The pair of longitudinal beams 1185 is fixedly attached to the top surface of, and at the ends of, the lateral beams 186. The pair of bearings 1182 is fixedly attached to the bottom surface of, and at the inboard end of, the pair of lateral beams 1186.

The input lateral beam of the pair of lateral beams 1186 incorporates a narrow slot 1188 through which an input mount bolt 1189 passes with small clearance to threadably mount into the top surface of an input rack mount 1190. By tightening the input mount bolt 1189, the input lateral beam of the pair of lateral beams 1186 is compressively held in place. The input side of the input mount rack 1190 that is adjacent to the outboard end thereof, is rigidly affixed along the output surface of a reject assembly riser 1192. The reject assembly riser 1192 is in turn rigidly affixed in a vertical orientation to the outboard side of the diverter stringer 1142, through the interspacing auspices of a reject riser standoff 1194, shown in FIG. 40.

The output lateral beam of the pair of lateral beams 1186 incorporates a wide slot 1196 through which an output mount bolt 1198 passes with lateral clearance ample enough to require the use of a washer 1199. The output mount bolt 1198 threadably mounts into the top surface of an output rack mount 1200. By tightening the output mount bolt 1198, the output member of the pair of lateral beams 1186 can be compressively held to the top surface of the output rack mount 1200. The output edge of the output rack mount 1200 that is adjacent the outboard end thereof, is rigidly affixed to the input face of a cap plate 1202 of an overhang mount 1203. The "L" shaped overhang mount 1203 is fixedly mounted to the top surface of the diverter stringer 1142 by means of an overhang base plate 1204 that is fixedly mounted thereto.

The reject mount rack 1184 is shown in a squared position with respect to FIG. 41, while the plan view of FIG. 40 shows the reject mount rack 1184 in a skewed position, to demonstrate its adjustability to control, to some degree, the lateral direction of the bottle carriers 106 being ejected from the side of the discard assembly 984. This angular adjustment is made possible by the narrow slot 1188 which permits a pivoting degree of freedom, while the wide slot 1196 permits both a pivoting and a longitudinal degree of freedom. Also the narrow and wide slots 1188 and 1196, respectively, permit a considerable degree of lateral adjustment to accommodate the requirements of various sizes of bottle carriers 106.

The input end of the reject shaft 1178 extends slightly through the input bearing of the pair of bearings 1182 to fixedly incorporate a V-belt drive sheave 1206 (FIG. 41). The V-belt drive sheave 1206 receives power through a discard V-belt 1208 that communicates with a discard transfer sheave 1209 and a discard idler sheave 1210. The discard transfer sheave 1209 is fixedly attached to a transfer power takeoff shaft 1212 (FIGS. 41 and 42) of a right angle gear box 1214 that receives power through a transfer input shaft 1215. A discard transfer sprocket 1216 is fixedly attached upon the transfer input shaft 1215 and receives power from the discard chain 950 that rises vertically from the power takeoff discard sprocket 949 about which it communicates. The right angle gear box 1214 is fixedly hung from the inboard underside of a gear box mount 1218 whose output edge is rigidly affixed along the input face of the reject assembly riser 1192 in such manner as to form a cantilever shelf that extends inboardly therefrom. An idler mount block 1219 is rigidly affixed in an upright disposition upon the top surface of the gear box mount 1218. Pivotally attached thereto is an idler sheave arm 1220 whose upper end is also pivotally attached to a lateral adjustment arm 1222. The discard idler sheave 1210 is rotatably mounted close to the top end of the idler sheave arm 1220 on a short shaft 1221. The lateral adjustment arm 1222 incorporates a long slot 1223 through which passes a lock screw 1224 that threadably mounts into a spacer block 1226 that is in turn rigidly affixed at the top of, and to the input face of, the reject assembly riser 1192. The long slot 1223 permits a considerable lateral movement of the lateral adjustment arm 1222, and being pinned to the top end of the pivotally mounted idler sheave arm 1220, swings the idler sheave arm 1220 through a considerable arc on both sides of top dead center, thereby achieving a fair degree of vertical height variation for the discard idler sheave 1210 for the purpose of drawing tension into the discard V-belt 1208. The discard idler sheave 1210 is clamped into position by the lock screw 1224 (FIG. 41). In this manner, power is transferred from the bottom nip shaft 704 to the reject shaft 1178 for counterclockwise rotation of the set of reject wheels 988 when viewing FIG. 42.

As has been previously described, air is utilized to augment the accept and reject function of the pairs of bottom and top nip wheels 702 and 706, respectively. The mechanical elements of the air system are shown in FIGS. 34, 35, 40 and 41. The vertical nozzle 990 projects a stream of air against the bottom of the bottle carrier 106 as it is executing the reject cycle. The vertical nozzle 990 (FIGS. 34 and 35) is threadably connected in an upright position to the end of an output extension tube 1228 that is in turn threadably mounted in the left hand orifice of a fitting 1229. The fitting 1229 is fixedly attached upon a mount 1230 that is rigidly affixed in a cantilever manner to the output face of the lateral reject mount 998. A tube elbow 1232 is threadably mounted in the right hand orifice of the fitting 1229 with its open end pointing downwardly. Threadably connected to the tube elbow 1232 is an extended crossover tube 1234 that extends downwardly and then laterally to the left until it passes under the surge hopper patter 974. Thereafter, the extended crossover tube 1234 turns upwardly a small amount to threadably connect to an output elbow 1235 that is threadably mounted in the output face of a switch valve 1236. The switch valve 1236 is fixedly mounted to the right hand surface of a vertical mount plate 1237 that is in turn rigidly affixed along its upper input left hand side to the lower right hand edge of a mount foot 1238. The mount foot 1238 is clampedly mounted to the output face of the lateral reject mount 998 by a back plate 1240 that is clamped to the input face of the lateral reject mount 998 by a pair of bolts 1242 that extend therebetween. The switch valve 1236 incorporates a switching lever 1243 (FIG. 35) extending from the top thereof, and a switch roller 1244 that is rotatably mounted to the top of the switching lever 1243. The switch roller 1244 works against the bottom surface of a switch trip finger 1246, that is in turn fixedly attached in a cantilever manner at its right hand end to the left side of the extension arm mount 1007. As previously described, the extension arm mount 1007 is operated by the reject cylinder 1002, thereby actuating the switch valve 1236 in concert with the reject cycle.

Threadably mounted in the lower output face of the switch valve 1236 is a tube attachment block 1247. Rigidly affixed within the left face of the tube attachment block 1247 is a short tube extension 1248 which in turn rigidly incorporates, at its left end, a tee 1250. The vertical outlet of the tee 1250 incorporates the overhead tube 987 that rises vertically to be clampedly mounted upon the top surface of the input member of the pair of lateral beams 1186 of the discard assembly 984. The overhead tube 987 then passes toward the center of the surge hopper 20 to be adjustably suspended from the input end of the right hand member of the pair of longitudinal beams 1185 by a spring 1251. The end of the overhead tube 987 is then directed downwardly toward the bottle carrier 106 that is being ejected from the pair of lower and upper nip wheels 702 and 704, respectively.

The left hand outlet of the tee 1250 fixedly incorporates a diverter extension tube 1252 that passes upwardly and then toward the diverter assembly 983. As can be seen in FIG. 40, the diverter extension tube 1252 subsequently extends laterally to enter the diverter assembly 983 from the left hand side, then turns toward the vertex thereof to be fixedly mounted in an anchor block 1254 that is in turn fixedly attached to the underside of the upper triangular plate 1153. The diverter plate tube 989 is threadably affixed in the input end of the anchor block 1254 and is directed outwardly from the vertex of the diverter assembly 983 toward the leading edge 115 and the carier top panel 118 of the bottle carrier 106 as it is being ejected from the lower and upper pairs of nip wheels 702 and 706, respectively.

The switch valve 1236 is an either/or switch, that is, either air is being delivered to the output elbow 1235 (FIG. 35), or the tube attachment block 1247. In other terms, air is subsequently supplied to either the vertical nozzle 990, or both the overhead tube 987 and the diverter plate tube 989. As the bottle carrier 106 is delivered to the surge hopper 20, the reject cylinder 1002 is in its withdrawn position, which also places the reject roller 982 in its down position, and places the switch lever 1243 of the switch valve 1236 in such position as to deliver air to the tube attachment block 1247 and finally to the diverter plate tube 989 and the overhead tube 987. As the reject cycle is activated, the reject cylinder 1002 extends, placing the reject roller 982 and the switch lever 1243 in their up positions causing the switch valve 1236 to deliver air to the output elbow 1235 thereof, and subsequently to the vertical nozzle 990 to aid in pushing the bottle carrier 106 up and over the diverter assembly 983. Dry non-lubricated air is supplied to the switch valve 1236 through an input air line 1255 that rises vertically and enters the input side of the switch valve 1236 through a tube elbow 1256 and an inlet nipple 1257.

The limit switches that control the surge hopper 20 and the discard assembly 984 are shown in detail in FIGS. 33, 37, 39 and 43. Their functions have been previously described and only their mechanical makeup will be considered at this point. The actuation arm 978 (FIGS. 37 and 39) is pivotally attached at its upper end to the left side of an arm mount 1258 that is in turn rigidly affixed to the upper right hand side of a switch slide mount 1260. The switch slide mount 1260 is a built up piece of boxlike cross section that fits closely around the surge hopper accessory rail 1040 and provides a measure of lateral adjustment to the limit switch LS-9. The switch mount 1260 is held in fixed place by a switch lock handle 1262 whose shank is threaded through the output wall of the switch slide mount 1260 to forcefully bear against the output face of the surge hopper accessory rail 1040. The actuation arm 978 (FIG. 37) works against a limit switch roller 1264 that is rotatably mounted upon the left side of a switch trigger 1265 of the limit switch LS-9. The limit switch LS-9 is adjustably and fixedly attached to the right hand side of a lower horizontal leg of a switch hanger 1266. The vertical leg of the switch hanger 1266 is rigidly hung from the lower left hand side of the switch slide mount 1260. The limit switch LS-9, as previously described, is a double pole switch.

Referring now to FIGS. 40 and 43, the actuation shoe 980 of the limit switch LS-20 is fixedly attached to a shoe mount 1270 through the inter spacing auspices of a shoe spacer 1268. The shoe mount 1270 is rigidly affixed to the input side of a mount collar 1272 and is positioned to point somewhat downwardly and is also formed so as to hold the actuation shoe 980 in parallel alignment along the right side of the diverter assembly 983. The mount collar 1272 is pivotally mounted upon the right extremity of the diverter pivot shaft 1156 and is attached in a generally horizontal operator mount 1274. A switch operator plate 1275 is fixedly attached in a cantilever manner to the top surface of the operator plate 1274 and extends in the output direction. The output end of the switch operator plate 1275 is counterbalanced by a leaf spring 1276 that is fixedly attached in a diagonal position across the top of the limit switch LS-20. The output end of the switch operator plate 1275 also rides upon a switch wheel 1278 that is in turn rotatably mounted upon the left input side of a short switch trigger 1279. The short switch trigger 1279 activates the limit switch LS-20. The limit switch LS-20 is fixedly attached upon the top surface of a switch mount plate 1280 that is in turn rigidly affixed in a cantilever manner from the top output surface of a lateral switch mount 1282. The right extremity of the lateral switch mount 1282 is rigidly affixed to the inboard surface of the right side accessory mount 1042 (indicated in phantom lines in FIG. 43). The lateral switch mount 1282 is adjacent to and in parallel alignment with the surge hopper accessory rail 1040. As the actuation shoe 980 is forced upwardly, the switch operator plate 1275 swings downwardly against the leaf spring 1276 and causes the short switch trigger 1279 to swing to actuate the limit switch LS-20.

The limit switch LS-21 and its mechanical arrangement is shown in FIGS. 17, 18 and 33. The sensing arm 991 is pivotally attached upon the head of the limit switch LS-21, which is in turn fixedly attached upon the upper surface of a slanted plate 1284. The slanted plate 1284 is rigidly affixed to the chamfered end of a horizontal mount arm 1285. The horizontal mount arm 1285 overhangs the nip wheel section, as is shown in FIGS. 17 and 18. The input end of the horizontal mount arm 1285 is rigidly affixed in a cantilever manner to the top of the accessory bridge plate 689 through the interspacing auspices of a spacer block 1286. The horizontal mount arm 1285 is positioned upon the accessory bridge plate 689 slightly to the left of and parallel to the pair of roller hangers 694 of the upper secondary compression belt 528U.

CARRIER PACKING ASSEMBLY

Figure 44:
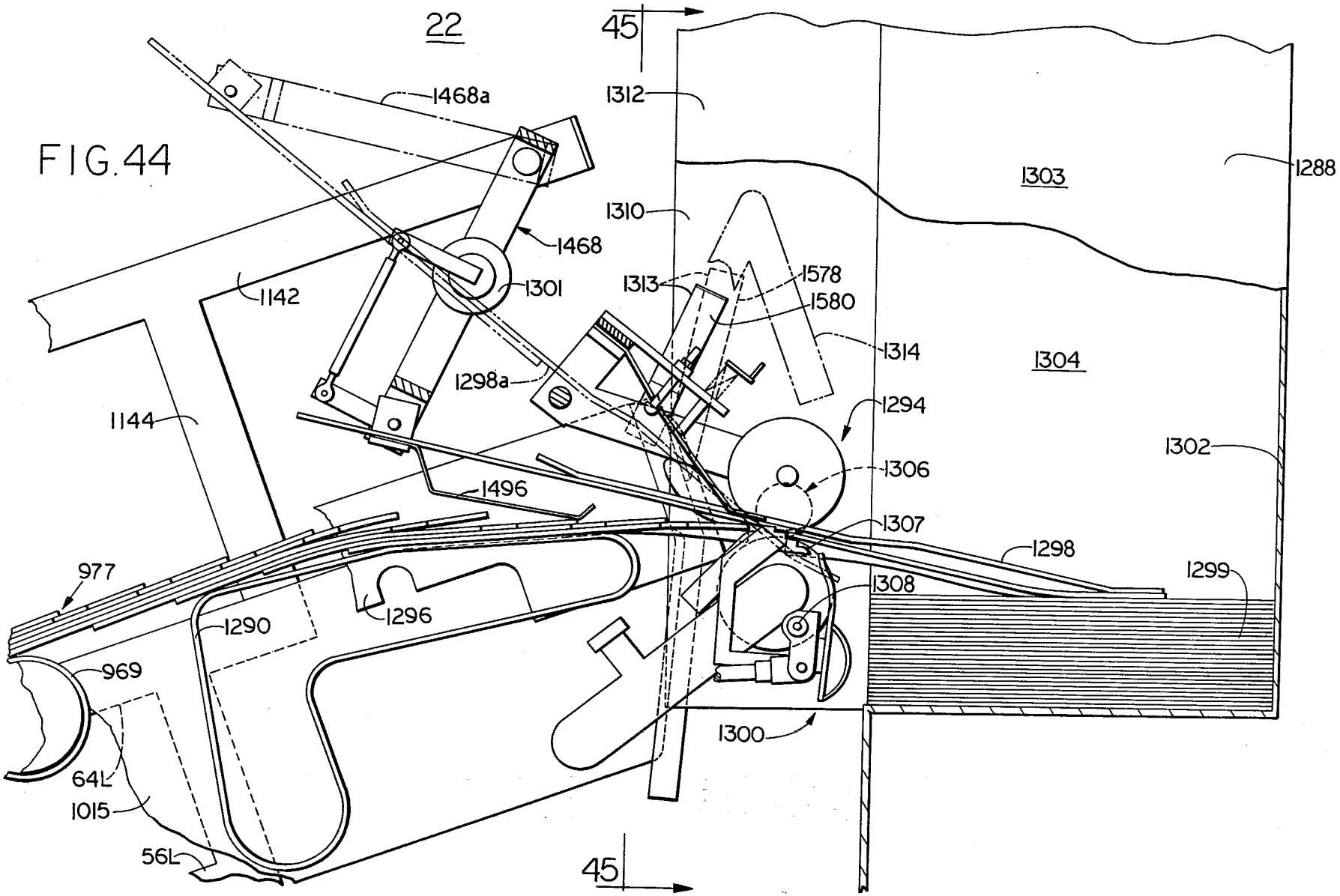
FIG. 44 is a schematic view in side elevation of a bottle carrier packing assembly of the bottle carrier checker/packer machine.

After inspection and acceptance, the bottle carriers 106 are delivered into the surge hopper 20, which is the first step in the packing process. The input of bottle carriers 106 to the surge hopper 20 is substantiallly steady and continuous, whereas the surge hopper output stream of carriers 977 is intermittent, but high output. The bottle carriers 106 are injected at this high speed into a case 1288 of corrugated fiberboard construction, as shown in FIG. 44. As one case 1288 is filled, a finite amount of time is necessary to remove the case 1288 and insert another one, at which time there is no flow of bottle carriers 106 from the surge hopper 20. The purpose then of the surge hopper 20 is to provide a variable reservoir of bottle carriers 106 to permit substantially continuous flow of bottle carriers through the inspection section 18 while supplying the carrier packing assembly 22 with an intermittent and high speed stream. During the high speed packing phase, the stack of carriers 973 of the surge hopper 20 will diminish, and then rebuild while the full case 1288 is being removed and an empty one inserted.

The surge hopper output stream of cariers 977 in shingle formation (FIG. 32) enters the carrier packing assembly 22 upon a packing belt 1290 as can be seen in FIG. 44. The packing belt 1290 moves in a clockwise cycle, transporting the shingled stream of bottle carriers toward a nip wheel assembly 1294. It can be seen in FIGS. 45 and 48 that the shingled stream of bottle carriers is held in lateral alignment by a right hand carrier guide 1295 and a left hand carrier guide 1296. As the shingled stream of bottle carriers passes through the nip wheel assembly 1294, it is forcefully inserted into the case 1288. The peripheral speed of the wheels of the nip wheel assembly 1294 is slightly higher than the surface speed of the packing belt 1290, but not high enough to unshingle the shingled stream of bottle carriers 1292. The bottle carriers 106 are not permitted to slow down in a manner to increase their shingle to prevent binding between cartons. The additional velocity derived from the nip wheel assembly 1294 helps the individual bottle carriers 106 to overcome the frictional effects being applied by a hold down tongue 1298 (FIGS. 44 and 45) and possible contact with either side of the case 1288. As a case stack of carriers 1299 increases within the case 1288, three operations are performed on the stack to insure a successful pack.

First, a pack patter 1300 (FIG. 44) continuously nudges the individual bottle carriers of the case stack of carriers 1299 into physical contact with a case bottom 1302 of the case 1288.

Figure 45:
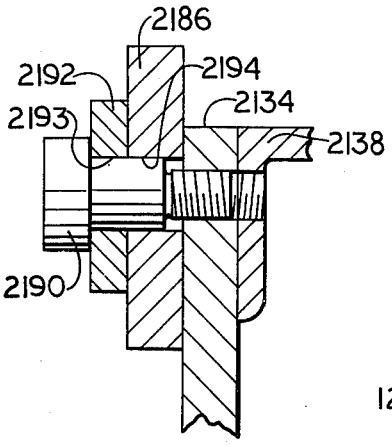
FIG. 45 is an end elevational view of a corrugated case during the packing operation looking in the direction of arrows 45—45 in FIG. 44, portions of a packing elevator utilized in transporting the corrugated case past the packing assembly being shown in association therewith.

Secondly, as the case stack of carriers 1299 increases, it tends to fall over due to a differential thickness between the bottle carrier handle 108 and the carrier bottom 112 which is thinner. This effect is indicated in FIG. 45 by the partial stack of carriers shown in double dot and dash lines. The case stack of carriers 1299 will not fall over per se, since the cases are laterally restrained within a case right side 1303 and a case left side 1304 of the case 1288. Nevertheless, the case stack of carriers 1299 will rise unevenly, causing the bottle carrier handle 108 side to be considerably higher than the carrier bottom 112. Eventually this unevenness would become so extreme that the top bottle carrier 106 of the case stack of carriers 1299 would slide off the stack and down between the stack and the case left side 1304. Other carriers would follow, resulting in lateral deformation of the case left side 1304 and failure of the pack cycle. To prevent this, the hold down tongue 1298 exerts a vertically downward pressure upon the bottle carrier handle 108 of the case stack of carriers 1299. The hold down tongue 1298 is a dual function device, also incorporating a microtorque or modulating valve 1301 (FIG. 44) that controls the rate of descent of the case 1288, thus keeping the top of the case stack of carriers 1299 in line with the nip wheel assembly 1294. The carrier bottom 112 of each bottle carrier 106 is bent downwardly by a carrier bottom bender 1306 that in its cumulative effect tends to compensate for the unevenness caused by the differential thickness previously described. The carrier bottom bender 1306 is mounted upon the left hand surface of the nip wheel assembly 1294 and will be discussed in greater detail hereinafter.

And thirdly, as the microtorque valve 1301 indexes the case 1288 downward, a count switch 1309 (FIGS. 49, 49A and 49B) counts the cartons and a circuit controlled thereby, to be described hereinafter, is preset to determine the exact number of bottle carriers 106 that will fit in the case 1288. The last two or three bottle carriers 106 entering a particular case 1288 (FIG. 44) come under additional friction when entering the case 1288 and consequently can remain extended therefrom due to the tight fit. A nudger assembly 1307, a stepped pusher, is cycled once, pivoting about a nudger pivot 1308 that swings the assembly forwardly and downwardly. In so doing the nudger assembly 1307 catches the trailing edges 117 of the extended bottle carriers 106 on successive steps of the nudger to forcefully push them into the case 1288 in a flush alignment with the rest of the case stack of carriers 1299, thus completing a successful pack.

Figure 48:
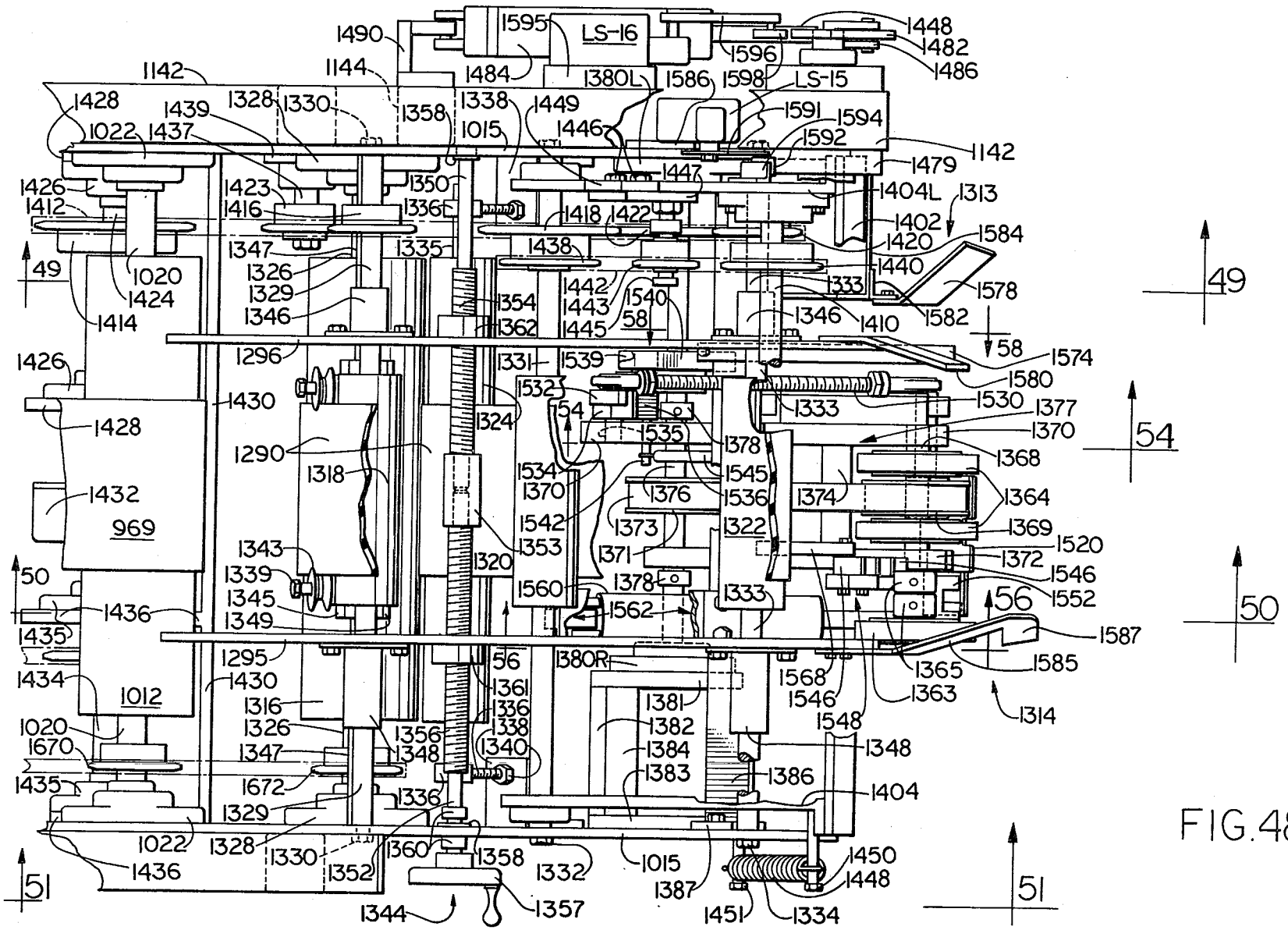
FIG. 48 is a plan view of the packing assembly shown in schematic form in FIG. 44, parts being cut away to expose assemblies in the lower portion of the assembly.
Figure 49:
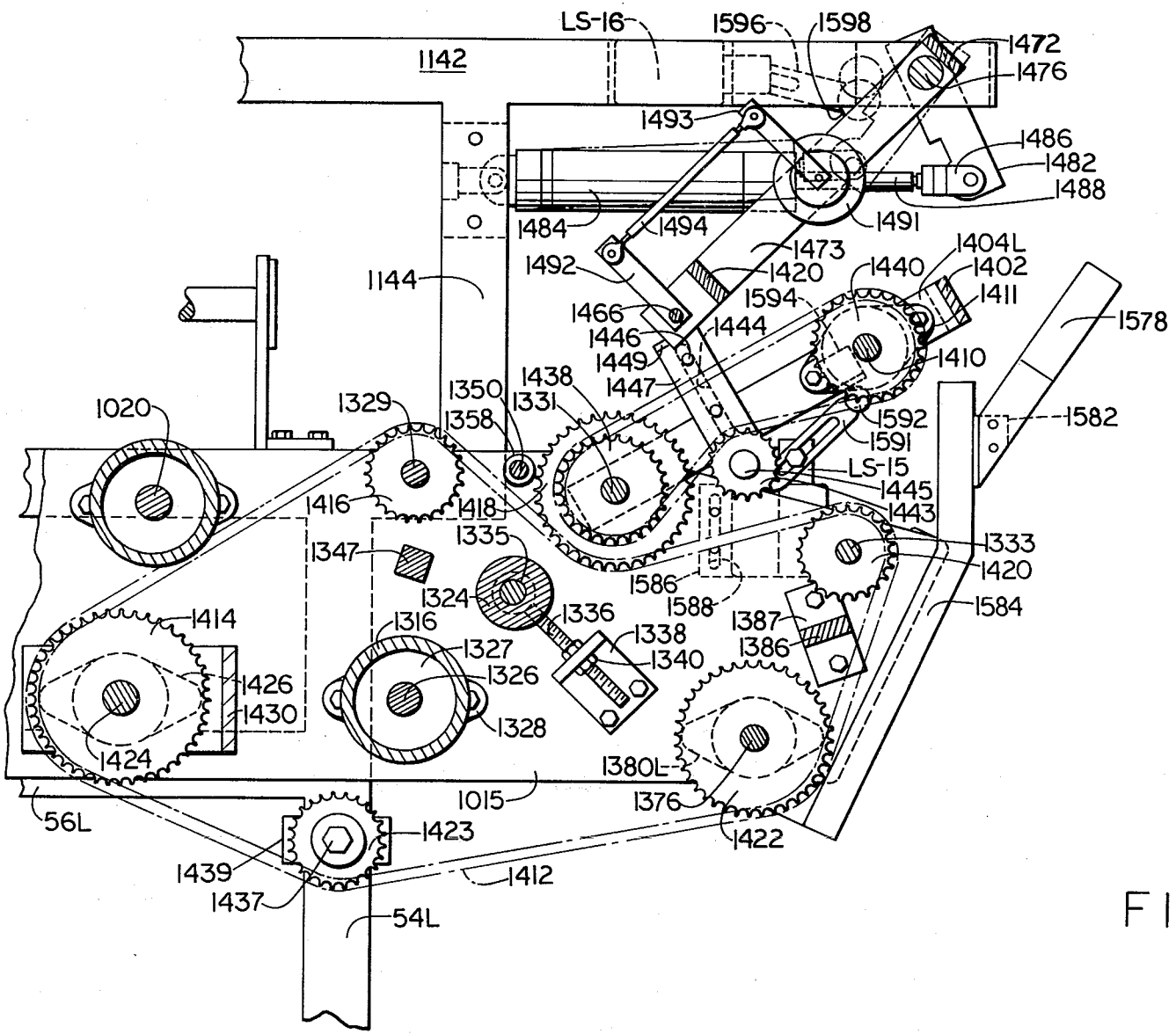
FIG. 49 is a view in section of the packing assembly taken on the line 49—49 in FIG. 48.

Shortly before the predetermined number of bottle carriers 106 have arrived at the case 1288, a limit switch LS-1A (FIG. 70), to be discussed hereinafter with respect to the case handling assembly 14, is operated by the downward movement of the case 1288, and makes the appropriate circuit which permits the machine to utilize a "pack on count cycle". The count switch is thereby preset, and when the predetermined count is reached, the packing belt 1290 (FIG. 44) is stopped abruptly by means of a brake. The circuitry provides a small time delay to permit the last few bottle carriers 106 to clear the nip wheel assembly 1294, which continues to run, then simultaneously activates the nudger assembly 1307 and retracts the hold down tongue 1298 to a retracted position 1298*a* as shown in FIG. 44. The nudger assembly 1307 cycles faster than the hold down tongue 1298 can retract, so that when a limit switch LS-16, as shown in FIGS. 48 and 49, is actuated by the structure of the hold down tongue 1298, everything is clear of the case 1288. The limit switch LS-16 then makes the appropriate circuit which lowers the case 1288 in the preparation for leaving the bottle carrier checker/packer 10. If the counter malfunctions, providing a pack signal before the limit switch LS-1A is reached, the count signal is ignored, the case 1288 will continue to fill and will enter the pack cycle when a limit switch LS-1 (FIG. 70) is activated by the descending case 1288. The limit switch LS-1 is located just below the limit switch LS-1A on the lower portion of the elevator incline 36. The limit switch LS-1 will also be discussed hereinafter since it is a part of the case handling assembly 14. If the counter malfunctions, by giving a pack signal after the limit switch LS-1 has been reached, then the limit switch LS-1 will have preempted the count switch and started the pack cycle, thereby preventing an overfill of the case 1288. The limit switch LS-1 also can reset the counter in preparation for another cycle.

As the case 1288 descends into physical proximity of the carrier packing assembly 22, a left side flap 1310 (FIG. 45) of the case left side 1304 is guided down past the nip wheel assemby 1294 and associated assemblies by a left side guide assembly 1313. Similarly, a right side flap 1312 of the case right side 1303 is guided downwardly and around the nip wheel assembly 1294 by a right side flap guide 1314 shown in FIG. 45, and in FIG. 44 in double dot dash lines to indicate a phantom showing and that the piece is located to the right of the plane of the FIG. 44.

A mechanical description of the carrier packing assembly 22 follows. The packing belt 1290 and its associated structure is shown specifically in FIGS. 48, 49 and 50. The packing belt 1290 is mounted and made mobile in the clockwise direction upon a pack conveyor drive roller 1316 (FIG. 50), an input pack conveyor roller 1318, a middle pack conveyor roller 1320, an output pack conveyor roller 1322, and a pack conveyor idler 1324. The pack conveyor drive roller 1316 is a hollow drum and is rigidly affixed upon a pack conveyor drive shaft 1326 by a pair of end plates 1327 that is rigidly affixed in the ends thereof. The pack conveyor drive shaft 1326 is rotatably mounted in a pair of conveyor bearings 1328 that is in turn fixedly attached to the inboard surfaces of the pair of pack assembly side plates 1015. The pair of conveyor bearings 1328 is located just above and to the output side of the intersection of the pair of short stringers 56 and 56L and the pair of output posts 54 and 54L.

The input pack conveyor roller 1318 is rotatably mounted upon a conveyor input shaft 1329 by integral bearings, not shown. The conveyor input shaft 1329 is fixedly attached at each end, and in a perpendicular disposition to the inboard surfaces of the pair of pack assembly side plates 1015, by a pair of input shaft cap screws 1330 (FIG. 48). The conveyor input shaft 1329 is located above the pack conveyor drive shaft 1326 and at the top of the pair of pack assembly side plates 1015.

The middle pack conveyor roller 1320 (FIG. 50) is rotatably mounted upon a conveyor middle shaft 1331 by integral bearings, not shown. The conveyor middle shaft 1331 is fixedly attached at each end to the inboard surfaces of, and at the top of, the pair of pack assembly side plates 1015 by a pair of middle shaft cap screws 1332 (FIG. 48). It is also located to the output side of the conveyor input shaft 1329.

The output pack conveyor roller 1322 (FIG. 50) is likewise rotatably mounted upon a conveyor output shaft 1333 by integral bearings, not shown. The conveyor output shaft 1333 is fixedly attached at both ends to the inboard surfaces of, and near the top output end of, the pair of pack assembly side plates 1015 by a pair of output shaft cap screws 1334. The pairs of input shaft, middle shaft and output shaft cap screws, 1330, 1332 and 1334 respectively, pass through clear holes in the pair of pack assembly side plates 1015 and threadably mount within the ends of the hollow conveyor input, middle and output shafts 1329, 1331 and 1333, respectively.

The pack conveyor idler 1324 is also rotatably mounted upon a conveyor idler shaft 1335 by integral bearings, not shown. The conveyor idler shaft 1335 is laterally disposed within the carrier packing assembly 22, between the pack conveyor drive shaft 1326 and the conveyor middle shaft 1331. Each end of the conveyor idler shaft 1335 is fixedly held within the eye of a pair of pack conveyor eyebolts 1336. The threaded shank of each of the pair of pack conveyor eyebolts 1336 passes through a clear hole in a laterally extending flange of one of a pair of eyebolt angle mounts 1338 (FIGS. 48 and 49). The threaded shank of the pair of pack conveyor eyebolts 1336 is fixedly and axially adjustable within the clear hole by a pair of lock nuts 1340. The pair of eyebolt angle mounts 1338 is fixedly attached upon the inboard surface of the pair of pack assembly side plates 1015 and approximate to the output side of the pack conveyor drive shaft 1326. The pair of eyebolt angle mounts 1338 is positioned at approximately a 45° angle to the vertical, so as the pair of locknuts 1340 is adjusted, the pack conveyor idler is moved angularly upward in opposition against the outside surface of the packing belt 1290 to bring tension therein.

The packing belt 1290 moves in a clockwise direction (FIG. 50) about the pack conveyor drive roller 1316, then upwardly to pass over the input, middle and output pack conveyor rollers 1318, 1320 and 1322, respectively. The packing belt 1290 reverses its direction in passing around the output pack conveyor roller 1322 and extends horizontally in the input direction to pass over and downwardly about the pack conveyor idler 1324 before returning to the output side of the pack conveyor drive roller 1316.

Figure 50:
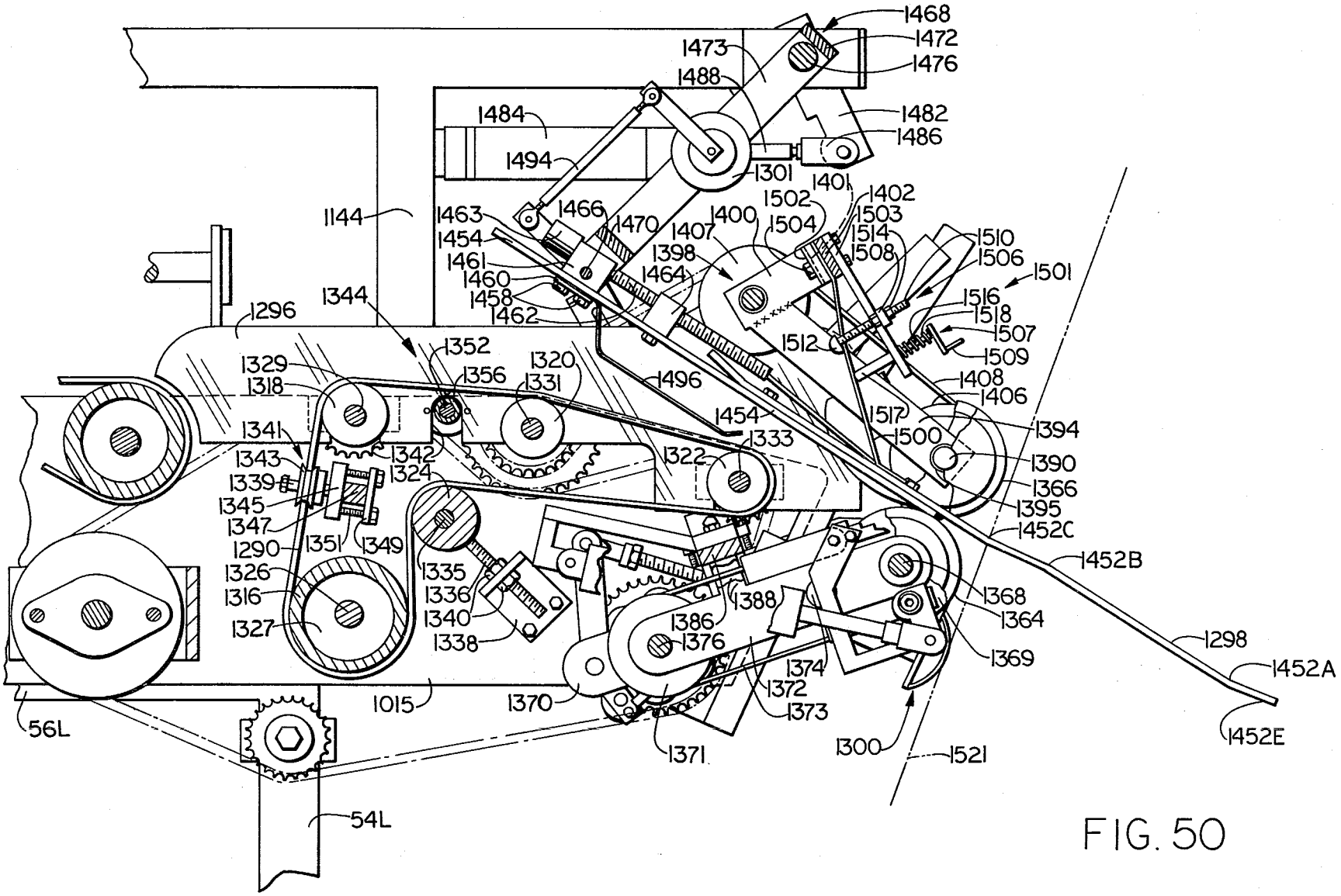
FIG. 50 is a view in section of the packing assembly taken on the line 50—50 in FIG. 48.
Figure 51:
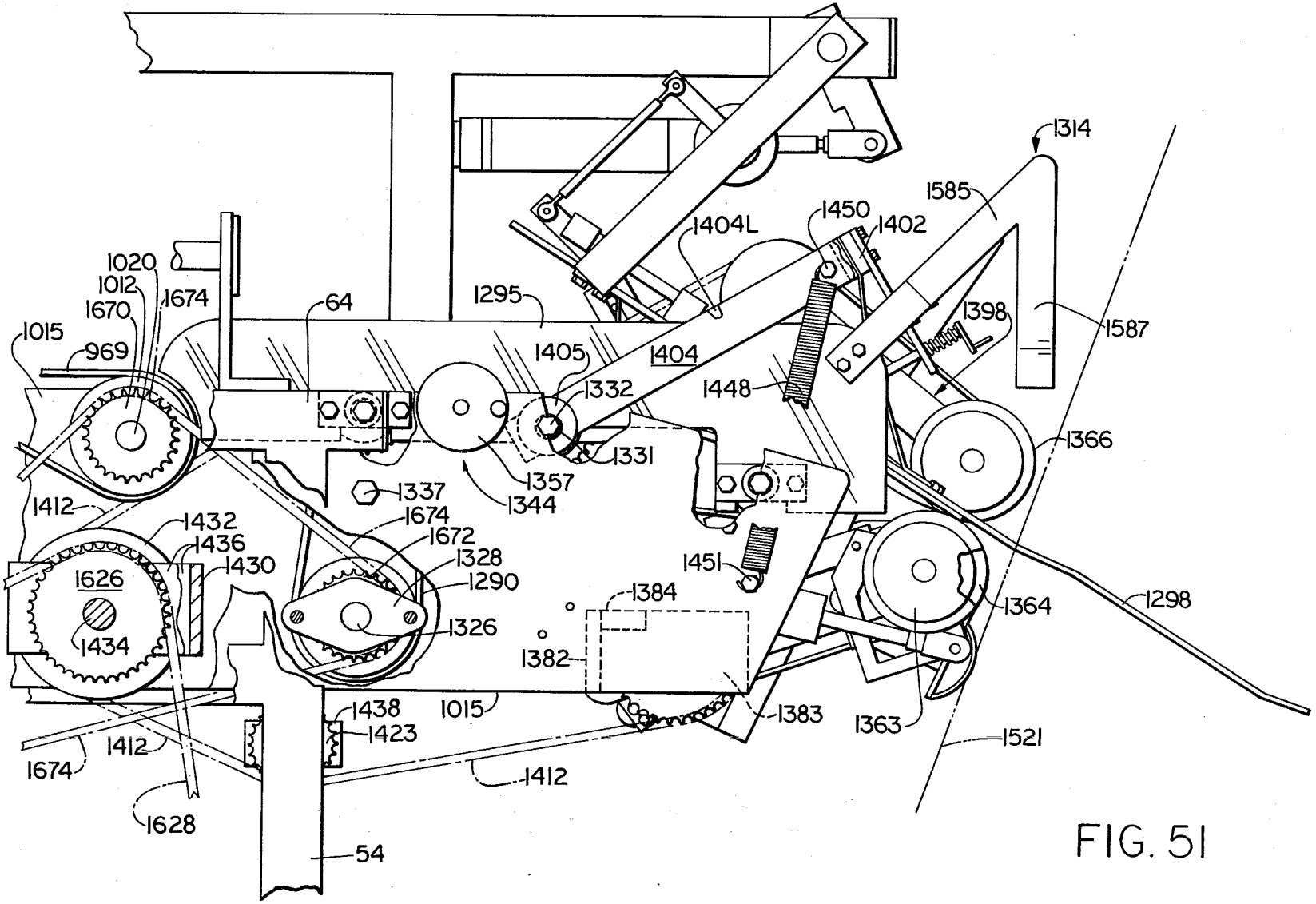
FIG. 51 is a side elevational view of the packing assembly looking in the direction of the arrows 51—51 in FIG. 48, parts being cut away to expose machinery otherwise not visible in the views.

The packing belt 1290 is maintained in lateral placement by a lateral guide assembly 1341, as shown in FIGS. 48, 49, 50 and 51. The lateral guide assembly 1341 is located between the pack conveyor drive roller 1316 and the input pack conveyor roller 1318, as is best seen in FIG. 50. The lateral guide assembly 1341 is comprised of a pair of side guide rollers 1343, a pair of guide roller mounts 1345 and a lateral guide mount bar 1347. Each one of the pair of guide rollers 1343 is rotatably mounted upon a guide spindle 1339 that is in turn fixedly attached in a perpendicular orientation in the input face of one of the pair of guide roller mounts 1345. Each one of the pair of guide roller mounts 1345 is fixedly clamped to the input face of the lateral guide mount bar 1347 by a back plate 1349 and a pair of spanner bolts 1351 that passes through clear holes in the back plate 1349 and threadably mount in the overhanging portions of each one of the pair of guide roller mounts 1345. The lateral guide mount bar 1347 is fixedly attached at each end to the inboard surfaces of the pair of pack assembly side plates 1015 by a pair of cap screws 1337 that passes through clear holes therein and threadably mount in the ends of the latter guide mount 1347, as can be seen in FIG. 51. In this manner the pair of guide rollers 1343 can be adjusted angularly to coincide with the edges of the packing belt 1290 as it rises from the pack conveyor drive roller 1316 to the input pack conveyor roller 1318, as well as laterally upon the lateral guide mount bar 1347 to permit installation and proper alignment of the packing belt 1290.

As the shingled stream of bottle carriers 977 passes through the carrier packing assembly 22 upon the packing belt 1290, it is held in lateral alignment by the left hand carrier guide 1296 and the right hand carrier guide 1295. Referring to FIGS. 48 and 50, the left hand carrier guide 1296 is a flat plate and irregularly shaped to conform to the upper profile of the packing belt 1290. The left hand carrier guide 1296 also incorporates along its bottom edge a series of cutouts 1342 that permit lateral passage of the conveyor input, middle and output shafts 1329, 1331 and 1333, respectively, and also a lateral adjustment assembly 1344. The left hand carrier guide 1296 is fixedly attached to a pair of slide mounts 1346 that is concentrically aligned with the end cutouts of the series of cutouts 1342. The pair of slide mounts 1346 is slidably mounted upon the left hand side of the conveyor input and output shafts 1329 and 1333, respectively.

The right hand carrier guide 1295, shown in FIGS. 48 and 51, is of generally similar in shape to the left hand carrier guide 1296 and is fixedly attached to a pair of right hand slide mounts 1348. The pair of right hand slide mounts 1348 is slidably mounted upon the right hand side of the conveyor input and output shafts 1329 and 1333, respectively.

The left and right hand carrier guides 1296 and 1295, respectively, are laterally and symmetrically adjustable with respect to the carrier packing assembly 22 by the lateral adjusting assembly 1344 as is shown in FIGS. 48 and 50. The lateral adjusting assembly 1344 comprises a left hand crankshaft 1350 and a right hand crankshaft 1352, a shaft coupler 1353, a left hand thread hollow shaft 1354, a right hand thread hollow shaft 1356, and a packer guide crank handle 1357. The left hand thread hollow shaft 1354 is rigidly and coaxially affixed about the left hand crank shaft 1350 in such a lateral position as to have a shoft length of the left hand crankshaft 1350 protruding from the right hand extremity of the left hand thread hollow shaft 1354. Similarly, the right hand thread hollow shaft is rigidly and coaxially affixed upon the right hand crankshaft 1352 in such a lateral position as to leave a short length of the right hand crankshaft 1352 protruding from the left hand extremity of the right hand thread hollow shaft 1356. Consequently, the protruding ends of the left and right hand crankshafts 1350 and 1352, respectively, are fixedly attached end to end by the shaft coupler 1353 to form one continuous and rigid shaft that spans the carrier packing assembly 22. This combined shaft is rotatably held through the pair of pack assembly side plates 1015 by a pair of bushings 1358, that is in turn fixedly pressed into holes provided near the top of the pair of pack assembly side plates 1015. The combined shaft is laterally restrained in the pair of bushings 1358 by a pair of locking collars 1360 that is installed upon the right hand crankshaft 1352 on both sides of the right hand member of the pair of pack assembly side plates 1015. The packer guide crank handle 1357 is fixedly attached to the right hand extremity of the right hand crankshaft 1352.

The right hand carrier guide 1295 is connected to the right hand thread hollow shaft 1356 by a right hand thread collar 1361 and the left hand carrier guide 1296 is connected to the left hand thread hollow shaft 1354 by a left hand thread collar 1362. Therefore, as the packer guide crank handle 1357 is manually turned clockwise with respect to FIG. 51, the left and right hand carrier guides 1296 and 1295, respectively, will move away from each other, increasing the distance between themselves, in accommodation of a larger bottler carrier 106. Counterclockwise rotation will adjust the carrier guides inwardly to accommodate smaller cartons.

The nip wheel assembly 1294 is comprised of a pair of bottom pack nip wheels 1364 and a pair of top pack nip wheels 1366, as can be seen most easily in FIGS. 48 and 50. The pair of bottom pack nip wheels 1364 is fixedly attached upon a lower nip shaft 1368 that is in turn rotatably mounted in bearings (not shown) in the output ends of a left side nip beam 1370 and a right side nip beam 1372. The right extremity of the lower nip shaft 1368 extends to the right of the right side nip beam 1372 to fixedly incorporate an auxiliary nip wheel 1363 to assure vertical support for large bottle carriers 106. The auxiliary nip wheel 1363 is spacedly mounted from the right side nip beam 1372 with the aid of a pair of shaft collars 1365. The left and right side nip beams 1370 and 1372, respectively, are held in lateral and parallel spaced relationship by a transverse beam 1374 that is rigidly affixed therebetween. The input ends of the left and right side nip beams 1370 and 1372, respectively, are pivotally mounted upon a lower nip mount shaft 1376 by a pair of bearings not shown. The left and right side nip beams 1370 and 1372, respectively, and the transverse beam 1374 comprise a lower nip frame 1377 that is held in lateral place upon the rotating lower nip mount shaft 1376 by a pair of lock collars 1378. The pair of lock collars 1378 is fixedly attached to the lower nip mount shaft 1376 on each side of lower nip frame 1377.

The lower nip mount shaft 1376 is rotatably mounted in a pair of pack nip bearings 1380R and 1380L. The left hand pack nip bearing 1380L is fixedly attached to the inboard surface of, and at the lower output corner of, the left hand member of the pair of pack assembly side plates 1015, as can be seen in FIG. 49. The right hand pack nip bearing 1380R is fixedly attached to the inboard surface of a standoff bearing mount 1381 (FIGS. 48 and 51) that is in turn rigidly affixed to the left end of a standoff plate 1382. The standoff plate 1382 is rigidly attached at the input end of, and upon the inboard surface, of a standoff mount 1383 that is in turn fixedly attached to the inboard surface of, and at the lower output corner of, the right hand member of the pair of pack assembly side plates 1015. The standoff bearing mount 1381, the standoff plate 1382, and the standoff mount 1383 form a U-shaped bracket with its open end toward the output end of the carrier packing assembly 22. A partial web plate 1384 is rigidly affixed within the bottom of the "U", but at the top of the mounting assembly for additional strength. This mounting arrangement permits the right side flap 1312 of the case 1288 to freely pass during the pack cycle.

The lower nip frame 1377 is fixedly held in angular relationship to the carrier packing assembly 22 by a lower nip stabilizer bar 1386 (FIGS. 49 and 50). The lower nip stabilizer bar 1386 incorporates a pair of mounting pads 1387 rigidly affixed to the ends thereof, the pair of mounting pads 1387 being fixedly attached to the inboard surfaces of, and near the output ends of, the pair of pack assembly side plates 1015. A pair of lower nip frame hangers 1388 (FIG. 50) is rigidly and centrally affixed to the underside of the lower nip stabilizer bar 1386. The pair of lower nip frame hangers 1388 is also rigidly affixed in an integral manner to the top edge of the left side nip beam 1370 and the right side nip beam 1372, suspending the lower nip frame 1377 in an inclined orientation in the output direction, as previously indicated.

A bottom nip timing sheave 1369 is fixedly attached to the lower nip shaft 1368 between the pair of bottom pack nip wheels 1364. Power is transferred to the bottom nip timing sheave 1369 from a bottom transfer sheave 1371 by a lower nip belt 1373. The bottom transfer sheave 1371 is fixedly attached upon, and in the center of, the lower nip mount shaft 1376.

Figure 52:
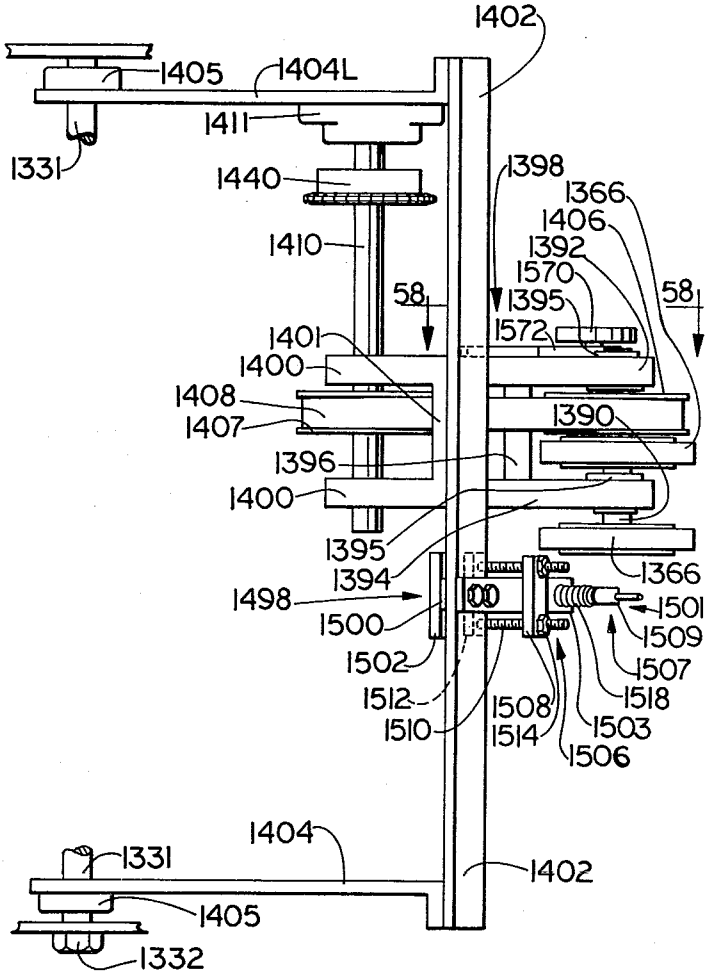
FIG. 52 is a fragmentary plan view of an upper nip roll assembly of the machine.

The pair of top pack nip wheels 1366 and its supporting structure are shown in FIGS. 50 and 52. The pair of top pack nip wheels 1366 is fixedly attached to a top nip shaft 1390 that is in turn rotatably mounted in the output ends of a left hand nip beam 1392 and a right hand nip beam 1394 by a pair of top nip shaft bearings 1395. The left and right hand nip beams 1392 and 1394, respectively, are held in rigid parallel and lateral spaced relationship by a top lateral brace 1396 to form a top nip frame 1398. The top nip shaft 1390 is rotatably mounted in the pair of top nip shaft bearings 1395 in such manner that it extends from the right hand side thereof, to incorporate the right hand member of the pair of top pack nip wheels 1366. The left hand member of the pair of top pack nip wheels 1366 is mounted along the left hand side of the right hand nip beam 1394 of the top nip frame 1398. The orientation upon the top nip shaft 1390 brings the pair of top pack nip wheels 1366 in vertical alignment with the pair of bottom pack nip wheels 1364.

The top nip frame 1398 also comprises a pair of hanger mounts 1400 that is rigidly affixed to the input ends thereof, as is shown in FIG. 50. The upper ends of the pair of hanger mounts 1400 are held in lateral spaced relationship by a spacer mount 1401 that is rigidly affixed therebetween. The top nip frame 1398 is fixedly attached to the central input side of a top nip cross bar 1402, as is best shown in FIGS. 49, 51 and 52. The top nip cross bar 1402 is fixedly attached at its ends to the upper extremities of a pair of top nip radius arms 1404 and 1404L, which are in turn pivotally mounted upon the conveyor middle shaft 1331 by a pair of upper nip bearings 1405.

Fixedly attached to the top nip shaft 1390 is an upper timing belt sheave 1406 (FIGS. 50 and 52) that is located between the left hand nip beam 1392 and the left hand member of the pair of top pack nip wheels 1366. Power is transferred to the upper timing belt sheave 1406 from a transfer timing sheave 1407 by an upper timing belt 1408. The transfer timing sheave 1407 is fixedly attached to a short nip transfer shaft 1410 that is in turn rotatably held in a pair of bearings (not shown in detail) in the input end of the pair of hanger mounts 1400 of the top nip frame 1398, and a top nip transfer bearing 1411. The top nip transfer bearing 1411 is fixedly attached to the inboard surface of and at the upper end of the left hand top nip radius arm 1404L as is seen in FIG. 49.

Referring now to FIGS. 48 and 49, power is distributed to the pairs of top and bottom pack nip wheels 1366 and 1364, respectively, by a distribution chain 1412. The distribution chain 1412 is mounted and made mobile in the clockwise direction (with respect to FIG. 49), upon a distribution sprocket 1414, a conveyor input shaft sprocket 1416, a conveyor middle shaft sprocket 1418, a conveyor output shaft sprocket 1420, a lower nip mount shaft sprocket 1422, and a distribution idler sprocket 1423. The distribution sprocket 1414 is fixedly attached upon a left side pack clutch shaft 1424 that is in turn rotatably mounted within a pair of left side clutch bearings 1426, as can be seen in FIGS. 39, 48 and 49. The pair of left side clutch bearings 1426 is fixedly attached to the opposing surfaces of a pair of left side bearing mounts 1428 that is in turn rigidly affixed at its output edge, and in a cantilever manner, to the input face of a clutch mount beam 1430. The left member of the pair of left side bearing mounts 1428 is located at the left extremity of the clutch mount beam 1430 and also functions as a mounting plate for the clutch mount beam 1430. The right member of the pair of left side bearing mounts 1428 is located just left of center upon the clutch mount beam 1430. The right extremity of the left side pack clutch shaft 1424 is appropriately affixed within a pack clutch 1432. The right side of the pack clutch 1432 is appropriately affixed to the left extremity of a right side pack clutch shaft 1434 that is rotatably mounted in a pair of right side clutch bearings 1435. The pair of right side clutch bearings 1435 is fixedly mounted to the inboard surfaces of a pair of right side bearing mounts 1436 that is in turn rigidly affixed at its output edge, and in a cantilever manner, to the input face of the clutch mount beam 1430. The left member of the pair of right side bearing mounts 1436 is located just right of center of the carrier packing assembly 22 and adjacent to the pack clutch 1432. The right member of the pair of right side bearing mounts 1436 is located at the right extremity of the clutch mount beam 1430 and also functions as a mounting plate for the clutch mount beam 1430. The clutch mount beam 1430 is fixedly attached to the inboard surfaces of and at the bottom of the pair of pack assembly side plates 1015, and located underneath the surge output shaft 1020 of the surge hopper 20. Further explanation of the pack clutch 1432 will be included hereinafter.

The conveyor input shaft sprocket 1416 (FIGS. 48 and 49) is rotatably mounted upon the left side of the conveyor input shaft 1329, the conveyor middle shaft sprocket 1418 is rotatably mounted upon the left side of the conveyor middle shaft 1331, the conveyor output shaft sprocket 1420 is rotatably mounted upon the left side of the conveyor output shaft 1333, and the lower nip mount shaft sprocket 1422 is fixedly attached to the left side of the lower nip mount shaft 1376. The distribution chain 1412 passes clockwise (FIG. 49) about the distribution sprocket 1414, then upwardly and in the output direction to pass over the conveyor input shaft sprocket 1416, then under the conveyor middle shaft sprocket 1418. The distribution chain 1412 continues in the output direction to pass over the conveyor output shaft sprocket 1420, then downward to pass around and under the lower nip mount shaft sprocket 1422 (rotation is clockwise). The distribution chain 1412 returns to the distribution sprocket after passing under the distribution idler sprocket 1423. The distribution idler sprocket 1423 (FIG. 49) is rotatably mounted upon a short spindle 1437 that is in turn mounted in a perpendicular manner upon the inboard face of a distribution idler mount 1439. The distribution idler mount 1439 is rigidly affixed to the inboard surface of the left hand output post 54L, just below the intersection of the left hand short stringer 56L.

In this manner, the conveyor input and output shaft sprockets 1416 and 1420 perform as idlers only, while power is transferred from the distribution sprocket 1414 to the conveyor middle shaft sprocket 1418, and the lower nip mount shaft 1376 by the lower nip mount shaft sprocket 1422. Fixedly attached to the inboard face of the hub of the conveyor middle shaft sprocket 1418 is a top nip output sprocket 1438. Power is delivered from the top nip output sprocket 1438 to a top nip transfer sprocket 1440 by a top nip transfer chain 1442. A transfer idler 1443 bears against the underside of the lower half of the top nip transfer chain 1442, forcing it upward and developing the proper tension therein. The transfer idler 1443 is rotatably mounted upon a transfer idler spindle 1445 that is in turn rigidly affixed in a perpendicular disposition upon the inboard face of, and at the lower end of, a transfer idler slide 1447 (FIGS. 48 and 49). The transfer idler slide 1447 is fixedly and adjustably attached to the inboard side of a transfer idler mount 1449 that incorporates an elongated slot 1444 through which a pair of slide bolts 1446 clearly pass to be threadably mounted into the transfer idler slide 1447. The transfer idler mount 1449 is rigidly affixed along its bottom edge to the top edge of the left hand top nip radius arm 1404L, slightly to the output side of the conveyor middle shaft sprocket 1418, as is shown in FIG. 49. The top nip transfer sprocket 1440 is fixedly attached to the left side of the short nip transfer shaft 1410 delivering power thereto (FIG. 52). Consequently, power is transferred through the transfer timing sheave 1407, the upper timing belt 1408, the upper timing belt sheave 1406, the top nip shaft 1390, and to the pair of top pack nip wheels 1366. In similar manner, power is transferred through the lower nip mount shaft sprocket 1422 (FIGS. 48 and 49), the lower nip mount shaft 1376, the bottom transfer sheave 1371, the lower nip belt 1373, the bottom nip timing sheave 1369 and the lower nip shaft 1368, to the pair of bottom pack nip wheels 1364.

Referring now to FIG. 51, as the shingled stream of bottle carriers passes between the pairs of bottom and top pack nip wheels 1364 and 1366, respectively, the pair of top pack nip wheels 1366 is moved upwardly, pivoting the top nip frame 1398, the top nip cross bar 1402 and the pair of top nip radius arms 1404 and 1404L about the conveyor middle shaft 1331, to release excessive compressive forces thereupon. A pair of long springs 1448 restrains the pair of top nip radius arms 1404 and 1404L along with the top nip frame 1398 from excessive vertical movement. Each spring of the pair of long springs 1448 is stretched between an upper nip pin 1450 and an anchor bolt 1451. The upper nip pin 1450 is a shoulder bolt that is threadably mounted in the outboard side of, and at the upper end of, each member of the pair of top nip radius arms 1404 or 1404L. The anchor bolts 1451 are also threadably mounted in the outboard sides of, and at the output ends of, the pair of pack assembly side plates 1015.

The hold down tongue 1298 and its respective structure, to be herein described, is shown in FIGS. 44, 49, 50 and 53. The hold down tongue 1298 is a changeable part, each tongue cooperating with a particular size bottle carrier 106. The tongue 1298 is so shaped to bring a downward pressure upon the top of the case stack of carriers 1299 at a point not far removed from the case bottom 1302 as can be seen in FIG. 44. As shown in FIG. 45, the hold down tongue 1298 overlies the thickest portions of the bottle carriers to depress the bottle carriers at their thickest portions and to stabilize the stack 1299 as the stack is being formed. The hold down tongue 1298 exerts a significant hold down pressure on the stack. Referring to FIG. 50, a bend relief 1452A, 1452B and 1452C is provided along the extended portion of the tongue 1298 to insure that only the under surface of the turned up end 1452E is in contact with the top of the case stack of carriers 1299. This provides, upon retraction, that minimal friction forces are applied upon the case stack of carriers 1299 to prevent the dragging of several bottle carriers 106 back out of the case 1288.

Figure 53:
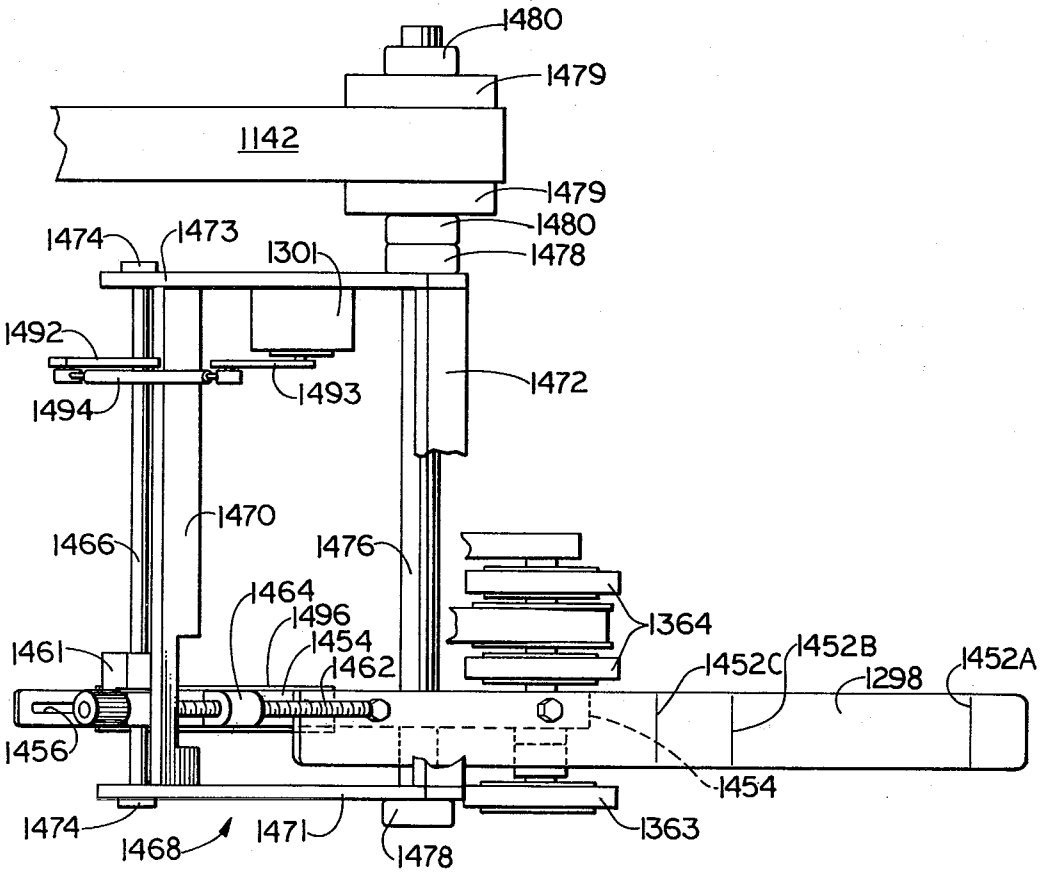
FIG. 53 is a fragmentary plan view of a modulating valve or microtorque assembly of the machine.

The hold down tongue 1298 (FIGS. 50 and 53) is fixedly attached to the top surface of, and extending from the input end of, a tongue mount 1454. As can be seen in FIG. 53, the input end of the tongue mount 1454 incorporates an adjustment slot 1456. A pair of clamping bolts 1458 (FIG. 50) passes through clear holes in a clamping plate 1460, then through the adjustment slot 1456, before threadably mounting into the lower surface of a tongue block 1461. The tongue block 1461 incorporates a clear longitudinal hole through which extends the stem of an adjustment knob 1463. A tongue adjustment screw 1462 is mounted on the end of the stem of the adjustment knob 1463, and is threadably mounted through a tongue lug 1464. The tongue lug 1464 is fixedly attached upon the top of the tongue mount 1454 so that when the adjustment knob 1463 is rotated, the tongue lug 1464, and consequently the hold down tongue 1298, is adjusted longitudinally, then locked into fixed position by the pair of clamping bolts 1458.

The tongue block 1461 is also fixedly attached to the right side of a torque rod 1466 that is in turn pivotally mounted in the lower end of a tongue retraction frame 1468. The tongue retraction frame 1468 is comprised of a bottom lateral brace 1470, a top lateral brace 1472, a right hand retraction arm 1471 and a left hand retraction arm 1473. The bottom lateral brace 1470 is rigidly affixed at each end near the lower extremities of the right and left hand retraction arms 1471 and 1473, respectively, and the top lateral brace 1472 is likewise rigidly affixed at both ends to the top extremities thereof to form the rigid and rectangular tongue retraction frame 1468.

The torque rod 1466 is pivotally mounted in sleeve bearings (not shown) carried in clear holes in the lower extremities of the right and left hand retraction arms 1471 and 1473, respectively. The torque rod 1466 is laterally held in place by a pair of torque shaft collars 1474 fixedly attached upon the ends thereof. The right and left hand retraction arms 1471 and 1473 also incorporate at their upper ends a pair of clear holes that permit fixedly mounting the torque retraction frame 1468 upon a retraction spindle 1476. The tongue retraction frame 1468 is held thereupon in proper lateral placement by a pair of spindle collars 1478. The left end of the retraction spindle 1476 is pivotally mounted through a pair of retraction spindle bushings 1479 that is in turn rigidly affixed to both sides of, and at the output end of, the diverter stringer 1142. The retraction spindle 1476 passes through a clear hole in the diverter stringer 1142 and is retained in proper lateral placement in the pair of retraction spindle bushings 1479 by a pair of spindle retainer collars 1480.

As can be seen by reference to FIG. 44, retraction of the hold down tongue 1298 to the retracted position shown at **1298*a* requires that the tongue retraction frame 1468 and the retraction spindle 1476 rotate almost ninety degrees to the position at which the tongue retraction frame is indicated at 1468*a*. This is accomplished by a retraction torque arm 1482 and a retraction cylinder 1484 that is shown in FIGS. 48 and 49. The retraction torque arm 1482 is fixedly attached upon the left end of the retraction spindle 1476, and the lower extremity thereof pivotally accepts a retraction cylinder clevis 1486. The retraction cylinder clevis 1486 is fixedly attached upon the end of a retraction cylinder rod 1488 that is fully extended, as is shown in solid line in FIG. 49. The retraction cylinder 1484 is pivotally mounted to a standoff retraction cylinder mount 1490 (FIG. 48), a U-shaped bracket, that is in turn fixedly attached to the outboard surface of, and near the top of, the discard riser 1144. As the retraction cylinder rod 1488 withdraws into the retraction cylinder 1484, the retraction torque arm 1482 assumes the position indicated in double dot and dash lines in FIG. 49, thus withdrawing the hold down tongue 1298 from the case 1288**.

The microtorque valve 1301 is fixedly attached to the inboard surface of the left hand retraction arm 1473, as is shown in FIGS. 49 and 53. Fixedly attached to the spindle of the microtorque valve 1301 is a microtorque arm 1493 that extends upwardly and transversely with respect to the left hand retraction arm 1473. Fixedly attached to the left hand side of the torque rod 1466 is a torque rod arm 1492 that is positioned upwardly, generally parallel to, and in longitudinal line with the microtorque arm 1493. Pivotally connecting the upper ends of the torque rod arm 1492 and the microtorque arm 1493 is a turnbuckle rod 1494 which allows for minor adjustments of the microtorque valve 1301. As the hold down tongue 1298 is forced upward by the growing case stack of carriers 1299, it rotates the torque rod 1466, which through the linkage just described, rotates the spindle of the microtorque valve 1301 counterclockwise with respect to FIG. 49, causing controlled lowering of the case 1288 to keep the top of the case stack of carriers 1299 in line with the nip wheel assembly 1294.

As the shingles stream of bottle carriers 977 moves through the carrier packing assembly 22 (see FIG. 44), it must negotiate a slight change in elevational angle as it passes over the middle pack conveyor roller 1320 of FIG. 50. The leading edges 115 of the bottle carriers 106 tend to "stand up", but are forced downward by a leaf spring 1496 that is mechanically shown in FIG. 50. The leaf spring 1496 is fixedly clamped under the clamping plate 1460 that secures the tongue mount 1454 to the tongue block 1461 that is mounted upon the tongue retraction frame 1468. Other leaf springs are used as necessary to hold the shingled stream of bottle carriers 1292 to their appropriate transport belts. Even in a nicely compressed shingle, the leading edges 115 of the bottle carriers 106 individually impact the bottom surface of the tonque mount 1454 as they pass from under the leaf spring 1496 to the nip wheel assembly 1294 and can cause the tonque mount 1454 to bounce. Any such bounce, particularly if resonant in nature, would interfere with the smooth operation of the microtorque valve 1301. To minimize such bounce, a hold down spring assembly 1498 is employed and is shown in FIGS. 50 and 52. The hold down spring assembly 1498 also serves to put pressure on the carton stack 1299 (FIG. 44) to stabilize the stack.

The hold down spring assembly 1498 (FIG. 50) is comprised of a tongue hold down spring 1500 and a pressure assembly 1501. The tongue hold down spring 1500 is fixedly clamped at its input end to the input surface of the top nip cross bar 1402 by an input clamp plate 1502 and bolt 1504. It is located upon the top nip cross bar 1402 to the right of the top nip frame 1398. The output end of the tongue hold down spring 1500 rests upon the top of the hold down tongue 1298.

Vertical pressure of the hold down tongue 1298 is governed by the pressure assembly 1501 that is comprised of an elevation yoke 1506 and an adjustment jack 1507. The elevation yoke 1506 incorporates an elevation yoke mount 1508 rigidly affixed across the top surface of a pressure assembly mount 1503. The pressure assembly mount 1503 is fixedly attached at its input end, and in a cantilever manner, to the top surface of the top nip cross bar 1402, and its lateral position thereupon is directly above the tongue hold down spring 1500. A pair of elevation screws 1510 is fixedly inserted into the ends of a spring bar 1512 that passes under the tongue hold down spring 1500. The pair of elevation screws 1510 stands upwardly and passes through clear holes in the ends of the elevation yoke mount 1508 and is adjustably held therein by a set of four nuts 1514. The vertical height of the end of the tongue hold down spring 1500 can be controlled by the elevation yoke 1506 since the hold down spring 1500 has a permanent set that would move it considerably downward if the elevation yoke 1506 did not hold it up. Appropriate end pressure is then achieved by turning an adjustment jack crank 1509 of the adjustment jack 1507 that rotates a jack screw 1516 to which it is fixedly attached. The jack screw 1516 is threadably mounted through the output end of the pressure assembly mount 1503 and fixedly incorporates a ram 1517 upon its lower end. The ram 1517 is rotated downward against the top of the tongue hold down spring 1500 and is held in set place by a jack spring 1518. The jack spring 1518 is compressively mounted between the pressure assembly mount 1503 and the adjustment jack crank 1509.

Figure 54:
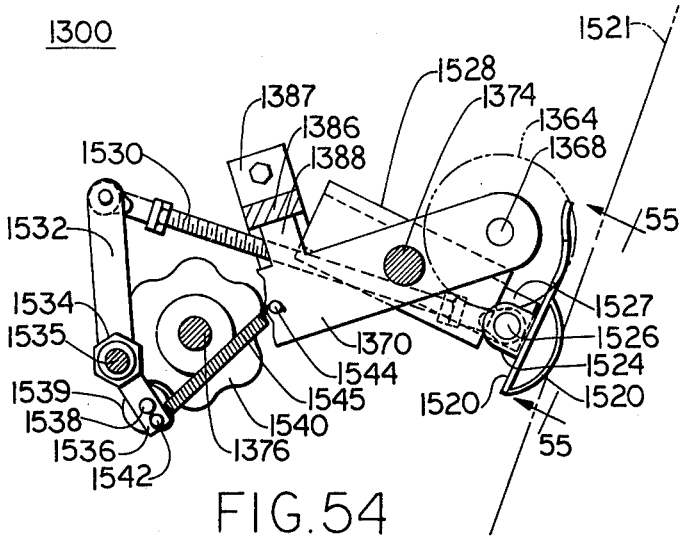
FIG. 54 is a fragmentary view in section of a pack patter assembly taken on the line 54—54 in FIG. 48, parts being cut away for exposition of the patter cam.
Figure 55:
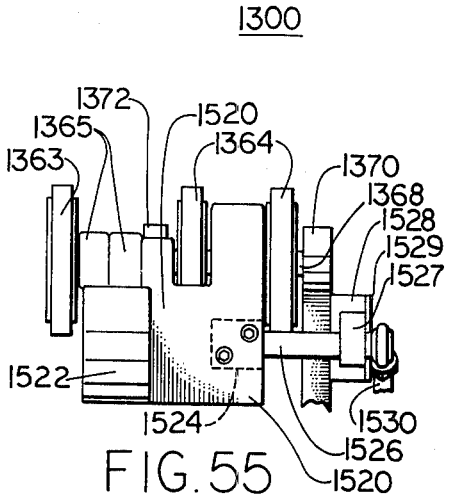
FIG. 55 is a front elevational view of the patter plate taken in the direction of the arrows 55—55 in FIG. 54.

The pack patter 1300 is shown principally in FIGS. 48, 54 and 55 and in spaced relationship with the other subassemblies of the carrier packing assembly 22 in FIG. 50. A pack patter plate 1520 is held in nearly upright position and parallel to a case line 1521 as shown in FIG. 54. The case line 1521 is an imaginary line along which the top edge of all cases travel during the pack cycle. The case handling assembly 14, FIG. 1, is longitudinally adjusted to achieve this case positioning no matter what size case is being employed. The pack patter plate 1520 is of irregular shape (FIG. 55) to accommodate the right member of the pair of bottom pack nip wheels 1364. Right and left refer to the bottle carrier checker/packer 10, not to FIG. 55. The upper portion of the pack patter plate 1520 (FIG. 54) is backwardly curved to assure that the bottle carrier 106 is caught on the face thereof and urged into the case 1288 to form the case stack of carriers 1299. The right hand side of the pack patter plate 1520 rigidly incorporates a curved extension plate 1522 in a cantilever manner to insure that the bottle carriers 106 are urged into physical contact with the case bottom 1302, as shown in FIG. 44.

The pack patter plate 1520 is fixedly attached along its left edge to the output side of a patter lug 1524. The patter lug 1524 is fixedly attached to the right end of a patter bar 1526 that is also fixedly attached through the output end of a pack patter slide 1527. The pack patter slide 1527 is retained with a channel mount 1528 by a channel cover 1529. The left hand end of the patter bar 1526 extends slightly from the left side of the pack patter slide 1527, and pivotally incorporates the output end of a patter turnbuckle rod 1530 to the end thereof. The input end of the patter turnbuckle rod 1530 is pivotally attached to the upper extremity of, and upon the left hand side of, a pack oscillator arm 1532, FIGS. 48 and 54. The pack oscillator arm 1532 is in turn rigidly affixed to the top surface of a pivot collar 1534. The pivot collar 1534 is pivotally mounted upon a pack oscillator pin 1535 that is in turn rigidly affixed in a cantilever manner into the left side of the extended input end of the left side nip beam 1370 (FIG. 48). The lower portion of the pivot collar 1532 rigidly incorporates a pack cam roll mount 1536 that is slightly wider than the pivot collar 1532 and extends to the left thereof. A cam roll pin 1538 is rigidly affixed in a lateral disposition through the pack cam roll mount 1536 and extends from the left side therefrom to rotatably incorporate a pack cam roll 1539. The pack cam roll 1539 runs against a pack cam 1540 that incorporates a plurality of lobes, six in this configuration. The pack cam 1540 is rigidly affixed to slightly left of center of the lower nip mount shaft 1376 and in longitudinal alignment with the pack cam roll 1539. The lower extremity of the pack cam roll mount 1536 rigidly incorporates a pack spring pin 1542 that protrudes perpendicularly from the right side thereof. A pack spring anchor pin 1544 is rigidly affixed in a perpendicular manner into the right hand surface of the left side nip beam 1370 near the location of the left hand member of the pair of lower nip frame hangers 1388. A pack patter spring 1545 is stretched between the pack spring pin 1542 and the pack spring anchor pin 1544 and retained in grooves therein to keep the pack cam roll 1539 in rolling contact with the pack cam 1540.

Rotational power is provided by the lower nip mount shaft 1376, transmitted through the pack cam 1540 and the pack cam roll 1539 to oscillate the pack oscillator arm 1532. The patter turnbuckle rod 1530 being connected to the pack oscillator arm 1532 and the patter bar 1526, transmits the oscillating power to the pack patter slide 1527, which in turn oscillates the pack patter plate 1520 in an in-and-out manner. Consequently, the case stack of carriers 1299 is patted six times for each rotation of the pack cam 1540 to continuously urge the bottle carriers 106 to the case bottom 1302.

Figure 56:
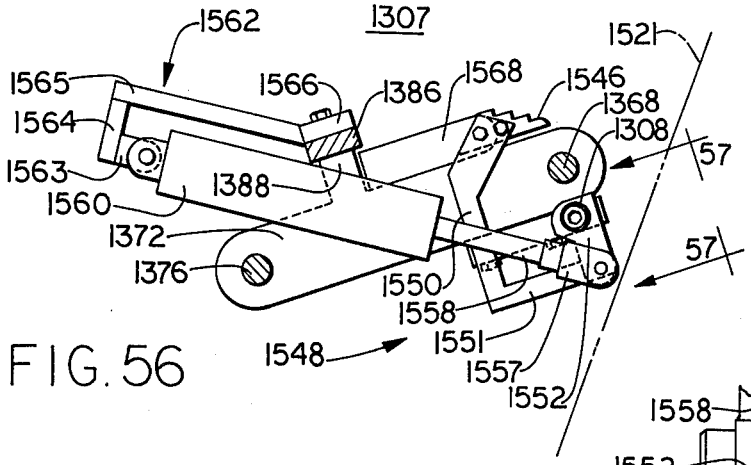
FIG. 56 is a fragmentary view in section of a nudger assembly taken on the line 56—56 in FIG. 48.
Figure 57:
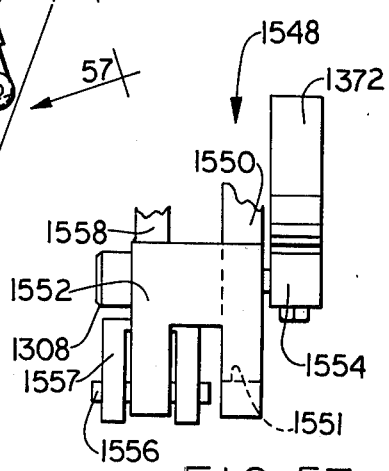
FIG. 57 is a fragmentary front elevational view of the nudger assembly and taken in the direction of the arrows 57—57 in FIG. 56.

The nudger assembly 1307 is shown in detail in FIG. 56 and in spaced relationship with neighboring assemblies in FIGS. 48 and 50. The working extremity of the nudger assembly 1307 is comprised of a quadruple detent 1546 that is fixedly attached to the left hand side of an offset arm 1548. The offset arm 1548 is shown in FIGS. 56 and 57, and is a one-piece weldment that is comprised of a detent vertical riser 1550, a detent horizontal bar 1551 and a detent clevis mount 1552. The detent vertical riser 1550 is rigidly affixed to the input end of the detent horizontal bar 1551 whose input end is in turn rigidly affixed to the lower input face of the left hand lug of the detent clevis mount 1552. The quadruple detent 1546 is fixedly attached to the upper inboard face of the detent vertical riser 1550, as was previously indicated. The offset arm 1548 is pivotally mounted upon the nudger pivot 1308 that is perpendicularly and rigidly affixed in the right hand face of, and at the output end of, a nudger mount 1554. The nudger mount is fixedly attached to the underside of, and at the output end of, the right side nip beam 1372.

The right hand lug of the detent clevis mount 1552 fixedly incorporates in a lateral orientation an offset clevis pin 1556 that pivotally accommodates a nudger cylinder clevis 1557. The nudger cylinder clevis 1557 is fixedly attached to the working end of a nudger cylinder rod 1558 that in turn is activated by a nudger cylinder 1560. The nudger cylinder 1560 is pivotally mounted to a cantilever cylinder mount 1562 that is comprised of a cylinder mount lug 1563, a vertical hanger mount 1564, a cantilever extension arm 1565, and an extension arm pad 1566. The extension arm pad 1566 is fixedly attached to the top surface of the lower nip stabilizer bar 1386 almost underneath the right hand extremity of the output pack conveyor roller 1322, as is shown in FIG. 48. The cantilever extension arm 1565 is rigidly affixed to the input edge of the extension arm pad 1566 at a slightly inclined angle with respect thereto. The vertical hanger mount 1564 is rigidly affixed to the lower surface of, and at the input end of, the cantilever extension arm 1565. The cylinder mount lug 1563 is rigidly affixed to the lower output face of the vertical hanger mount 1564. In this manner, the nudger cylinder 1560 is suspended below the lower nip stabilizer bar 1386, and in cycling the nudger cylinder rod 1558, swings the offset arm 1548 and the quadruple detent 1546 in an arc that nearly coincides with the path of travel of the shingled stream of bottle carriers 1292 as they pass through the nip wheel assembly 1294.

A carton guide 1568 (FIG. 56) is pivotally attached at its output end to the left hand side and input end of the quadruple detent 1546. The input end of the carton guide 1568 rides up and back upon the top of the right side nip beam 1372, and in its full back position clears the right member of the pair of lower nip frame hangers 1388. The leading edge 115 of the bottle carrier 106 is prevented from impacting the input side of the detent vertical riser 1550 or the quadruple detent 1546 by the upper surface of the carton guide 1568.

The nudger cylinder 1560 is contracted at the end of each pack cycle, withdrawing the nudger cylinder rod 1558 which rotates the offset arm 1548 about the nudger pivot 1308, and swings the quadruple detent 1546 into physical contact with the last few bottle carriers 106 that have entered the case 1288. The last two or three bottle carriers 106 have difficulty reaching the case bottom 1302 because the case 1288 is tightly packed, and consequently, might stop before entering fully. The quadruple detent 1546 receives the trailing edges 117 of the bottle carriers 106 in the successive notches of the quadruple detent 1546, and mechanically pushes them the rest of the way into the case 1288. This is accomplished because the quadruple detent 1546, in pivoting about the nudger pivot 1308, brings the notches of the quadruple detent 1546 into nearly parallel alignment with the input surface of the case stack of carriers 1299.

Figure 58:
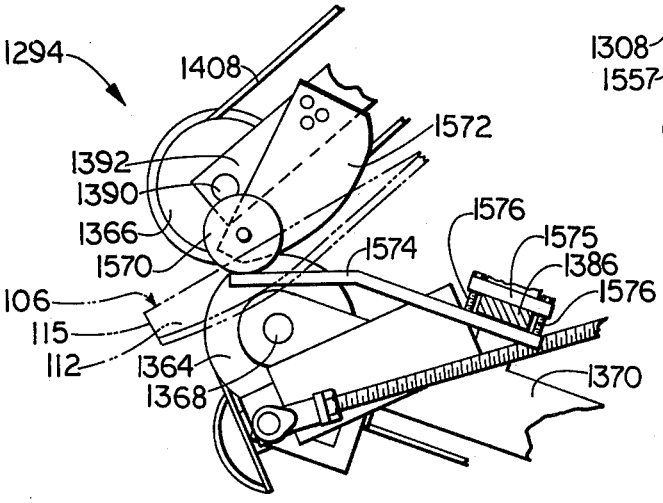
FIG. 58 is a fragmentary view in section showing a bottle carrier bottom bender in side elevation taken on the line 58—58 in FIG. 48.

The carrier bottom bender 1306 is shown in FIG. 58 and is partially shown in FIGS. 48 and 52. Referring to FIG. 58, a bender wheel 1570 is rotatably mounted upon the output end of a shoe mount 1572 that is fixedly but adjustably attached to the left side of the left hand nip beam 1392 of the top nip frame 1398. The shoe mount 1572 hangs downwardly at such an angle to bring the lower edge of the bender wheel 1570 to a point somewhat below the line of traverse of a bottle carrier 106 through the nip wheel assembly 1294. The bottom edge of the shoe mount 1572 is smoothly curved in order to capture the leading edge 115 of the bottle carrier 106 and guide it downwardly and under the bender wheel 1570. A bender bar 1574 extends in the output direction from the lower nip stabilizer bar 1386 and is fixedly but adjustably attached thereto by a clamp plate 1575 and a pair of spanner bolts 1576. The pair of spanner bolts 1576 passes through clear holes in the clamp plate 1575 and threadably mount into the input end of the bender bar 1574. The bender bar 1574 is so positioned along the left side of the lower nip stabilizer bar 1386 to bring the output end of the bender bar 1574 to bear up against the left side of the carrier bottom panel 120 so that when the carrier bottom 112 is forced downwardly by the bender wheel 1570, the bottle carrier 106 will be permanently bent along the line of intersection between the carrier top and bottom panels 118 and 120, respectively, and the carrier bottom 112, as is shown in FIG. 45. The downward bend of the carrier bottom 112 assists in keeping the case stack of carriers 1299 in an erect position, as has been previously described.

The case 1288 incorporates the left and right side flaps 1310 and 1312 (FIGS. 44 and 62), respectively, that are controlled or guided by the left side guide assembly 1313 and the right side flap guide 1314, respectively, as the case 1288 descends past the nip wheel assembly 1294. Referring to FIG. 48, the left side guide assembly 1313 is comprised of a left hand outside guide 1578 and a left hand inside guide 1580. The left hand outside guide 1578 is fixedly attached to an angle bracket 1582 that is in turn rigidly affixed to the output surface of a pack assembly chain guard 1584 that is also shown in FIG. 49. The pack assembly chain guard 1584 is fixedly attached to the output end of the left member of the pair of pack assembly side plates 1015. The left hand outside guide 1578 extends upwardly and in the output direction (FIG. 49), and the upper extremity thereof flares outwardly toward the left side of the carrier packing assembly 22 as is clearly shown in FIGS. 45 and 48. The left hand inside guide 1580 is shown in FIGS. 44, 45 and 48, and is fixedly attached to the outboard surface of, and at the top outboard corner of, the left hand carrier guide 1296, and is in near parallel alignment with the left hand outside guide 1578. The upper portion of the left hand inside guide 1580 flares inwardly toward the centerline of the carrier packing assembly 22. The left hand outside guide 1578 is not adjustable, while the left hand inside guide 1580 is laterally adjustable since it is connected to the left hand carrier guide 1296. For small cases, only the left hand inside guide 1580 is functional since the left side flap 1310 will not reach the left hand outside guide 1578. For large cases then, the left side flap 1310 will be trapped between and temporarily bent by the left side guide assembly 1313 to insure that it does not interfere with the surrounding mechanisms of the carrier packing assembly 22 as it descends therethrough.

The right side flap guide 1314 is clearly shown in side elevation in FIG. 51, and in end elevation in FIG. 45. The right side flap guide 1314 is comprised of a flat diagonal member 1585 and a flat vertical member 1587. The flat diagonal member 1585 is fixedly attached at its lower extremity to the outboard surface of, and at the upper output corner of, the right hand carrier guide 1295. The upper portion of the flat diagonal member 1585 flares toward the centerline of the carrier packing assembly 22. Rigidly affixed to the upper extremity of the flat diagonal member 1585 is the flat vertical member 1587, which descends vertically in the same plane as the flared upper portion of the flat diagonal member 1585. The right side flap guide 1314 will receive the lower extremity of the right side flap 1312 and guide it outwardly around the mechanisms of the nip wheel assembly 1294. As the case 1288 descends, the right side flap 1312 is thereby guided through the clear space provided between the standoff bearing mount 1381 and the standoff mount 1383 of the U-shaped bracket of the bottom nip wheel structure that has been previously described. The right side flap guide 1314 is laterally adjustable since it is connected to the right hand carrier guide 1295 and is therefore functional for all case sizes.

Referring now to FIGS. 48 and 49, a limit switch LS-15 is associated with the pair of top pack nip wheels 1366. The limit switch LS-15 is fixedly attached to the outboard surface of a switch mount plate 1586 that is in turn fixedly but adjustably attached to the outboard surface of the left member of the pair of pack assembly side plates 1015. The switch mount plate 1586 incorporates a vertical slot 1588 that permits it to be vertically adjusted. A top nip switch arm 1591 is fixedly but adjustably attached to the working extremity of the limit switch LS-15, and rotatably incorporates at its upper extremity a switch roller 1592. The switch roller 1592 of the limit switch LS-15 works against the lower surface of a trigger angle 1594 that is rigidly affixed to the outboard surface of the left hand top nip radius arm 1404L and in juxtaposition to the top nip transfer bearing 1411. As has been previously described, the pair of top pack nip wheels 1366 is rigidly connected to the left hand top nip radius arm 1404L. Therefore, if the shingled stream of bottle carriers 1292 would jam in the nip wheel assembly 1294, the pair of top pack nip wheels 1366 and, subsequently, the left hand top nip radius arm 1404L would be forced upward, permitting the top nip switch arm 1591 to pivot counterclockwise, thus making the appropriate circuit that will stop machine operations and advance of conveyor belts of the machine.

Again referring to FIGS. 48 and 49, a limit switch LS-16 is shown therein. The limit switch LS-16 is fixedly attached to a standoff block 1595 that is in turn rigidly affixed to the outboard surface of the diverter stringer 1142. A tongue switch arm 1596, extending in the output direction, is pivotally attached to the working head of the limit switch LS-16. The output extremity of the tongue switch arm 1596 rotatably incorporates a tongue roller 1598 that in turn comes in rolling contact with the input surface of the retraction torque arm 1482 that motivates the hold down tongue 1298. The retraction cylinder 1484 withdraws the retraction cylinder rod 1488 and the retraction torque arm 1482 to a retract position indicated by the double dot and dash outline shown in FIG. 49. In so doing, the tongue roller 1598 is moved upwardly to a retracted position, also shown in double dot and dash line, which in turn pivots the tongue switch arm 1596 upwardly, thus making the limit switch LS-16. The limit switch LS-16 indicates that all machinery has been withdrawn from the case 1288, and subsequently causes the case 1288 to descend rapidly in preparation for another pack cycle.

The surge-pack drive assembly 26 is shown in FIGS. 34, 39 and 51, with some additional details shown in the plan view of FIG. 48. A pack motor 1600 is fixedly attached upon the top of, and to the left output side of, a drive assembly plate 1602 (FIG. 39). The drive assembly plate 1602 is rigidly affixed across an input plate support 1604 and an output plate support 1606, both being lateral stiffeners that are rigidly affixed between the pair of short mounting members 66 and 66L, as in FIGS. 34 and 39. The shaft of the pack motor 1600 is fitted with a variable width pulley 1608 that incorporates a movable disc 1610. The width of the variable width pulley 1608 can be set manually by a knob 1612 that in turn controls the radius about which a pack drive belt 1615 runs. A variable speed follower pulley 1614 is fixedly mounted upon a gear box input shaft 1616 of a reduction gear box 1617. The discs of the variable speed follower pulley are spring loaded and are consequently free to expand or contract according to the amount of transverse pressure applied by the pack drive belt 1615. As the knob 1612 is turned in one direction, the movable disc 1610 is moved toward its mate, thus forcing the pack drive belt 1615 to a larger radius. As the pack drive belt 1615 expands its circumference about the variable width pulley 1608, it must consequently decrease its circumference about the variable speed follower pulley 1614, forcing the discs of the variable speed follower pulley 1614 apart in opposition to spring pressure. In so doing, the speed of the gear box input shaft 1616 is adjusted downwardly, permitting the speed of the surge hopper belt 969 and the carrier assembly 22 to be synchronized with the speed of the bottle carrier inspection section 18. The reduction gear box 1617 is fixedly attached to the top surface of, and near the right hand output corner of, the drive assembly plate 1602, and physically elevated thereabove by the interspacing auspices of a pair of spacer bars 1618.

A gear box output shaft 1620 extends laterally from both sides of the reduction gear box 1617 and fixedly incorporates upon its right end a low speed transfer sprocket 1622 and upon its left end a high speed transfer sprocket 1623. The low speed transfer sprocket 1622 transmits power to a low speed sprocket 1624 and a pack clutch drive sprocket 1626 through a low speed pack chain 1628 as is shown in FIGS. 34 and 39. The pack clutch drive sprocket 1626 is fixedly attached to the right side pack clutch shaft 1434, adjacent to the outboard face of the left member of the pair of right side bearing mounts 1436. Power is thereby delivered into the right side pack clutch shaft 1434, through the pack clutch 1432, the left side pack clutch shaft 1424, the distribution sprocket 1414, to the distribution chain 1412 of the nip wheel assembly 1294, as has been previously described.

The low speed sprocket 1624 is fixedly attached to a low speed coaxial shaft 1630 (FIG. 39) that is in turn rotatably mounted upon a conveyor speed shaft 1632. The conveyor speed shaft 1632 is rotatably mounted in a right side speed shaft bearing 1633 and a middle speed shaft bearing 1631. The right side speed shaft bearing 1633 is fixedly mounted to a bearing pad 1634 that is in turn rigidly affixed to the inboard surface of the right hand short vertical hanger 68 somewhat below the intersection of the right hand short stringer 56. The middle speed shaft bearing 1631 is fixedly attached upon the top of a bearing pad 1629 that is in turn rigidly affixed upon the top of a short bearing riser 1627. The short bearing riser 1627 is rigidly affixed upon the top of the drive assembly lateral stiffener 80 somewhat left of center of the surge-pack drive assembly 26. The conveyor speed shaft 1632 extends through the middle speed shaft bearing 1631 to extend to the left thereof, where it is coupled to a belt drive brake 1635. The belt drive brake 1635 is fixedly attached to the inboard surface of a standoff brake mount 1636. A standoff plate 1637 is rigidly affixed in a perpendicular manner to the center of the outboard surface of the standoff brake mount 1636, and rigidly mounted at its other end to the output surface of the left hand short vertical hanger 68L. A two speed pack clutch 1638 is mounted upon the center of the conveyor speed shaft 1632 and is comprised of a low speed pack clutch 1640, a high speed pack clutch 1642 and a pack clutch armature assembly 1644. The left hand extremity of the low speed coaxial shaft 1630 is fixedly attached within the low speed pack clutch 1640, and is engageably connected to the conveyor speed shaft 1632 by the pack clutch armature assembly 1644. In this manner, the right side pack clutch shaft 1434 and the low speed coaxial shaft 1630 are driven continuously from the low speed side of the reduction gear box 1617, while the conveyor speed shaft 1632 is selectively driven when the low speed pack clutch 1640 is engaged to the pack clutch armature assembly 1644.

The low speed chain 1628 (see FIG. 34), passes in the clockwise direction about the low speed transfer sprocket 1622, the low speed sprocket 1624 and the pack clutch drive sprocket 1626. Tension is maintained in the low speed pack chain 1628 by a low speed idler 1643 that is rotatably mounted upon the inboard face of an idler block 1645. The idler block 1645 is rigidly affixed to the inboard surface of a spanner plate 1646 that is in turn fixedly but adjustably clamped to the inboard face of a right side idler riser 1647 by a spanner back plate 1648 and a pair of spanner bolts 1649. A stop lug 1650 is rigidly attached to the inboard face of the right side idler riser 1647 just below the idler block 1645 of the low speed idler 1643. A riser screw 1651 is threadably mounted through the stop lug 1650 from the bottom and rises to exert a lifting pressure against the bottom of the idler block 1645 to forcefully raise the low speed idler 1643 into pressure contact against the bottom of the low speed pack chain 1628, thereby producing tension therein. The right side idler riser 1647 is rigidly affixed in a vertical disposition to the input side of the input plate support 1604.

The high speed transfer sprocket 1623 (FIG. 39) transmits power from the left side of the gear box output shaft 1620 to a high speed sprocket 1652 by a high speed pack chain 1654. The high speed sprocket 1652 is fixedly attached to a high speed coaxial shaft 1656 that is in turn rotatably mounted upon the conveyor speed shaft 1632, to the left of, the two speed pack clutch 1638. The right extremity of the high speed coaxial shaft 1656 is fixedly attached within the high speed pack clutch 1642, and is selectively engaged to the conveyor speed shaft 1632 through the pack clutch armature assembly 1644. Referring to FIG. 34, the high speed pack chain 1654 passes about the high speed transfer sprocket 1623 and the high speed sprocket 1652 in the clockwise direction. Tension is maintained in the high speed pack chain 1654 by a high speed idler sprocket 1658. The high speed idler sprocket 1658 is rotatably attached to a spanner mount 1660 that is in turn fixedly but adjustably attached to the right hand face of a short idler riser 1661 by a spanner back mount 1662 and a pair of spanner bolts 1663, as shown in FIG. 39. An adjustment lug 1664 is rigidly affixed across the right hand face of the short idler riser 1661 just below the spanner mount 1660, and threadably incorporates a long adjustment screw 1665 vertically disposed therethrough to bring an upward pressure against the bottom of the spanner mount 1660. Consequently, the high speed idler sprocket 1658 is brought to bear against the bottom of the lower portion of the high speed pack chain 1654, raising it as in FIG. 34, and producing tension therein. The short idler riser 1661 is rigidly affixed upon the top output end of a short cantilever tube 1666 that is in turn rigidly affixed to the output face of the short bearing riser 1627.

The pack clutch armature assembly 1644 of the two speed pack clutch 1638 can be engaged to the low speed pack clutch 1640, or to the high speed clutch 1642, or to neither. With this facility, the conveyor speed shaft 1632 will receive either high or low speed power, or neither, at which time the belt drive brake 1635 is engaged to stop it abruptly. Power is taken from the conveyor speed shaft 1632 by means of a conveyor power sprocket 1668 that is fixedly attached to the right side thereof and adjacent to the right side speed shaft bearing 1633. Referring to FIGS. 34, 48 and 51, power is transferred from the conveyor power sprocket 1668 (FIG. 34) to a surge conveyor input sprocket 1670 (FIG. 51) and a pack conveyor input sprocket 1672 by a conveyor chain 1674 that runs in clockwise manner thereabout. The surge conveyor input sprocket 1670 (FIG. 48) is fixedly attached to the right hand side of the surge output shaft 1020 and the pack conveyor input sprocket 1672 is fixedly attached to the right hand side of the pack conveyor drive shaft 1326. A conveyor chain tension idler 1676 (FIG. 39) is rotatably mounted to the upper portion of the right side idler riser 1647 by an idler mount fixture 1675 in the same way as the low speed idler 1643 of the low speed pack chain 1628, but in reverse lateral position. A top adjustment lug 1677 is rigidly affixed in an overhung manner to the top extremity of the right side idler riser 1647 so that a lifter screw 1678, that is rigidly affixed in a vertical manner in the top of the idler mount fixture 1675, can pass vertically upward through a clear hole in the overhung portion thereof. An adjustment nut 1680 is run down the lifter screw 1678 and against the top surface of the top adjustment lug 1677 to forcefully raise the conveyor chain tension idler 1676 into contact with the bottom surface of the bottom portion of the conveyor chain 1674, thereby providing tension therein.

In consequence then, power is continuously supplied by the pack motor 1600 to the variable width pulley 1608, to the pack drive belt 1615, to the variable speed follower pulley 1614, and to the reduction gear box 1617. The speed of the reduction gear box 1617 is manually adjustable through the function of the variable width pulley 1608 and the variable speed follower pulley 1614, as previously described. Power is then continuously supplied from the reduction gear box 1617 to the low speed pack chain 1628 and the high speed pack chain 1654. Subsequently, the low speed pack chain 1628 delivers power to the pack clutch drive sprocket 1626 and makes power available in the low speed pack clutch 1640, while the high speed pack chain 1654 makes power available in the high speed pack clutch 1642. Assuming that the surge hopper 20 is empty, then the pack clutch armature 1644 is not engaged to either the low or high speed pack clutch 1640 and 1642, respectively, leaving the conveyor speed shaft 1632 without power and fixedly held from rotation by the belt drive brake 1635.

As bottle carriers 106 begin to fill the surge hopper 20, they begin to form the stack of carriers 973. As the stack of carriers 973 reaches a minimum height, the first pole of the limit switch LS-9 is made, activating the proper circuit that simultaneously disengages the belt drive brake 1635 and engages the pack clutch armature 1644 to the low speed pack clutch 1640, thus putting the surge hopper belt 969 and the packing belt 1290 into low speed operation. The stack of carriers 973 will continue to rise in the surge hopper 20 until the second pole of the limit switch LS-9 is made, which activates the proper circuit that causes the pack clutch armature 1644 to disengage the low speed pack clutch 1640 and engage the high speed pack clutch 1642. Thus the surge hopper belt 969 and the packing belt 1290 is transferred into high speed operation which will gradually lower the stack of carriers 973 in the surge hopper 20. As the stack of carriers 973 reaches its minimum height, the first pole of the limit switch LS-9 is again made, low speed operation resumes and the cycle repeats itself until it is interrupted by the count switch 1309 of the carrier packing assembly 22.

Figure 49A:
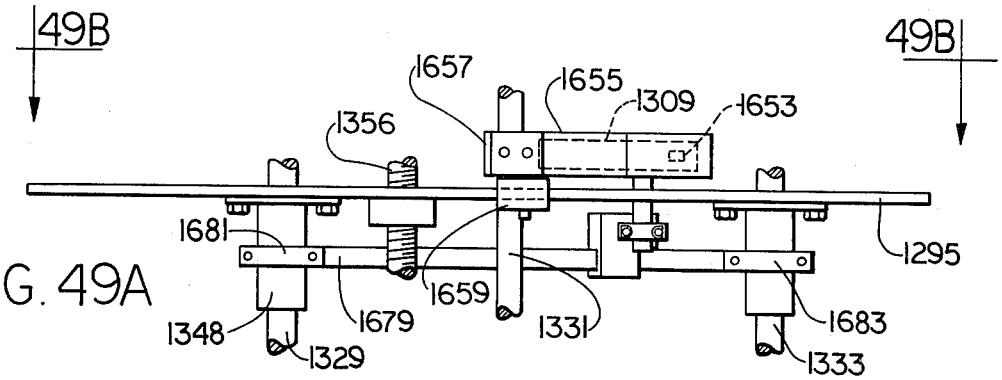
FIG. 49A is a fragmentary plan view showing a side guide, a count switch and a count switch spring.
Figure 49B:
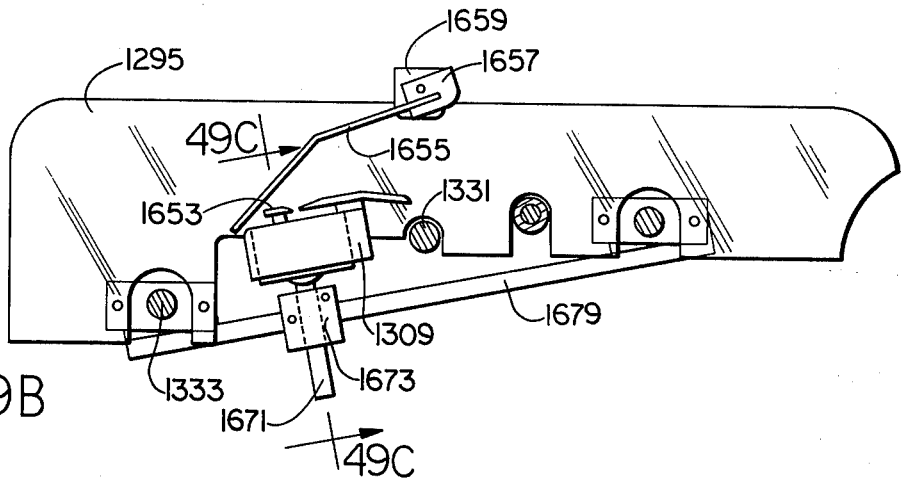
FIG. 49B is a fragmentary view in section taken in the direction of the arrows 49B—49B in FIG. 49A.
Figure 49C:
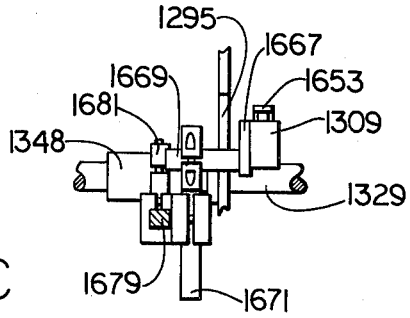
FIG. 49C is a view in section taken on the line 49C—49C in FIG. 49B.

As has been previously described, the count switch 1309 governs the number of bottle carriers 106 entering each case 1288 in normal operation. As shown in FIGS. 49A, 49B and 49C, the count switch 1309 is mounted to move with the right hand carrier guide 1295. The count switch can be of the type shown in Lloyd U.S. Pat. No. 3,715,529, and a push-button 1653 thereof is depressed by the trailing edge of each carton and is released when the trailing edge has passed to record the passage of each carton. A leaf spring 1655 holds the cartons in position for engagement with the push-button 1653. The spring 1655 is mounted in a spring bracket 1657. The spring bracket 1657 is supported by a clamp bracket 1659 which is mounted on the upper edge of the right hand carrier guide 1295. The count switch 1309 is mounted on a bracket 1667 having a shank 1669 adjustably mounted in an upright split ring eyebolt 1671. The shank of the eyebolt 1671 is mounted in a slide member 1673, which is carried by a rod 1679. The rod 1679 is supported on clamp fittings 1681 and 1683 mounted on the right hand slide mounts 1348. As the count switch reaches its preset number, it makes the appropriate circuit that disengages the pack clutch solenoid 1644 (FIG. 39) from both the low and high speed pack clutch 1640 and 1642, respectively, and engages the belt drive brake 1635, stopping the surge hopper belt 969 and the packing belt 1290 abruptly. The pack clutch drive sprocket 1626 ordinarily runs continuously, as does the nip wheel assembly 1294, unless the limit switch LS-15 is released. Release of the limit switch LS-15 indicates a build-up of cartons at the nip wheel assembly 1294. When the limit switch LS-15 is released, the operation of the machine and the advance of conveyor belts is arrested, as already pointed out. The case fill cycle can be synchronized with the surge hopper cycle so that when the count switch goes off, the stack of carriers 973 (FIG. 33) in the surge hopper 984 will be near its low point, so that while the surge hopper belt 969 is stopped, a sufficient length of time is available to allow the surge hopper to fill, but not overfill, until the next case 1288 is in place and filling.

CASE HANDLING ASSEMBLY

Figure 59:
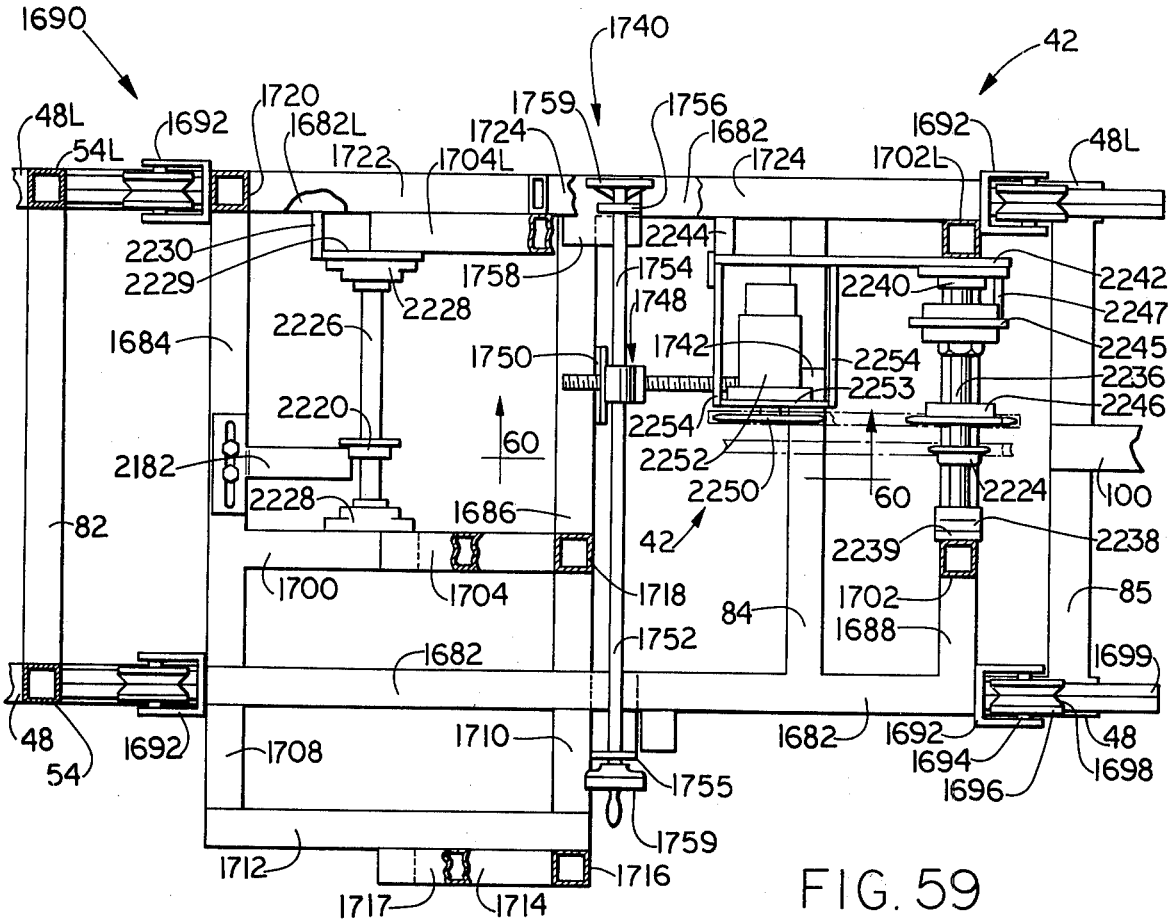
FIG. 59 is a view of the lower extremity of a case handling assembly and taken in section generally along the line 59—59 in FIG. 1.

Referring to FIGS. 1 and 59, the case section frame assembly 44 incorporates a pair of base stringers 1682 and 1682L that is rigidly held in lateral and parallel spaced relationship by an input lateral brace 1684, a middle lateral brace 1686 and an output lateral brace 1688 to form a base rectangle 1690. Rigidly affixed at each corner of the base rectangle 1690 is a wheel yoke 1692 that incorporates a wheel axle 1694 and a wheel 1696. The four wheels 1696 of the base rectangle 1690 each incorporate a V-shaped groove 1698 that cooperates with an inverted angle iron 1699 that functions as a guide rail. The input pair of inverted angle irons 1699 is rigidly affixed upon the top of the pair of bottom stringers 48 and 48L, and butt against the output side of the pair of output posts 54 and 54L, while the remaining two inverted angle irons 1699 are rigidly affixed upon the pair of bottom stringers 48 and 48L at the output end thereof, and somewhat overhung therefrom. In this manner, the four inverted guide rails 1699 allow the mobile base rectangle 1690 of the case handling assembly 14 enough longitudinal freedom to accomodate a full range of sizes of the case 1288. A secondary longitudinal beam 1700 is rigidly affixed between the output face of the input lateral brace 1684 and the input face of the middle lateral brace 1686, and appropriately spaced to the left side of the right hand base stringer 1682 so it will serve as base mounting structure for the elevator incline 36 and the output tipover assembly 40.

The structure of the elevator incline 36 of the case section frame assembly 44 incorporates a pair of tall risers 1702 and 1702L rigidly affixed upon the top surface of the output lateral brace 1688. The left hand tall riser 1702L is located at the left end of the output lateral brace 1688 but not upon the left hand base stringer 1682L. The right hand tall riser 1702 is longitudinally aligned with the secondary longitudinal beam 1700. The top extremities of the pair of tall risers 1702 and 1702L are finished at an acute angle to accommodate a pair of incline risers 1704 and 1704L that is rigidly affixed thereto. The bottom extremity of the left hand incline riser 1704L is rigidly affixed to the inboard surface of the left hand base stringer 1682L approximately half way between the input and middle lateral braces 1684 and 1686, respectively. The bottom extremity of the right hand incline riser 1704 is rigidly affixed to the top surface of the secondary longitudinal beam 1700 and in lateral alignment with the left hand incline riser 1704L. The right and left sides of the elevator incline 36 are held in fixed lateral and parallel alignment by an incline brace 1706 (FIG. 1).

The structure of the output tipover assembly 40 of the case section frame assembly 44 incorporates an input lateral brace extension 1708 (FIG. 59) that extends rigidly outward in a cantilever manner to the right of the case handling assembly 14. A middle lateral brace extension 1710, of equal dimension to the input lateral brace extension 1708, is likewise rigidly affixed to the outboard surface of the right hand base stringer 1682 and in lateral alignment with the middle lateral brace 1686. Rigidly affixed to the outboard extremities of the input and middle lateral brace extensions 1708 and 1710, respectively, is an outboard longitudinal beam 1712, which in turn rigidly incorporates upon its outboard surface, and adjacent its output end, a short base doubler 1714. Rigidly affixed in an upright position upon the output end of the short base doubler 1714 is an output tipover riser 1716, the top end of which is finished at an acute angle that receives a short incline riser 1717 to which it is rigidly affixed. The short incline riser 1717 is also rigidly affixed upon the input end of the short base doubler 1714. The short incline riser 1717 and the right hand incline riser 1704 are in parallel alignment. A left hand output tipover riser 1718 is rigidly affixed between the top surface of the middle lateral brace 1686 and the lower surface of the steeply angled right hand incline riser 1704.

The structure of the case pushoff assembly 38 of the case handling assembly 14 is comprised of a pushoff riser 1720, a top longitudinal beam 1721 and a lower longitudinal beam 1722 as is also shown in FIGS. 1 and 59. The pushoff riser 1720 is rigidly affixed in an upright position upon the left hand input corner of the base rectangle 1690 of the case section frame assembly 44. The input end of the top longitudinal beam 1721 is rigidly affixed upon the top of the pushoff riser 1720 and extends horizontally in the output direction therefrom to be rigidly affixed upon the outboard surface of the left hand incline riser 1704L. The top longitudinal beam 1721 lies in the same vertical plane as the left hand short stringer 56L of the carrier handling assembly 12. As previously described, the left hand member of the pair of pack assembly side plates 1015 is rigidly affixed to the inboard surface of the left hand short stringer 56L. Therefore, the top longitudinal beam 1721 of the case handling assembly 14 lies just underneath, and to the outboard side of, the left hand member of the pair of pack assembly side plates 1015, causing no interference between the case handling assembly 14 and the bottle carrier handling assembly 12. The input end of the lower longitudinal beam 1722 of the case handling assembly 14 is rigidly affixed to the output surface of the pushoff riser 1720 and extends horizontally in the output direction to be rigidly affixed upon the outboard surface of the left hand incline riser 1704L, as is specifically shown in FIGS. 1 and 59. A power assembly mount beam 1724 is rigidly and horizontally affixed upon the outboard surfaces of the left hand incline riser 1704L and the left hand tall riser 1702L at a somewhat higher elevation than the lower longitudinal beam 1722, as is also shown in the Figures.

Figure 61:
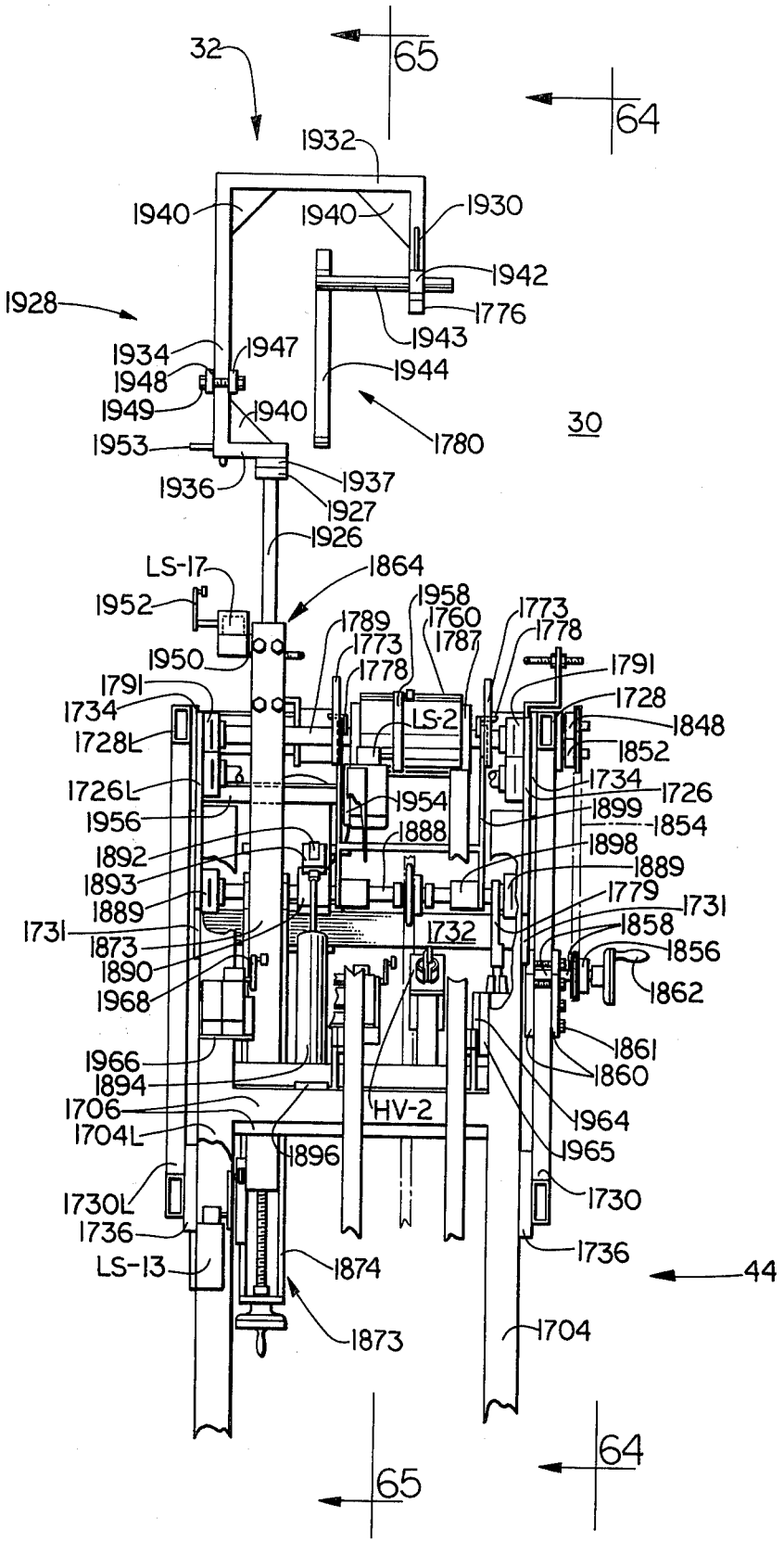
FIG. 61 is a front elevational view of a case input conveyor, case tipover assembly and upper portion of an elevator incline assembly.

The structure of the case input conveyor 30 of the case handling assembly 14 is shown in FIGS. 1 and 61, and incorporates a pair of pivot plates 1726 and 1726L, a pair of horizontal rails 1728 and 1728L, and a pair of diagonal stiffeners 1730 and 1730L. The pair of pivot plates 1726 and 1726L is rigidly affixed to the outboard surfaces of, and at the upper extensions of, the pair of incline risers 1704 and 1704L, respectively, in such manner that the pair of pivot plates 1726 and 1726L extend in a cantilever manner toward the output end of the bottle carrier checker/packer 10. The bottom output corners of each plate of the pair of pivot plates 1726 and 1726L integrally incorporate a vertical hanger 1731 that functions as a mounting bracket for a lateral pivot stiffener 1732. The lateral pivot stiffener 1732 functions to keep the pair of pivot plates 1726 and 1726L in rigid and lateral spaced relationship, as well as providing a structural mounting means for a cantilever motor mount 1733. The pair of horizontal rails 1728 and 1728L is rigidly affixed to the outboard surfaces of the pair of pivot plates 1726 and 1726L, respectively, through the interspacing auspices of a pair of spacing plates 1734. The pair of spacing plates 1734 is of rectangular shape and is centrally located at the upper edge of the pair of pivot plates 1726 and 1726L. The output ends of the pair of horizontal rails 1728 and 1728L are rigidly held in horizontal disposition by the pair of diagonal stiffeners 1730 and 1730L that is in turn rigidly affixed to the outboard surfaces of the pair of incline risers 1704 and 1704L through the interspacing auspices of a pair of spacer blocks 1736. Lastly, the output extremity of the pair of horizontal rails 1728 and 1728L is rigidly held in lateral spaced relationship by a stabilizer bar 1738 (FIG. 1).

Figure 60:
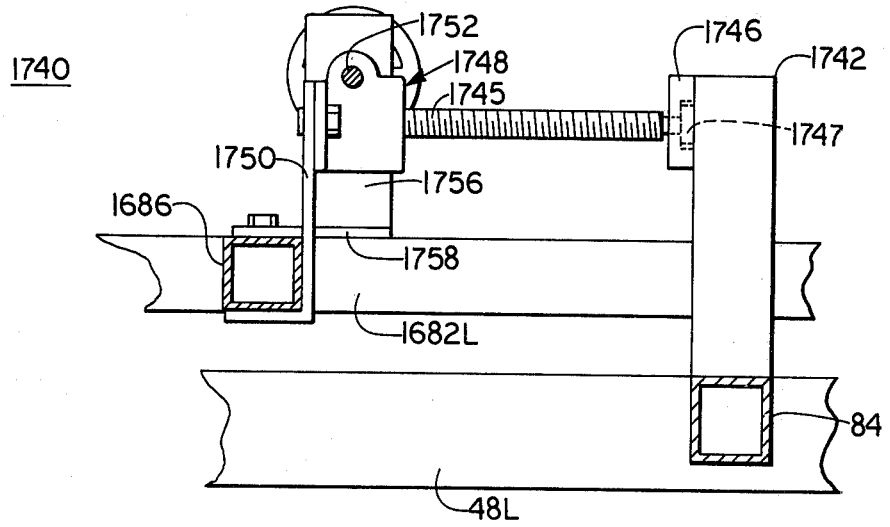
FIG. 60 is a fragmentary view in section showing a case handling section adjustment and lock assembly taken on the line 60—60 in FIG. 59.

Referring to FIGS. 1, 59 and 60, the case section frame assembly 44 is moved and fixedly held upon the output extension of the carrier section frame assembly 28 by a jack screw adjustment and holding assembly 1740. The jack screw adjustment and holding assembly 1740 incorporates a jack screw anchor 1742 that is rigidly affixed in an upright position upon the top surface of the case lateral stiffener 84. The output end of a longitudinal jack screw 1745 is attached to the input face of, and at the upper end of, the jack screw anchor 1742 by a retainer pad 1746 and retaining lug 1747. The shaft of the retaining lug 1747 is held in a socket of the retainer pad 1746. The shaft of the retaining lug 1747 is rigidly affixed within the output end of the longitudinal jack screw 1745. A jack 1748 is in turn fixedly attached to the upper output surface of a jack mount 1750. The jack mount 1750 is an L-shaped bracket whose lower extremity is fixedly attached to the under surface of the middle lateral brace 1686 while its upper extension lies against the output face thereof.

A shaft of the jack 1748 incorporates a right side shaft extension 1752 and a left side shaft extension 1754. The right side shaft extension 1752 extends laterally to the right, its right end being rotatably held in the vertical flange of an angle mount 1755 (FIG. 59). The horizontal extremity of the angle mount 1755 extends inboardly and is rigidly affixed to the bottom surface of the right hand base stringer 1682. The vertical flange of the angle mount 1755 is laterally displaced to the right of the right hand base stringer 1682 to make allowance for a cylinder and mount of the output tipover assembly 40 to be discussed hereinafter. The left side shaft extension 1754 extends laterally to the left and is rotatably held through the upper end of a left side shaft mount 1756 that is rigidly affixed in a perpendicular orientation to the upper surface of a shaft mount base plate 1758. The shaft mount base plate 1758 is fixedly attached to the upper surface of the middle lateral brace 1686 and the left hand base stringer 1682L. The outboard extremities of the right and left side shaft extensions 1752 and 1754 respectively are fixedly fitted with a pair of crank wheels 1759. In this manner, the case section frame assembly 44 can be moved by manual rotation of either one of the pair of crank wheels 1759 that requires only a small torque for rotation thereof. Since the longitudinal jack screw 1745 is greatly geared down with respect to the right and left side shaft extensions 1752 and 1754, respectively, the frame assembly 44 will also be held in fixed longitudinal placement.

Figure 62:
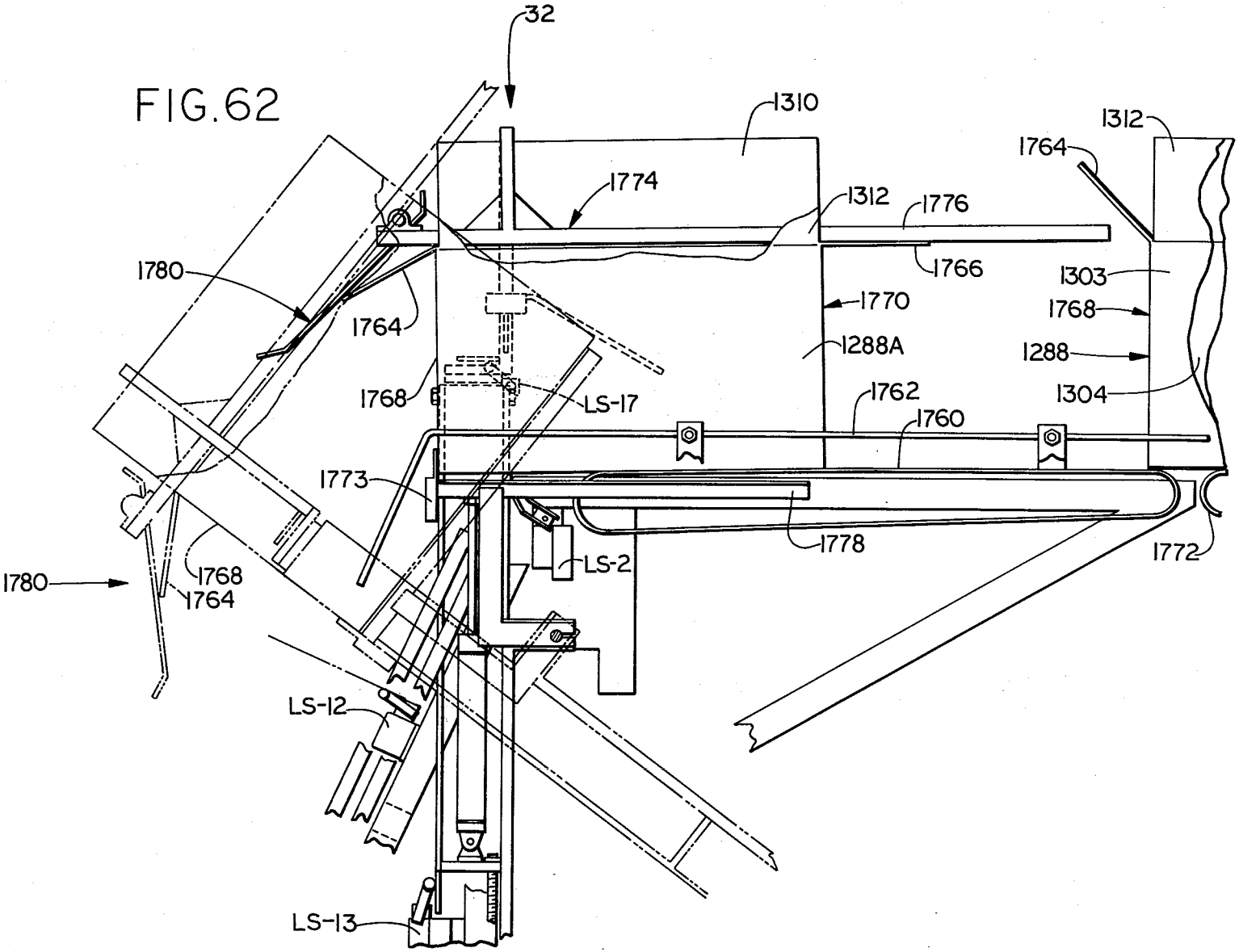
FIG. 62 is a schematic view in side elevation of the machinery shown in FIG. 61 showing the corrugated case as it is processed in the case input section, a partially processed case and associated machine parts being shown in double-dot-dash lines.

The upper portion of the case handling assembly 14 is shown in schematic form in FIG. 62. The corrugated case 1288 is manually or mechanically placed upon a case conveyor 1760 and between a pair of side guide rails 1762. The case 1288 is pre-assembled with its top flaps left open. More specifically, the left side flat 1310 and the right side flap 1312 are not bent or broken inwardly, and therefore remain in stiff and aligned relationship with the case left side 1304 and case right side 1303, respectively. An input end flap 1764 and an output end flap 1766 are broken outwardly to a horizontal position, and upon release, spring upward to assume a somewhat outwardly angled relationship with a case input end 1768 and a case output end 1770.

If the cases 1288 are delivered mechanically, they are received from a customer input conveyor 1772 as is indicated in FIG. 62. Referring now to FIGS. 61 and 62, the case conveyor 1760 runs in a counterclockwise direction when a limit switch LS-13 is engaged by the lower extremity of the input tipover assembly 32, thus carrying the case 1288 in the direction of the input end of the bottle carrier checker/packer 10. When the leading portion of the case 1288 is extended beyond the input end of the case conveyor 1760, its forward motion is halted by a pair of retainer tines 1773. At the same time, the case 1288 depresses a limit switch LS-2 that turns off the case conveyor 1760 and makes the appropriate circuit which causes a compressor 1774 to move downward upon the top of the case 1288, thereby trapping the case 1288 between a top compressor bar 1776 and a pair of tipover rails 1778. The top compressor bar 1776 incorporates upon its input end a flap bender assembly 1780 that serves to sufficiently depress the input end flap 1764 downwardly past the horizontal plane so that the input end flap 1764 is properly positioned to be received by a flap retainer 1998 (FIG. 74) of the elevator 34. As the compressor 1774 (FIG. 62) reaches the bottom of its travel, a limit switch LS-17 is depressed as is also indicated in FIGS. 61 and 62.

Figure 65:
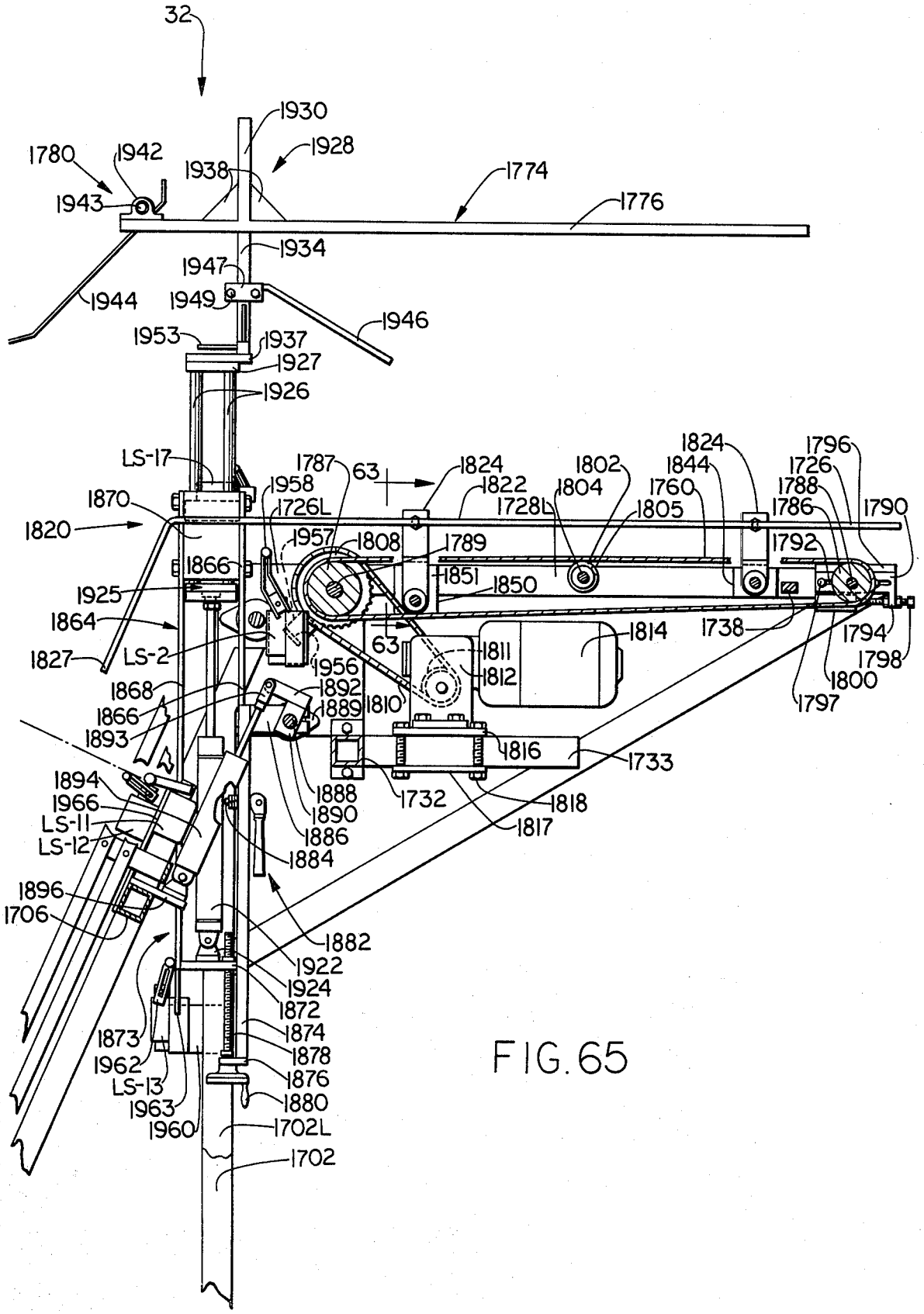
FIG. 65 is a sectional view of the case input section taken on the line 65—65 in FIG. 61.

As LS-17 is made, the input tipover assembly 32 raises the case 1288 off the case conveyor 1760 and tips it counterclockwise with respect to FIG. 62 to a position indicated in double dot-dash lines in the Figure. This position is considered to be approximately 80 percent of full tip, when full tip infers that the case 1288 is in parallel alignment with the elevator incline 36. The input tipover assembly 32 is stopped in the 80% tip position when a hydraulic valve HV-1 is depressed by a tip cam 1779 of the input tipover assembly 32, as is shown in FIGS. 61 and 64. The input tipover assembly 32 will remain in this position until the packing elevator 34 (FIG. 1) moves up the elevator incline 36 and operates a limit switch LS-11 and a hydraulic valve HV-2 that are shown in FIGS. 61, 64 and 65. The limit switch LS-11 stops the packing elevator 34 in its upward travel and resets the entire control circuitry thereof for downward movement and then waits for the tip operation to be completed. The hydraulic valve HV-2 is a release valve that permits the input tipover assembly 32 to complete its tip, bringing the case 1288 into parallel alignment with, and upon the top of, the packing elevator 34.

The pair of retainer tines 1773 are subsequently rotated counterclockwise with respect to FIG. 62, releasing the case 1288 from the tipover assembly 32. As the tip is completed, the input tipover assembly 32 depresses a limit switch LS-12, that is shown in FIGS. 61 and 62. The limit switch LS-12 makes the appropriate circuit that releases the compressor 1774, and also satisfies a dual condition with the limit switch LS-11 (FIG. 70) that, after a slight delay, sends the packing elevator 34 and the case 1288 down the elevator incline 36 in fast traverse.

Figure 68:
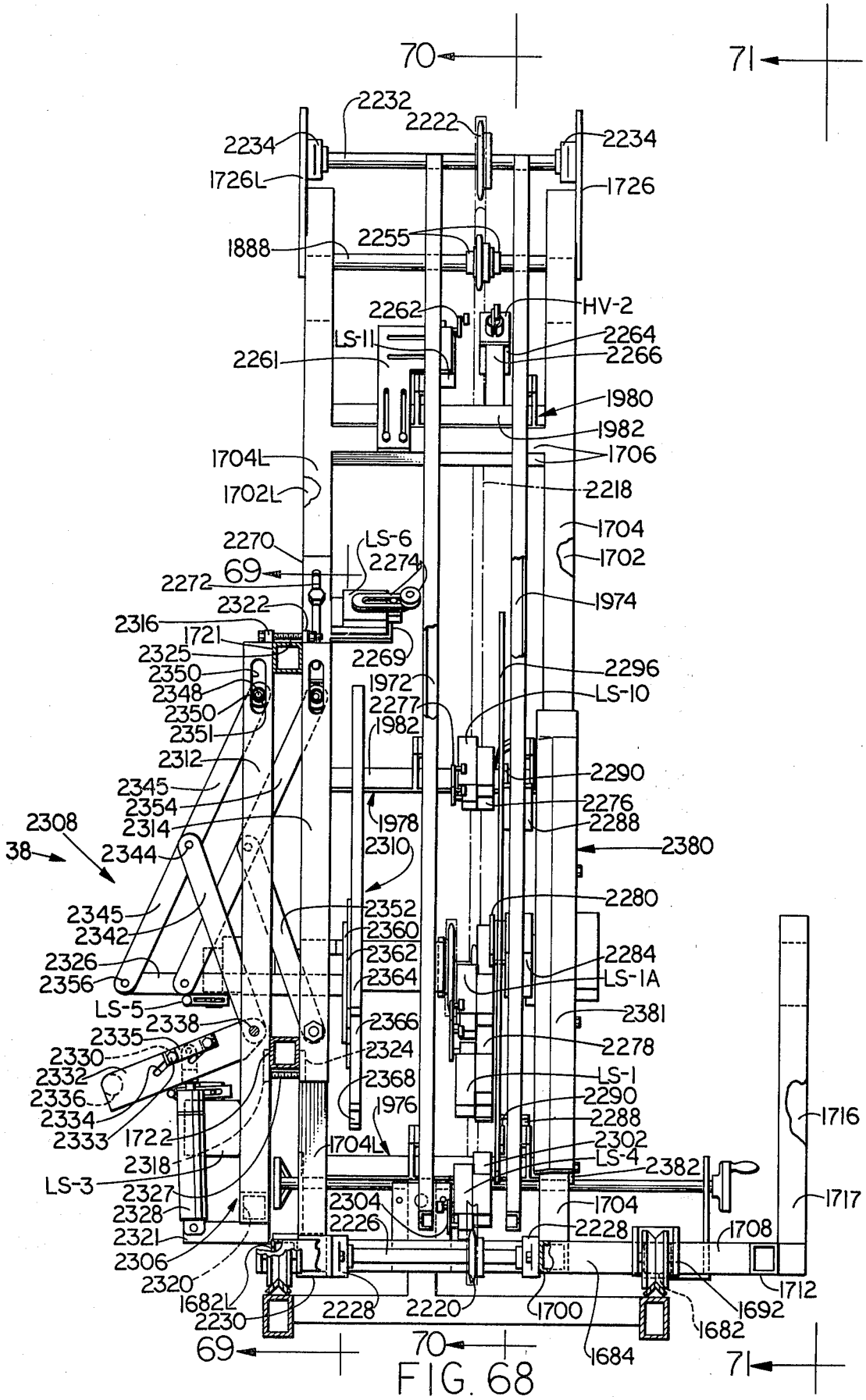
FIG. 68 is a front elevational view of the elevator incline of the bottle carrier checker/packer machine including a case pushoff assembly, some parts having been cut away for clarity, some frame elements being shown in section.

As is shown in FIGS. 68 and 70, the packing elevator 34 trips a limit switch LS-6 as it descends which causes four other functions to follow. First, the fast traverse of the packing elevator 34 is terminated. Second, and as can be seen in FIGS. 33 and 34, the appropriate circuit is made that permits the packing belt 1290 and the surge hopper belt 969 to run, thereby bringing bottle carriers 106 from the surge hopper 20 to the case 1288. Third, the limit switch LS-6 also makes the appropriate circuit that causes the hold down tongue 1298 to be inserted into the case 1288 and, finally, it energizes the hydraulic servo system that is governed by the microtorque valve 1301, so that the packing elevator 34 will descend in concert with the number of bottle carriers 106 entering the case 1288.

As the case 1288 is filling, the packing elevator 34 trips a toggle-action limit switch LS-10 that is shown in FIGS. 68 and 70. As this circuit is made, the input tipover assembly 32 is returned to its upright position and receives another case 1288. The packing elevator 34 continues to fill and descend, and subsequently contacts the limit switch LS-1A near the end of the fill cycle. As previously described, the limit switch LS-1A energizes the counter circuit, and if all is normal, the fill cycle will terminate on count. If not, the limit switch LS-1 will terminate the fill cycle based on physical dimensions as the packing elevator 34 trips it. The packing elevator 34 halts until the limit switch LS-16 (FIG. 49) of the carrier packing assembly 22 is actuated, indicating that the hold down tongue 1298 is clear of the case 1288, thereupon the packing elevator 34 (FIG. 70) is energized to move down fast.

As the packing elevator 34 reaches the bottom of the elevator incline 36, it trips a limit switch LS-4 that is shown in FIGS. 68 and 70, that in turn makes the appropriate circuit that stops the packing elevator 34. The limit switch LS-4 also energizes the case pushoff assembly 38, that is shown in FIGS. 68, 69 and 70, and that extends laterally to the right of the bottle carrier checker/packer 10 to push the full case 1288 off the packing elevator 34 and onto the output tipover assembly 40.

Before the case 1288 translates to the right, the input end flap 1764 has assumed a position 1764A as a result of being downwardly bent by the compressor 1774 as was previously described and is seen in the lower portion of FIG. 72. As the case 1288 is translating to the right, a folding rod 1782, that extends inboardly and downwardly in a smooth curve, catches underneath the input end flap 1764A and folds it to a position 1764B.

Figure 76:
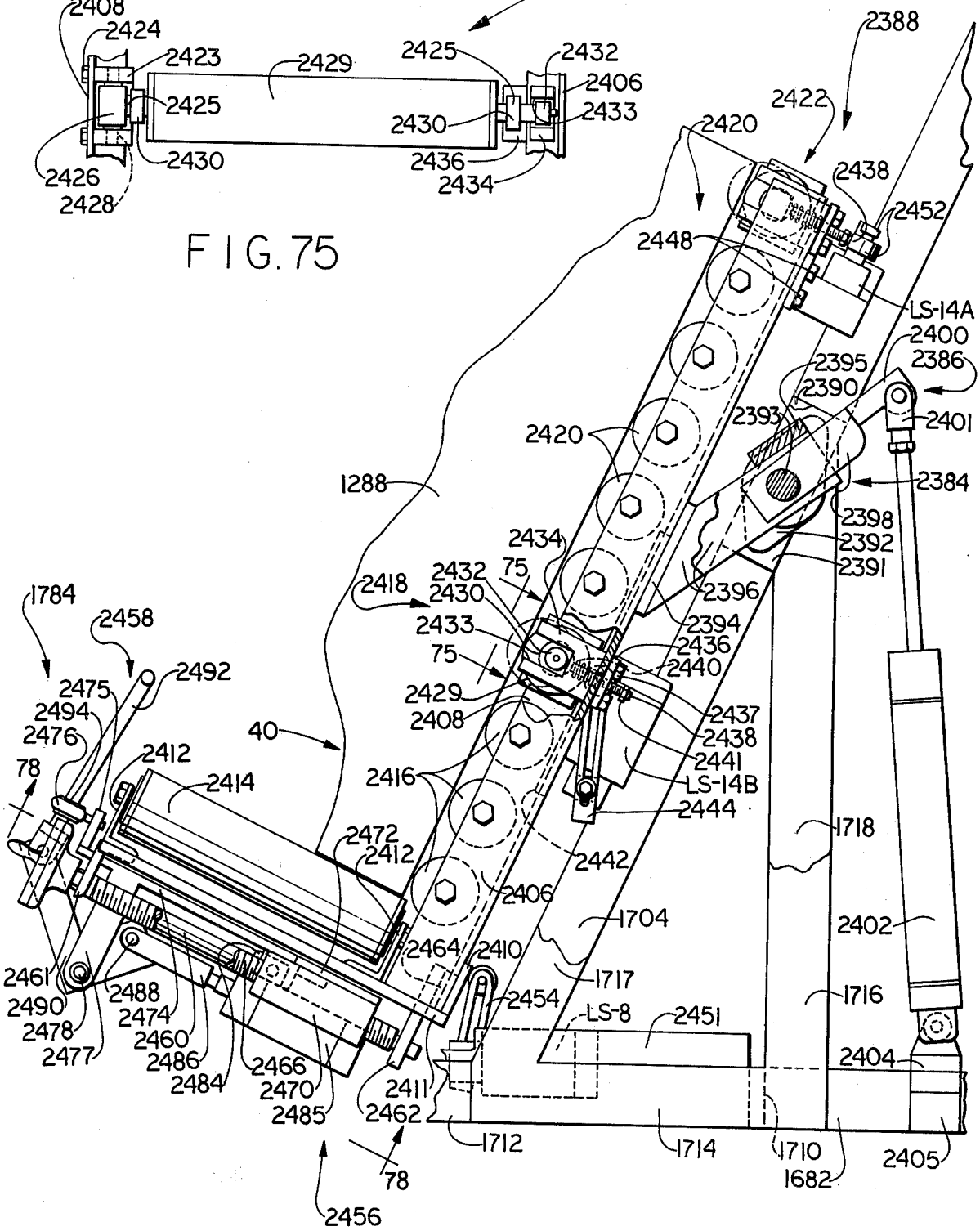
FIG. 76 is a side elevational view of the output tipover assembly, parts of the supporting structure being cut away to expose the tipover mechanism.
Figure 77:
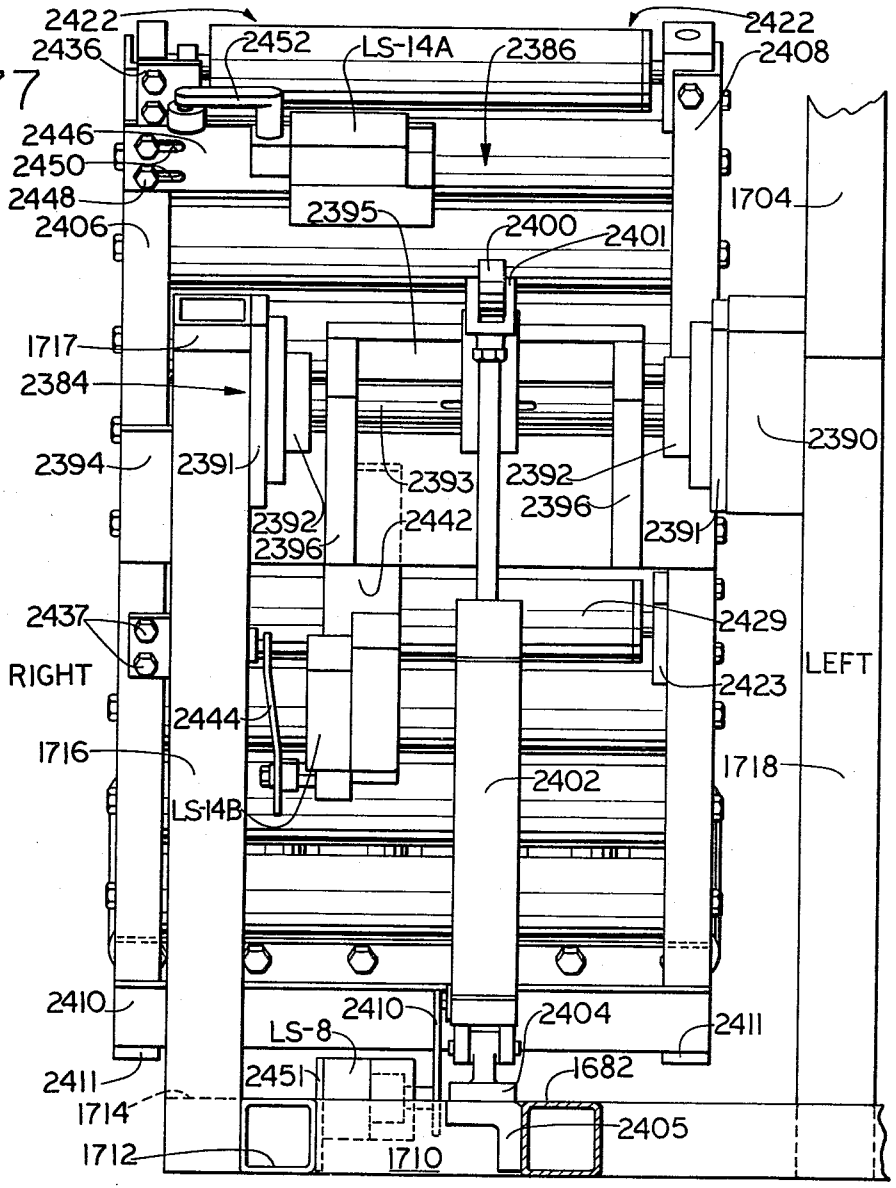
FIG. 77 is a back elevational view of the output tipover assembly of FIG. 76.

As the case 1288 slides upon the output tipover assembly 40, it depresses a limit switch LS-14A and a limit switch LS-14B that are shown in FIGS. 76 and 77, respectively. At this point, the case pushoff assembly 38 has reached its full extension, and the actuator of a limit switch LS-5 (FIGS. 68 and 69) is engaged by one of a pair of primary actuation arms 2332 to make the appropriate circuit to return the case pushoff assembly 38 to its original position. Upon reaching its original position, the case pushoff assembly 38 depresses a limit switch LS-3 that in turn causes the packing elevator 34 to move up the elevator incline 36 in rapid traverse. The limit switches LS-14A and LS-14B make a circuit which, when the limit switch LS-3 (FIG. 68) is actuated, activates a flap folding assembly 1784 of the output tipover assembly 40, moving the input end flap 1764B to a folded position 1764C (FIG. 72). On its way up, the packing elevator 34 contacts a second trip of the toggle-action limit switch LS-10 (FIG. 70) that resets this switch for the next pack cycle. The second function of the limit switch LS-3 makes the appropriate circuit that permits the output tipover assembly 40 to rotate clockwise with respect to FIGS. 72 and 76, bringing the full case 1288 up past horizontal so that gravity will cause the case 1288 to roll in the output direction onto the output conveyor 46.

The left side flap 1310 of the case 1288 passes to the left side of the right hand member of the pair of pack assembly side plates 1015 as the case 1288 rotates up to the customer output conveyor 46 upon the output tipover assembly 40. More specifically, the left side flap 1310 passes through the lateral clearance provided between the standoff bearing mount 1381 and the standoff mount 1383 (FIG. 48) of the carrier packing assembly 22. As the case 1288 rotates, the output end flap 1766 comes into contact with an output flap folder 1785 (FIG. 72) that folds it inwardly and down between the right side flap 1312 and the left side flap 1310.

The output flap folder 1785 is appropriately weighted to bring the output end flap 1766 inward, as well as to hold it and the folded input end flap 1764C in place as the case 1288 rolls off the output tipover assembly 40. Subsequent flap folding functions that close and seal the case 1288 are accomplished in the customer machine associated with the customer output conveyor 46. As the case 1288 exits the output tipover assembly 40, it releases the limit switch LS-14B and then the limit switch LS-14A. The limit switch LS-14B indicates that a case of any size is in place upon the output tipover assembly 40, while the limit switch LS-14A indicates that the full case 1288 has exited therefrom. As the limit switch LS-14A is released, the appropriate circuit is made that causes the output tipover assembly 40 to return to its receiver position and is indicated so by the making of a limit switch LS-8 that is shown in FIGS. 76 and 77. The structural attributes of the individual assemblies will now be discussed.

The case conveyor 1760 of the case input conveyor 30 is mounted about a case input roller 1786 and a case drive roller 1787 as is shown in FIG. 65. The case drive roller 1787 is fixedly attached, upon the right side of a case drive shaft 1789 as is shown in FIG. 61. The case drive shaft 1789 is rotatably mounted in a pair of case drive shaft bearings 1791 that is in turn fixedly attached to the upper inboard surfaces of the pair of pivot plates 1726 and 1726L that is mounted at the top of the case section frame assembly 44 as previously described. The case input roller 1786 (FIG. 65) is rotatably mounted upon a case input shaft 1788 and held in longitudinal alignment with the case input roller 1786 by a pair of shaft collars not shown. The case input shaft 1788 is fixedly held at each end by a pair of adjustable slide plates 1790, each one incorporating a pair of adjustment slots 1792 and an adjustment lug 1794. Each member of the pair of adjustable slide plates 1790 is fixedly but adjustably attached to the inboard surface of an input slide mount 1796 by a pair of slide bolts 1797 that passes through the pair of adjustment slots 1792 and threadably mounts into the face of the respective input slide mount 1796. The two input slide mounts 1796 are rigidly affixed to the inboard surface of, and at the output end of, the pair of horizontal rails 1728 and 1728L. The adjustment lug 1794 threadably incorporates an adjustment bolt 1798 that bears against an adjustment stop 1800 that is in turn rigidly affixed to the lower inboard surface of the input slide mount 1796. As the two adjustment bolts 1798 are turned inwardly, the pair of adjustable slide plates 1790 move in the output direction with respect to the bottle carrier checker/packer 10 as does the case input shaft 1788 and the case input roller 1786, thereby bringing tension into the case conveyor 1760.

A middle support roller 1802 (FIG. 65) longitudinally located at the middle of the case conveyor 1760 is rotatably mounted upon a middle support shaft 1804 and is held in longitudinal alignment with the case conveyor 1760 by a pair of shaft collars 1805. The middle support shaft 1804 is fixedly attached between the pair of horizontal rails 1728 and 1728L by a pair of middle shaft bolts 1806, as is shown in FIG. 64. The middle support roller 1802 maintains the elevational stability of the upper span of the case conveyor 1760.

Continuing with FIG. 65, a power input sprocket 1808 is fixedly attached upon the left side of the case drive shaft 1789 to cooperate with a case conveyor power chain 1810. The case conveyor power chain 1810 receives power from a power output sprocket 1811 of a case conveyor gear box 1812. A case conveyor motor 1814 is cantilever mounted to the output side of the case conveyor gear box 1812 and supplies motive power thereto to rotate the power output sprocket 1811 and subsequently the case conveyor 1760 in a counterclockwise direction. The case conveyor gear box 1812 is fixedly attached upon a case gear box mount plate 1816 that overhangs both sides of the cantilever motor mount 1733. A bottom spanner plate 1817 and a set of four spanner bolts and nuts 1818 cooperate with the case gear box mount plate 1816, to fixedly clamp it to the upper surface of the cantilever motor mount 1733.

The case 1288 is held in lateral alignment upon the top of the case conveyor 1760 by a case side guide assembly 1820 that is shown in FIGS. 63, 64 and 65, and incorporates a pair of slide rails 1822. The case input end 1826 of the pair of guide rails 1822 is flaired outboardly a small amount to accommodate some lateral misalignment of the incoming case 1288 while the case output end 1827 thereof is bent sharply downward to laterally control the case 1288 as it is manipulated by the input tipover assembly 32.

Referring to FIG. 63, each of the pair of guide rails 1822 rigidly incorporates a pair of threaded lateral studs 1823 that passes through clear holes in the top of a pair of offset rail risers 1824. The pair of threaded lateral studs 1823 is fixedly but adjustably clamped within the pair of offset rail risers 1824 by a set of four adjustment nuts 1825. The case input members of each pair of offset rail risers 1824 are rigidly affixed to the outboard ends of a pair of case input collars 1828, and the case output members thereof are likewise affixed to a pair of case output collars 1830. The left hand member of the pair of case input collars 1828 is threadably mounted upon a left hand input traverse shaft 1832, while the right hand member thereof is likewise mounted upon a right hand input traverse shaft 1834. The left hand member of the pair of case output collars 1830 is threadably mounted upon a left hand output traverse shaft 1836, while the right hand member thereof is likewise mounted upon a right hand output traverse shaft 1838. The inboard ends of the left and right hand input traverse shafts 1832 and 1834, respectively, are rigidly affixed to a case input shaft coupler 1840 so that they perform as one input adjustment shaft 1841. In identical manner, the left and right hand output traverse shafts 1836 and 1838, respectively, are rigidly coupled by a case output shaft coupler 1842 so that they perform as one output adjustment shaft 1843. The left hand input and output traverse shafts 1832 and 1836, respectively, incorporate left hand threads, while the right hand input and output traverse shafts 1834 and 1838, respectively, incorporate right hand threads so that when the input and output adjustment shafts 1841 and 1843, respectively, are rotated in unison, the left and right hand members of the pair of guide rails 1822 will either move apart or toward each other to accommodate various sizes of cases 1288.

The left hand extremity of the input adjustment shaft 1841 is rotatably mounted in an input channel bushing 1844 (FIG. 63) that is in turn rigidly carried by the inboard surface of the left hand horizontal rail 1728L through the interspacing auspices of a bushing spacer (not shown); while the right hand end thereof extends through the right hand horizontal rail 1728 and is rotatably held in a spacer bushing 1846 (FIG. 64) that is rigidly affixed to the outboard side thereof. An input adjustment sprocket 1848 is fixedly attached to the right hand extremity of the input adjustment shaft 1841.

The left hand extremity of the output adjustment shaft 1843 is rotatably mounted in an output channel bushing 1850 (FIGS. 63 and 65), that is in turn rigidly carried by the inboard surface of the left hand horizontal rail 1728L through the interspacing auspices of a bushing hanger spacer 1851; while the right hand end thereof extends under the right horizontal rail 1728 and is rotatably held in a right hand bushing hanger spacer 1853 (FIGS. 63 and 64) that is rigidly affixed to the outboard side thereof. An output adjustment sprocket 1852 is fixedly attached to the right hand extremity of the output adjustment shaft 1843.

Referring now to FIGS. 61 and 64, the rotation of the input and output adjustment sprockets 1848 and 1852 respectively is synchronized by a side rail chain 1854 that circumscribes the two sprockets and a crank sprocket 1856 (FIG. 61). The crank sprocket 1856 is fixedly attached to a short crank shaft 1858 that is in turn rotatably mounted at and through the top of a pair of bushing plates 1860. The pair of bushing plates is fixedly clamped to opposing sides of the right hand diagonal stiffener 1730 by a set of four spanner bolts 1861. The outboard extremity of the short crank shaft 1858 is fixedly fitted with a side guide crank handle 1862 for manual adjustment of the pair of guide rails 1822.

The input tipover assembly 32 is shown structurally in FIGS. 61 and 65, and is comprised of a tip body 1864 and the compressor 1774. The top body 1864 incorporates an input plate 1866, an output plate 1868, a top slide block 1870 and a bottom plate 1872. The bottom plate 1872 is rigidly affixed to the bottom inside surfaces of the input and output plates 1866 and 1868, respectively, while the top slide block 1870 is fixedly attached between the upper ends thereof, to form a rectangular framework 1873. The input plate 1866 of the rectangular framework 1873 is slidably mounted within the inner confines of a slide channel 1874 whose flanges extend in the case output direction to substantially envelop three sides of the input plate 1866.

The bottom end of the slide channel 1874 is rigidly fitted with a jack base plate 1876 that incorporates a bearing bushing in the output end thereof. Vertically and rotatably retained in the jack base plate 1876 is an input tipover jack screw 1878 whose lower extremity is fixedly fitted with a compressor adjustment handle 1880. The input tipover jack screw 1878 is threadably mounted through the bottom plate 1872 of the rectangular framework 1873. The rectangular framework 1873 is adjustably retained and locked in parallel relationship to the slide channel 1874 by a cam lock handle 1882 and a retainer pin 1884. The retainer pin 1884 fits through a clear hole in the slide channel 1874 and an elongated slot, not shown, in the input plate 1866 and incorporates a head on the output end thereof for retention of washers and the input plate 1886. When the cam lock handle 1882 is in the horizontal position, the cam thereof is in a released position, retaining the rectangular framework 1873 in parallel alignment with the slide channel 1874, but not clamping it thereto. Manual rotation of the compressor adjustment handle 1880 will raise or lower the rectangular framework 1873 in relation to the slide channel 1874. Subsequently, the cam lock handle 1882 is pulled down to the vertical position, the cam pulls the retainer pin 1884 and washers against the output side of the input plate 1866, thereby locking the rectangular framework 1873 in fixed relationship to the slide channel 1874.

The upper input extremity of the slide channel 1874 rigidly incorporates a tipover pivot block 1886. The input end of the tipover pivot block 1886 is fixedly mounted about the left side of a tipover pivot shaft 1888.

The tipover pivot shaft 1888 (FIG. 61) is pivotally mounted in a pair of input tipover bearings 1889 that is in turn fixedly attached to the lower inboard surfaces of the pair of pivot plates 1726 and 1726L. As is seen in FIGS. 61 and 65, a pivot block 1890 is fixedly attached to the tipover pivot shaft 1888 and laterally adjacent to the right hand side of the tip body 1864. Rigidly affixed to the top of, and extending in the output direction from the pivot block 1890, is a tip lug 1892. The free end of the tip lug 1892 pivotally incorporates a tip cylinder clevis 1893 that is fixedly attached to the working end of an input tipover cylinder 1894. The base of the input tipover cylinder 1894 is pivotally attached to an input tipover cylinder mount 1896 that is in turn rigidly affixed to the upper surface of the incline brace 1706 of the case section frame assembly 44.

Figure 66:
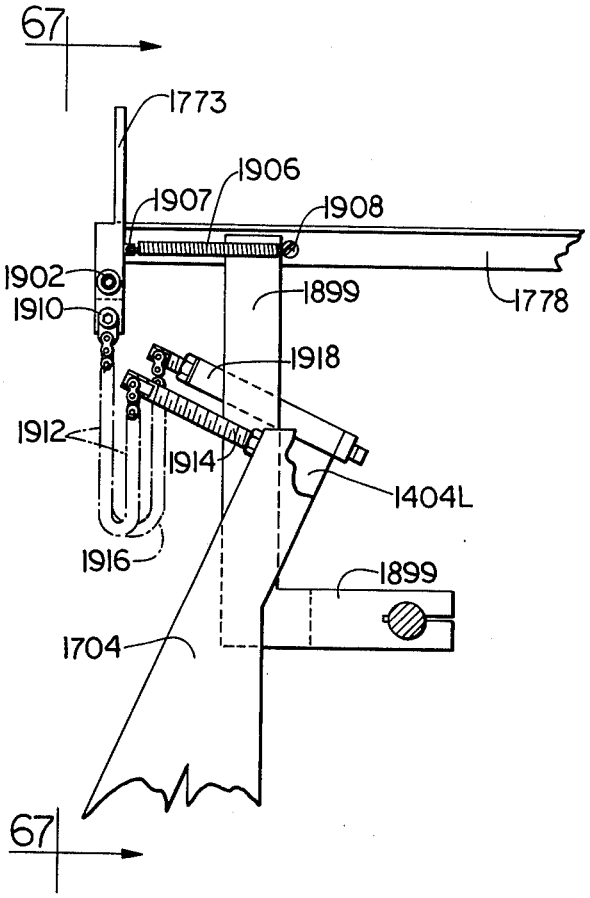
FIG. 66 is a fragmentary view of the top of the elevator incline in side elevation showing details of a pair of trip chains associated with the case input tipover assembly.
Figure 67:
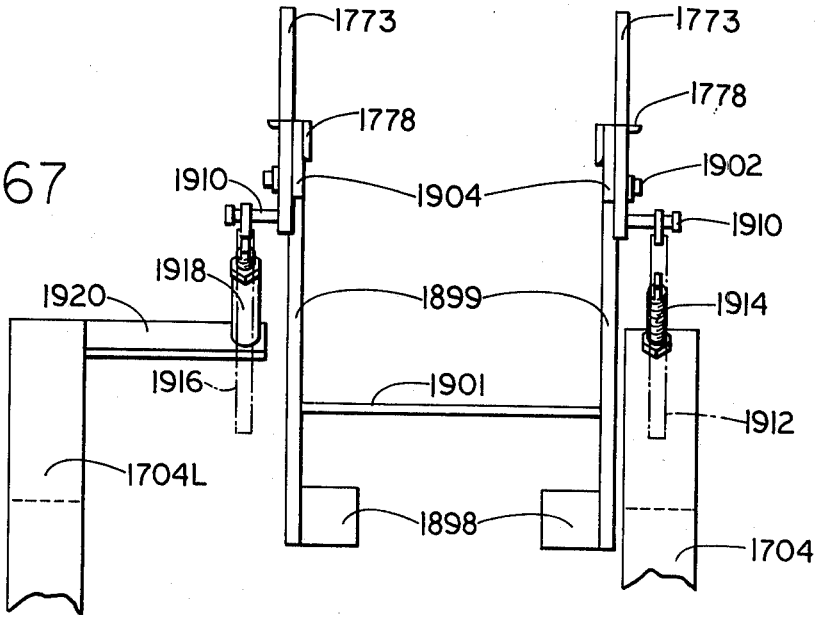
FIG. 67 is a fragmentary front elevational view looking in the direction of the arrows 67—67 in FIG. 66.

As is shown in FIGS. 61 and 64, the tip cam 1779 is fixedly attached to the tipover pivot shaft 1888 and at a lateral position that is adjacent to the right hand member of the pair of input tipover bearings 1889, and extends in the case output direction and somewhat downwardly. Symmetrically located on the tipover shaft 1888 between the pivot block 1890 and the tip cam 1779 is a pair of rail mounts 1898, that is of rectangular shape as seen in FIG. 64. Rigidly affixed to the outboard surfaces of the pair of rail mounts 1898 is a pair of L-shaped risers 1899 that extend in the case output direction and then upwardly, as is best shown in FIGS. 66 and 67. A lateral stiffener bar 1901 is rigidly affixed between the vertical portions of the pair of L-shaped risers 1899 to keep them in fixed lateral spaced relationship.

Rigidly affixed in a horizontal and longitudinal disposition across the upper extremities of the pair of L-shaped risers 1899, is the pair of tipover rail, 1778, as is shown specifically in FIGS. 66 and 67. The pair of tipover rails 1778 extends a small distance in the case output direction from the upper extremities of the L-shaped risers 1899 and pivotally supports the pair of retainer tines 1773. The upper flange of the pair of angle rails 1778 is partially cut away to accommodate the pair of retainer tines 1773 that is pivotally mounted by a pair of shoulder bolts 1902 to a pair of tine mounts 1904. The pair of tine mounts 1904 is rigidly affixed to the outboard surfaces of the vertical flanges of the angle rails 1778 in such position that the upright pair of retainer tines 1773 will rest against the foreshortened end of the upper rail flange, thereby preventing any clockwise rotation of the pair of retainer tines 1773 beyond the vertical.

Rotational force in the clockwise direction is provided by a pair of tine reset springs 1906 that is hooked between a pair of spring lugs 1907 and a pair of spring pins 1908 that is shown in the upper position of FIG. 66. The pair of spring lugs 1907 is rigidly affixed to the case input side of the pair of retainer tines 1773 and just below the horizontal flange of the pair of angle rails 1900. The pair of spring pins 1908 is rigidly affixed in the outboard face of the vertical flange of the pair of angle rails 1900 and adjacent the case input side of the intersection between the pair of angle rails 1900 and the pair of L-shaped risers 1899.

Again referring to FIGS. 66 and 67, the lower extremity of the pair of retainer tines 1773 fixedly incorporates a pair of chain shoulder bolts 1910 that extends in cantilever manner from the outboard surfaces thereof. The right hand member of the pair of chain shoulder bolts 1910 pivotally accommodates a right hand restraining chain 1912 that hangs vertically downward and then is looped upward and toward the case input end to be pivotally retained upon the upper end of a right hand chain pin 1914. The right hand chain pin 1914 is fixedly attached in the carrier input side of, and at the top extremity of, the right hand incline riser 1704. The left hand member of the pair of chain shoulder bolts 1910 likewise pivotally accommodates a left hand restraining chain 1916 that hangs vertically downward and then is looped upward and toward the case input end to be pivotally retained upon the upper end of a left hand chain pin 1918. The left hand chain pin 1918 is somewhat longer than the right hand chain pin 1914 so that is can be fixedly attached in the inboard end of a left side pin mount 1920. The left side pin mount 1920 is rigidly affixed in a cantilever manner to the carrier output side of, and at the upper extremity of, the left hand incline riser 1704L. When the input tipover cylinder 1894 contracts, the tip lug 1892 and the pivot block 1890 rotate the tipover pivot shaft 1888 counterclockwise with respect to FIG. 65. Consequently, the tipover pivot block 1886 and the tip body 1864, along with the pair of rail mounts 1898 (FIG. 64), the pair of L-shaped risers 1899 and the pair of angle rails 1900, rotate with the tipover pivot shaft 1888 until the tip cam 1779 rotates into physical contact with the hydraulic valve HV-1. The hydraulic valve HV-1 stops the input tipover cylinder 1894, thus placing the input tip assembly 32 in the 80% tipped position as previously described. When the hydraulic valve HV-2 is operated, the tip process is completed, and in so doing the right and left hand restraining chains 1912 and 1916, respectively, are drawn taut, causing the pair of retainer tines 1773 to rotate about the pair of shoulder bolts 1902. When the pair of retainer tines 1773 becomes parallel with the pair of angle rails 1900, the case 1288 is released therefrom and placed in the retaining elements of the packing elevator 34 which thereafter moves the case 1288 down the elevator incline 36. When the input tipover assembly 32 is released, the left and right hand restraining chains 1916 and 1912 respectively relax, permitting the pair of tine reset springs 1906 to return the pair of retainer tines 1773 to their upright position in preparation for another case 1288.

Mounted within the rectangular framework 1873 is a compressor cylinder 1922, as shown in FIG. 65. More specifically, the base of the compressor cylinder 1922 is pin mounted to a base lug 1924 that is in turn rigidly affixed to the top surface of the bottom plate 1872. The compressor cylinder 1922 stands upright, and its working end is fixedly retained within a bottom slide retainer 1925. The bottom slide retainer 1925 also functions as a base retainer for a pair of compressor slide rods 1926 that is fixedly attached therein. The pair of compressor slide rods 1926 is slidably retained in parallel holes in the top slide block 1870 and its top extremity is fixedly attached within a top slide retainer 1927.

Referring now to FIGS. 61 and 65, the top compressor bar 1776 is fixedly attached to the top slide retainer 1927 by a compressor bar mount assembly 1928. The compressor bar mount assembly 1928 is comprised of a short hanger 1930, a lateral arm 1932 (FIG. 61), a side riser 1934, a short lateral arm 1936 and a compressor bar mount assembly pad 1937. The short hanger 1930 is rigidly affixed upon the upper surface of the top compressor bar 1776 with the greater portion thereof extending in the case input direction. A pair of gussets 1938 is rigidly affixed at the intersection of the short hanger 1930 and the top compressor bar 1776 to provide a degree of elevational stability along the length of the top compressor bar 1776. The upper extremity of the short hanger 1930 is rigidly affixed to the inboard end of the lateral arm 1932 (FIG. 61), the outboard end of the lateral arm 1932 is rigidly affixed to the top extremity of the side riser 1934, the bottom inboard end of the side riser 1934 is rigidly affixed to the outboard extremity of the short lateral arm 1936, and the short lateral arm 1936 is rigidly affixed across the top of, and at the case input end of, the compressor bar mount assembly pad 1937 to form the rectangularly shaped compressor bar mount assembly 1928. The intersections of the compressor bar mount assembly 1928 are strengthened by a set of three gussets 1940 that is rigidly affixed in the corners thereof.

The compressor bar mount assembly 1928 is fixedly attached upon the top surface of the top slide retainer through the auspices of the compressor bar mount assembly pad 1937. Consequently, when the compressor cylinder 1922 withdraws, it moves the slide rod assembly and the compressor bar mount assembly 1928 downward, so that the top compressor bar 1776 comes down to rest upon the top of the corrugated case 1288 with a small compressive force.

The case output end of the top compressor bar 1776 incorporates the flap bender assembly 1780. Referring to FIGS. 61 and 65, the flap bender assembly 1780 is comprised of a mount bushing 1942, a depresser shaft 1943, and a depresser leaf spring 1944. The depresser leaf spring 1944 is rigidly affixed to the left end of the depresser shaft 1943, that is in turn fixedly and adjustably mounted, at its right hand extremity, in the mount bushing 1942 so that the depresser leaf spring 1944 angles appropriately downwardly in the case output direction.

Also shown in FIGS. 61 and 65, is a flap lifter rod 1946 that is rigidly affixed to the outboard side of, and at the input end of, a rod bracket 1947. The rod bracket 1947 overhangs the edges of the side riser 1934, and is fixedly but adjustably clamped thereto by a clamp bracket 1948 and a pair of spanner bolts 1949. The flap lifter rod 1946 is bent downwardly in the case input direction to receive the outside surface of the left side flap 1310 of the case 1288 to insure that is passes the side riser 1934 without interference.

Consequently, when the compressor cylinder 1922 contracts, the working end thereof retracts the pair of compressor slide rods 1926, the compressor bar mount assembly 1928, and therefore the top compressor bar 1776 downwardly upon the top of the case 1288 (FIG. 62) with sufficient pressure to secure it upon the pair of angle rails 1778 of the input tipover assembly 32 during the tipover operation. The case input end of the top compressor bar 1776 folds the output end flap 1766 downwardly to a horizontal position, while the input end flap 1764 is bent downwardly beyond the horizontal by the flap bender assembly 1780. This additional bending of the input end flap 1764 is so adjusted that the input flap 1764 will be captured by the flap retainer 1998 (FIG. 74) of the packing elevator 34, as disclosed more fully hereinafter.

Using FIGS. 61 and 64, it can be seen that the limit switch LS-17 is fixedly mounted to the upper output side of the tip body 1864 of the input tipover assembly 32 through the interspacing auspices of a mount spaces 1950. A trip arm and roller 1952 of the limit switch LS-17 extends to the left side of the input tipover assembly 32 and is so positioned as to be depressed by a switch trip 1953 that is rigidly affixed to the lower outboard surface of the side riser 1934 of the compressor bar mount assembly 1928.

The limit switch LS-2 is fixedly mounted upon a mount plate 1954 that is in turn rigidly affixed to the unsupported end of a long cantilever mount 1956. The long cantilever mount 1956 rigidly incorporates a mount foot 1957 (FIG. 65) at the left end thereof, which is in turn fixedly attached to the upper inboard surface of the left hand pivot plate 1726L. The limit switch LS-2 incorporates a switch arm and roller 1958 that extends to the right side therefrom, and upwardly so that the roller is laterally centered with respect to the case conveyor 1760, and extends slightly thereabove. In this manner, the incoming case 1288 will rotate the switch arm and roller 1958 counterclockwise with respect to FIG. 63, as has been previously described (FIG. 62).

The limit switch LS-13 is fixedly attached to a switch mount plate 1960 that is in turn rigidly affixed to the outboard surface of the left hand tall riser 1702L and adjacent the bottom end of the input tipover assembly 32. The switch mount plate 1960 extends in the carrier input direction to hold the limit switch LS-13 and an associated switch arm and roller 1962 in lateral and longitudinal alignment with a trip lip 1963 that is rigidly affixed in a vertical disposition to the bottom case output corner of the rectangular framework 1873.

The hydraulic valve HV-1 that is mechanically shown in FIGS. 61 and 64 is fixedly attached to the outboard surface of a cantilever mount plate 1964, that is in turn rigidly affixed to the left hand surface of the right hand tall riser 1702 through the interspacing auspices of a spacer block 1965. The cantilever mount plate 1964 extends in the case input direction and holds the hydraulic valve HV-1 in lateral and longitudinal alignment with the tip cam 1779 as it swings downward to a vertical disposition during the tip operation.

The limit switch LS-12, shown in FIGS. 61 and 65, is fixedly attached near the top of, and to the carrier input face of, the left hand incline riser 1704L through the interspacing auspices of a mounting bracket 1966. A trip arm and roller 1968 extends to the right of the limit switch LS-12 which is so positioned to bring it in longitudinal alignment with the output plate 1868 of the input tipover assembly 32. As the input tipover assembly 32 rotates from its 80% tip position (FIG. 62) to its full tip position, the trip arm and roller 1968 comes in contact with the upper portion of the output plate 1868 and is rotated counterclockwise and terminates the tip process as has been previously described.

Figure 74:
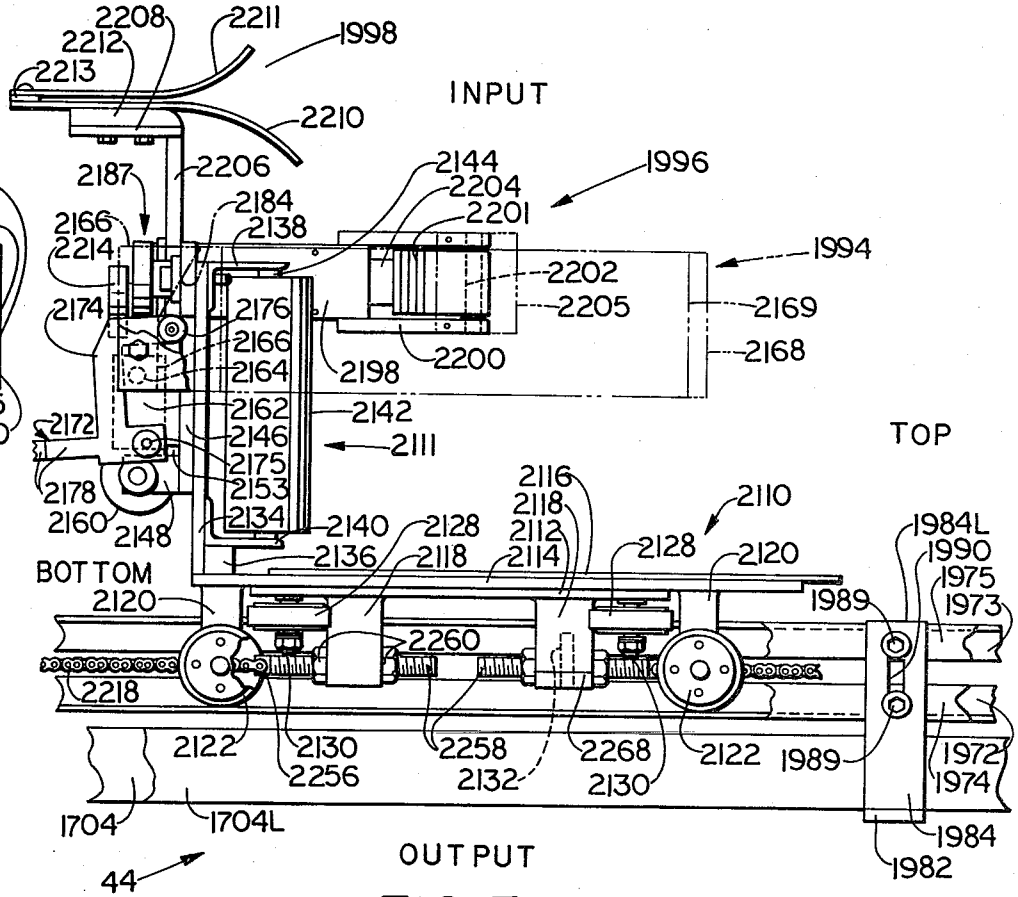
FIG. 74 is a side elevational view showing the packing elevator and its mounting upon the elevator incline.
Figure 73:
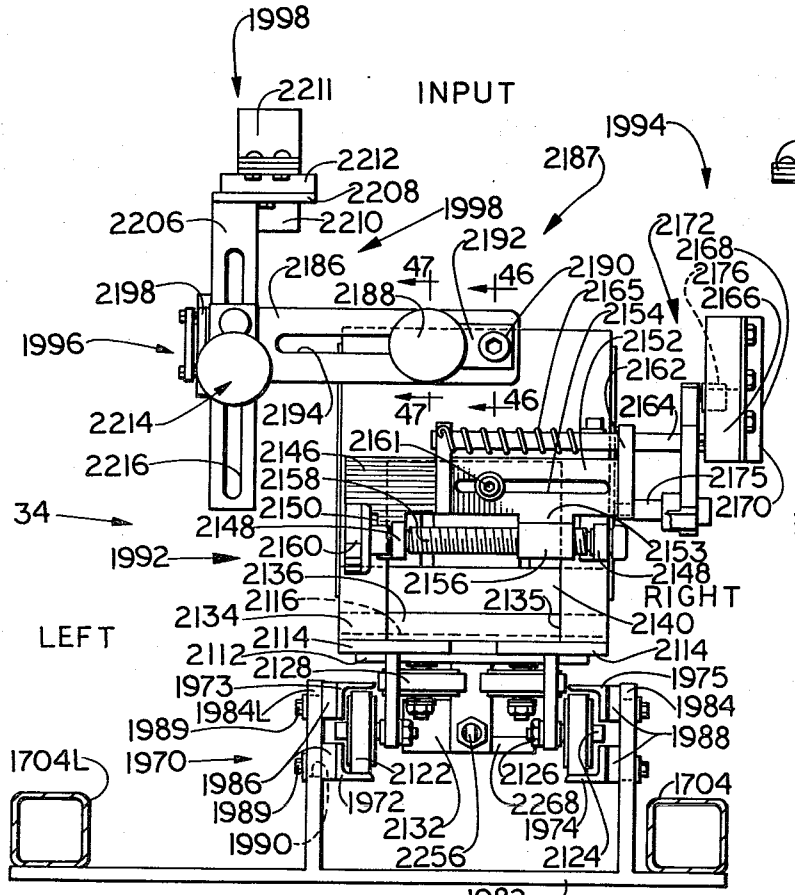
FIG. 73 is a bottom view of a packing elevator and its mounting upon the elevator incline, frame elements being shown in section, looking in the direction of the arrows 73—73 in FIG. 45.

The method of attachment of the elevator incline 36 to the case section frame assembly 44 is shown in FIGS. 73 and 74. The packing elevator 34 traverses up and down the elevator incline 36 within the confines of a rail assembly 1970 that is comprised of a left hand rail 1972, a right hand rail 1974, a left hand retainer rail 1973, and a right hand retainer rail 1975. As can be seen in FIG. 70, the rail assembly 1970 is fixedly but adjustably attached to the pair of incline risers 1704 and 1704L by a bottom rail mount assembly 1976, a middle rail mount assembly 1978, and a top rail mount assembly 1980. The bottom, middle and top rail mount assemblies 1976, 1978 and 1980, respectively, are similar in structure and each incorporates, as shown in FIGS. 73 and 74, a lateral mount bar 1982, a pair of rail risers 1984 and 1984L, a pair of left hand mount blocks 1986, and a pair of right hand mount blocks 1988. With respect to FIG. 73, the upper member of the pair of left hand mount blocks 1986 is rigidly affixed to the outboard side of the left hand retainer rail 1973, while the lower member of the pair of left hand mount blocks 1986 is likewise attached to the left hand rail 1972. The pair of left hand mount blocks 1986 is fixedly and adjustably attached to the inboard face of the left hand rail riser 1984L by a pair of cap screws 1989 that passes through a clear slot 1990 in the upper portion thereof, and threadably mount in the pair of left hand mount blocks 1986. The left hand rail riser 1984L is rigidly and perpendicularly affixed to the top of the lateral mount bar 1982.

The right hand retainer rail 1975 and the right hand rail 1974 are mounted to the lateral mount bar 1982 in the same manner as, but in a mirror image to, the left hand rail 1972 and the left hand retainer rail 1973 as just described. The pair of rail risers 1984 and 1984L is laterally located upon the lateral mount bar 1982 in such position to bring the packing elevator 34 in proper lateral alignment with the carrier packing assembly 22. Consequently, the left and right hand rails 1972 and 1974, respectively, and the left and right hand retainer rails 1973 and 1975, respectively, can be appropriately aligned with respect to each other and also with respect to the pair of incline risers 1704 and 1704L upon the bottom, middle and top rail mount assemblies 1976, 1978 and 1980, respectively. The packing elevator 34 is thereby confined within the adjustable space between the right hand rail 1974 and the right hand retainer rail 1975, and the left hand rail 1972 and the left hand retainer rail 1973.

The packing elevator 34 is mechanically shown in FIGS. 45, 73 and 74 and is comprised of a body assembly 1992, a right hand case retainer 1994, a left hand case retainer 1996 and the flap retainer 1998.

The body assembly 1992 incorporates a back assembly 2110 and a base assembly 2111 as is most clearly shown in FIG. 74. The back assembly 2110 incorporates a side guide mount plate 2112 (FIGS. 73 and 74), a pair of long mount plates 2114, a back plate 2116, a pair of chain lugs 2118, and a set of four wheel struts 2120. In discussing the packing elevator 34, the directional terminology of the bottle carrier handling assembly 12 will be followed, making the top of FIG. 74 the input side; the bottom, the output side; the left hand side of the figure is the bottom; and the right hand side the top. The back plate 2116 is rigidly affixed to the input face of the pair of long mount plates 2114 and slightly overhangs the top end thereof, while the bottom ends of the pair of long mount plates 2114 extend beyond the lower extremity of the back plate 2116. The side guide mount plate 2112 is rigidly affixed in laterally centered position to the output surface of the pair of long mount plates 2114. The side guide mount plate 2112 is located somewhat closer to the bottom extremity of the pair of long mount plates 2114. The set of four wheel struts 2120 is rigidly affixed in a perpendicular disposition to the output surface of the pair of long mount plates 2114, and positioned thereupon adjacent to the top and bottom extremities of the side guide mount plate 2112.

The set of four wheel struts is laterally placed so as to coincide with the center lines of each member of the pair of long mount plates 2114. A set of four wheels 2122 is rotatably mounted upon a set of four shoulder bolts 2124, the threads of which pass through clear holes in the unsupported end portions of the set of four wheel struts 2120 and are fixedly held therein by a set of four nuts 2126 (FIG. 73). The set of four wheels 2122 extends outwardly from the set of four wheel struts 2120 to cooperate with the lateral flanges of the left and right hand rails 1972 and 1974, respectively, but not to interfere with the side flanges thereof.

A set of four side guide wheels 2128 is rotatably mounted on a set of four shoulder studs 2130, that is in turn threadably mounted into the output face of the side guide mount plate 2112 so that the top and bottom pairs thereof are adjacent to the top and bottom pair of the set of four wheel struts 2120. The set of four shoulder studs 2130 is laterally placed so that the set of four side guide wheels 2128 can cooperate with the inboard edges of the lateral flanges of the left and right hand retainer rails 1973 and 1975, respectively, (FIG. 73), to insure that the packing elevator 34 retains a sound lateral alignment with the carrier packing assembly 22. The pair of chain lugs 2118 is also perpendicularly and rigidly affixed to the output face of the side guide mount plate 2112, each being adjacent to the top and bottom pair of the set of four side guide wheels 2128. The top chain lug rigidly incorporates a limit switch trip plate 2132 that extends laterally from the left side thereof to cooperate in contacting the switch arm and rollers of limit switches LS-11, LS-10, LS-1A and LS-1 that are shown in FIGS. 68 and 70.

The base assembly 2111 of the body assembly 1992 of the packing elevator 34 is comprised of a base plate 2134, a square bar 2136, an input angle 2138, an output angle 2140 and a set of three base rollers 2142, as shown in FIGS. 45, 73 and 74. The base plate 2134 incorporates a square cutout 2135 (FIG. 73) that enters from the output edge thereof, making the base plate 2134 appear as an inverted "U" in the Figure as is indicated by the dashed lines. The base plate 2134 is then rigidly affixed in this position to the lower input surface of the pair of long mount plates 2114, and their perpendicular relationship is assured by the square bar 2136 that is rigidly affixed in the intersection therebetween. The upright flange of the output angle 2140 is rigidly affixed to the input surface of the square bar 2136 and the other flange is rigidly affixed to the upper surfaces of the base plate 2134. The output angle 2140 and the square bar 2136 extend laterally across the width of the body assembly 1992, to span the square cutout 2135 of the base plate 2134. The input angle 2138 is rigidly affixed across the upper input edge of the base plate 2134 so that its upright flange is opposite the upright flange of the output angle 2140. The set of three base rollers 2142 is rotatably mounted upon a set of three shafts 2144 that is in turn fixedly attached in a uniform distribution between the upright flanges of the input and output angles 2138 and 2140, respectively.

The right hand case retainer 1994 is also shown in FIGS. 45, 73 and 74, and is a laterally adjustable device that must fold its side guide from an upright to the transverse position to permit the case 1288 to exit therefrom. The right hand case retainer 1994 incorporates a slide mount plate 2146 that is rigidly affixed in a lateral orientation across the central portion of, and upon the lower surface of, the base plate 2134 of the body assembly 1992. A pair of adjustment screw mounts 2148 is perpendicularly and rigidly affixed to the lower surface of a pair of output lugs 2150 that is an integral part of the slide mount plate 2146.

A right side slide plate 2152 incorporates an integral output lug 2153 and a lateral slide slot 2154. An adjustment lug 2156 is rigidly affixed upon the lower surface of the integral output lug 2153 and extends downwardly between the pair of adjustment screw mounts 2148. The adjustment lug 2156 is threadably mounted upon an adjustment screw 2158 that is in turn rotatably mounted in and between the pair of adjustment screw mounts 2148. The left extremity of the adjustment screw 2158 extends laterally and outwardly beyond the left hand member of the pair of adjustment screw mounts 2148 to fixedly incorporate an adjustment handle 2160. The right side slide plate 2152 is fixedly but adjustably attached to the lower surface of the slide mount plate 2146 by a cap screw 2161 that extends through the clear lateral slide slot 2154 to threadably mount in the slide mount plate 2146.

The lateral extremities of the right side slide plate 2152 rigidly incorporate in a vertical disposition a pair of retainer shaft mounts 2162 that extends downwardly sufficiently to pivotally incorporate a retainer shaft 2164. The right hand extremity of the retainer shaft 2164 extends beyond the right hand member of the pair of retainer shaft mounts 2162 to fixedly incorporate a right hand retainer mount 2166. As positioned in the Figures, the output extemity of the right hand retainer 2166 is mounted upon the retainer shaft 2164 so that it functions as a torque arm to rotate the shaft against a torque spring 2165. The right hand extremity of the torque spring 2165 is fixedly attached to the retainer shaft 2164 while the other end is retained upon the top of the left hand member of the pair of retainer shaft mounts 2162. A right hand retainer plate 2168 is fixedly attached to the outboard surface of the right hand retainer mount 2166. The right hand retainer plate 2168 is constructed of spring steel and incorporates an outwardly extending lip 2169 at the upper end thereof to facilitate the entry of the case 1288. A relief bend 2170 is incorporated at the lower extremity of the right hand retainer plate 2168 to insure that excessive friction is not applied to the entering case 1288.

An actuation arm 2172 incorporates a "C" shaped upper member, when viewing FIG. 74, the output leg of the "C" being pivotally mounted upon a pivot stud 2175 that is in turn rigidly affixed in the outboard face of, and at the output edge of, the right hand member of the pair of retainer shaft mounts 2162. The input leg of the "C" shaped upper member 2174 of the actuation arm 2172, incorporates a cam roll 2176, rotatably mounted in the right hand side thereof. The actuation arm 2172 is also comprised of a downwardly extending offset arm 2178 (FIG. 45), whose upper extremity is fixedly attached in upright alignment with the output leg of the C-shaped upper member 2174. The lower extremity of the offset arm 2178 rigidly incorporates a cantilever shaft 2181 that extends to the left therefrom. The cantilever shaft 2181 rotatably incorporates a set of three rollers 2180 that is so positioned laterally so as to come in contact with a trip ramp 2182 (FIGS. 59 and 70) when the packing elevator 34 reaches the bottom of is travel upon the elevator incline 36. The trip ramp 2182 is laterally adjustable (FIG. 59), but fixedly attached to the upper surface of the input lateral brace 1684 of the case section frame assembly 44.

The cam roll 2176 that is rotatably attached to the input leg of the C-shaped upper member 2124 of the actuation arm 2172 works against an incline ramp 2184 (FIG. 74) that is an integral part of the upper surface of the right hand retainer mount 2166. When the set of three rollers 2180 comes downward into contact with the trip ramp 2182, the lower extremity of the offset arm 2178 is forced to move in the output direction, thereby pivoting the C-shaped upper member 2174 in the counter-clockwise direction (FIG. 74) about the pivot stud 2175. As the cam roll 2176 swings down, its interaction with the incline ramp 2184 forces the right hand retainer mount 2166 to pivot in concert with the retainer shaft 2164 and against the restoring force of the torque spring 2165. The right hand retainer plate 2168 will therefore rotate approximately 90° from its upright position to a transverse position, pointing in the carrier input direction. The case 1288 can then leave the packing elevator 34. As the packing elevator 34 begins to move up the elevator incline 36, the torque spring 2165 will restore the right hand retainer plate 2168 to its original position and secures it there, while gravity holds the actuation arm 2172 in proper relationship thereto in preparation for the next cycle. The right hand retainer plate 2168 is laterally adjustable by rotation of the adjustment handle 2160 of the adjustment screw 2158 to accommodate various sizes of cases 1288.

The case left side 1304 is gripped and restrained from sliding out of position upon the packing elevator 34 by a left hand case retainer 1996 thatis shown in FIGS. 45, 73 and 74. The left hand case retainer 1996 incorporates a lateral extension arm mount 2186. The lateral extension arm mount 2186 is fixedly but adjustably mounted to the lower surface of, and along the input side of, the base plate 2134 by a clamp adjustment assembly 2187. The clamp adjustment assembly 2187 is comprised of a hand lock 2188, a stop slide pin 2190, and a pressure plate 2192.

Figure 46:
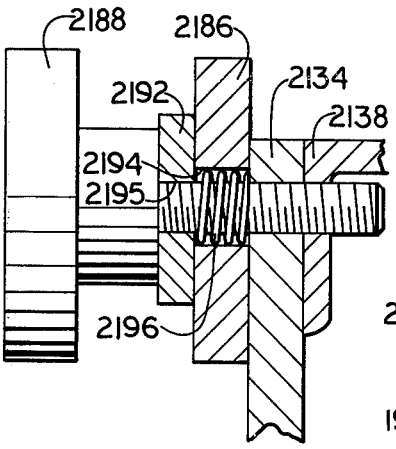
FIG. 46 is an enlarged fragmentary sectional view of a clamp assembly taken along line 46—46 in FIG. 73.
Figure 47:
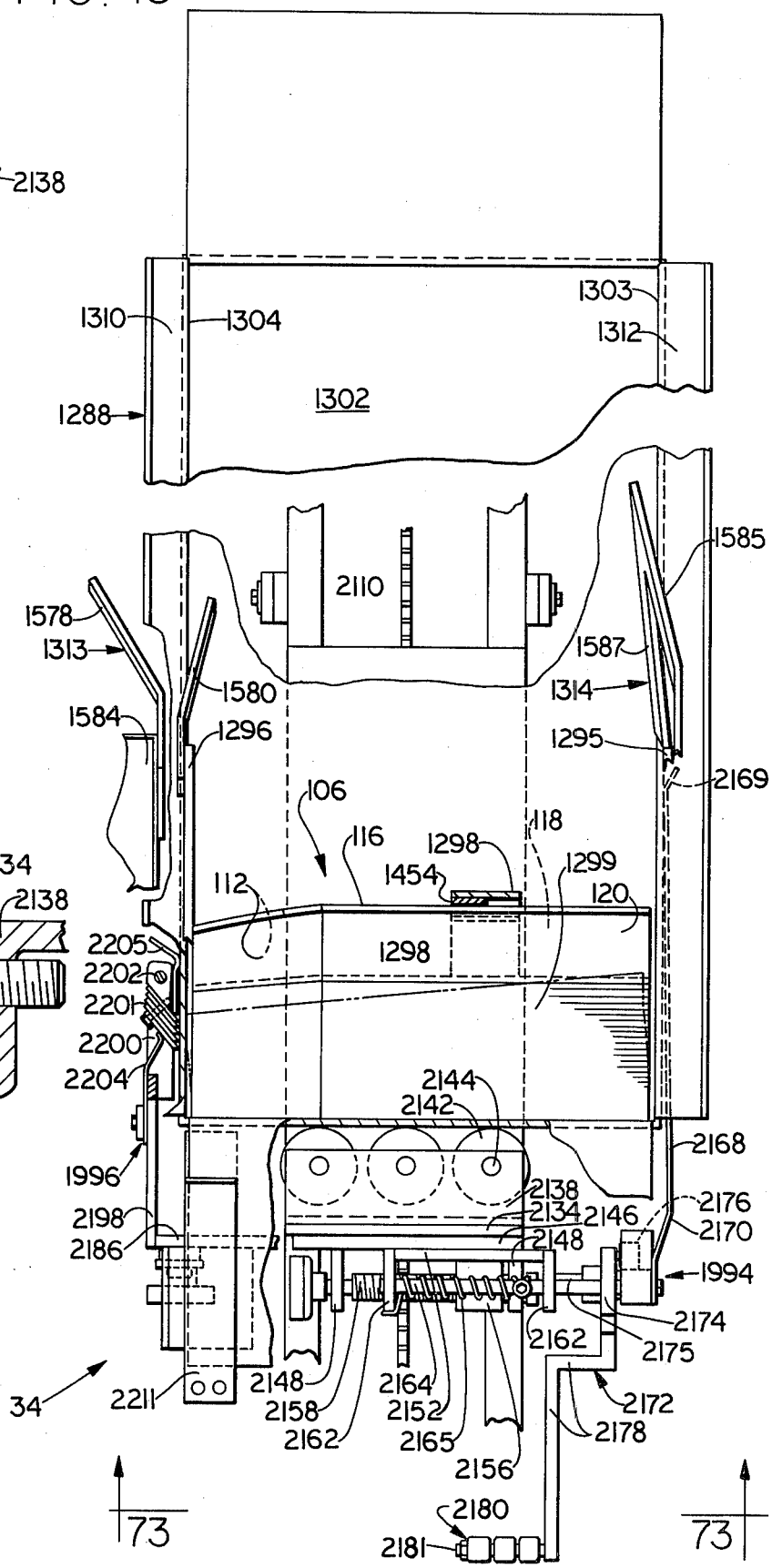
FIG. 47 is an enlarged fragmentary sectional view of a hand lock assembly taken along line 47—47 in FIG. 73.

As can be seen in FIG. 46, the stop slide pin 2190 is a short shoulder bolt that fits closely through a clear hole 2193 in the pressure plate 2192 as well as a clear long slot 2194 in the lateral extension arm mount 2186. The stop slide pin 2190 is threadably mounted in the base plate 2134 at its approximate lateral center (FIG. 73). Referring now to FIG. 47, the threaded shank of the hand lock 2188 passes closely through a small clear hole 2195 in the left end of the pressure plate 2192 and also through the clear long slot 2194 of the lateral extension arm mount 2186 the threadably mount through the base plate 2134 and the input angle 2138. A lock spring 2196 fits closely over the threaded shank of the hand lock 2188 and also closely within the confines of the clear long slot 2194.

When both the stop slide pin 2190 and the hand lock 2188 are loosened, the lateral extension arm mount can be adjusted laterally within the limits of the clear long slot 2194 (FIG. 73) without rotating downward out of position. The lock spring 2196 and the pressure plate 2192 cooperate to provide a measure of frictional to facilitate the adjustment. After the lateral position has been chosen, the stop slide pin 2190 is tightened with a wrench, while the hand lock 2188 is tightened manually, compressing the lock spring 2196 between the pressure plate 2192 and the base plate 2134. The lock spring 2196 will prevent the clamp adjustment assembly 2187 from vibrating loose, while the hand lock 2188 permits periodic check tightening by hand.

The left hand extremity of the lateral extension arm mount 2186 rigidly incorporates a left holder mount 2198 that stands upwardly therefrom, as shown clearly in FIGS. 45 and 74. The upper extremity of the left holder mount 2198 rigidly incorporates a pair of parallel extension mounts 2200, that is rigidly affixed to the upper sides thereof. A gripper assembly 2201 is pivotally mounted upon a gripper shaft 2202 that is in turn pressed into clear holes in the upper ends of the pair of parallel extension mounts 2200. The gripper assembly 2201 is then capable of pivoting in a pendulum like manner about the gripper shaft 2202, but is urged into contact with the case 1288 by a pressure spring 2204. The pressure spring 2204 is fixedly clamped at its bottom edge to the left hand surface of the left holder mount 2198. Its upper edge is so formed so that when the gripper assembly 2201 is forced outboardly by the case 1288, the upper end of the pressure spring 2204 will be bent outboardly away from the left holder mount 2198, thereby applying a gripping force against the case 1288. The upper inboard extremity of the pair of parallel extension mounts 2200 is fixedly fitted with a deflector spring 2205 that facilitates the entry of the case 1288 to the inboard side of the left hand case retainer 1996.

The flap retainer 1998 of the packing elevator 34 is shown in FIGS. 45, 73 and 74. The flap retainer 1998 is comprised of a longitudinal adjustment bar 2206, a gripper mount 2208, an output gripper slide 2210 and an input gripper slide 2211. The gripper mount 2208 is rigidly affixed upon the input end of the longitudinal adjustment bar 2206 and extends downward therefrom. The output gripper slide 2210 is fixedly attached to the gripper mount 2208 through the interspacing auspices of a gripper spacer 2212 while the lower extremity of the input gripper slide 2211 is fixedly attached to the ouput gripper slide 2210 through the interspacing auspices of a flap spacer 2213. As can be seen in FIG. 74, the upper portions of the input and output gripper slides 2211 and 2210, respectively, diverge from each other to be capable of receiving the input end flap 1764 of the case 1288 that is not always in perfect perpendicular relationship with the case input end 1768. The flap retainer 1998 is adjustable to cooperate with the flaps of various sizes of cases by virtue of the longitudinal adjustment bar 2206 and a clamp assembly 2214. The clamp assembly 2214 cooperates with a longitudinal slot 2216 (FIG. 73) in the longitudinal adjustment bar 2206, and fixedly but adjsutably clamps it to the lower surface of, and at the left end of, the lateral extension arm mount 2186 in the same way as the clamp adjustment assembly 2187. The clamp assembly 2214 is slightly shorter than the clamp adjustment assembly 2187 to cooperate with the width of the lateral extension arm mount 2186.

Figure 71:
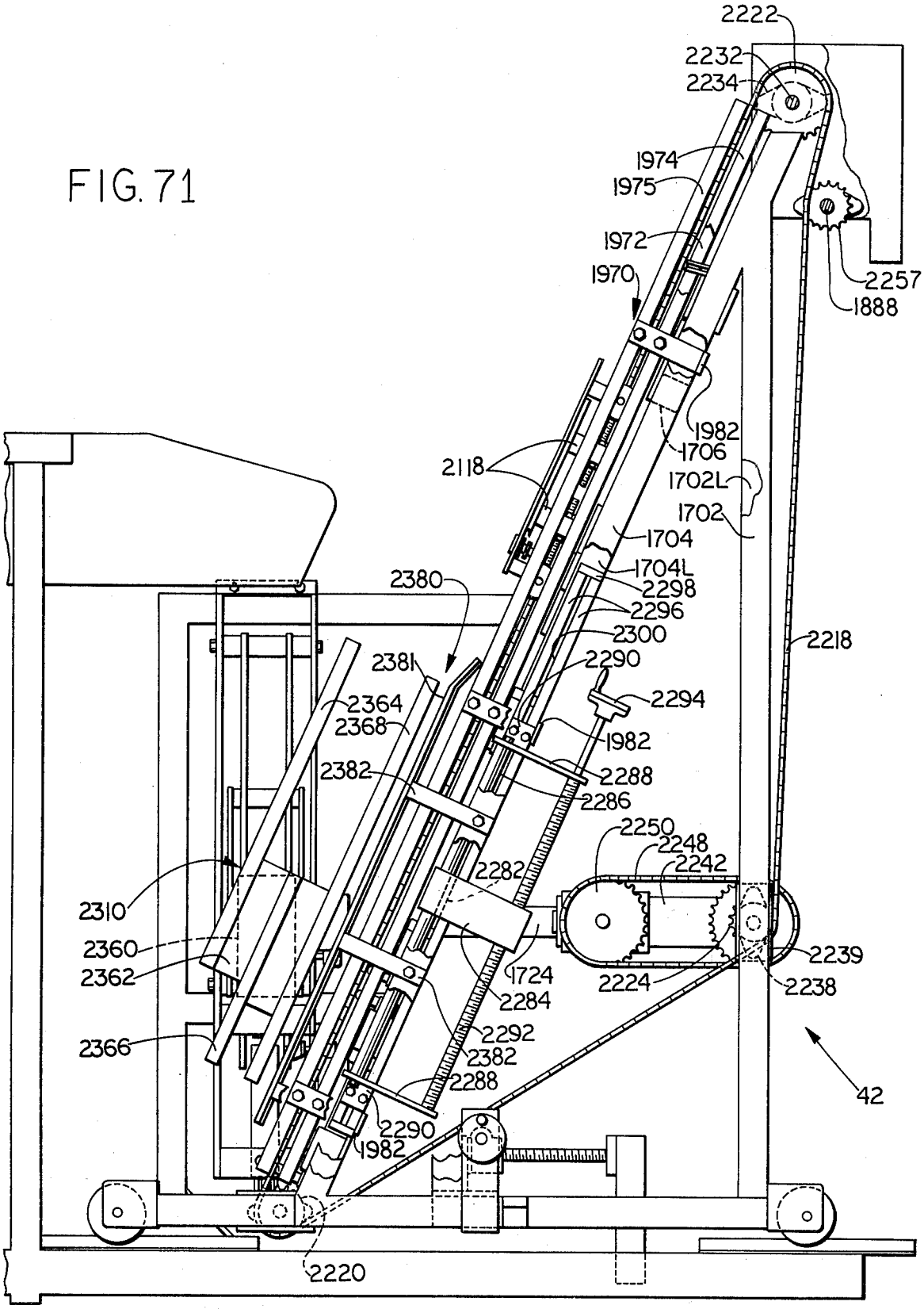
FIG. 71 is a fragmentary side elevational view showing the relative relationships of the pushoff assembly, a packing elevator and the elevator incline looking in the direction of arrows 71—71 in FIG. 68, structure for a tipover assembly being cut away for exposure of machinery in the lower portion of the elevator incline.

The packing elevator 34 is moved up and down the elevator incline 36 by means of an elevator chain 2218 that is shown in FIGS. 68, 70 and 71. The elevator chain 2218 is mounted upon a bottom elevator sprocket 2220, a top elevator sprocket 2222, and a power input sprocket 2224. Referring specifically to FIGS. 59, 68 and 70, the bottom elevator sprocket 2220 is fixedly attached upon a bottom elevator shaft 2226 that is in turn rotatably mounted in a pair of bottom shaft bearings 2228. The right hand member of the pair of bottom shaft bearings 2228 is fixedly attached to the left hand surface of the secondary longitudinal beam 1700 and adjacent to the intersection of the right hand incline riser 1704. The left hand member of the pair of bottom-shaft bearings 2228 is fixedly attached to a rectangular platemount 2229 that is in turn rigidly affixed at its input end to a mount standoff plate 2230 and along its output edge to the lower inboard surface of the left hand incline riser 1704L. The mount standoff plate 2230 is rigidly affixed in a perpendicular orientation to the inboard surface of the left hand base stringer 1682L. The bottom elevator sprocket 2220 is laterally placed upon the bottom elevator shaft 2226 so as to place the elevator chain 2218 in the middle of the elevator incline 36.

Referring to FIGS. 68, 70 and 71, the top elevator sprocket 2222 is fixedly attached to a top elevator shaft 2232 that is in turn rotatably mounted in a pair of top shaft bearings 2234. The pair of top shaft bearings 2234 is fixedly attached to the inboard surfaces of the pair of pivot plates 1726 and 1726L and is located thereupon near the upper end of the elevator incline 36, so that the elevator chain 2218 remains parallel to the left and right hand rails 1972 and 1974, respectively. The top elevator sprocket 2222 is laterally placed upon the top elevator shaft 2232 so that it will be in the same vertical plane as the bottom elevator sprocket 2220.

The power input sprocket 2224 is an integral part of the case handling system drive assembly 42 which will be described herein and is shown in FIGS. 59 and 71. The power input sprocket 2224 is fixedly attached upon a brake shaft 2236 that is in turn rotatably mounted in a right hand brake shaft bearing 2238 and a left hand brake shaft bearing 2240. As can be seen in FIG. 71, the right hand brake shaft bearing 2238 is fixedly attached to a right hand bearing mount plate 2239 that is in turn rigidly affixed in a parallel relationship to the left hand surface of the right hand tall riser 1702 at a vertical height to be horizontally aligned with the power assembly mount beam 1724. The left hand brake shaft bearing 2240 (FIG. 59) is fixedly attached in a horizontal disposition to the right hand surface of, and at the output end of, a power assembly mount plate 2242. The power assembly mount plate 2242 is rigidly affixed at its output end to the inboard surface of the left hand tall riser 1702L and at its input end to the left end of a standoff power assembly bracket 2244. The standoff power assembly bracket 2244 is rigidly affixed in a perpendicular orientation to the inboard surface of the power assembly mount beam 1724. A brake assembly 2245 is appropriately mounted upon the brake shaft 2236 and adjacent to the left hand brake shaft bearing 2240. A brake arm 2247 mounted on the housing of the brake assembly 2245 is attached to the power assembly mount plate 2242. The brake assembly 2245 provides a drag on the brake shaft. An input brake shaft sprocket 2246 is fixedly attached upon the brake shaft 2236 and laterally located between the brake assembly 2245 and the power input sprocket 2224. The input brake shaft sprocket 2246 cooperates with a short power chain 2248 that in turn communicates with a hydraulic motor sprocket 2250.

The hydraulic motor sprocket 2250 is fixedly attached to the output shaft of a hydraulic motor 2252. The hydraulic motor 2252 is fixedly attached to a face plate mount 2253 that incorporates a clear hole in the center thereof, and which provides for clear passage of the shaft of the hydraulic motor 2252. The input and output edges of the face plate mount 2253 are rigidly affixed between the right hand extremities of a pair of motor box side plates 2254 (FIG. 59) that is in turn rigidly affixed in a perpendicular orientation upon the right hand face of the power assembly mount plate 2242. The mount box of the hydraulic motor 2252 is positioned at the input end of the power assembly mount plate 2242. Therefore, as the hydraulic motor is operated, in either direction, power is transferred to the brake shaft 2236.

Referring now to FIG. 71, the portion of the elevator chain 2218 that extends vertically between the power input sprocket 2224 and the top elevator sprocket 2222 would interfere with the tipover pivot shaft 1888, but is prevented from doing so by an elevator idler sprocket 2257. The elevator idler sprocket 2257 is rotatably mounted upon the tipover pivot shaft 1888 and is held in proper lateral alignment by a pair of shaft collars 2255, as is shown in FIG. 68.

The elevator chain 2218 begins and terminates its circuit about the top, power and bottom sprockets 2222, 2224 and 2220, respectively, within the pair of chain lugs 2118 of the packing elevator 34 as is shown in FIG. 74. Each end of the elevator chain 2218 is affixed to its respective member of the pair of chain lugs 2118 in identical manner but in opposing directions. The free extremity of the lower portion of the elevator chain 2218 is pinned to a flat end 2256 of a threaded rod 2258 in the same manner as each link of the chain is pinned together. The flat end 2256 is formed by grinding away material from each side of the threaded rod 2258 until the end thereof appears as is shown in FIG. 73, and is narrow enough to accept the end of the open chain link. Each of the threaded rods 2258 passes through a clear hole in the lower extremity of the associated one of the pair of chain lugs 2118 and is fixedly and adjustably held therein by a pair of chain adjustment nuts 2260. By adjusting the two threaded rods 2258 in opposition to each other, proper tension can be produced in the elevator chain 2218.

The mechanical mountings of the limit switches that are associated with the packing elevator 34 and the elevator incline 36 are shown in FIGS. 68 and 70. The limit switch LS-11 is fixedly attached to, but laterally adjustable upon, the output surface of a dual function mount plate 2261. The lower end of the dual function mount plate 2261 is fixedly attached to, but vertically adjustable upon, the input face of the incline brace 1706 of the case section frame assembly 44. A switch arm and roller 2262 extends to the right from, and in the input direction from, the head of the limit switch LS-11 to be actuated by the limit switch trip plate 2132 of the packing elevator 34 as previously described.

The hydraulic valve HV-2 is shown in FIGS. 64 and 68 and is fixedly attached upon the upper surface of a valve mount plate 2264 that is in turn rigidly affixed along its input end upon the top edge of a cantilever valve mount 2266. The lower end of the cantilever valve mount 2266 is rigidly affixed to the output surface of the lateral mount bar 1982 of the top rail mount assembly 1980 at a lateral location so that the working end of the hydraulic valve HV-2 can cooperate with a hydraulic valve trip 2268 (FIGS. 73 and 74) of the packing elevator 34. Referring to FIGS. 73 and 74, the hydraulic valve trip 2268 is rigidly affixed in a perpendicular orientation along the right hand output edge of the upper member of the pair of chain lugs 2118.

The limit switch LS-6 (FIGS. 68 and 70) is fixedly attached upon the input surface of a lateral mount plate 2269, that is in turn rigidly affixed along its left hand edge to the central portion of the right hand edge of an incline slide plate 2270. The incline slide plate 2270 incorporates a lengthy slot 2272 that permits it to be fixedly but adjustably attached to the input face of the left hand incline riser 1704L at a point adjacent to the top longitudinal beam 1721 of the case pushoff assembly framework. The lengthy slot 2272 also permits the limit switch LS-6 a considerable degree of adjustment along the length of the left hand incline riser 1704L. A switch arm and roller 2274 of limit switch LS-6 extends laterally to the right therefrom to cooperate with the lower left hand edge of the left hand member of the pair of long mount plates 2114 (FIG. 73) of the packing elevator 34.

The limit switch LS-10 (FIGS. 68 and 70) is fixedly attached upon a small mount plate 2276 that is in turn fixedly attached across the input surface of the lateral mount bar 1982 of the middle rail mount assembly 1978. The small mount plate 2276 is laterally positioned so as to place the limit switch LS-10 in the middle of the elevator incline 36 so that the dual switch arm and roller 2277 thereof can cooperate with the limit switch trip plate 2132 of the packing elevator 34.

The limit switches LS-1 and LS-1A are opposedly and fixedly mounted upon the input surface of a long cantilever mount plate 2278, as shown in FIGS. 68 and 70. The upper end of the long cantilever mount plate 2278 rigidly incorporates along its right hand edge a small vertical plate 2280 that is in turn rigidly affixed to the left hand edge of a plate spacer 2282. The plate spacer 2282 extends a small distance to the right of the small vertical plate 2280 and is rigidly affixed to the left hand side of a large slide block 2284 as can be seen in FIG. 71.

The large side block 2284 is slidably mounted upon a switch slide rod 2286 that passes through a clear hole in the input end thereof. The switch slide rod 2286 is fixedly held at each end between the upper ends of a pair of switch jack screw mounts 2288. Each member of the pair of switch jack screw mounts 2288 incorporates an outwardly extending tab 2290 that is rigidly affixed thereto. The pair of switch jack screw mounts 2288 extends downwardly and in the output direction to rotatably incorporate at the lower end therebetween, a switch jack screw 2292. The switch jack screw 2292 is threadably mounted through the lower end of the large slide block 2284. The upper end of the switch jack screw 2292 extends upwardly through the upper member of the pair of switch jack screw mounts 2288 to fixedly incorporate a crank handle 2294.

The two outwardly extending tabs 2290 are fixedly attached to the right side of a pair of incline mounts 2296. Each member of the pair of incline mounts 2296 is rigidly affixed in parallel and spaced alignment with each other by a pair of end spacers 2298 so as to form a slot 2300 along its entire length. The output member of the pair of incline mounts 2296 is rigidly affixed across the input surfaces of the lateral mount bars 1982 of the bottom and middle rail mount assemblies 1976 and 1978, respectively, as is seen in FIG. 70. Referring to FIG. 68, the pair of incline mounts 2296 is laterally positioned to the left side of the right hand rail 1974 so that the working extremities of the limit switches LS-1 and LS-1A cooperate with the limit switch trip plate 2132 of the packing elevator 34.

Therefore, rotation of the crank handle 2294 (FIG. 7) of the switch jack screw 2292 will cause the large slide block 2284 to move appropriately along the switch slide rod 2286, thus carrying with it the plate spacer 2282, the small vertical plate 2280, the long cantilever mount plate 2278, and finally the limit switches LS-1 and LS-1A. The plate spacer 2282 extends through the slot 2300 so that interference with a lateral mount bar 1982 does not occur. This affords a large degree of vertical adjustment to these switches that is necessary to compensate for considerable variation in the sizes of the various cases 1288 that can be handled in this machine.

The limit switch LS-4 (FIGS. 68 and 70) is fixedly attached to a short cantilever mount 2302 that is in turn rigidly affixed to the input surface of the lateral mount bar 1982 of the bottom rail mount assembly 1976. The limit switch LS-4 is laterally aligned so that the long switch arm and roller 2304 thereof (FIG. 68) can cooperate with the lower edge of the left hand member of the pair of long mount plates 2114 of the packing elevator 34 (FIG. 73).

The case pushoff assembly 38 is shown in FIGS. 68, 69 and 71. The case pushoff assembly 38 is comprised of a pusher mounting assembly 2306, pusher arm assembly 2308, and a pusher plate assembly 2310. The pusher mounting assembly 2306 is shown specifically in FIGS. 68 and 69 and is mounted upon the top longitudinal beam 1721, the pushoff riser 1720, and the lower longitudinal beam 1722 of the case section frame assembly as was previously described.

The pusher mounting assembly 2306 is comprised of a pair of outboard risers 2312 and a pair of inboard risers 2314. The individual members of the vertically disposed pair of outboard risers 2312 are rigidly held in longitudinal spaced relationship with each other by a top mount bar 2316, a middle mount plate 2318, and a bottom box beam 2320. A cylinder cantilever mount plate 2321 is rigidly affixed to the bottom surface of the bottom box beam 2320, and extends outboardly from the center thereof. The individual members of the vertically disposed pair of inboard risers 2314 are rigidly held in longitudinal and parallel spaced relationship with each other by an upper mount bar 2322 and a lower mount bar 2324. The pair of outboard risers 2312 is fixedly clamped to the left hand surfaces of the top longitudinal beam 1721 and the lower longitudinal beam 1722 by a pair of top spacer bolts 2325 and a pair of bottom spanner bolts 2327, that reach laterally across the beams to fixedly clamp the pair of inboard risers 2314 to the right hand surfaces of the top and lower longitudinal beams 1721 and 1722, respectively. Each bolt of the pair of top spanner bolts 2325 passes through clear holes in the top and upper mount bars 2316 and 2322, respectively. Each bolt of the pair of bottom spanner bolts 2327 passes through clear holes in the middle mount plate 2318 and the lower mount bar 2324.

The pusher arm assembly 2308 incorporates a ram 2326 that is moved horizontally and laterally across the lower end of the elevator incline 36. The ram 2326 is actuated by a pusher cylinder 2328 that is pivotally mounted at its lower extremity to the unsupported end of the cylinder cantilever mount plate 2321. The upper end of, or the working end of, the pusher cylinder 2328 is pivotally mounted to the connecting member of a cylinder mount 2330 (FIG. 69). The cylinder mount 2330 is fixedly but adjustably mounted between the pair of primary actuation arms 2332 by a set of four bolts 2333 (FIG. 68) that passes through a pair of washer plates 2335, then through a set of four slanted slots 2334 in the primary actuation arms 2332 to threadably mount into the extremities of the cylinder mount 2330. The individual members of the pair of primary actuation arms 2332 are held in spaced parallel relationship by a pair of cross tubes 2336 that is rigidly affixed between the ends thereof. The inboard end of the pair of primary actuation arms 2332 is pivotally mounted on a primary pivot shaft 2338 that is fixedly attached between the pair of outboard risers 2312 just above the lower longitudinal beam 1722, as is shown in FIG. 68, but not shown explicitly in FIG. 69. Rigidly affixed to the outer surfaces of, and at the inboard end of, the pair of primary actuation arms 2332 and concentric with the primary pivot shaft 2338, is a pair of secondary arm spacers 2340.

Also pivotally mounted upon the primary pivot shaft 2338 is a pair of secondary actuation arms 2342, that is in turn rigidly affixed to the outer surfaces of the pair of secondary arm spacers 2340. A pair of spacer bushings 2343 is rigidly affixed to the outer surfaces of the pair of secondary actuation arms 2342 and in axial alignment with the pair of secondary arm spacers 2340 to provide proper alignment of a rigid right angle assembly upon the primary pusher shaft 2338 (FIG. 69). The pair of primary actuation arms 2332 and the pair of secondary actuation arms 2342 form the rigid right angle assembly (FIG. 68), so that when the working end of the pusher cylinder 2328 rises, the assembly will pivot clockwise about the primary pivot shaft 2338. This swings the upper end of the pair of secondary actuation arms 2342 in an arc about the primary pivot shaft 2338.

The upper end of the pair of secondary actuation arms 2342 is rigidly affixed about the ends of a primary pusher shaft 2344 (FIG. 68), that is in turn pivotally mounted through the center of a pair of primary pusher arms 2345. The individual elements of the pair of primary pusher arms 2345 are held in rigid parallel alignment with each other by a pair of cross members 2346 (FIG. 69) of tubular nature. Rigidly affixed to the outer surfaces of, and in axial alignment with the lower member of the pair of cross members 2346, is a pair of short spacers 2347, and in the same manner, a pair of long spacers 2349 is rigidly affixed in relationship to the upper member of the pair of cross members 2346. The lower member of the pair of cross members 2346 and the pair of short spacers 2347 are in concentric communication with the primary pusher shaft 2344 and serve to hold the pair of primary pusher arms 2345 in centered relationship between the pair of secondary actuation arms 2342. Similarly, the upper member of the pair of cross members 2346 and the pair of long spacers 2349 are in fixed concentric communication with an outboard riser shaft 2348 (FIG. 68), and serve to hold the upper ends of the pair of primary pusher arms 2345 in centered relationship between the pair of outboard risers 2312.

The ends of the outboard riser shaft 2348 are fitted with a pair of cam rolls 2351 that is in turn fixedly held thereupon by a pair of nuts 2353 (FIG. 69). The pair of cam rolls 2351 runs vertically within the confines of a pair of outboard riser slots 2350. Therefore, as the upper end of the pair of secondary actuation arms 2342 swings through its arc toward the elevator incline 36, the pair of cam rolls 2351 will rise within the pair of outboard riser slots 2350 until the pair of primary pusher arms 2345 has swung past the pair of outboard risers 2312, then they will move downward. This cyclic motion of the upper ends of the pair of primary pusher arms 2345 permits the lower extremity thereof to move along a substantially straight and horizontal line.

The lower extremity of the pair of primary pusher arms 2345 fixedly incorporates a ram shaft 2356, that is in turn pivotally mounted through the left hand extremity of the ram 2326. The ram 2326 incorporates a pair of shaft spacers 2358, that is rigidly affixed to both sides thereof and concentric with the ram shaft 2356, to maintain its centered position with respect to the pusher arm assembly 2306.

A pair of stabilizer actuation arms 2352 and a pair of stabilizer pusher arms 2354 are mounted to the pair of inboard risers 2314, to the ram 2326, and to each other in substantially the same manner as, but in parallel relation to, the pair of secondary actuation arms 2342 and the pair of primary pusher arms 2345, except for the following difference. The lower extremity of the pair of stabilizer actuation arms 2352 is pivotally attached to the lower extremity of the pair of inboard risers 2314, and is not attached to an actuation assembly. This stationary attachment plus the parallel nature of the pusher arm assembly 2308 requires that the ram 2326 remain in a horizontal attitude.

The pusher plate assembly 2310 is shown in FIGS. 68 and 71 and is comprised of a back plate 2360, a face plate 2362, an input box brace 2364, a middle box brace 2366 and an output box brace 2368. The inboard extremity of the ram 2326 is rigidly affixed in a perpendicular orientation to the center of the back plate 2362. The face plate 2362 is rigidly affixed to the right hand face of the back plate 2362 in a skewed orientation so as to be aligned parallel and perpendicular to the elevator incline 36. The input box brace 2364 is of bar stock and is rigidly affixed across the input side of the right hand surface of the face plate 2362. The input brace extends upwardly beyond the face plate 2362 to accommodate the dimensions of the largest cartons that can be processed in the case handling assembly 14, but does not extend downwardly therefrom since it would interfere with portions of the output tipover assembly 40 to be described hereinafter. The middle box brace 2366 is rigidly affixed across the middle of the face plate 2362 and parallel to the input box brace 2364. The middle box brace 2366 extends downwardly a short distance beyond the face plate 2362 to accommodate the input end of the case 1288. The output box brace 2368 is rigidly affixed across the right hand face of, and along the output side of, the face plate 2362 and extends upwardly and downwardly beyond the face plate 2362 to accommodate the entire length of any size case 1288. In this manner, the case 1288 receives a uniform lateral push that translates it off the set of three base rollers 2142 and the back plate 2116 of the packing elevator 34.

The structural mounting of the limit switch LS-5 is shown primarily in FIG. 69 and secondarily in FIG. 68. The limit switch LS-5 is fixedly attached to a switch mount plate 2370 that is in turn rigidly affixed to the output surface of the output member of the pair of outboard risers 2312, and just above the lower longitudinal beam 1722. Pivotally attached to the working end of the limit switch LS-5 is an extension shaft 2372. Fixedly attached to the unsupported end of the extension shaft 2372 is a switch arm and roller 2374 that cooperates with one of the primary actuation arms 2332. When the ram 2326 is fully advanced, the limit switch LS-5 is actuated, thereby making the proper circuit to return the pushoff as previously described.

The limit switch LS-3 is fixedly attached to a mount plate 2376 that is in turn rigidly affixed to the output surface of the output member of the pair of outboard risers 2312. The mount plate 2376 holds the limit switch LS-3 outboardly in such a position so that a switch arm and roller 2378 thereof can cooperate with the bottom edge of the output member of the pair of primary actuation arms 2332. As the pair of primary actuation arms 2332 moves up and down, it operates the limit switch LS-3.

As the case 1288 translates laterally to the right, it leaves the packing elevator 34 by means of the pushoff assembly 38 and passes over a ramp assembly 2380 before coming to rest upon the output tipover assembly 40. The ramp assembly 2380 is shown in FIGS. 68 and 71, and comprises a ramp 2381 and a set of three risers 2382. The ramp 2381 is rigidly affixed upon the input, or upper extremities of the set of three risers 2382, the lower extremities of which are rigidly affixed to the outboard surface of the right hand incline riser 1704. The set of three risers 2382 extends in the input direction and upwardly in a perpendicular orientation to the input surface of the right hand incline riser 1704. The set of three risers 2382 are rigidly affixed to the output surface of, and along the right side of, the ramp 2381 so that the left edge thereof is unsupported. The left edge of the ramp 2381 incorporates a downward bend to insure that the case 1288 will ride up on the top thereof and not jam against its left hand edge. The top end of the ramp 2381 also incorporates a bend in the output direction that insures that wide cases 1288 coming down the packing elevator 34 do not jam against the top edge of the ramp 2381.

The output tipover assembly 40 is shown in FIGS. 75 to 78 inclusive, and is comprised of a pivot mounting assembly 2384, a tipover mechanism 2386, an output tipover frame assembly 2388, and the output flap folder assembly 1784.

The pivot mounting assembly 2384 (FIGS. 76 and 77) is comprised of a standoff box mount 2390, a pair of tipover bearing mount plates 2391, a pair of output tipover bearings 2392, and an output tipover shaft 2393. The tipover shaft 2393 is pivotally mounted in the pair of output tipover bearings 2392 that is in turn fixedly attached to the inboard surfaces of the pair of tipover bearing mount plates 2391. The right hand member of the pair of tipover bearing mount plates 2391 is rigidly affixed to the inboard surface of the short incline riser 1717 and adjacent to the intersection of the output tipover riser 1716, as is shown in FIG. 77. The left hand member of the pair of tipover bearing mount plates 2391 is rigidly affixed to the right hand surface of the standoff box mount 2390 that is in turn rigidly affixed to the right hand surface of the right hand incline riser 1704 and adjacent to the intersection of the left hand output tipover riser 1718.

The output tipover frame assembly 2388 is rigidly affixed to the tipover mechanism 2386 that is in turn rigidly affixed to the output tipover shaft 2393. More specifically, the output tipover frame assembly 2388 is rigidly affixed to a tipover mount plate 2394 that is in turn rigidly affixed to the input edges of a pair of tip arms 2396. Referring to FIGS. 76 and 77, the pair of tip arms 2396 extend upwardly and in the output direction to the output tipover shaft 2393, to which it is fixedly attached. Each one of the pair of tip arms 2396 is laterally spaced upon the output tipover shaft 2393 so that they are adjacent to each one of the pair of output tipover bearings 2392. The upper extremity of the pair of tip arms 2396 is held in rigid spaced relationship by a lateral stiffener plate 2395, fixedly attached to the upper input edge thereof. A cylinder torque arm 2398 is fixedly attached to the center of the output tipover shaft 2393 and rigidly incorporates at its output end, a cylindes lug 2400. The cylinder lug 2400 pivotally cooperates with a cylinder clevis 2401 that is fixedly attached to the working end of an output tipover cylinder 2402. The lower extremity of the output tipover cylinder 2402 is pivotally attached to a base lug 2404 that is in turn rigidly affixed to the horizontal flange of a heavy angle mount 2405. The heavy angle mount 2405 is rigidly affixed to the right hand side of the right hand base stringer 1682. As can be seen by comparing FIGS. 1 and 76, room has been left for the jack screw adjustment and holding assembly 1740 that is not shown in FIG. 76.

Figure 78:
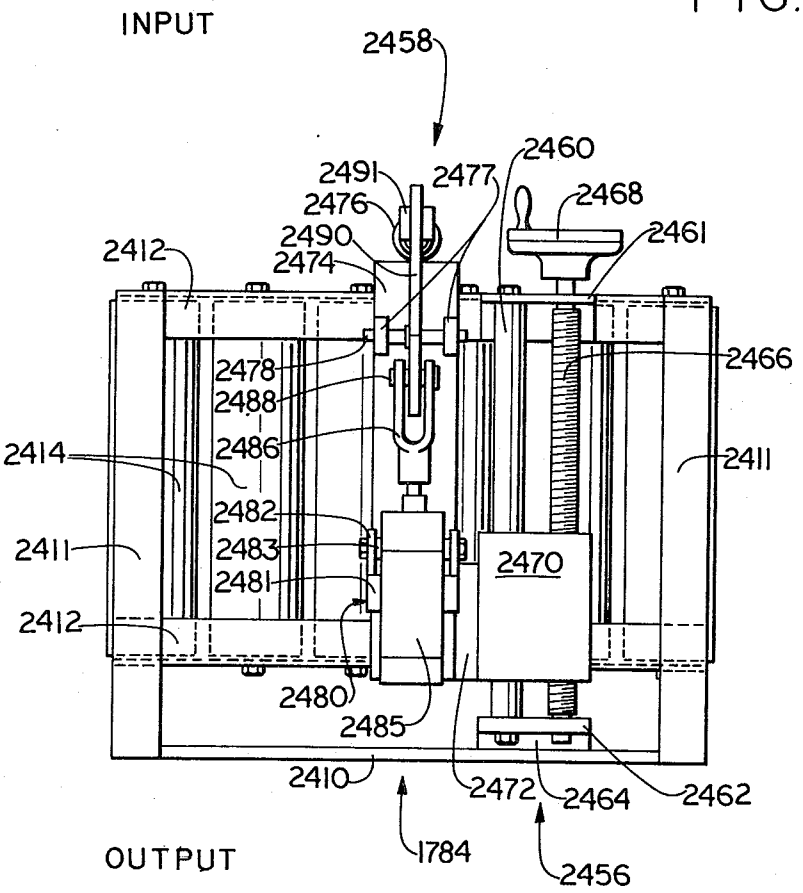
FIG. 78 is a bottom view of the output tipover assembly looking in the direction of the arrows 78—78 in FIG. 76.

The output tipover frame assembly 2388 incorporates a right hand angle support 2406 and a left hand angle support 2408 that are rigidly affixed to the input surface of, and along the ends of, the tipover mount plate 2394, as is shown in FIGS. 76 and 77. Rigidly affixed across the lower output surfaces of the right and left hand angle supports 2406 and 2408 respectively, is a base brace 2410. Referring now to FIGS. 76 and 78, the bottom of the output tipover frame assembly 2388 incorporates a pair of bottom braces 2411, that is longitudinally disposed and rigidly affixed at its output end to the bottom extremity of the right and left hand angle support 2406 and 2408, respectively, and the base brace 2410. A pair of roller mount angles 2412 is rigidly affixed across the pair of bottom braces 2411, one member at the input end thereof, the other near the output end thereof. The mostly upright flanges of the pair of roller mount angles 2412 are widely spaced while the transverse flanges thereof extend toward each other. The mostly upright flanges of the pair of roller mount angles 2412 provide mounting structure for a set of six bottom rollers 2414 that is rotatably mounted therebetween to provide, upon entry, a substantially frictionless receiving surface to the filled case 1288.

The flanges of the right and left hand angle supports 2406 and 2408 (FIGS. 76 and 77) are also widely spaced to provide mounting structure for sets of rollers that provide a substantially frictionless surface for the filled case 1288 that is leaving the output tipover assembly 40. Referring to FIG. 76, a set of three lower back rollers 2416 is rotatably mounted between the outer flanges of the right and left hand angle supports 2406 and 2408, respectively, and is located at the lower ends thereof and adjacent to the output ends of the set of six bottom rollers 2414. Directly above the set of three lower back rollers 2416 and also mounted between the right and left hand angle supports 2406 and 2408, respectively, is a LS-14B switch roller assembly 2418 to be described hereinafter. Directly above the LS-14B switch roller assembly 2418 is a set of five upper back rollers 2420, each roller thereof being evenly spaced and rotatably mounted between the upper portions of the right and left hand angle supports 2406 and 2408, respectively. Mounted between the upper extremities of the right and left hand angle supports 2406 and 2408 respectively is a LS-14A switch roller assembly 2422 that is substantially similar to the structure of the LS-14B switch roller assembly 2418 to be described herein.

Figure 75:
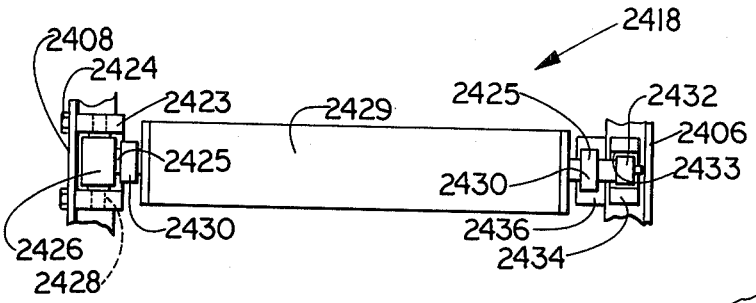
FIG. 75 is a view of a switch roller looking in the direction of the arrows 75—75 in FIG. 76.

The LS-14B switch roller assembly 2418 is shown in FIGS. 75 and 76 incorporates a yoke mount 2423 that is fixedly attached to the inside surfaces of the left hand angle support 2408 by a pair of bolts 2424 that in turn passes through clear holes in the vertical flange of the left hand angle support 2408 and threadably mount into the side of the lower portion of the yokl mount 2423. The left extremity of a switch roller shaft 2425 is rigidly affixed within a pivot mount 2426. The pivot mount 2426 fixedly incorporates, at right angles to the switch roller shaft 2425, short pivot shaft portions 2428 that extend from both sides thereof. The short pivot shaft portions 2428 are pivotally mounted between the tines of the yoke mount 2423 and provides a pivotal degree of freedom for the switch roller shaft 2425 that permits the right end thereof to raise and lower as necessary. A switch roller 2429 is rotatably mounted upon the switch roller shaft 2425 and is held in lateral place thereupon by a pair of shaft collars 2430 that is fixedly attached thereto.

The right extremity of the switch roller shaft 2425 incorporates a bearing 2432 that cooperates with an open end slot 2433 of a right hand bearing retainer 2434. A spring plate 2436 is fixedly attached to the output surface of the right hand angle support 2406, directly opposite the right hand bearing retainer 2434, by a pair of bolts 2437. The pair of bolts 2437 passes through clear holes in the spring plate 2436 and the lateral flange of the right hand angle support 2406 to threadably mount into the lower end of the right hand bearing retainer 2434, thereby securing both at the same time. The spring plate 2436 extends inwardly under the right hand member of the pair of shaft collars 2430 and incorporates a clear hole in vertical line therewith. As seen in FIG. 76, a spring pin 2438 passes through the clear hole of the spring plate 2436 and is rigidly affixed in the right hand member of the pair of shaft collars 2430. A reset spring 2440 is coaxially mounted upon the spring pin 2438, between the right hand member of the pair of shaft collars 2430 and the spring plate 2436 to forcefully push the switch roller 2429 outwardly. The spring pin 2438 is prevented from leaving the confines of the spring plate 2436 by a detent nut 2441.

The limit switch LS-14B is fixedly suspended from the output face of a cantilever mount plate 2442 whose upper end is rigidly affixed to the input surface of the tipover mount plate 2394 and adjacent to the right hand member of the pair of tip arms 2396 (FIG. 77). A switch arm and roller 2444 of the limit switch LS-14B extends upwardly (FIG. 76) so that the roller thereof is in rolling contact with the output side of the right hand end of the switch roller 2429. In this way, the switch roller 2429 is depressed when the case 1288 is in place, rotating the switch arm and roller 2444 of the limit switch LS-14B clockwise. As the case 1288 leaves the output tipover assembly 40, the reset spring 2440 raises the switch roller 2429 permitting the switch arm and roller 2444 to reset in the counterclockwise direction.

The limit switch LS-14A is fixedly attached to the output surface of a lateral switch mount 2446, that is in turn fixedly and adjustably attached to the output surface of the right hand angle support 2406 by a pair of cap screws 2448 that passes through a pair of clear slots 2450 in the right end thereof, and threadably mount in the right hand angle support 2406. The lateral switch mount 2446 is attached adjacent to the spring plate 2436 of the LS-14A switch roller assembly 2422 so that a laterally disposed switch arm and roller 2452 of the limit switch LS-14A can communicate with the output end of the spring pin 2438 of the LS-14A switch roller assembly 2422. Both the LS-14B and LS-14A switch roller assemblies 2418 and 2422, respectively, provide for actuation of the limit switches LS-14B and LS-14A no matter how wide or narrow the case 1288 may be.

The limit switch LS-8 is fixedly attached to the left side of a vertically disposed limit switch mount plate 2451 (FIGS. 76 and 77) that is in turn rigidly affixed to the inboard surface of the outboard longitudinal beam 1712. The limit switch LS-8 is longitudinally positioned so that a switch arm and roller 2454 of the limit switch LS-8 can be engaged by the output surface of the base beam 2410 to signal that the output tipover assembly 40 is in the untipped position.

The flap folder assembly 1784 is shown in FIGS. 76 and 78 and is comprised of a jack screw slide rod mount assembly 2456 and a folder assembly 2458. The jack screw slide rod mount assembly 2456 incorporates a short slide rod 2460 that is fixedly attached between an input angle bracket 2461 and an output plate bracket 2462. The input angle bracket 2461 is rigidly affixed to the lower surface of the input member of the pair of roller mount angles 2412 and located toward the right side thereof (FIG. 78). The output place bracket 2462 is rigidly affixed to a plate spacer 2464 that is in turn rigidly affixed to the input surface of the base brace 2410 and laterally aligned with the input angle bracket 2461. The short slide rod 2460 is fixedly attached between the left sides of the input angle bracket 2461 and the output plate bracket 2462, while a short jack screw 2466 is rotatably mounted through their right sides. The input end of the short jack screw 2466 fixedly incorporates a crank handle 2468 for manual adjustment of a slide mount block 2470 that is slidably mounted on the short slide rod 2460 and threadably mounted upon the short jack screw 2466.

Rigidly affixed to the upper surface of the slide mount block 2470 is a lateral extension plate 2472 that extends toward the center of the output tipover assembly 40. Rigidly affixed along the left hand edge of the lateral extension plate 2472 is a folder base plate 2474 that extends toward the input end of the output tipover assembly 40. When the slide mount block 2470 is fully retracted, the folder base plate 2474 just overhangs the input member of the pair of roller mount angles 2412 and there incorporates an eyelet mount 2475 (FIG. 76) that extends upwardly therefrom. The eyelet mount 2475 threadably incorporates a rod eyebolt 2476 that extends in the input direction therefrom. Rigidly affixed to the lower surface of the folder base plate 2474 is a pair of pivot mount arms 2477 that is located toward the input end thereof and extend downwardly to fixedly incorporate a folder pivot pin 2478 at the bottom thereof. Also rigidly affixed across the lower surface of the folder base plate 2474 is a cylinder pivot mount 2480, that is located near the output end thereof.

The cylinder pivot mount 2480 is comprised of a lateral brack 2481, a pair of pin lugs 2482 and a cylinder mount pin 2483. The pair of pin lugs 2482 is vertically disposed and rigidly affixed to the input edge of, and at the corners of, the lateral brace 2481 in such position that the cylinder pivot mount 2480 will lay flush against the folder base plate 2474. The cylinder mount pin 2483 is fixedly attached between the pair of pin lugs 2482 with clearance to accommodate a side mount lug 2484 of a folder cylinder 2485. The folder cylinder 2485 is free to pivot a certain degree in the vertical plane.

The working end of the folder cylinder 2485 fixedly incorporates a deep yoke 2486 that fixedly incorporates through the end thereof, a yoke pin 2488 (FIG. 78). The yoke pin 2488 is pivotally mounted through the output end of an L-shaped actuator bracket 2490 (FIG. 76). The vertex of the L-shaped actuator bracket 2490 is pivotally mounted to the folder pivot pin 2478, and the input end thereof pivotally incorporates a rod yoke 2491. A folder rod 2492 is fixedly attached to the rod yoke 2491 and extends upward through a universal bushing 2494 that is inserted within the eye of the rod eyebolt 2476. In this manner, the folder cylinder 2485 retracts, which swings the L-shaped actuator bracket 2490 in a clockwise direction (FIG. 76), which pushes the folder rod 2492 upward against the input flap 1764 of the case 1288 and closes it. The bushing 2494 of the rod eyebolt 2476 permits the folder rod 2492 to change its angle of alignment therewith as the rod yoke 2491 moves through the arc defined by the motion of the input end of the L-shaped actuator bracket 2490.

Referring to FIG. 72, the output flap folder 1785 is comprised of a plate belt 2496 that is suspended from a packing assembly bracket 2498 to an elevator incline bracket 2500. The packing assembly bracket 2498 is comprised of a mount foot 2501 and a lateral standoff bar 2502. The left extremity of the lateral standoff bar 2502 is rigidly affixed to the mount foot 2501 in a perpendicular orientation. The mount foot 2501 is fixedly attached to the outboard surface of, and near the top edge of, the right hand member of the pair of pack assembly side plates 1015. The outboard extremity of the lateral standoff bar 2502 incorporates a pin lug 2504 to which is pivotally mounted the input end of the plate belt 2496. The output end of the plate belt 2496 is pivotally mounted upon a standoff rod 2506 (FIG. 72A) that is cantilever mounted in the lateral direction from the input end of a pair of spanner mounts 2507. The pair of spanner mounts 2507 is fixedly clamped to the right and left hand surfaces of the right hand incline riser 1704 by a pair of spanner bolts 2508. The elevator incline bracket 2500 is located just below the incline brace 1706 of the case section frame assembly 44. The belt 2496 is thereby disposed laterally to the right a sufficient distance so that it will coincide with the centerline of most of the various size cases 1288 tht are processed in the case handling assembly 14. The plate belt 2496 is formed of a plurality of plates 2510 hinged together. A weight 2509 is fixedly attached upon the plate belt 2496 by fasteners 2512 which are threaded in bores 2513 in the weight 2509 and extend through bores 2514 in the plates 2510. The weight 2509 causes the portions of the belt on either side of the weight to assume nearly straight lines, with that portion thereof from the weight to the packing assembly bracket 2498 assuming a very slight arc. The weight 2509 is the low point of the belt, which provides that the free end of the output end flap 1766 of the case 1288 will be gradually rotated closed by sliding down the belt to the weight 2509. The end flaps 1764 and 1766 stay in place to a degree that will permit subsequent automatic case sealing as the case 1288 leaves the output tipover assembly 40. The underside of the belt 2496 is substantially smooth so that is does not catch and open the closed input end flap 1764C as is shown in FIG. 72.

OPERATION

The operation of the machine will now be described with special reference to FIGS. 79, 80 and 81 which show electrical connections, FIG. 82 which shows hydraulic connections, and FIG. 83 which shows pneumatic connections.

Figure 79:
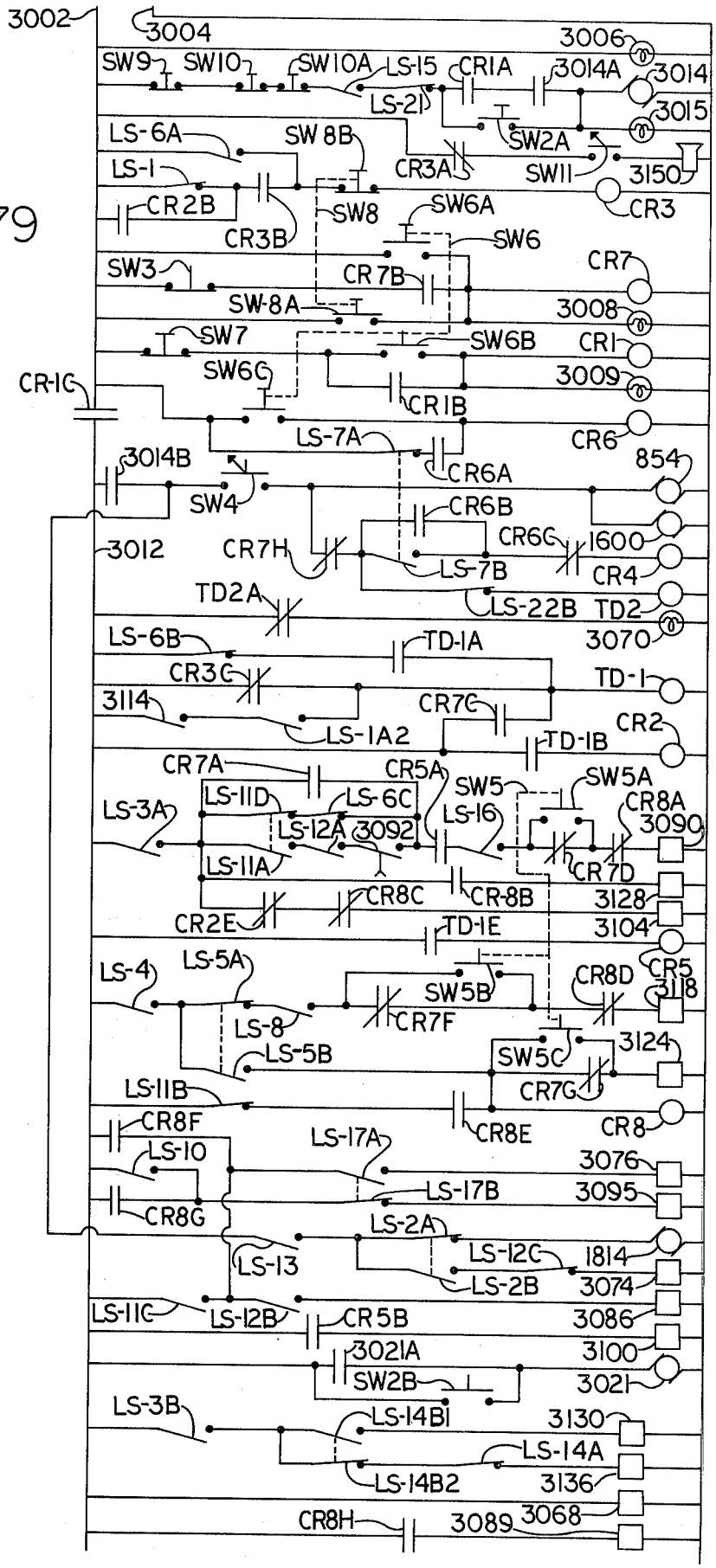
FIG. 79 is a schematic view of major electrical connections of the machine.

Referring to FIG. 79, electrical power is supplied by line leads 3002 and 3004. A lamp 3006 indicates that there is power at the line leads 3002 and 3004. As shown in FIG. 81, the power leads 3002 and 3004 power a rectifier network 3003 to supply direct current between leads 3005 and 3007.

When the machine is ready for operation, the limit switch LS-15 (FIG. 79) is held in closed position by action of the trigger angle 1594 (FIGS. 48 and 49), which is mounted on the top radius arm 1404L (FIG. 49). The limit switch LS-21 (FIGS. 18 and 33) is in its normally closed position as shown in FIG. 79 when the machine is ready for operation. A source of air under pressure is attached to an air lead 3011 (FIG. 83). A source of vacuum is connected to the vacuum supply hose 832 (FIG. 25). A vacuum switch 3013 (FIG. 81) is connected to the vacuum supply hose 832 to be closed when there is a vacuum. If it is necessary to operate the machine without vacuum, as when the machine must be cleared after vacuum failure, a vacuum bypass switch SW1 can be closed. If the machine is to pack on count, an on-off count switch SW11 (FIG. 79) is closed.

When the machine is to be started, a control start switch SW6 is actuated to close contacts SW6A, SW6B and SW6C. Closing of the contacts SW6A energizes a manual discharge control relay CR7 and lights a lamp 3008. Energizing of the manual discharge control relay CR7 causes closing of contacts CR7A, CR7B and CR7C, and opening of contacts CR7D, CR7F, CR7G and CR7H. The contacts CR7B are hold-in contacts. Closing of the contacts SW6B energizes a control relay CR1 to close contacts CR1A, CR1B and CR1C, and energizes a lamp 3009. In addition, the energizing of the control relay CR1 can close other contacts (not shown) which permit the operation of the input conveyor 104 (FIG. 2) and associated mechanism (not shown). The contacts CR1B (FIG. 7) are hold-in contacts. Closing of the contacts CR1C connects the power lead 3002 to a lead 3012. Closing of the contacts SW6C energizes an infeed override control relay CR6 to close contacts CR6A and CR6B and open contacts CR6C. The contacts CR6A are hold-in contacts. Opening of the contacts CR6C prevents operation of a carton conveyor stop relay CR4.

A hydraulic-vacuum start push button switch SW2 is depressed to close contacts SW2A and SW2B. Closing of the contacts SW2B energizes a vacuum pump motor 3021. Energizing of the motor 3021 closes hold-in contacts 3021A. Closing of the contacts SW2A energizes a hydraulic pump motor 3014 and a lamp 3015. Energizing of the hydraulic pump motor 3014 energizes motor relay contacts 3014A and 3014B. The contacts 3014A are hold-in contacts. The hydraulic pump motor 3014 drives a hydraulic pump 3016 (FIG. 82) which draws hydraulic fluid 3018 from a reservoir 3020 and directs fluid to a pressure line 3022. Fluid returns to the reservior 3020 through a return line 3024.

At the time of start-up, circuits are cleared by depressing a cycle step switch SW5 (FIG. 79) to close contacts SW5A, SW5B and SW5C and a reset switch SW3 to open the contacts thereof. Opening of the contacts of the reset switch SW3 de-energizes the manual discharge control relay CR7.

An on-off switch SW13 (FIG. 80) is turned to on position to supply power to a lead 3024, which powers electronic components.

Next, a conveyor on-off switch SW4 (FIG. 79) is turned to the on position to start the motors 854 (FIG. 28) and 1600 (FIG. 39). When the input conveyor 104 (FIG. 2) has supplied enough cartons to the input hopper 16, the limit switch LS-7 (FIG. 11) is actuated.

When the limit switch LS-7 is actuated, contacts LS-7A (FIG. 79) open to de-energize the infeed override relay CR6 and contacts LS-7B close to energize the carton conveyor stop control relay CR4. Energizing of the carton conveyor stop control relay CR4 closes contacts CR4A (FIG. 81), CR4B and CR4C. Closing of the contacts CR4B energizes the carrier section clutch 872 (FIG. 28). Closing of the contacts CR4A (FIG. 81) energizes the clutch 906 (FIG. 28) to drive the components of the input hopper 16 and the carton inspection section 8 at a slow speed. The pick-up wedge 432 (FIG. 10) of the side shuffler assembly 137 picks up the bottom carton from the stack in the input hopper 16 (FIG. 4) and shuffles it to the right as shown in FIG. 4. The pusher tongue 142 (FIG. 2) starts and accelerates the bottom carton until one of the pick-up lugs 146 picks up the carton to advance the carton to the carrier inspection section 18 (FIG. 1) where the carton is opened and passes the photocell assemblies PC2, PC3, and PC4 (FIG. 15) while the triggers 525 pass the photocell assembly PC1 (FIG. 17).

Figure 80:
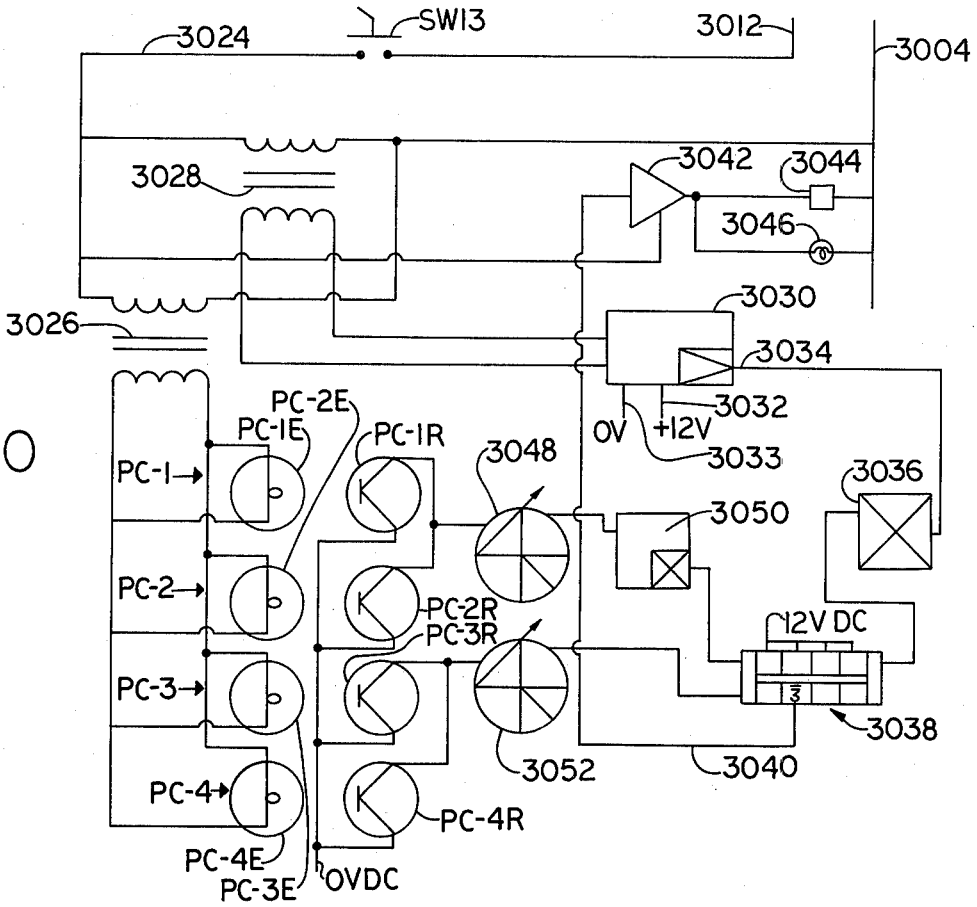
FIG. 80 is a schematic view of electronic components of the machine.
Figure 81:
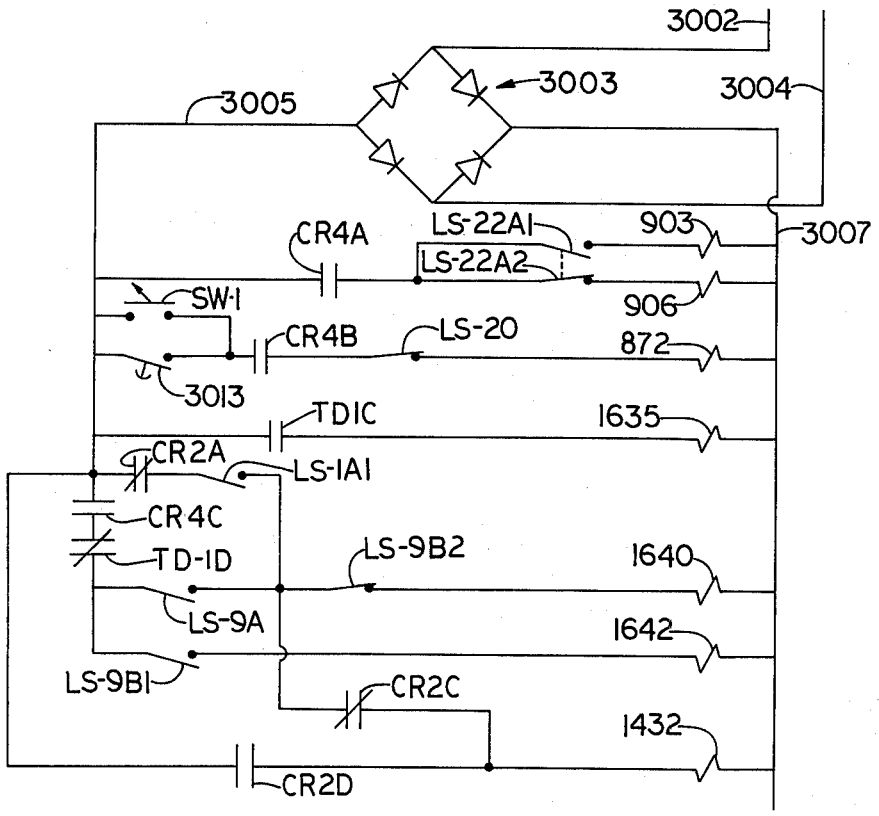
FIG. 81 is a schematic view of direct current electrical connections of the machine.

As shown in FIG. 80, power for energizing the emitters PC-1E, PC-2E, PC-3E and PC-4E is supplied by a transformer 3026 having its primary connected between the leads 3024 and 3004. A transformer 3028, also having its primary connected across the leads 3024 and 3004, supplies power to a rectifier power supply unit 3030, which supplies +12 V DC at a contact 3032 and 0 V DC at a contact 3033. A voltage for an output is supplied at a contact 3034. The contact 3034 is connected to an inverter 3036, which is connected to a shift register 3038. A lead 3040 connects the shift register to a relay output amplifier 3042. When the output voltage is supplied by the shift register to the relay output amplifier 3042, the relay output amplifier 3042 conducts to energize a discard solenoid 3044 (FIG. 83) and a lamp 3046 (FIG. 80).

The shift register 3038 is controlled by the photocell receivers PC-1R, PC-2R, PC-3R and PC-4R. When the light to the photocell receiver PC-1R is interrupted by one of the triggers 525 (FIG. 23) and the light to the photocell receiver PC-2R is simultaneously interrupted to indicate that a carton is at the inspection station 106G as shown in FIGS. 15 and 16, an indexing pulse is transmitted to the shift register 3038 through a trigger device 3048 and a single shot inverter 3050. The photocell receivers PC-3R and PC-4R are connected to the shift register 3038 through a trigger device 3052. If either of the receivers PC-3R and PC-4R is receiving light at the time that an indexing pulse is transmitted, indicating that a carton has not opened properly, the shift register receives a register cocking pulse through a trigger device 3052 so that, when the next indexing pulse is received, the output voltage is supplied to the relay output amplifier 3042. If neither of the photocell receivers PC-3R and PC-4R is receiving light at the time that an indexing pulse is received, there is no output voltage supplied at the next indexing pulse. If an output voltage is supplied to the relay output amplifier 3042, the output voltage is cancelled when the second succeeding indexing pulse is received unless there has been a second register cocking pulse at the time of the first succeeding indexing pulse. Power connections to the electronic units have been omitted for clarity.

When the discard solenoid 3044 is energized, a pneumatic valve 3054 (FIG. 83) is moved to its other position. Air under pressure is supplied to the valve 3054 from the air line 3011 through a filter 3057, a pressure regulator 3058, an air pressure line 3059, a lubricator 3060 and a lubricated air pressure line 3062. When the pneumatic valve 3054 is in its other position, the air under pressure is directed through the line 1006 (FIG. 35) to the reject cylinder 1002 to cause extension of a piston rod 3064 (FIG. 83) to cause raising of the reject roller 982 (FIGS. 34 and 35) to direct the improper carton over the discard plate 986 (FIG. 33) to be ejected by the reject wheels 988. Extension of the piston rod 3064 permits release of the switching lever 1243 of the switch valve 1236 to permit the switch valve 1236 to move to the position shown in FIG. 83. Air under pressure reaches the valve 1236 from the air pressure line 3059, a pressure on-off valve 3066 and the line 1255. A solenoid 3068 which actuates the pressure on-off valve 3066 is connected between the leads 3012 and 3004 as shown in FIG. 79 to be energized when the contacts CR1C are closed. When the valve 1236 (FIG. 83) is in the position shown, air under pressure is directed along the line 1234 (FIG. 35) to aid in advancing the improper carton over the discard plate 986. When the discard solenoid 3044 (FIG. 83) is de-energized, the valve 3054 (FIG. 83) is returned to the position shown and air under pressure is directed through the line 1008 to the reject cylinder 1002 to retract the piston rod 3064 thereof, retracting the reject roller 982 (FIGS. 34 and 35) so that cartons are directed into the surge hopper 20 (FIG. 33). When the piston rod 3064 is retracted, the switch lever 1243 of the valve 1236 is swung counterclockwise as shown in FIG. 34 to advance the valve 1236 (FIG. 83) to its other position to direct air through the tube extension 1248 to assist in directing the cartons into the surge hopper 20 (FIG. 33).

As the level of cartons in the input hopper 16 (FIG. 2) increases, the arm 150 of the limit switch LS-22 is engaged to actuate the first pole thereof and to close contacts LS-22A1 (FIG. 81) and open contacts LS-22A2. Closing of the contacts LS-22A1 engages the high speed clutch 903 to increase the speed at which the components of the input hopper 16 and the bottle carrier inspection section 18 operate. Ordinarily, the input hopper 16 and the bottle carrier inspection section 18 operate at a sufficient speed that there is no further build up of cartons in the input hopper 16. However, if the arm 150 (FIG. 2) is raised sufficiently to actuate the pole LS-22B, the contacts thereof open (FIG. 79) to de-energize a time delay relay TD2 to close time delay contacts TD2A thereof to illuminate a warning lamp 3070. In addition, other time delay contacts (not shown) of the time delay relay TD2 act to stop delivery of cartons by the conveyor 104 (FIG. 2). A sufficient time delay is permitted by the time delay relay TD2 that momentary opening of the contacts LS-22B does not stop delivery of cartons by the conveyor 104.

As the surge hopper 20 (FIG. 33) starts to fill the limit switch LS-9 is actuated to close the first pole LS-9A (FIG. 81) thereof. As the surge hopper 20 is filled further, the second pole LS-9B of the limit switch LS-9 is actuated to close contacts LS-9B1 and open contacts LS-9B2. In the event that an excessive number of cartons builds up in the surge hopper 20 (FIG. 33) the actuation shoe 980 is raised to actuate the limit switch LS-20 (FIG. 43) to open the contacts thereof (FIG. 81) to de-energize the clutch 872 (FIG. 28).

Meanwhile, an empty case 1288 (FIG. 62) is advanced into position for receiving cartons. The case conveyor motor 1814 (FIG. 65) is energized when contacts of the limit switch LS-13 are closed to indicate the input tipover assembly 32 (FIG. 62) is in untipped position. The case conveyor motor 1814 advances the case conveyor 1760. The case conveyor 1760, in turn, advances the case 1288 until the case 1288 engages the actuator of the limit switch LS-2 to open contacts LS-2A (FIG. 79) and close contacts LS-2B. Opening of the contacts LS-2A stops the motor 1814. Closing of the contacts LS-2B energizes a compress solenoid 3074. The compress solenoid 3074 moves an air valve 3075 (FIG. 83) to the position shown at which air under pressure from the lubricated air pressure line 3062 is directed to the upper end of the compressor cylinder 1922 (FIG. 65) to draw the compressor 1774 downwardly onto the case 1288A as shown in FIG. 62.

When the compressor 1774 is fully down, the limit switch LS-17 is actuated to close contacts LS-17A (FIG. 79) and open contacts LS-17B. Closing of the contacts LS-17A energizes a case tip solenoid 3076 to advance a valve 3078 (FIG. 82) to the left to direct fluid under pressure through a line 3080 to the upper end of the input tipover cylinder 1894 (FIG. 65) to cause the input tipover assembly 32 to swing to the 80% tipped position shown in dot-dash lines in FIG. 62. The fluid returns through a pilot check valve 3082 (FIG. 82), a valve assembly 3084 and a line 3086. The pilot check valve 3082 is controlled by pressure in the line 3080 and permits return flow from the input tipover cylinder 1894 through the line 3086 only when there is positive pressure in the line 3080. The valve assembly 3084 includes the hydraulic valves HV-1 and HV-2 and a check valve 3088. When the input tipover assembly 32 reaches the 80% tip position, the hydraulic valve HV-1 (FIG. 64) is actuated to move to its other position as shown in FIG. 82 to stop return flow through the line 3086 and swinging of the input tipover assembly 32. When the packing elevator 34 (FIG. 1) reaches or is at its full up position, the limit switch LS-11 (FIG. 65) is actuated to close contacts LS-11A and LS-11C and open contacts LS-11B and LS-11D (FIG. 79). In addition, when the packing elevator 34 is full up, it actuates the hydraulic valve HV-2 (FIG. 64) to move the valve HV-2 to its other position (FIG. 82) to permit return flow through the line 3086 and further swinging of the input tipover assembly 32. When the input tipover assembly 32 reaches its fully tipped position, the empty case is transferred to the packing elevator and the limit switch LS-12 (FIG. 62) is actuated to close contacts LS-12A (FIG. 79) and LS-12B and open contacts LS-12C. Opening of the contacts LS-11B de-energizes a control relay CR8 to place contacts CR8A, CR8B, CR8C, CR8D, CR8E, CR8F, CR8G and CR8H thereof in the positions shown. The contacts CR8H, when closed, energize a counter reset solenoid 3089 which sets counter mechanism (not shown in detail) for the start of a count by the count switch 1309 (FIGS. 49A and 49B). Closing of the contacts LS-11C (FIG. 79) and LS-12B energizes an uncompress solenoid 3086 which advances the valve 3075 (FIG. 83) to the left to direct air under pressure through a line 3088 to the bottom of the compressor cylinder 1922 to release the compressor 1774.

Closing of the contacts LS-11A (FIG. 79) and LS-12A serves to energize a fast down solenoid 3090 after a predetermined time delay. At this point, the limit switch LS-3 (FIG. 68) is actuated to indicate that the case pushoff assembly 38 is retracted, and contacts LS-3A (FIG. 79) and LS-3B are closed. In addition, the limit switch LS-16 (FIG. 49) is actuated and the contacts thereof are closed to indicate that the tongue retraction frame 1468 (FIG. 44) is retracted. The fast down solenoid 3090 is energized after the predetermined time delay is caused by a delay switch 3092 (FIG. 79). When the fast down solenoid 3090 is energized, a valve 3093 is advanced to the left as shown in FIG. 82 to direct fluid under pressure through a line 3094 to the hydraulic motor 2252 (FIG. 59) to rapidly advance the packing elevator 34 downwardly. Fluid returns from the hydraulic motor 2252 (FIG. 82) through a pilot check valve 3096 and a line 3098. The pilot check valve 3096 is controlled by pressure in the line 3094 and permits return from the hydraulic motor 2252 through the line 3098 only when there is pressure in the line 3094.

Figure 82:
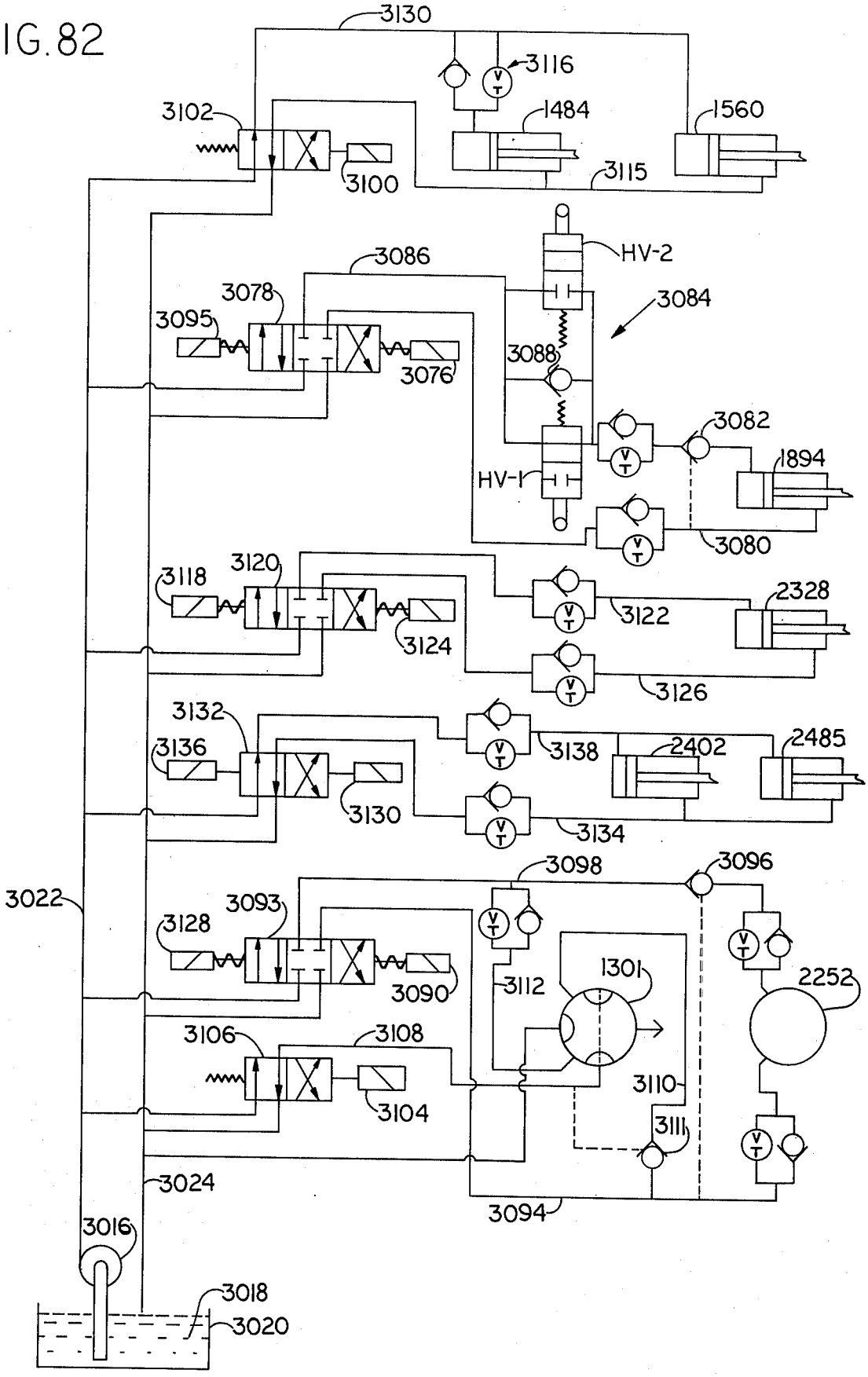
FIG. 82 is a schematic view of hydraulic connections of the machine.
Figure 83:
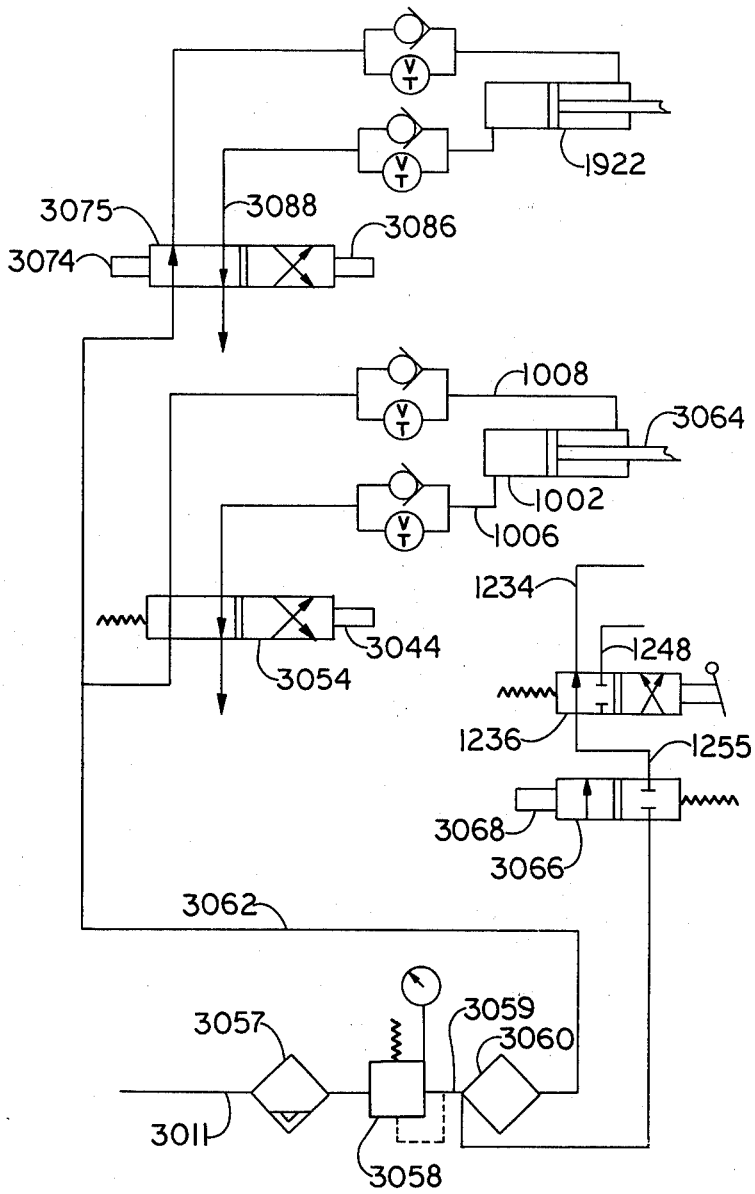
FIG. 83 is a schematic view of pneumatic connections of the machine.

When the packing elevator 34 is clear of the input tipover assembly 32, the toggle action limit switch LS-10 (FIG. 70) is actuated to close the contacts thereof (FIG. 79) and energize a tip valve solenoid 3095 which advances the valve 3078 to the right as shown in FIG. 82 to direct fluid along the line 3086 to the upright tipping cylinder 1894 to swing the input tipping assembly 32 back to the position shown in FIG. 65. When the packing elevator 34 reaches a fill position at which the actuator of the limit switch LS-6 (FIG. 70) is engaged, contacts LS-6A (FIG. 79) are closed and contacts LS-6B and LS-6C open. Closing of the contacts LS-6A energizes a control relay CR3 if it is not already energized to open contacts CR3A, close contacts CR3B and open contacts CR3C. The contacts of the limit switch LS-6 operate only when the packing elevator 34 descends and are not actuated when the packing elevator 34 moves upwardly. The contacts LS-6B and LS-6C are arranged to operate sequentially with the contacts LS-6C opening before the contacts LS-6B open. As the packing elevator 34 moves downwardly from full up position, the limit switch LS-11 is released and the contacts LS-11A open and the contacts LS-11D close. When the contacts LS-6C open, the fast down solenoid 3090 is de-energized and the valve 3092 returns to centered position stopping fast down advance of the hydraulic motor 2252. When the limit switch contacts LS-6B open, a time delay relay TD-1 is de-energized so that instantaneous contacts TD-1A, TD-1B and TD-1C (FIG. 81) and time delay contacts TD-1E (FIG. 79) open and instantaneous contacts TD-1D (FIG. 81) close. Opening of the instantaneous contacts TD-1B de-energizes a discharge control relay CR2. Opening of the instantaneous contacts TD-1C causes release of the belt drive brake 1635 (FIG. 39). Closing of the instantaneous contacts TD-1D (FIG. 81) permits energizing of the low speed pack clutch 1640 if only the pole LS-9A of the limit switch LS-9 is actuated or the energizing of the high speed pack clutch 1642 if both of the poles of the limit switch LS-9 ae actuated. Actuation of the low speed pack clutch 1640 or the high speed clutch 1642 initiates advance of the surge hopper belt 969 (FIG. 33) to remove cartons from the surge hopper 20 and the packing belt 1290 (FIG. 44) and associated elements to cause delivery of the cartons through the pack nip wheels 1364 and 1366 (FIG. 51) to the case 1288 (FIG. 44). After a predetermined time delay, the contacts TD-1E (FIG. 79) open to de-energize a control relay CR5. De-energizing of the control relay CR5 permits opening of contacts CR5A and CR5B. Opening of the contacts CR5B de-energizes a pack aids solenoid 3100. When the pack aids solenoid 3100 is de-energized, a valve 3102 (FIG. 82) is advanced to the position shown to direct fluid under pressure through a line 3103 to the retraction cylinder 1484 (FIG. 50) to advance the hold down tongue 1298 into the case 1288 as shown in FIG. 44. In addition, when the valve 3102 (FIG. 82) is in the position shown, fluid under pressure is directed to the cylinder 1560 (FIG. 56) to cause retraction of the nudger assembly 1307.

As the cartons build up inside the case 1288 (FIG. 44), the hold down tongue 1298 is swung upwardly to actuate the microtorque valve 1301 (FIG. 82). At this point, a solenoid 3104 (FIGS. 79 and 82) is energized to advance a valve 3106 to its other position to direct fluid under pressure along a line 3108 to the microtorque valve 1301. When the hold down tongue 1298 is swung upwardly, the microtorque valve 1301 directs the fluid under pressure from the line 3108 along a line 3110 through a pilot check valve 3111 to the line 3094 to power the hydraulic motor 2252 for controlled downward movement of the packing elevator 34 (FIG. 1). The fluid returns from the hydraulic motor 2252 (FIG. 82) through the line 3098 and a line 3112 and the microtorque valve 1301 to the return line 3024. The pilot check valve 3111 operates to permit flow through the line 3110 from the hydraulic motor 2252 only when there is positive pressure in the line 3108.

The microtorque valve 1301 permits controlled lowering of the case until the case is filled. When the case is nearly filled, the limit switch LS-1A (FIG. 70) is actuated to close contacts LS-1A1 (FIG. 81) and LS-1A2 (FIG. 79). When the proper count has been recorded by the count switch 1309 (FIGS. 49A and 49B), contacts 3114 thereof close (FIG. 79) to energize the time delay relay TD-1. Closing of the contacts TD-1B energizes the discharge control relay CR2 to open contacts CR2A (FIG. 81) and CR2C, and CR2E (FIG. 79) and close contacts CR2B and CR2D (FIG. 81). Opening of the contacts TD-1D and opening of the contacts CR2A de-energizes the low speed pack clutch 1640 and the high speed pack clutch 1642. However, the pack clutch 1432 remains energized through the contacts CR2D so that the pack nip rolls 1364 and 1366 continue to be driven to remove cartons which have already been counted. Closing of the contacts TD-1E (FIG. 79) energizes the control relay CR5 after a time delay to permit discharge of the last cartons into the case.

When the control relay CR5 is energized, the contacts CR5B close to energize the pack aids solenoid 3100 to shift the valve 3102 (FIG. 82) to its other position to direct fluid under pressure along a line 3115 to cause the pistons of the nudger cylinder 1560 and the retraction cylinder 1484 to retract to swing the quadruple detent 1546 (FIG. 56) of the nudger assembly 1307 into engagement with the last cartons and to retract the torque retraction frame 1468 (FIG. 44). The action of the nudger cylinder 1560 is rapid so that the quadruple detent 1546 is in position to hold the last cartons as the hold down tongue 1298 is retracted. A throttle valve-check valve assembly 3116 (FIG. 82) in the return line from the retraction cylinder 1484 makes it possible to control the speed of retraction of the retraction frame. Similar throttle valve-check valve assemblies, not described in detail, are provided in various of the pneumatic and hydraulic lines for controlling the speed of operation of associated elements.

When the retraction frame 1468 is fully retracted, the limit switch LS-16 (FIGS. 49 and 79) is actuated to energize the fast down solenoid 3090 to cause fast down movement of the packing elevator 34 (FIG. 70). The packing elevator 34 moves downwardly until it actuates the limit switch LS-4 to close the contacts thereof (FIG. 79). At this point, the limit switch LS-8 is actuated as shown in FIG. 76 to indicate that the output tipover assembly 40 is in position to receive the case, and actuation of the limit switch LS-4 (FIG. 79) causes energizing of a push-off solenoid 3118 to advance a valve 3120 (FIG. 82) to the right to direct fluid under pressure through a line 3122 to the pushoff cylinder 2328 (FIG. 68) to cause advance of the case pushoff assembly 38 to advance the case onto the output tipover assembly 40 (FIG. 1). When the case pushoff assembly 38 reaches full out position, the limit switch LS-5 (FIG. 68) is actuated to open contacts LS-5A (FIG. 79) and close contacts LS-5B. Closing of the contacts LS-5B energizes the control relay CR8 and also energizes a pushoff return solenoid 3124. Closing of contacts CR8H energizes the counter reset relay 3089 which resets the counter mechanism. Energizing of the pushoff return solenoid 3124 advances the valve 3120 to the left as shown in FIG. 82 to direct fluid under pressure through a line 3126 to the pushoff cylinder 2328 to cause retraction of the case pushoff assembly 38 (FIG. 68). When the case pushoff assembly 38 is fully retracted, the limit switch LS-3 is actuated to close the contacts LS-3A and LS-3B. Closing of the contacts LS-3A causes energizing of a sled fast up solenoid 3128. Energizing of the sled fast up solenoid 3128 causes advance of the valve 3093 to the right as shown in FIG. 82 to direct fluid under pressure through the line 3098 to the hydraulic motor 2252 to advance the packing elevator 39 (FIG. 1) rapidly upwardly. Closing of the contacts LS-3B energizes a discharge pivot solenoid 3130. Energizing of the discharge pivot solenoid 3130 causes advance of a valve 3132 (FIG. 82) to the left to direct fluid under pressure through a line 3134 to the folder cylinder 2485 and the output tipover cylinder 2402 to cause folding of the input end flap as shown at 1764C in FIG. 72 and to cause upward tipping of the output tipover assembly 40.

When the output tipover assembly 40 is fully tipped, the case advances off the output tipover assembly 40 to the right as shown in FIG. 72, and the limit switch LS-14B (FIG. 76) is released so that contacts LS-14B1 (FIG. 79) open and contacts LS-14B2 close. When the case is fully off the output tipover assembly 40, the limit switch LS-14A (FIG. 76) is released and the contacts thereof (FIG. 79) close to energize a pivot return solenoid 3136. The pivot return solenoid 3136 advances the valve 3132 (FIG. 82) to the right to direct fluid under pressure along a line 3138 to the folder cylinder 2485 and the output tipover cylinder 2402 so that the output tipover assembly is returned to the ready position shown in full lines in FIG. 72 and the folder assembly 2458 (FIG. 76) is retracted. When the packing elevator reaches its full up position, the limit switch LS-11 is actuated and the packing cycle is ready to be repeated.

In the event that the count switch fails to register a proper count shortly after actuation of the limit switch LS-1A (FIG. 70) on the downward controlled advance of the packing elevator 34, actuation of the limit switch LS-1 (FIG. 79) causes de-energizing of the control relay CR3 to permit the contacts CR3C to close to by-pass the counter contacts 3114 and institute case discharge. In addition, closing of the contacts CR3A energizes an alarm 3150.

If a case is to be removed before completion of a packing cycle, the reject push button switch SW8 is depressed to close contacts SW8A energizing the manual discharge control relay CR7 and opening contacts SW8B to de-energize the control relay CR3.

The control relay CR1 can be de-energized by depressing a push button switch SW7.

When the hydraulic motor 3014 is to be de-energized or in the event of an emergency, one of a series of emergency stop push button switches SW9, SW10 and SW10A can be opened to de-energize the hydraulic motor 3014.

The machine which has been described above and which is illustrated in the drawings is subject to structural modification without departing from the spirit and scope of the appended claims.

Having described our invention, what we claim as new and desire to secure by letters patent is:

1. A machine for opening a folding carton having a central panel, side panels on opposite sides of the central panel, and bottom panel means linking the side panels to break improper glue spots and to demonstrate that the carton opens properly which comprises an inspection section, means for engaging the central panel and for advancing the carton through the inspection section, vacuum cup means on opposite sides of the path of advance of the carton advancing means for engaging the side panels, means for advancing the vacuum cup means in the direction of advance of the carton advancing means in timed relation with the carton advancing means, the vacuum cup means diverging from the path of the carton advancing means as the carton advances through the inspection section, whereby the side panels are drawn apart from the central panel to open the carton.

2. A machine as in claim 1 wherein there is means for directing a light beam transversely of the path of advance of the carton advancing means and substantially parallel to the side panels at an inspection station to be broken by the bottom panel means when the carton is properly opened, photocell means receiving said beam, trigger means operating in timed relation with the means for advancing the carton for indicating a carton engaging portion of the carton advancing means is opposed to the light beam, and means controlled by said photocell means and said trigger means for sensing if the beam is broken by the bottom panel means when the trigger means is actuated.

3. A machine as in claim 2 wherein there is means for discharging the carton when the means controlled by the photocell means and the trigger means senses the beam is not broken.

4. A machine as in claim 3 wherein there is means for directing a second beam of light transversely of the direction of advance of the carton advancing means at the inspection station and transversely of the side panels to be broken by one of the side panels when the carton is at the inspection station, second photocell means receiving said second beam, and means for disabling the carton discharging means when the second beam is unbroken when the trigger means is actuated.

5. A machine as in claim 1 wherein the means for advancing the vacuum cup means includes first and second chain conveyor means, the conveyor means being on opposite sides of the path of carton advance, each of said chain conveyor means having an active course extending along the path of carton advance, the active courses diverging as the active courses advance, the ends of the active courses being defined by input and output sprocket means around which the chain conveyor means turn outwardly of the active course, a vacuum cup base member mounted on each conveyor chain means, and means for supporting the vacuum cup means on each of the vacuum cup base members.

6. A machine as in claim 5 wherein the means for supporting the vacuum cup means on one of the base members includes slide support means attached to the associated vacuum cup means and slidably mounted on the one of the base members for movement of the associated vacuum cup means transversely of the associated chain conveyor means, and stop means limiting sliding movement, the vacuum cup means resiliently engaging the associated side panel at an input end of the active course, the stop means drawing the vacuum cup means and the associated side panel transversely of the path of carton advance as the carton proceeds toward an output end of the active course.

7. A machine as in claim 5 wherein each vacuum cup base member is pivotally mounted on the associated chain conveyor means, a link connects each vacuum cup base member to the associated chain conveyor means, and the vacuum cup means has a face for engaging a side panel which is substantially parallel to the associated chain conveyor means when the associated chain conveyor means is straight, the face swinging into parallelism with the side panel as the conveyor chain means swings around the input sprocket means so that the face engages the side panel in substantial parallelism.

8. A machine for opening a folding carton having spaceable panels and means linking the panels to break improper glue spots and to demonstrate that the carton opens properly which comprises an inspection section, carton conveyor means for engaging one of the panels and for advancing the carton through the inspection section, vacuum cup means engageable with another panel, and means for advancing the vaccum cup means in the direction of advance of the carton in timed relation with the means for advancing the carton through the inspection section, the path of the vaccum cup means diverging from the path of advance of the means for advancing the carton through the inspection section as the vacuum cup means and the carton advance through the inspection section, whereby the panels are drawn apart to open the carton.

9. In combination with a machine as in claim 8, a vacuum control device which includes a rotating distributor head having a flat face and an opening therein, flexible tubular means connecting the opening to the vacuum cup means, means for rotating the rotating distributor head in timed relation with the advance of the vacuum cup means, a stationary distributor head having a flat face and a slot therein, the slot being aligned with the opening when the vacuum cup travels through the inspection section, means for resiliently urging the stationary distributor head to a position in which the flat faces are in a flatwise face-to-face relation, and means for impressing a vacuum on the slot to impress a vacuum on the vacuum cup means when the opening is aligned with the slot.

10. A machine as in claim 8 wherein there is an inspection station in the inspection section, means at the inspection station to sense if the carton opens properly, trigger means operating in timed relation with the means for advancing the carton for indicating the carton is at the inspection station and means controlled by said sensing means and said trigger means for directing a properly opened carton along one path and an improperly opened carton along another path.

* * * * *